US008866861B2

(12) United States Patent
Schuh et al.

(10) Patent No.: US 8,866,861 B2
(45) Date of Patent: Oct. 21, 2014

(54) SYSTEMS AND METHODS FOR AUTOMATIC PRINT ALIGNMENT

(71) Applicant: Zink Imaging, Inc., Bedford, MA (US)

(72) Inventors: Dana F. Schuh, Windham, NH (US); James Peter Zelten, Melrose, MA (US); Suhail S. Saquib, Shrewsbury, MA (US)

(73) Assignee: Zink Imaging, Inc., Bedford, MA (US)

( * ) Notice: Subject to any disclaimer, the term of this patent is extended or adjusted under 35 U.S.C. 154(b) by 0 days.

(21) Appl. No.: 13/830,948

(22) Filed: Mar. 14, 2013

(65) Prior Publication Data

US 2014/0111594 A1 Apr. 24, 2014

Related U.S. Application Data

(60) Provisional application No. 61/716,303, filed on Oct. 19, 2012, provisional application No. 61/765,311, filed on Feb. 15, 2013.

(51) Int. Cl.

| | |
|---|---|
| ***B41J 29/00*** | (2006.01) |
| ***B41J 11/42*** | (2006.01) |
| ***B41J 11/46*** | (2006.01) |
| ***B41J 11/66*** | (2006.01) |
| ***B41J 2/335*** | (2006.01) |
| ***B41J 3/407*** | (2006.01) |
| ***B41J 3/36*** | (2006.01) |
| *B41J 11/00* | (2006.01) |

(52) U.S. Cl.

CPC *B41J 11/66* (2013.01); *B41J 11/42* (2013.01); *B41J 11/46* (2013.01); *B41J 2/3358* (2013.01); *B41J 3/4075* (2013.01); *B41J 3/36* (2013.01); *B41J 11/006* (2013.01); *B41J 11/008* (2013.01); *B41J 11/0095* (2013.01)

USPC ..... 347/116

(58) Field of Classification Search

USPC ..... 347/116; 399/301

See application file for complete search history.

(56) References Cited

U.S. PATENT DOCUMENTS

| | | | |
|---|---|---|---|
| 4,819,011 | A | 4/1989 | Yokota |
| 6,343,647 | B2 | 2/2002 | Kim et al. |

(Continued)

FOREIGN PATENT DOCUMENTS

| | | |
|---|---|---|
| EP | 0 719 650 | 7/1996 |
| GB | 2 403 453 | 1/2005 |

(Continued)

OTHER PUBLICATIONS

US Office Action on U.S. Appl. No. 13/831,226 Dtd Sep. 5, 2013.
US Office Action on U.S. Appl. No. 13/830,682 DTD Jul. 11, 2014.
International Search Report and Written Opinion for International Patent Application PCT/US2013/065966 dated Jul. 9, 2014.

* cited by examiner

*Primary Examiner* — Huan Tran
(74) *Attorney, Agent, or Firm* — Foley & Lardner LLP; Michel Morency; Daniel E. Rose

(57) ABSTRACT

The present application is directed to systems and methods for print alignment by a continuous feed printer. A sensor of a printer detects a first line of a pattern on a non-printing side of a printing medium, the pattern comprising two non-parallel lines separated by a predetermined distance at a predetermined position of the printing medium. The printer advances the printing medium a first distance, and the sensor detects a second line of the pattern. The printer identifies a horizontal offset of the printing medium from an expected location of the predetermined position proportional to the difference between the first distance and the predetermined distance.

20 Claims, 88 Drawing Sheets

(56) References Cited

U.S. PATENT DOCUMENTS

| | | | | |
|---|---|---|---|---|
| 6,682,163 | B2 * | 1/2004 | Metzler et al. | 347/19 |
| 7,825,945 | B2 | 11/2010 | Busch et al. | |
| 2007/0041737 | A1 * | 2/2007 | Runkowske et al. | 399/16 |
| 2011/0102535 | A1 | 5/2011 | Busch et al. | |
| 2012/0243049 | A1 | 9/2012 | Takayama | |
| 2013/0021622 | A1 | 1/2013 | Yamaguchi et al. | |

FOREIGN PATENT DOCUMENTS

| | | |
|---|---|---|
| JP | 2001-260426 | 9/2001 |
| JP | 2012-179882 | 9/2012 |
| JP | 2012-196859 | 10/2012 |
| WO | WO-2008/117106 | 10/2008 |

100

(a) Bordered printing (b) Full bleed printing (c) Misaligned full bleed printing Diagonal
Horizontal
Quadratic ($\Sigma_d \neq \Sigma_h$)
Linear ($\Sigma_d = \Sigma_h$)
Linear ($\Sigma_d = \Sigma_h = I$)
740
720
700
680
660
640
620
c
−400
−350
−300
−250
−200
−150
a (1/mm²) --->

Label width selection screen 1510

Library element selection screen 1511

Element selection screens 1512a-1512c

Dynamic border width selection screen 1514

Dynamic color selection screen 1516

Element edit controls
1517

Edit Screen
1504

Library selection screen 1520

Print screen 1522

SYSTEMS AND METHODS FOR AUTOMATIC PRINT ALIGNMENT

RELATED APPLICATIONS

The present application claims the benefit of and priority to U.S. Provisional Patent Application No. 61/716,303, entitled "Printing Systems and Control Methods," filed Oct. 19, 2012; and U.S. Provisional Patent Application No. 61/765,311, entitled "Printing Tracking Correction Methods and Systems," filed Feb. 15, 2013.

FIELD OF THE INVENTION

The present application generally relates to printing systems. In particular, the present application relates to printing systems, including multicolor direct thermal printers, and methods for automatic alignment of printing for said printing systems.

BACKGROUND

Printers have long suffered from portability problems, with the majority of printers primarily for desktop use and typically weighing dozens of pounds. Even as computing devices have moved towards more lightweight systems, such as smart phones, laptop computers, notebook and sub-notebook computers, and tablet computers, printing from these devices frequently requires connecting, either wirelessly or physically, to a desktop printer. As a result, use cases for these printers are limited.

Manufacturers have attempted to extend portability to printers, though current implementations suffer from various defects. For example, continuous-roll black and white direct thermal printers, such as those used in portable credit card readers and point-of-sale terminals utilize a thermal printing head that applies heat to a dye impregnated in a printing medium, activating the dye or color-forming chemical to create black and/or gray pixels. The resulting prints are frequently low-resolution and relatively unstable, fading and/or darkening over time, and as a result are useful only for temporary prints, such as receipts.

Conversely, continuous-roll thermal wax transfer printers or dye-diffusion thermal transfer printers use separate donor and receiver materials, allowing color-on-color printing with very high stability. Prints typically do not fade unless damaged through friction. However, color choices are fixed (e.g. black lettering on a white medium, or red lettering on a yellow medium), and switching between colors requires switching cassettes or cartridges. As a result, multicolor images or labels cannot be created.

Multicolor thermal printers produce full-color, stable prints, and may be relatively small. However, in typical implementations, the printing medium is delivered in predetermined dimensions, such as 3 inches by 5 inches, or 5 inches by 7 inches, limiting potential uses compared to a continuous-roll printer. Other printing methods such as ink jet printers and laser printers are typically larger and heavier, making them unavailable for portable printing, and suffer from problems such as ink cartridges drying out before the user has consumed the maximum number of prints possible.

Furthermore, as typically befits their roles as printers for other computing devices, most printers lack user interfaces for editing images or text to be printed. Conversely, the few that include keypads such as handheld label printers, typically allow only alphanumeric entry, and have formatting constraints such as fixed sizes, fonts, or text orientations.

BRIEF SUMMARY

The present application is directed to portable printers, including printers with user interfaces for direct what-you-see-is-what-you-get (WYSIWYG) editing and printers that provide network printing capability for other computing devices, such as smart phones, tablet computers, or other devices. In some embodiments, the printers may be multicolor direct thermal printers, and/or may utilize continuous-roll cassettes of printing media, allowing printing of labels or images of variable length, and in other embodiments, other printing technologies may be employed. In embodiments utilizing multicolor direct thermal printers, the printing medium may comprise a substrate and one or more color-forming layers, each impregnated with a temperature-activated color forming dye having various activation times and temperatures. The printer may include a pulsing thermal print head with pulse amplitudes and frequencies controllable to selectively activate one or more of the color-forming layers of the printing medium to generate a pixel of any color.

The printers may include one or more cutters capable of cutting fully through a printing medium to perform a full cut, or capable of cutting only partway through a printing medium, such as through a medium substrate and adhesive layer to a backing liner, to perform a partial cut or "kiss cut". These latter cuts may be used to make labels that may be easily peeled from a backing by a user. The printers may execute printing and image placement methods to print to or beyond the edges of the printing medium to perform "full-bleed" printing, or printing whereby the resulting image fills the printing medium without leaving an un-printed border.

The printers may incorporate either a manually-triggered or automatic media ejection mechanism and/or cutting system. Manual triggering may be via a swipe gesture by a user via a touch-sensitive input device. To reduce friction and load on the media that may cause stuttering or the appearance of visual bands on printed media, the media ejection mechanism may incorporate a non-circular roller that does not interfere with the media during printing, and rotates into position for ejection of the media after cutting.

To print on various widths of media, the printers may utilize cassettes or cartridges of different widths. Each cassette may include a spool of printing medium, and to ensure the printing medium exits the cassette in a uniform fashion, may dynamically vary the position of the axis of the spool of printing medium. To prevent dust or foreign bodies from interfering with printing, the cassette may include a cleaning material along a media exit slot or opening. The printer may utilize a variable pressure print head such that constant pressure may be applied to the printing medium regardless of width of the medium.

To ensure proper alignment of printing and to allow printing of full-bleed images across the width of the printing medium, the printing medium may include an alignment pattern. A sensor of the printer may detect the alignment pattern during printing and dynamically adjust output of the print heads to remove lateral displacement errors, resulting in an aligned image.

As discussed above, the printer may include a user interface for editing and printing images, or may directly connect wirelessly to a second device providing a user interface such as a smart phone or tablet computer. The printer may also be able to join an existing wireless network to allow printing from the second device or from other devices connected to the network. In some embodiments in which the printer does not include a user interface, the printer may utilize a wireless interface to provide an access point. The second device may connect to the access point to provide images for printing, or may provide configuration commands to cause the printer to join the existing wireless network, allowing custom network configurations of the printer without utilizing cumbersome on-board controls.

The user interface provided by the printer or by the second device may allow WYSIWYG editing in an intuitive manner, allowing users to drag elements dynamically around a representation of the printed label, add text or images, dynamically adjust colors, sizes, and borders, and dynamically adjust the length of a label or image to be printed. The user interface may further provide communication with an online database or store of elements, and may provide functionality for purchasing elements, themes, images, templates, or other articles for generating images.

In one aspect, the present disclosure is directed to a variable pressure print head for a printer. The variable pressure print head includes a print head for printing on a print medium, the print head having a bow perpendicular to the plane of the print medium. The variable pressure print head also includes a platen roller for supporting the print medium. The variable pressure print head further includes a variable print head load mechanism for positioning the print head and platen roller, wherein the print head and platen roller position are automatically varied responsive to a width of the print medium.

In some embodiments of the variable pressure print head, positioning of the print head and platen roller is varied to maintain a constant pressure on the print medium regardless of width of the print medium. In a further embodiment of the variable pressure print head, the constant pressure comprises a constant pressure per unit width of the print medium. In one embodiment of the variable pressure print head, the platen roller is deflected responsive to pressure from the print head transmitted via the print medium. In a further embodiment, the platen roller is deflected to have a curvature parallel to the bow of the print head.

In some embodiments of the variable pressure print head, the variable print head load mechanism further comprises a head pressure controller configured for receiving an identification of a width of the print medium of a predetermined plurality of widths; and selecting a position for the print head and platen roller from a corresponding plurality of predetermined positions, responsive to the identified width. In other embodiments, the variable print head load mechanism further comprises a screw, fixed to a frame of the variable print head load mechanism, in contact with the print head and rotatable to vary the bow of the print head. In still other embodiments, the variable print head load mechanism further comprises a lever supporting an axis of the platen roller, said lever moved to vary the position of the platen roller. In a further embodiment, the lever is fixed at a fulcrum at a first position, and wherein the axis of the platen roller is supported by the lever at a second position displaced from the first position. In another further embodiment, the print head load mechanism includes a motor attached to the lever, controlled by the variable print head load mechanism to move said lever.

In another aspect, the present disclosure is directed to a method for providing variable pressure to a print head. The method includes identifying, by a head pressure controller of a printer, a width of a print medium. The method also includes determining a print head and platen roller position, responsive to the width of the print medium. The method further includes adjusting positions of a print head and a platen roller responsive to the determined positions.

In one embodiment of the method, determining the print head and platen roller position further comprises determining positions of the print head and platen roller to provide a constant pressure on the print medium when the print medium is between the print head and platen roller, regardless of width of the print medium. In a further embodiment, the constant pressure comprises a constant pressure per unit width of the print medium.

In some embodiments of the method, the print head has a bow perpendicular to the plane of the print medium, and adjusting positions of the print head and platen roller further includes positioning the platen roller to be deflected responsive to pressure from the print head transmitted via the print medium. In a further embodiment, the platen roller is deflected to have a curvature parallel to the bow of the print head.

In some embodiments of the method, the head pressure controller receives an identification of the width of the print medium of a predetermined plurality of widths, and determining the print head and platen roller position comprises selecting a position for the print head and platen roller from a corresponding plurality of predetermined positions, responsive to the identified width.

In one embodiment, the method includes reading a parameter stored on a storage medium attached to a print medium cassette to identify a width of the media. In another embodiment, adjusting positions of the print head and platen roller further includes moving a lever supporting an axis of the platen roller. In a further embodiment, the lever is fixed at a fulcrum at a first position, and the axis of the platen roller is supported by the lever at a second position displaced from the first position. In another further embodiment, the method includes controlling a motor attached to the lever.

In another aspect, the present disclosure is directed to a method for full bleed printing. The method includes cutting, by a cutter of a printer, a first kiss cut in a continuous printing medium at a first position displaced from an end of the continuous printing medium. The method also includes positioning, by a medium advancement mechanism of the printer, the continuous printing medium with a print head of the printer at a print start location between the first position and the end of the continuous printing medium. The method further includes printing, by the print head, a first image on a continuous printing medium to a print end location. The method also includes cutting, by the cutter, a second cut in the continuous printing medium at a second position between the first position and the print end location. A portion of the continuous printing medium between the first kiss cut and the second cut comprises a full bleed print.

In one embodiment, the method includes cutting the first kiss cut by cutting through the continuous printing medium to an adhesive backing. In another embodiment, the cutter is positioned beyond the print head in the direction of travel of the continuous printing medium by a first distance. In a further embodiment, the method includes positioning the continuous printing medium with the print head of the printer at the print start location by retracting the continuous printing medium by an amount greater than the first distance. In another further embodiment, the method includes cutting the second cut in the continuous printing medium at the second position by advancing the continuous printing medium, after printing the first image, by an amount less than the first distance.

In some embodiments of the method, the second cut is a full cut. In other embodiments of the method, the second cut is a kiss cut. In a further embodiment, the method includes cutting, by the cutter, a third kiss cut in the continuous printing medium at a third position. The method also includes positioning, by the medium advancement mechanism of the printer, the continuous printing medium with the print head of the printer at a second print start location between the second position and the third position. The method further includes printing, by the print head, a second image on the continuous printing medium to a second print end location. The method also includes cutting, by the cutter, a fourth cut in the continuous printing medium at a fourth position between the third position and the second print end location. The portion of the continuous printing medium between the third kiss cut and the fourth cut comprises a second full bleed print. In a further embodiment, cutter is positioned beyond the print head in the direction of travel of the continuous printing medium by a first distance, and cutting the third kiss cut in the continuous printing medium comprises advancing the continuous printing medium by an amount greater than the first distance. In another further embodiment, the fourth cut comprises a full cut.

In yet another aspect, the present disclosure is directed to an apparatus for full bleed printing. The apparatus includes a print head of a printer for printing a first image on a continuous printing medium. The apparatus also includes a cutter of the printer configured for cutting a first kiss cut in the continuous printing medium. The apparatus further includes a medium advancement mechanism of the printer configured for: positioning the continuous printing medium with the cutter at a first position displaced from an end of the continuous printing medium; subsequent to the cutter cutting the kiss cut at the first position, repositioning the continuous printing medium with the print head at a print start location between the first position and the end of the continuous printing medium; and subsequent to the print head printing the first image on the continuous printing medium from the print start location to a print end location, repositioning the continuous printing medium with the cutter at a second position between the first position and the print end location. The cutter is further configured for cutting a second cut in the continuous printing medium at the second position, such that a portion of the continuous printing medium between the first kiss cut and the second cut comprises a full bleed print.

In one embodiment of the apparatus, the cutter of the printer is configured for cutting the first kiss cut by cutting through the continuous printing medium to an adhesive backing. In another embodiment, the cutter is positioned beyond the print head in the direction of travel of the continuous printing medium by a first distance. In a further embodiment, the medium advancement mechanism is further configured for positioning the continuous printing medium with the print head of the printer at the print start location by retracting the continuous printing medium by an amount greater than the first distance. In another further embodiment, the medium advancement mechanism is further configured for repositioning the continuous printing mechanism with the cutter at the second position by advancing the continuous printing medium by an amount less than the first distance.

In some embodiments of the apparatus, the second cut is a full cut. In other embodiments, the second cut is a kiss cut. In a further embodiment, the medium advancement mechanism of the printer is further configured for: positioning the continuous printing medium with the cutter at a third position for the cutter to execute a third kiss cut; subsequently repositioning the continuous printing medium with the print head of the printer at a second print start location between the second position and the third position; and subsequent to the print head printing a second image on the continuous printing medium to a second print end location, repositioning the continuous printing medium with the cutter at a fourth position between the third position and the second print end location for the cutter to execute a fourth cut. The portion of the continuous printing medium between the third kiss cut and the fourth cut comprises a second full bleed print. In a further embodiment, the cutter is positioned beyond the print head in the direction of travel of the continuous printing medium by a first distance, and positioning the continuous printing medium with the cutter at the third position includes advancing the continuous printing medium by an amount greater than the first distance. In another further embodiment, the fourth cut comprises a full cut.

In yet another aspect, the present disclosure is directed to a dual time-constant heat sink for a thermal printer. The dual time-constant heat sink includes a print head heat sink, in contact with a print head of a thermal printer, the print head heat sink having a first thermal time constant. The dual time-constant heat sink also includes an insulator in contact with the print head heat sink; and a thermal reservoir, in contact with the insulator, the thermal reservoir having a second thermal time constant, the second time constant longer than the first thermal time constant.

In one embodiment of the dual time-constant heat sink, the print head heat sink has a high thermal conductivity and a small volume, or a low heat capacity. In a further embodiment, the print head heat sink has a thermal conductivity of at least 50 W/mK.

In another embodiment of the dual time-constant heat sink, the thermal reservoir has a high thermal conductivity and a large volume and/or large surface area, or a high heat capacity. In a further embodiment, the thermal reservoir has a thermal conductivity of at least 50 W/mK.

In still another embodiment of the dual time-constant heat sink, the insulator has a low thermal conductivity. In a further embodiment, the insulator has a thermal conductivity of less than 1 W/mK. In a still further embodiment, the thermal conductivity of the insulator is at least two orders of magnitude lower than the thermal conductivity of the print head heat sink or the thermal reservoir. In another further embodiment, the thermal conductivity of the insulator is at least three orders of magnitude lower than the thermal conductivity of the print head heat sink or the thermal reservoir.

In some embodiments of the dual time-constant heat sink, the insulator comprises a controllable heat pipe, and heat flow from the print head heat sink to the thermal reservoir is reduced during preheating of the print head of the thermal printer. In other embodiments, the insulator comprises an air gap. In a further embodiment, after preheating the print head of the thermal printer, the air gap is closed to place the print head heat sink in contact with the thermal reservoir. In a still further embodiment, the dual time-constant heat sink includes a lever connected to the thermal reservoir to move the thermal reservoir to contact the print head heat sink after preheating the print head. In another still further embodiment, the print head heat sink further includes a bimetallic strip configured to contact the thermal reservoir upon reaching a predetermined temperature. In other embodiments, the dual time-constant heat sink has no moving parts.

In yet another aspect, the present disclosure is directed to a method for controlling temperature of a print head of a thermal printer via a dual time-constant heat sink. The method includes preheating a print head of the thermal printer to a first predetermined temperature, the print head in contact with a print head heat sink having a first thermal time constant, the print head heat sink in contact with an insulator, and the insulator in contact with a thermal reservoir having a second thermal time constant longer than the first thermal time constant such that the print head heat sink reaches the first predetermined temperature before the thermal reservoir. The method also includes printing a first image via the print head, the print head and print head heat sink reaching a second, higher temperature, the thermal reservoir at a temperature lower than the second temperature. The method further includes cooling, by the thermal reservoir, the print head and print head heat sink to a third temperature lower than the second temperature.

In one embodiment of the method, the print head heat sink has a high thermal conductivity and a small volume, or a low heat capacity. In a further embodiment of the method, the print head heat sink has a thermal conductivity of at least 50 W/mK. In still another embodiment of the method, the thermal reservoir has a high thermal conductivity and a large volume and/or large surface area, or a high heat capacity. In a further embodiment of the method, the thermal reservoir has a thermal conductivity of at least 50 W/mK. In some embodiments of the method, the insulator has a low thermal conductivity. In a further embodiment, the insulator has a thermal conductivity of less than 1 W/mK. In one embodiment of the method, the insulator has a thermal conductivity of at least two orders of magnitude less than the thermal conductivity of the print head heat sink or the thermal reservoir. In a further embodiment of the method, the insulator has a thermal conductivity of at least three orders of magnitude less than the thermal conductivity of the print head heat sink or the thermal reservoir. In another embodiment of the method, the insulator comprises a controllable heat pipe, and wherein heat flow from the print head heat sink to the thermal reservoir is reduced during preheating of the print head of the thermal printer. In yet another embodiment of the method, the insulator comprises an air gap. In a further embodiment, the method includes closing the air gap after preheating the print head. In a still further embodiment, the print head heat sink includes a bimetallic strip and the method includes bending, by the bimetallic strip, to contact the thermal reservoir upon reaching the first predetermined temperature. In still another embodiment, the dual time-constant heat sink has no moving parts.

In yet still another aspect, the present disclosure is directed to a method for print alignment by a continuous feed printer. The method includes detecting, by a sensor of a printer, a first line of a pattern on a non-printing side of a printing medium, the pattern comprising two non-parallel lines separated by a predetermined distance at a predetermined position of the printing medium. The method also includes advancing, by the printer, the printing medium a first distance. The method further includes detecting, by the sensor, a second line of the pattern. The method also includes identifying, by the printer, a horizontal offset of the printing medium from an expected location of the predetermined position proportional to the difference between the first distance and the predetermined distance.

In one embodiment, the method includes identifying a difference between the first distance and the predetermined distance by identifying a first time period from detecting the first line to detecting the second line. In another embodiment, the sensor and a print head of the printer are separated by a distance in the direction of travel of the printing medium, and the method includes identifying the horizontal offset of the printing medium further by adjusting the identified horizontal offset by a correction factor proportional to the distance. In yet another embodiment, the first line and second line of the pattern have different widths.

In some embodiments, the method includes advancing, by the printer, the printing medium a second distance; detecting, by the sensor, a third line of the pattern; and identifying a difference between the first distance and the second distance, the difference proportional to the horizontal offset. In a further embodiment, the method includes identifying a horizontal offset of the printing medium corresponding to the identified difference by identifying a horizontal offset proportional to a ratio of the difference between the first distance and the second distance and the sum of the first distance and the second distance. In another further embodiment, the first and third lines of the pattern are parallel, and the second line of the pattern is not parallel to either the first or third line. In still another further embodiment, the method includes categorizing, by the printer, each of the first line, second line, and third line, as belonging to either a first category or a second category. In an even further embodiment, the method includes maintaining a state machine, by the printer, the state machine having probability weights corresponding to transitions from the first category to the second category and from the second category to the first category. In many embodiments, the method includes printing, by the printer, an image on the printing side of the printing medium, offset according to the identified horizontal offset. In a further embodiment, the printing offset is obtained by dithering and quantizing the identified horizontal offset to a predetermined resolution.

In yet another aspect, the present disclosure is directed to a system for print alignment by a continuous feed printer. The system includes a continuous feed printer comprising a sensor placed to detect a pattern on a non-printing side of the printing medium, the pattern comprising two non-parallel lines separated by a predetermined distance at a predetermined position of the printing medium. The system also includes a print engine configured for: detecting, via the sensor, a first line of the pattern; advancing the printing medium a first distance; detecting, via the sensor, a second line of the pattern; and identifying a horizontal offset of the printing medium from an expected location of the predetermined position proportional to the difference between the first distance and the predetermined distance.

In one embodiment, the print engine is further configured for identifying a first time period from detecting the first line to detecting the second line. In another embodiment, the sensor and a print head of the printer are separated by a distance in the direction of travel of the printing medium, and the print engine is further configured for identifying the horizontal offset of the printing medium further by adjusting the identified horizontal offset by a correction factor proportional to the distance. In still another embodiment, the first line and second line of the pattern have different widths.

In some embodiments, the print engine is further configured for: advancing the printing medium a second distance; detecting, via the sensor, a third line of the pattern; and identifying a difference between the first distance and the second distance, the difference proportional to the horizontal offset. In a further embodiment, the print engine is further configured for identifying the horizontal offset of the printing medium corresponding to the identified difference as proportional to a ratio of the difference between the first distance and the second distance and the sum of the first distance and the second distance. In another further embodiment, the first and third lines of the pattern are parallel, and the second line of the pattern is not parallel to either the first or third line. In yet another further embodiment, the print engine is further configured for categorizing each of the first line, second line, and third line, as belonging to either a first category or a second category. In an even further embodiment, the print engine is further configured for maintaining a state machine, the state machine having probability weights corresponding to transitions from the first category to the second category and from the second category to the first category. In many embodiments, the print engine is further configured for printing an image on the printing side of the printing medium, offset according to the identified horizontal offset. In a further embodiment, the printing offset is obtained by dithering and quantizing the identified horizontal offset to a predetermined resolution.

In another aspect, the present disclosure is directed to an overcoat for a thermal printing medium, comprising two or more layers, wherein at least one layer of the overcoat comprises polyisocyanate or a derivative thereof. In some embodiments, at least one layer of the overcoat is an ultraviolet (UV) curable layer. In many embodiments, the ultraviolet (UV) curable layer comprises an additive selected from the group consisting of a photoinitiator, acrylate monomer, diacrylate monomer, triacrylate monomer, siliconized urethane acrylate oligomer and combinations thereof. In some embodiments, at least one layer of the overcoat comprises an additive selected from the group consisting of a latex component, activator, lubricant, surfactant, rheology control additive, anti-blocking additive, catalyst and combinations thereof.

In yet another aspect, the present disclosure is directed to a printing medium cassette. The cassette includes a shell comprising a vertical slot along a center line of each lateral side of the shell and a media exit slot tangent to a curve of the shell. The cassette also includes a spool extending laterally across the shell, the spool comprising two protrusions, each protrusion extending into and supported by a corresponding vertical slot of the shell. The cassette further includes at least one spring configured to raise the protrusion within the vertical slot as printing media wound around the spool is withdrawn from the media exit slot.

In some embodiments, an axis of the spool is raised by the spring such that the printing media exits the through the media exit slot tangent to the remaining media wound around the spool. In other embodiments, the spool further comprises a central spindle and a sleeve surrounding the central spindle, the sleeve able to slide laterally across the spindle within the shell. In a further embodiment, the sleeve comprises a space frame. In another further embodiment, the cassette includes the printing media wound around the sleeve.

In one embodiment, the cassette includes a cleaning pad attached within the media exit slot. In another embodiment, the cassette includes a storage memory storing parameters of the printing medium. In still another embodiment, the shell includes one or more ridges or notches for providing a secure grip for a user.

In yet another aspect, the present disclosure is directed to a method of dynamically resizing an image. The method includes displaying, by a display of a computing device, an image. The method also includes receiving, by an input device of the computing device, a user selection of an image resize function. The method further includes displaying, by the display, at least one dynamic length adjustment band as an overlay on the image. The method also includes detecting, by the input device, a selection and movement of the at least one dynamic length adjustment band by the user, the movement having a direction and distance. The method further includes resizing the image, by an image processing engine executed by a processor of the computing device, in a direction corresponding to the direction of the detected movement and by an amount proportional to the distance of the detected movement.

In one embodiment, the method includes displaying the at least one dynamic length adjustment band in a stretched format during detection of the movement of said dynamic length adjustment band. In another embodiment, resizing the image includes (i) enlarging the image, responsive to the direction of the detected movement being in a first predetermined direction, or (ii) reducing the image, responsive to the direction of the detected movement being in an opposing second predetermined direction.

In some embodiments, the method includes scaling the display of the image, subsequent to resizing the image, to fully display the resized image on the display. In other embodiments, the user selection of an image resize function includes a selection of a button. In still other embodiments, the user selection of an image resize function includes a pinch gesture.

In yet another aspect, the present disclosure is directed to a method for dynamically adjusting the dimensions of an image. The method includes displaying, by a display of a computing device, an image having a first length and a dynamic selection element on the image at a first position. The method also includes detecting, by a touch interface of the display, a contact on the surface at the first position. The method further includes detecting, by the touch interface, a first motion of the contact to a second position. The method also includes displaying, by the display, the dynamic selection element stretched to the second position, responsive to detection of the first motion. The method further includes extending, by the computing device, the image to a second length, the second length longer than the first length by an amount proportional to a length of the first motion.

In one embodiment, the method includes detecting, by the touch interface, a breaking of the contact at the second position; displaying, by the display, the dynamic selection element unstretched at the first position, responsive to the detection of the breaking of the contact; and retaining, by the computing device, the image at the extended length.

In still another aspect, the present disclosure is directed to a method for dynamically adjusting the aspect ratio of an image. The method includes displaying, by a display of a computing device, an image across a predetermined region of the display, the image having a first length, a first height, and a corresponding first aspect ratio, and displaying a dynamic selection element on the image at a first position. The method also includes detecting, by a touch interface of the display, a contact on the surface at the first position. The method further includes detecting, by the touch interface, a first motion of the contact to a second position. The method also includes displaying, by the display, the dynamic selection element stretched to the second position, responsive to detection of the first motion. The method also includes extending, by the computing device, the image to a second length, the second length longer than the first length by an amount proportional to a length of the first motion; and displaying, by the display, the extended image across the predetermined region of the display at a second aspect ratio of the second length and the first height.

In one embodiment, the method includes detecting, by the touch interface, a breaking of the contact at the second position. The method also includes displaying, by the display, the dynamic selection element unstretched at the first position, responsive to the detection of the breaking of the contact. The method further includes retaining, by the computing device, the image at the extended length.

In still yet another aspect, the present disclosure is directed to an automatic media ejection system for a printer. The media ejection system includes a platen configured to support media during and after printing. The system also includes a non-circular roller positioned above the platen having a first portion with a first diameter and a second portion with a second, smaller diameter, the smaller diameter less than the distance between the axis of the non-circular roller and the platen. The system further includes an auto-ejection motor configured to rotate the non-circular roller to orient the second portion toward the platen during printing of the media, and rotate the non-circular roller continuously to eject printed media after printing.

In one embodiment of the media ejection system, the non-circular roller does not contact the media during printing. In another embodiment of the media ejection system, the non-circular roller has a D-shaped profile. In still another embodiment of the media ejection system, the non-circular roller comprises a high friction surface. In yet another embodiment of the media ejection system, the platen comprises a low friction surface. In another aspect, the present disclosure is directed to a method for cutting a label by a printer. The method includes receiving, by a printer, a first image for printing on a continuous-feed printing medium. The method also includes printing, by the printer, the first image at a first position of the continuous-feed printing medium. The method further includes detecting, by a touch interface of a display of the printer, a motion of a contact on a surface of the display from a first predetermined position on the display to a second predetermined position on the display, and a breaking of the contact at the second predetermined position on the display. The method also includes cutting the continuous-feed printing medium at a second position of the continuous-feed printing medium subsequent to the printed first image, by a cutting mechanism of the printer, responsive to detection of the motion and breaking of the contact.

In some embodiments, the method includes receiving, by the printer, a second image for printing on the continuous-feed printing medium. The method also includes printing, by the printer, the second image at a third position of the continuous-feed printing medium subsequent to the second position. The method further includes receiving, by the direct thermal printer, a third image for printing. The method also includes kiss cutting the continuous-feed printing medium at a fourth position subsequent to the printed second image, by the cutting mechanism, responsive to receiving the third image. The method also includes printing, by the printer, the third image at a subsequent fifth position of the continuous-feed printing medium. The method further includes detecting, by the touch interface, a second motion of a second contact on the surface of the display from the first predetermined position on the display to the second predetermined position on the display, and a breaking of the second contact at the second predetermined position on the display. The method also includes cutting the continuous-feed printing medium at a sixth position of the continuous-feed printing medium subsequent to the printed third image, by the cutting mechanism, responsive to detection of the motion and breaking of the second contact. In a further embodiment, kiss cutting the continuous-feed printing medium further includes partially cutting through the medium to an adhesive backing of the medium.

In still another aspect, the present disclosure is directed to a method for illustrating the progress of printing of an image via a virtual image. The method includes receiving an image for printing, by a printer having a display positioned adjacent to a media ejection slot of the printer. The method also includes displaying, by the printer, a virtual image of the printed image on the display. The method further includes printing, by the printer, the image on a printing medium, the printing medium advanced through the media ejection slot during printing. The method also includes during printing, translating the image off the display, by the printer, in the direction of the media ejection slot, as a speed corresponding to a printing speed of the printer.

In one embodiment, the method includes positioning the image within the display offset from an edge of the display by a distance corresponding to a distance between a print head of the printer and the media ejection slot. In another embodiment of the method, the speed corresponding to the printing speed of the printer is proportional to a ratio of the size of the displayed virtual image and the printed image.

The details of various embodiments of the invention are set forth in the accompanying drawings and the description below.

BRIEF DESCRIPTION OF THE FIGURES

The foregoing and other objects, aspects, features, and advantages of the invention will become more apparent and better understood by referring to the following description taken in conjunction with the accompanying drawings, in which.

Figure 1A:
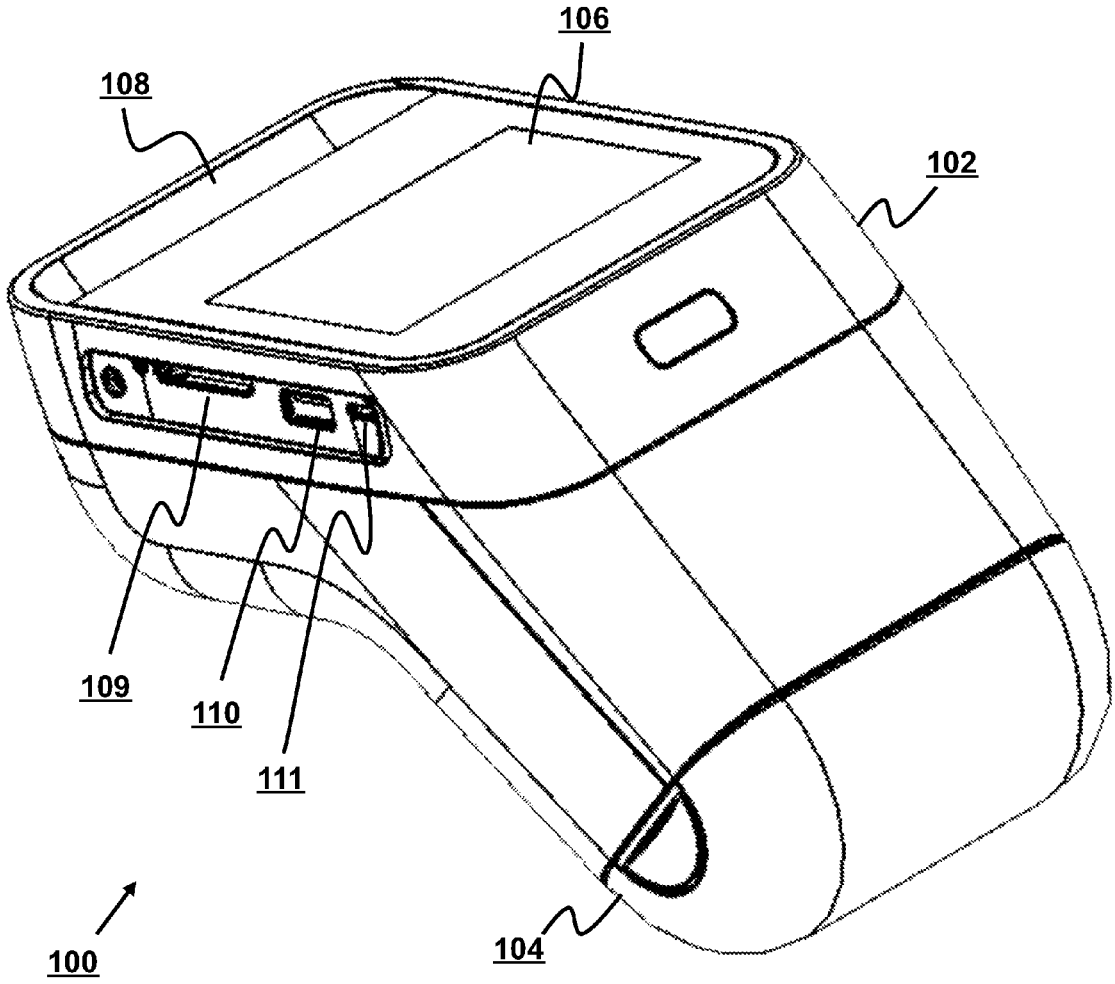
FIG. 1A is an isometric view of an embodiment of a printer with a user interface module.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

Referring first generally to FIGS. 1A-1H, illustrated are various views of an embodiment of a printing device or printer. The printer may be a direct thermal printer, capable of printing on dye-impregnated or color-former impregnated media in full color, with the ability to print full-bleed images, or images that extend fully across the media. As used herein, the term "dye" and "color-former" may be used interchangeably to represent chemicals that form color when activated by heat, UV light, visible light, IR light, pressure, or other energy. In other embodiments, the printer may be a black and white direct thermal printer, an ink jet printer, a thermal transfer printer, or any other type of printer. In some embodiments, the printer may use cassettes or cartridges containing rolls or strips of media, which may be cut to any length desired, and the printer may include one or more cutting blades, discussed in more detail below, for cutting media from the rolls. The printer may include a touch screen and present a user interface for configuration, editing of images for printing, purchasing image elements or themes from an online store, or performing other tasks, or may receive images from other devices, such as tablet computers, laptop computers, desktop computers, smart phones, digital cameras, or any other device.

Referring now to FIG. 1A, illustrated is an isometric view of an embodiment of a printer 100 with a user interface module 106. The printer 100 may comprise an outer shell or case 102, which may be of metal, plastic, a combination of metal and plastic, or any other elements. In some embodiments, part or all of the case may be rubberized to provide scratch or dent protection and/or higher friction for a safer grip. The case 102 may have a bent shape as shown, which may be adapted to fit a user's hand in operation. Such bends may be of any angle, such as 15 degrees, 30 degrees, or any other value. In other embodiments, the case may be straight, L-shaped, or any other shape.

The case 102 may include a removable or rotatable portion, shell or door 104 to cover and/or secure a cassette or cartridge inserted into the printer 100. Door 104 may be hinged on one edge, or may be held in place with clips, screws, thumbscrews, latches, pins, or via any other means, including compression-fitting.

Printer 100 may include a user interface module 106, which may include a capacitive or resistive touch screen or multi-touch screen; liquid crystal display (LCD), light emitting diode (LED) display, organic LED (OLED) display, electronic paper or electrophoretic ink (eInk) display, or any other type of display; one or more capacitive sensors, buttons, switches, or other contacts; a keypad or keyboard; a pointing stick or isometric joystick; or any other input/output devices or combination of these or other devices. For example, in one embodiment, the user interface 106 may include a multi-touch capacitive screen, one or more LEDs, and one or more capacitive sensors, while in another embodiment, the user interface 106 may include a resistive touch screen and a stylus. The user interface module 106, discussed in more detail below, may provide functionality for configuration, printing, editing of images, retrieving images from other devices or storage, connecting to a network, purchasing elements, or performing other functions.

Case 102 may include a media ejection slot 108 or similar opening through which printed media may be ejected. Although shown below user interface module 106, in other embodiments, the media ejection slot 108 may be on another side of the case 102 or above the user interface module 106, or even within the user interface module 106 in embodiments in which the user interface module 106 includes multiple portions such as a screen and keypad or screen and buttons. In other embodiments, media may be retained within printer 100 and the user may open a slot, door, or portion of case 102 to remove printed media.

Printer 100 may include one or more physical connection interfaces 109-111, and/or one or more wireless connection interfaces (WiFi, cellular, Bluetooth, or others, discussed in more detail below). Physical connection interfaces 109-111 may include any full-size, mini- or micro-receptacle, port or jack for interfaces such as universal serial bus (USB) including USB 2.0, or USB 3.0; FireWire (IEEE 1394, 1394b, or any other variant); Ethernet; Serial; Parallel; ThunderBolt or LightPeak; cylindrical connectors such as ⅛" TRS or other variants; or any other type and form of connection interface for transferring data into or out of printer 100. For example, as shown in FIG. 1A, a printer 100 may include a full-size USB receptacle 110 and a mini USB receptacle 111. Physical connection interfaces 109-111 may also include slots, receptacles, or interfaces for flash memory or other storage devices or expansion cards, such as PCMCIA cards, multi-media cards (MMC), CompactFlash; SecureDigital (SD), MicroSD, MiniSD; or any other type and form of storage device or card, as shown in receptacle 109 of FIG. 1A. Although shown on the side of case 102, one or more connection interfaces 109-111 may be in various locations of the printer 100 and may be together or separate in location.

Figure 1B:
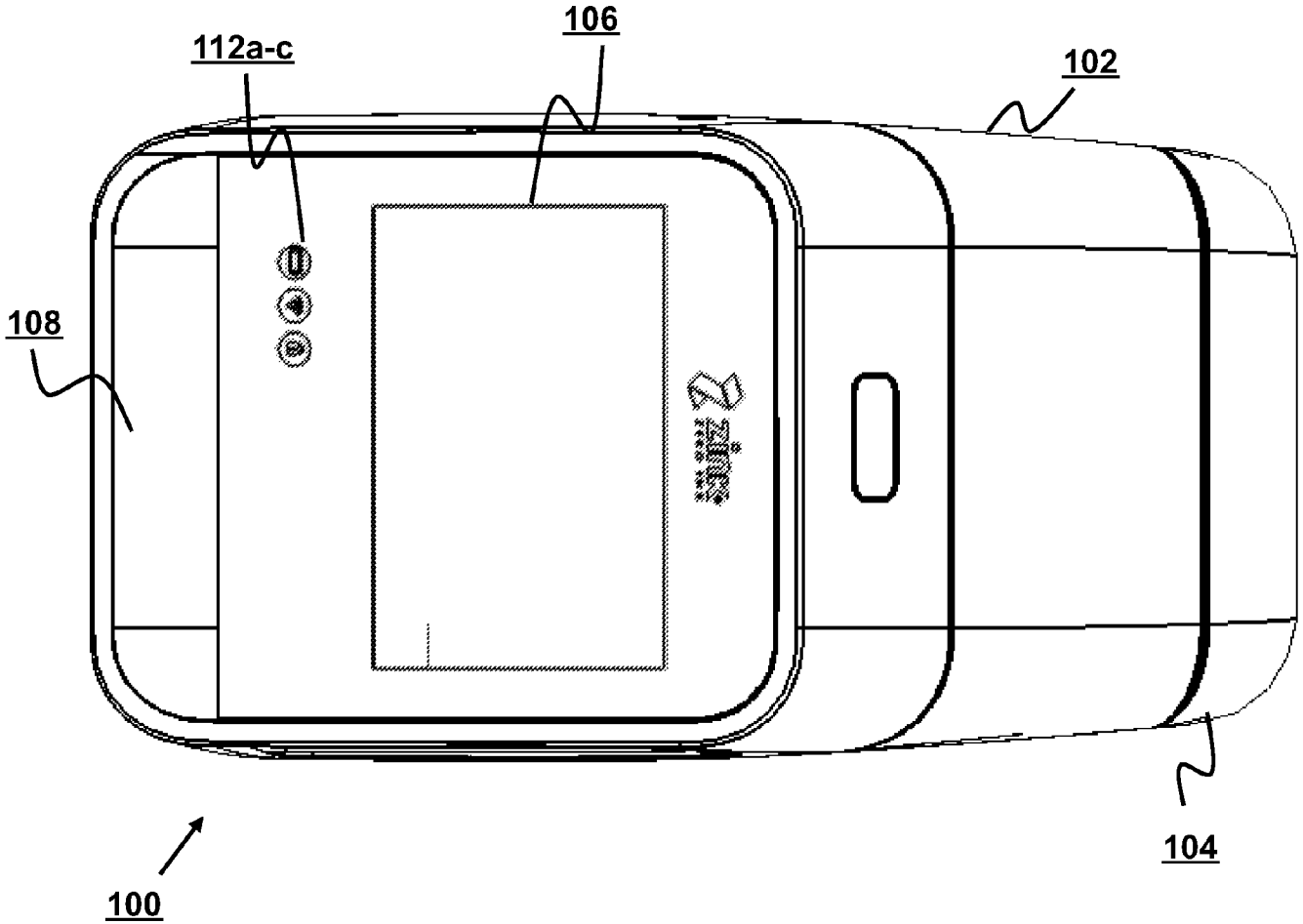
FIGS. 1B and 1C are top and bottom views, respectively, of the embodiment of a printer of FIG. 1A.
Figure 1C:
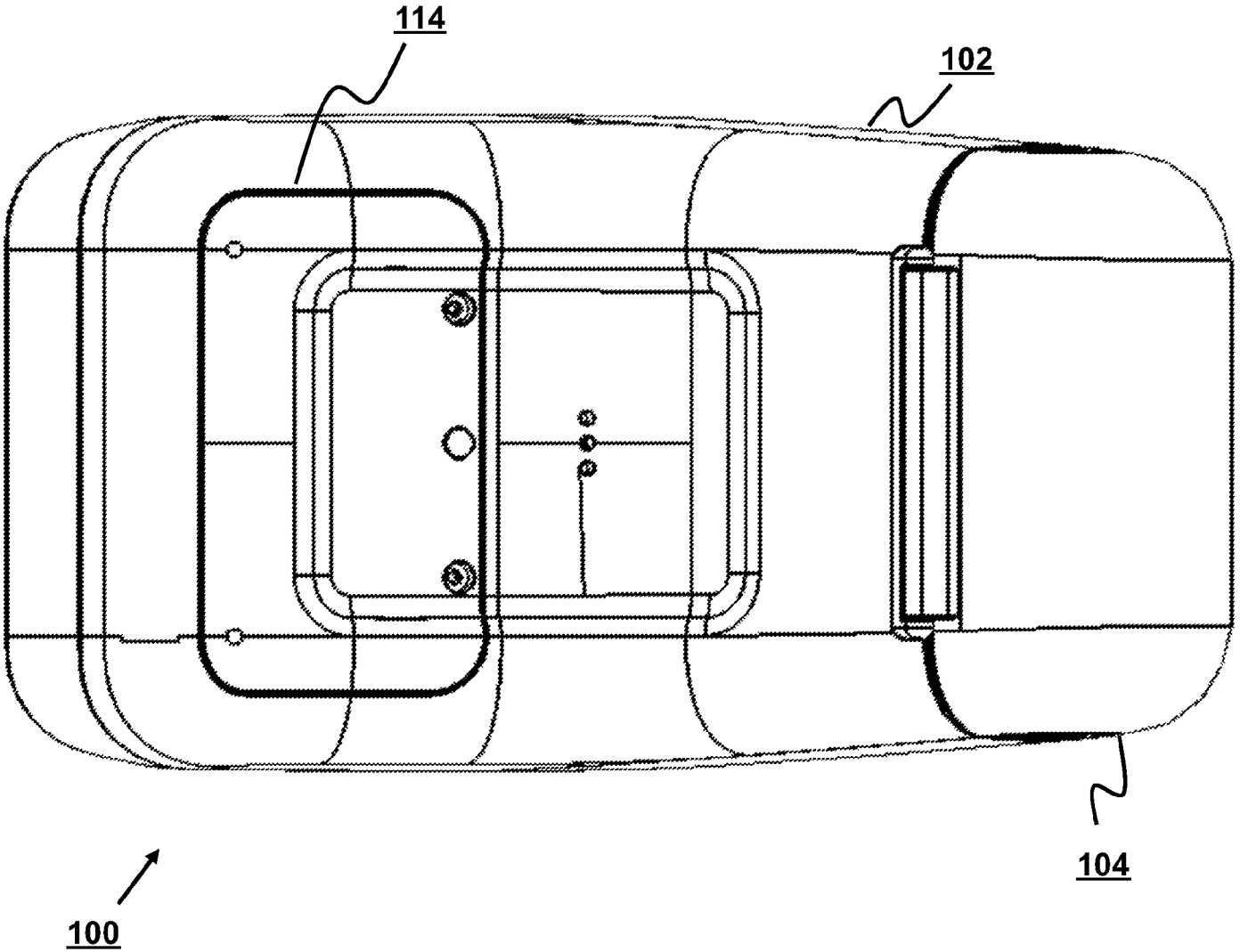

FIGS. 1B and 1C are top and bottom views, respectively, of the embodiment of a printer of FIG. 1A. As shown in FIG. 1B, printer 100 may include one or more indicator lights or LEDs or transparent openings for indicator lights or LEDs 112*a*-112*c* (referred to generally as indicator lights 112). Indicator lights 112 may indicate battery level, battery charge status, network status or data transfer status (such as whether the printer is connected to a network or connected to a computing device, either physically or wirelessly), media level (such as an out of media light), error status, status of a device or screen lock, or any other such indicator. In many embodiments, indicators 112 may have multiple functions, such as via different colors (red for low battery vs. green for full battery) or via solid or blinking lights. Indicators 112 may be positioned elsewhere on the printer 100 and/or may be separated, grouped together as shown, or arranged in other ways.

As shown in FIG. 1C, printer 100 may include a battery compartment with an access panel 114. Printer 100 may use user-replaceable standard batteries such as AA batteries or 9 volt batteries, or may include a battery pack, such as a lithium-ion (Li-ion) battery, nickel-cadmium (NiCad) battery or other type and form of battery or battery pack. In many embodiments, batteries may not be user-replaceable, and accordingly, the printer 100 may not include a door or panel for access to a battery compartment. Additionally, as can be seen in FIG. 1C, in many embodiments, media cassette or cartridge door 104 may be hinged.

Figure 1D:
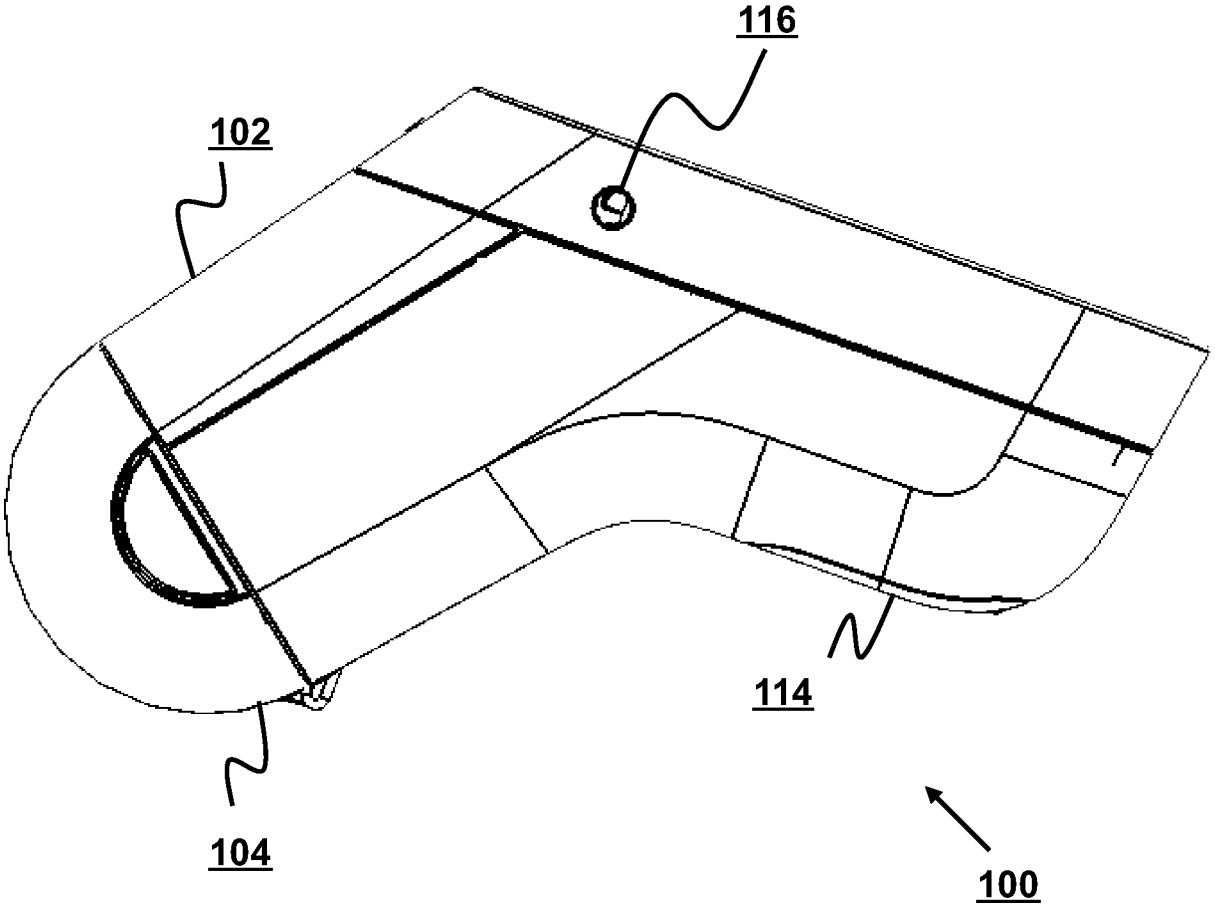
FIGS. 1D and 1E are left and right side views, respectively, of the embodiment of a printer of FIG. 1A.
Figure 1E:
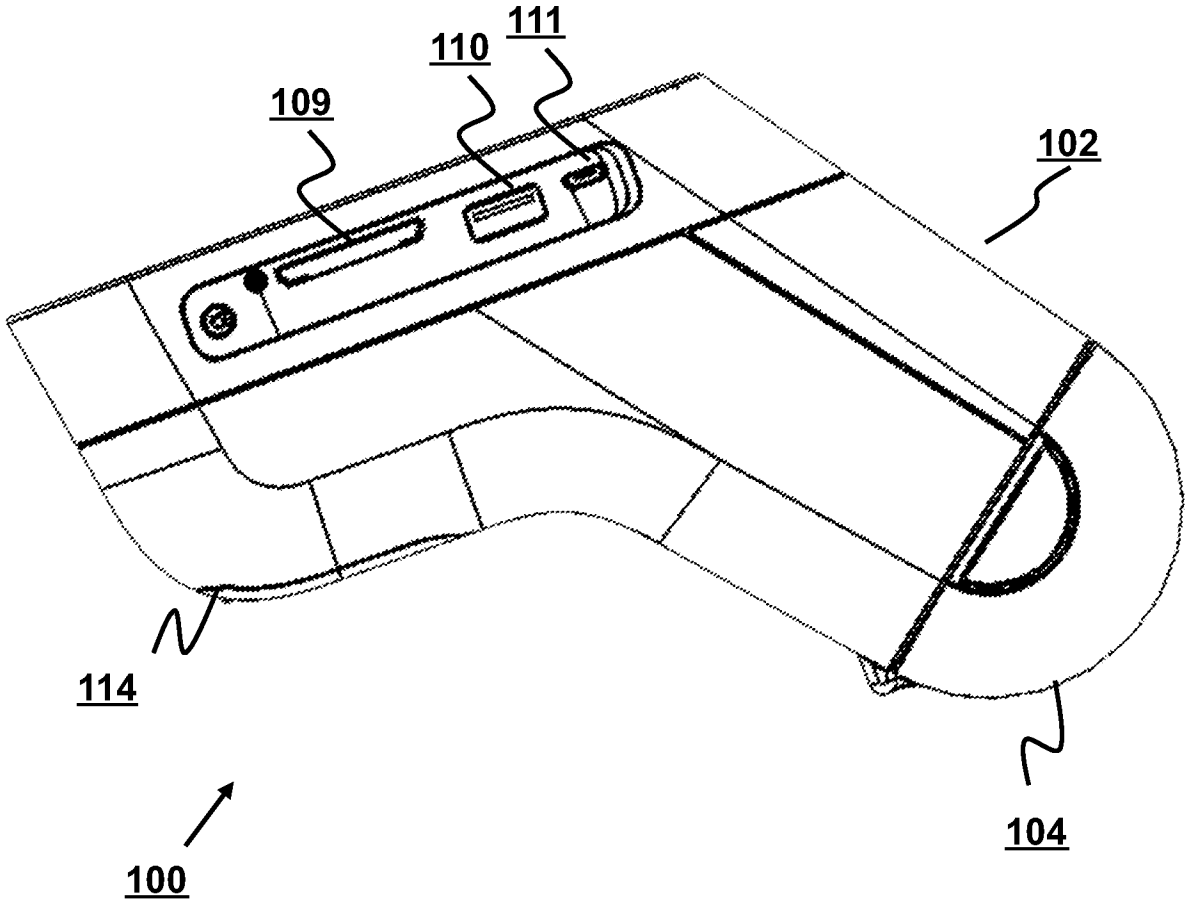

FIGS. 1D and 1E are left and right side views, respectively, of the embodiment of a printer of FIG. 1A. As shown in FIG. 1D, printer 100 may include a receptacle 116 for a power adapter, such as a DC power jack, for powering the printer 100 and/or for charging batteries of the printer. Although shown on the opposite side of printer 100 from connection interface 109-111, in some embodiments, connectors may be placed together on the same side. In still other embodiments, a physical connection interface 110-111 may be used for powering the printer and/or charging batteries. For example, a USB interface may be used to power the printer and to transfer data.

Figure 1F:
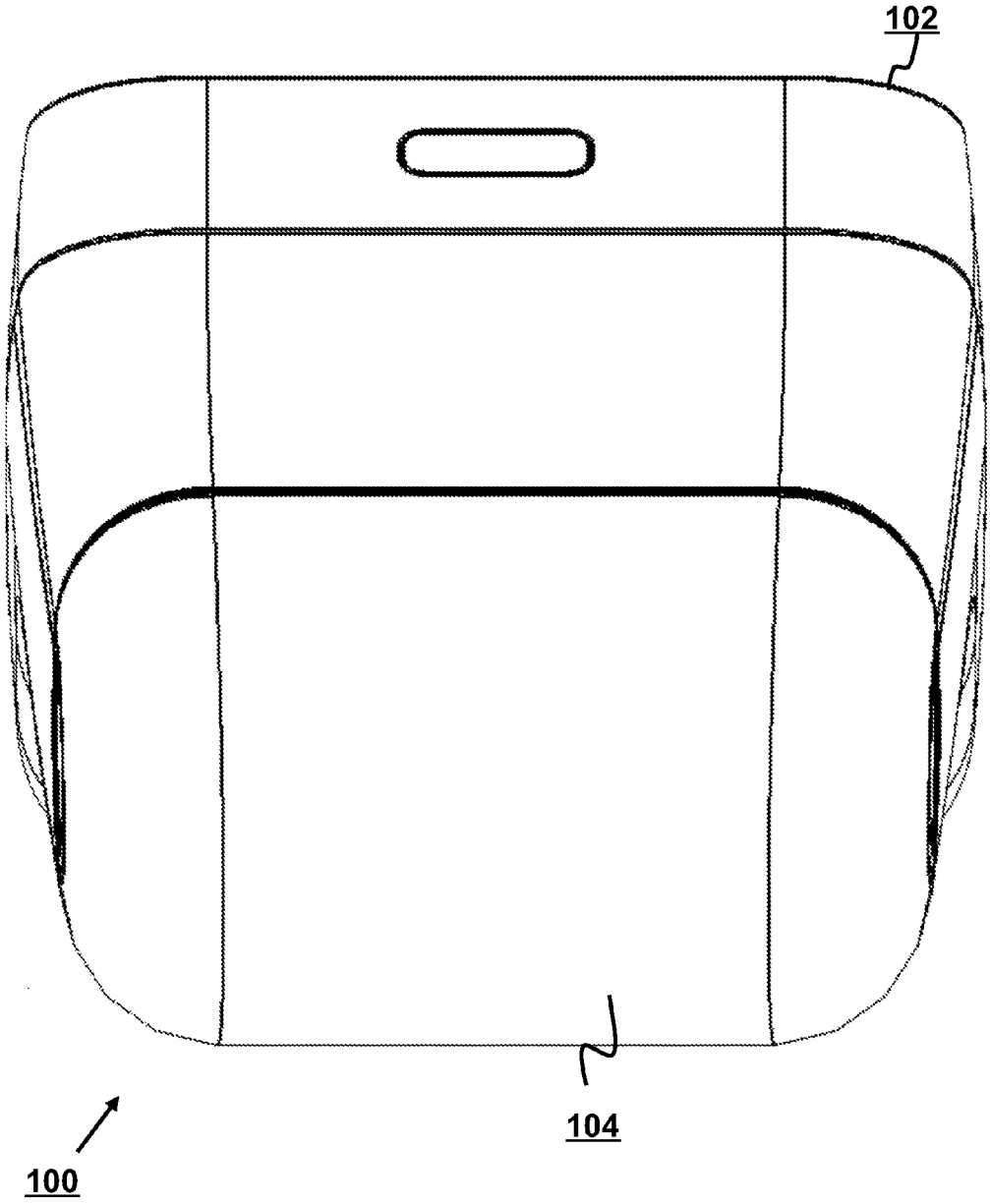
FIGS. 1F and 1G are back and front views, respectively, of the embodiment of a printer of FIG. 1A.
Figure 1G:
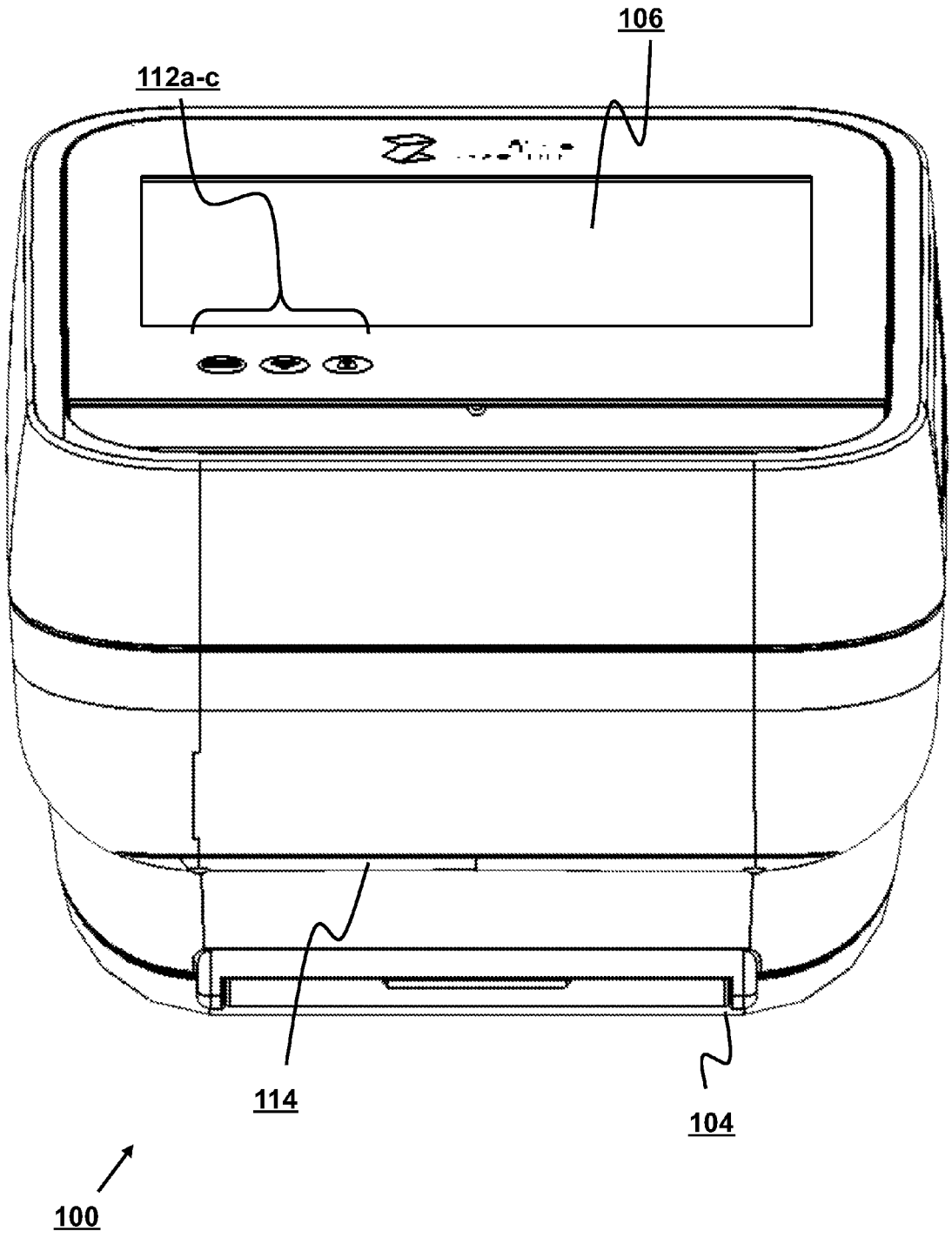

FIGS. 1F and 1G are back and front views, respectively, of the embodiment of a printer of FIG. 1A. As shown, the printer 100 may be slightly tapered to allow easy handling by the user.

Figure 1H:
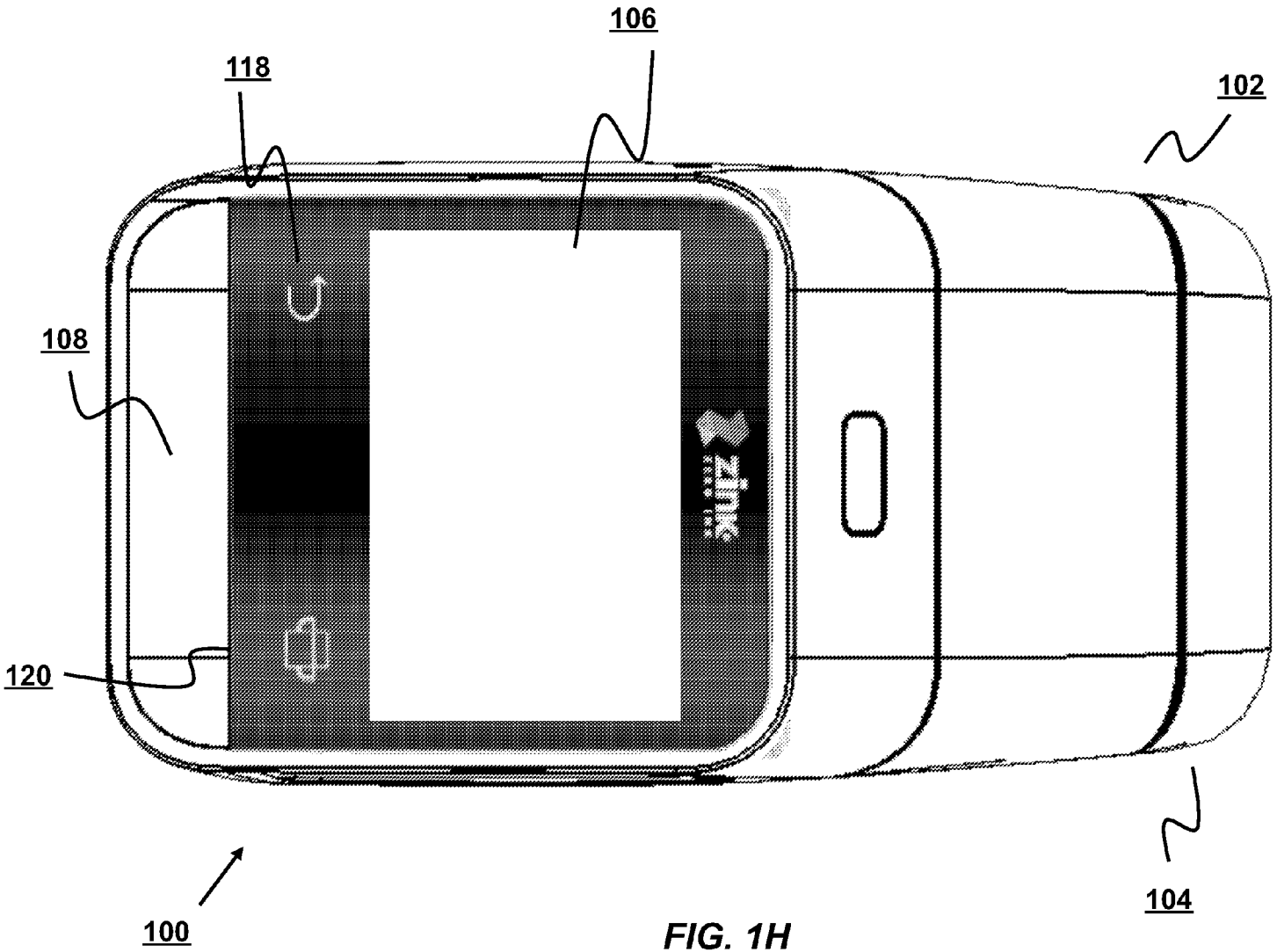
FIG. 1H is a top view of another embodiment of the printer of FIG. 1A.

FIG. 1H is a top view of another embodiment of the printer of FIG. 1A. The printer 100 may include one or more buttons or capacitive sensors 118-120, which may be lit or unlit. For example, the printer may include a home or return button 118, which may be used for interacting with applications and/or an operating system provided by the printer and user interface module, discussed in more detail below. For example, if a user is working within an editing application, the user may press the return button 118 to return to a main or home menu to select another application to execute. The printer may also include a print button 120, which may be used for initiating printing of an image or label the user has edited. As discussed above, buttons 118-120 may further act as indicator lights. For example, a print button 120 may be lit green when the printer has enough media in a cartridge or cassette, or be lit red or flash when the printer is out of media.

Figure 2A:
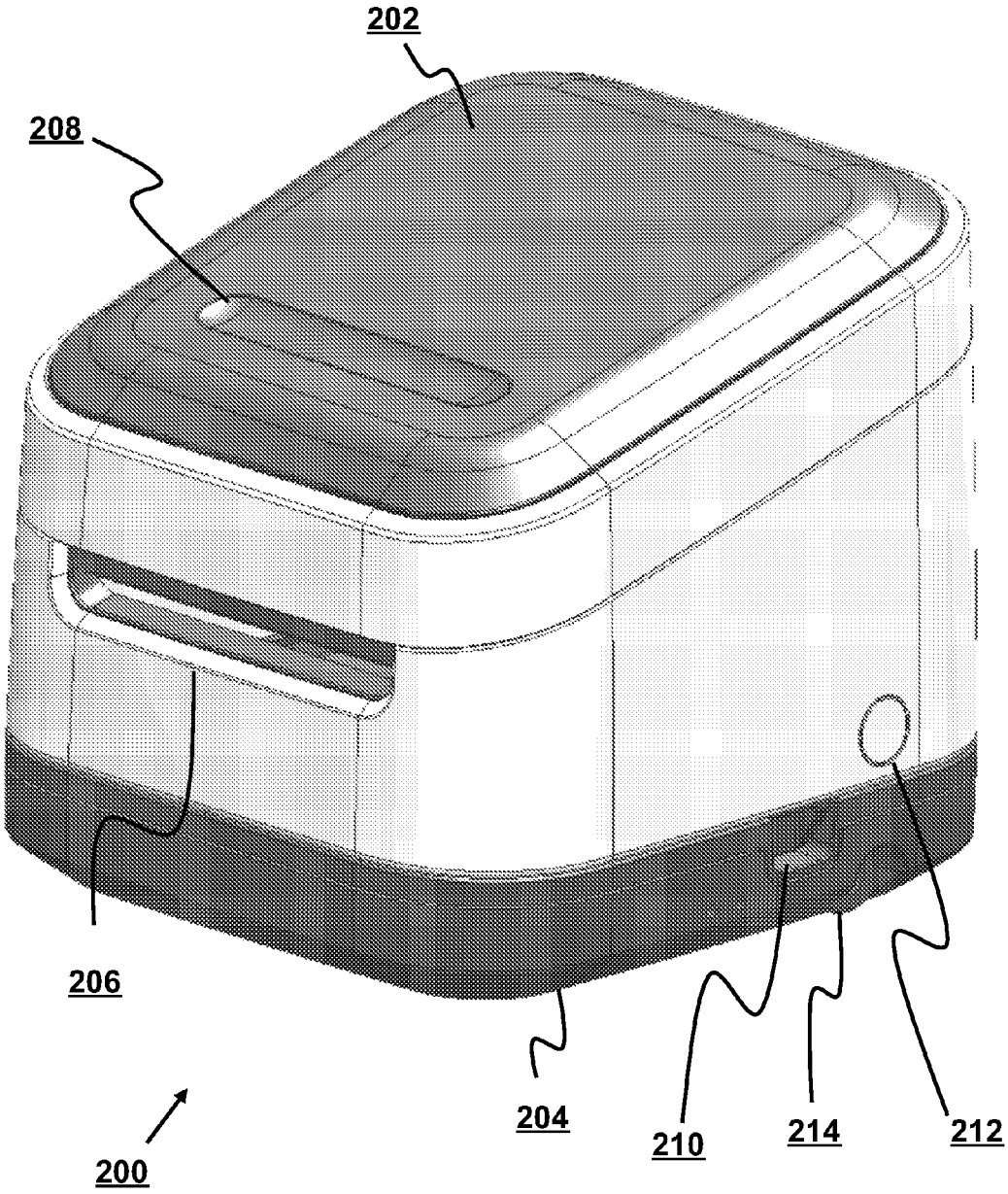
FIG. 2A is an isometric view of another embodiment of a printer.

Other embodiments of printers may not include a touch screen user interface module or similar interface, reducing size, weight, and cost. For example, referring now to FIG. 2A, illustrated is an isometric view of such a printer 200. The printer 200 may have a case 202, which may be made of metal, plastic, or any combination of metal and plastic or other materials. Although shown with a trapezoidal profile, the printer 200 may be in other shapes, including a cube or any other regular or irregular profile.

Printer 200 may include battery pack 204. Battery pack 204 may comprise a compartment and/or holder for user-replaceable batteries, such as AA or 9 volt batteries, or may include a Li-ion or NiCad battery pack. As shown, battery pack 204 may securely connect to a case 202 of printer 200, via one or more latches, clips, or compression fittings. For example, electrical connections from the battery pack 204 to the rest of the printer 200 may be via pins or contacts between pack 204 and case 202, and the battery pack 204 may clip into the case to form a tight physical and electrical connection. This may allow a user to swap battery packs if one is drained, and/or may also allow for attachment of accessories. For example, in one embodiment, an accessory pack with an extended battery or accessory pack with additional wired or wireless communications features may be attached in place of battery pack 204. In another embodiment, an accessory pack may be attached in addition to battery pack 204. For example, an accessory pack may be configured to fit in between battery pack 204 and case 202, with top and bottom electrical contacts to pass power from the battery to the printer.

Printer 200 may include a media ejection port or slot 206 through which printed media may exit. Although shown on the front of printer 200, media ejection slot 206 may be on top of the printer, or in any other location. Media ejection slot 206 may be open, as shown, or may include a door or cover. In some embodiments, accessories such as media catch trays may be connected to printer 200 and/or slot 206 to receive printed media after ejection.

Printer 200 may include a sensor for triggering a cut by a user, or a "cut sensor" 208. Cut sensor 208 may comprise one or more capacitive sensors, one or more buttons, one or more optical sensors, or any other type and form of sensor for detecting a user interaction to indicate a command to cut printed media. As discussed in more detail below, in some embodiments of cutting systems discussed herein, printed media may be cut partially through to a backing layer (referred to as a kiss cut), which may allow for easy removal of printed adhesive labels of variable length. Printed media may also be fully cut (referred to as a full cut) to eject the media from printer 200. In some embodiments of printer 200, a full cut mechanism may be positioned internally at some distance from media ejection slot 206, such that after cutting the media, in some instances, the media may not fall free of the ejection slot due to gravity alone. As a result, the printed media may rest partially inside printer 200. If the user tries to subsequently print another image, the media being printed would press against the previously printed and cut media, resulting in additional friction, bending of the media during printing, sliding or skipping resulting in visible distortions or "banding" within the printed image, or other undesirable effects. Accordingly, in some embodiments, the printer 200 may require the user to interact with a cut sensor 208 to perform a cut command or gesture, discussed in more detail below. Thus, the user can be in position to manually remove a cut segment of media from media ejection slot 206, eliminating the potential for the above undesirable effects.

In some embodiments, cut sensor 208 may further include one or more indicator lights, which may be lit responsive to the user interaction with the sensor 208. For example, the cut sensor 208 may comprise three capacitive sensors positioned across the width of the sensor region 208, with corresponding LEDs placed below transparent or partially transparent portions of case 202. As the user swipes a finger across the three sensors, each corresponding LED may light (either remaining lit, or extinguishing once the user's finger has moved from the corresponding sensor) and upon completion of the swipe, a cutting mechanism of the printer 200 may fully cut the printed media. The user may manually remove the printed media from slot 206, and the printer 200 is ready to print a subsequent image.

The printer 200 may also have a physically-controlled cutting mechanism, such as a rolling or sliding cutter. Sensor region 208 may be replaced in such embodiments with a physical handle, knob, button, or similar implement. The user may manually move said physical implement along a slot to move a corresponding physical cutter across the printed media. In still other embodiments, other manual cutting mechanisms, such as guillotine-type manual cutters, may be employed. In various embodiments, the printer 200 can include a mechanical actuator (e.g. a physical handle) to control the cutting mechanism, a sensor (e.g., sensor 208), or both.

Printer 200 may include may include one or more physical connection interfaces 210, and/or one or more wireless connection interfaces (WiFi, cellular, Bluetooth, or others, discussed in more detail below). Physical connection interfaces 210 may include any full-size, mini- or micro-receptacle, port or jack for interfaces such as USB, including USB 2.0, or USB 3.0; FireWire; Ethernet; Serial; Parallel; ThunderBolt or LightPeak; cylindrical connectors such as ⅛" TRS or other variants; or any other type and form of connection interface for transferring data into or out of printer 200. Physical connection interfaces 210 may also include slots, receptacles, or interfaces for flash memory or other storage devices or expansion cards, such as PCMCIA, MMC, CompactFlash; SD, MicroSD, MiniSD; or any other type and form of storage device or card. Although shown as a USB type B receptacle on the side of case 202, one or more connection interfaces 210 of various types may be in other locations of the printer 200 and may be together or separate in location.

Printer 200 may include one or more function buttons 212. Function buttons 212 may be physical buttons, capacitive sensors, or any other type of button, switch, or sensor. A button 212 may be a power button for powering the printer 200 on or off, or may be a function button for performing various control and/or configuration functions. For example, in one embodiment discussed in more detail below, a printer 200 may include a wireless network interface, and a function button 212 may be used to switch the network interface between an independent access point mode and an existing-network connected mode. A single function button 212 may also perform multiple functions, allowing the user to rotate between multiple status or configuration modes, such as off; on in access point mode; and on in network-connected mode.

Although shown on the side of case 202, one or more function buttons 212 may be placed anywhere on case 202 and/or battery pack 204.

Printer 200 may include a power receptacle 214, which may be positioned on the case 202 or as part of battery pack 204 as shown. For example, battery pack 204 may comprise a rechargeable Li-ion battery and may include a DC power input jack 214. This may allow users to charge a first battery pack 204 while using a second battery pack 204 with the printer, which may be particularly helpful in uses where portability is required, such as using printer 200 for printing wire labels during construction of a building, or using printer 200 for generating name tags at an outdoor reception.

Figure 2B:
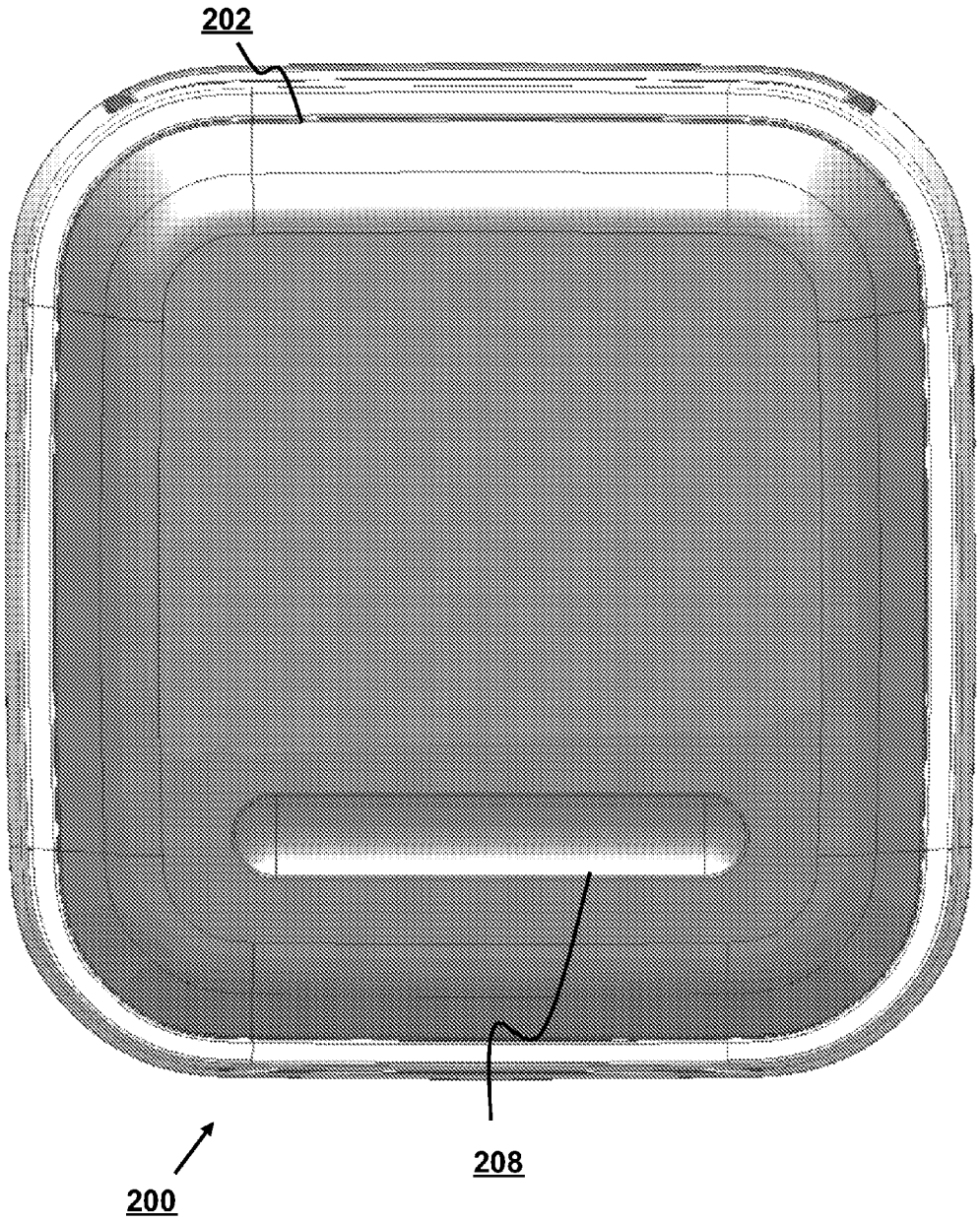
FIGS. 2B and 2C are top and bottom views, respectively, of the embodiment of a printer of FIG. 2A.
Figure 2C:
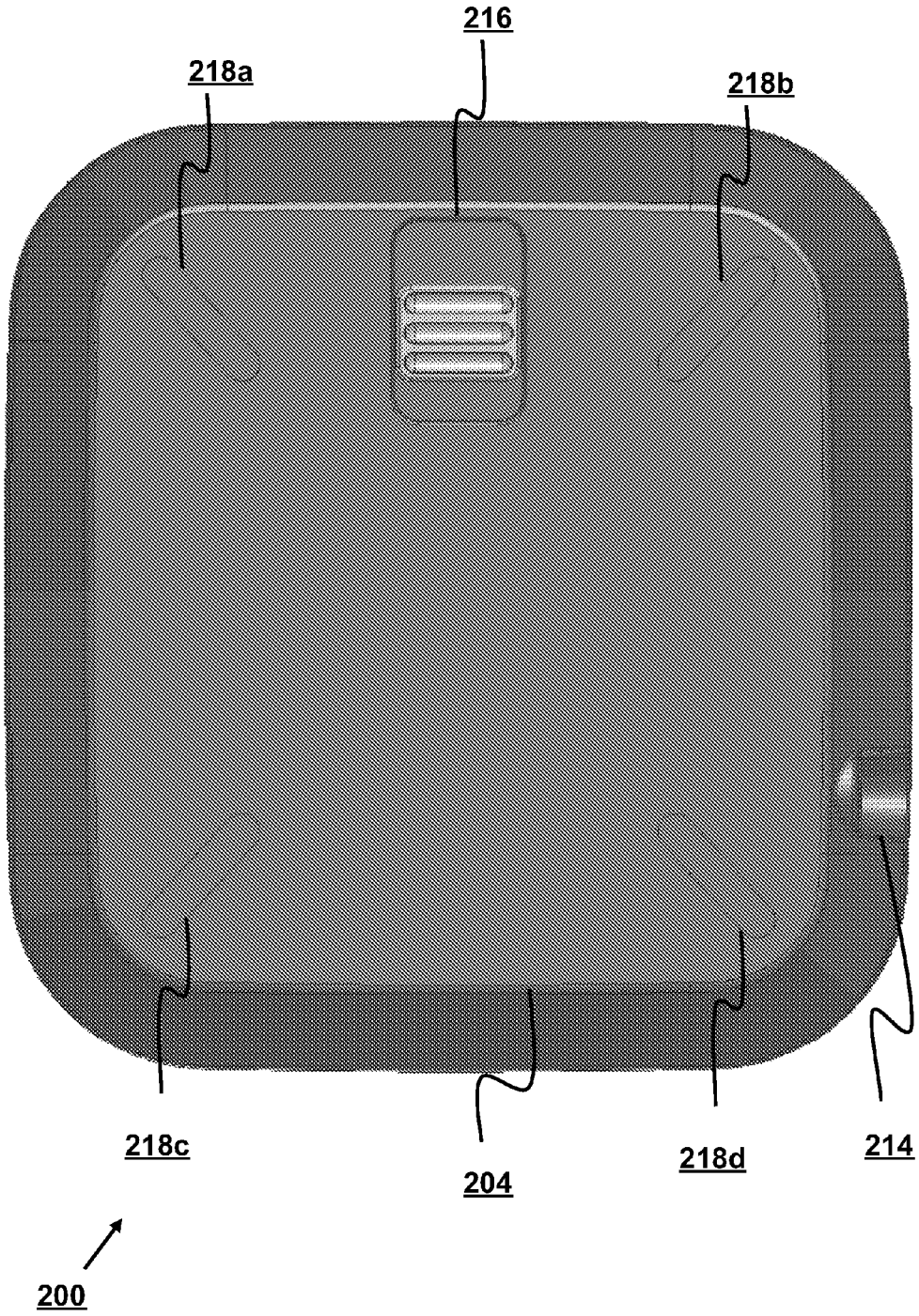

FIGS. 2B and 2C are top and bottom views, respectively, of the embodiment of a printer of FIG. 2A. As shown in bottom view 2C, printer 200 or a battery pack 204 of printer 200 may include one or more feet 218*a*-218*d*, which may be rubber or textured plastic to provide shock and vibration isolation and/or friction to provide stability of printer 200.

A battery pack 204 may also include a latch 216 for clipping battery pack into case 202. Latch 216 may comprise a spring latch, sliding or locking latch, or similar latch or clip to provide a secure connection of battery pack 204 to case 202. Battery pack 204 may include multiple latches 216 on different sides or in different orientations along the bottom, or may include a single latch as shown. In embodiments with the latter, the battery pack 204 may include hooks or similar protrusions along the top of the pack to connect with corresponding catches or receptacles of case 202, with latch 216 providing a secure hold on an opposing edge of the battery pack. In other embodiments, a battery pack 204 may not include a manually operated latch 216. In such embodiments, the battery pack 204 may securely attach to printer 200 via snap-in hooks or internal latches in deflectable or deformable portions of the plastic case, via magnets, or via other attachment means.

Figure 2D:
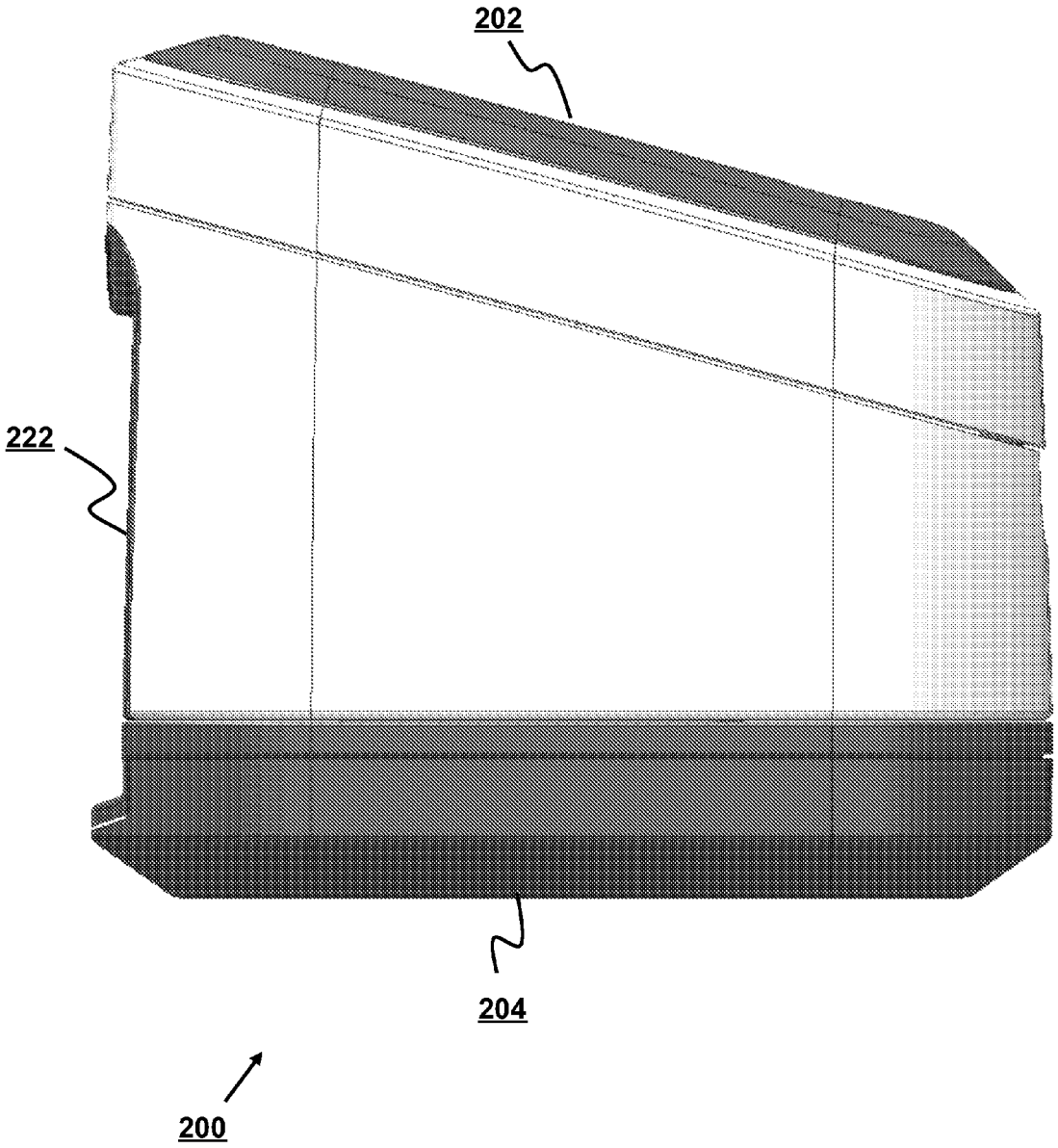
FIGS. 2D and 2E are left and right side views, respectively, of the embodiment of a printer of FIG. 2A.
Figure 2E:
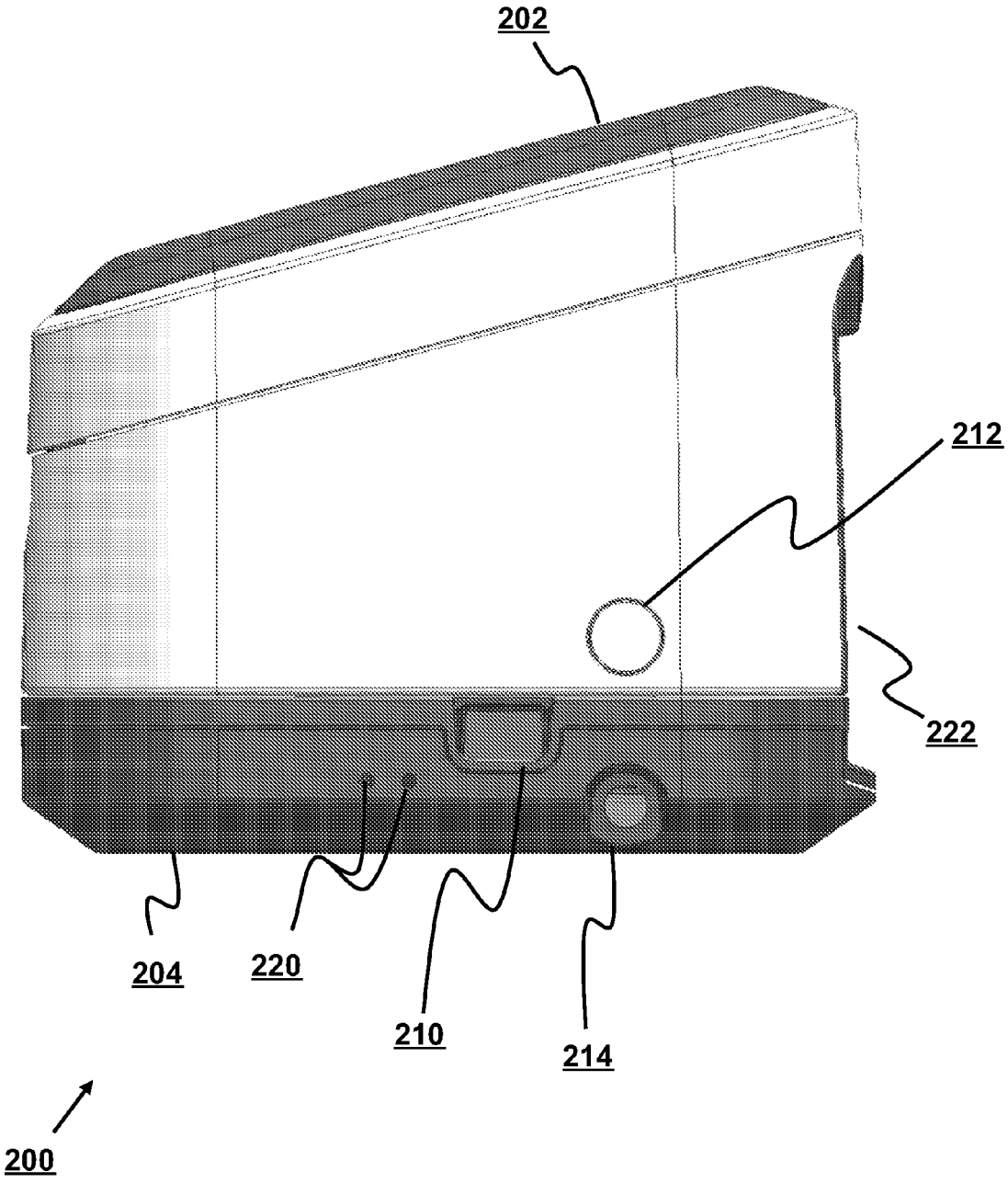

FIGS. 2D and 2E are left and right side views, respectively, of the embodiment of a printer of FIG. 2A. As shown, case 202 may include a receptacle 222 or opening for receiving a media cartridge or cassette. As shown in FIG. 2E, a battery pack 204 may include one or more status lights 220, including lights for battery status and charging status. Such lights may be single color or multi-color, solid or flashing, allowing various statuses to be communicated to the user. For example, a status light 220 may be solid green for fully charged or red for almost empty, or blinking for charging.

Figure 2F:
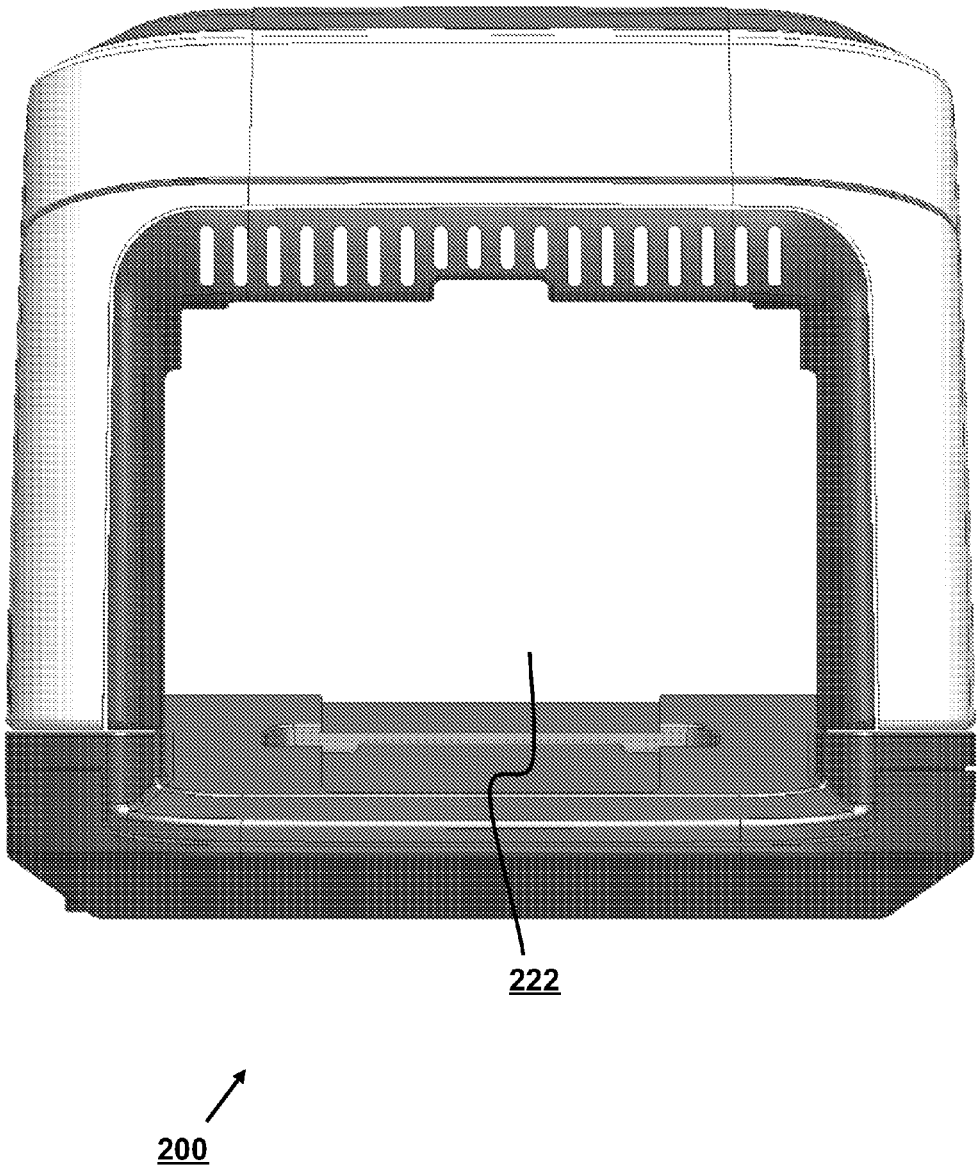
FIGS. 2F and 2G are back and front views, respectively, of the embodiment of a printer of FIG. 2A.
Figure 2G:
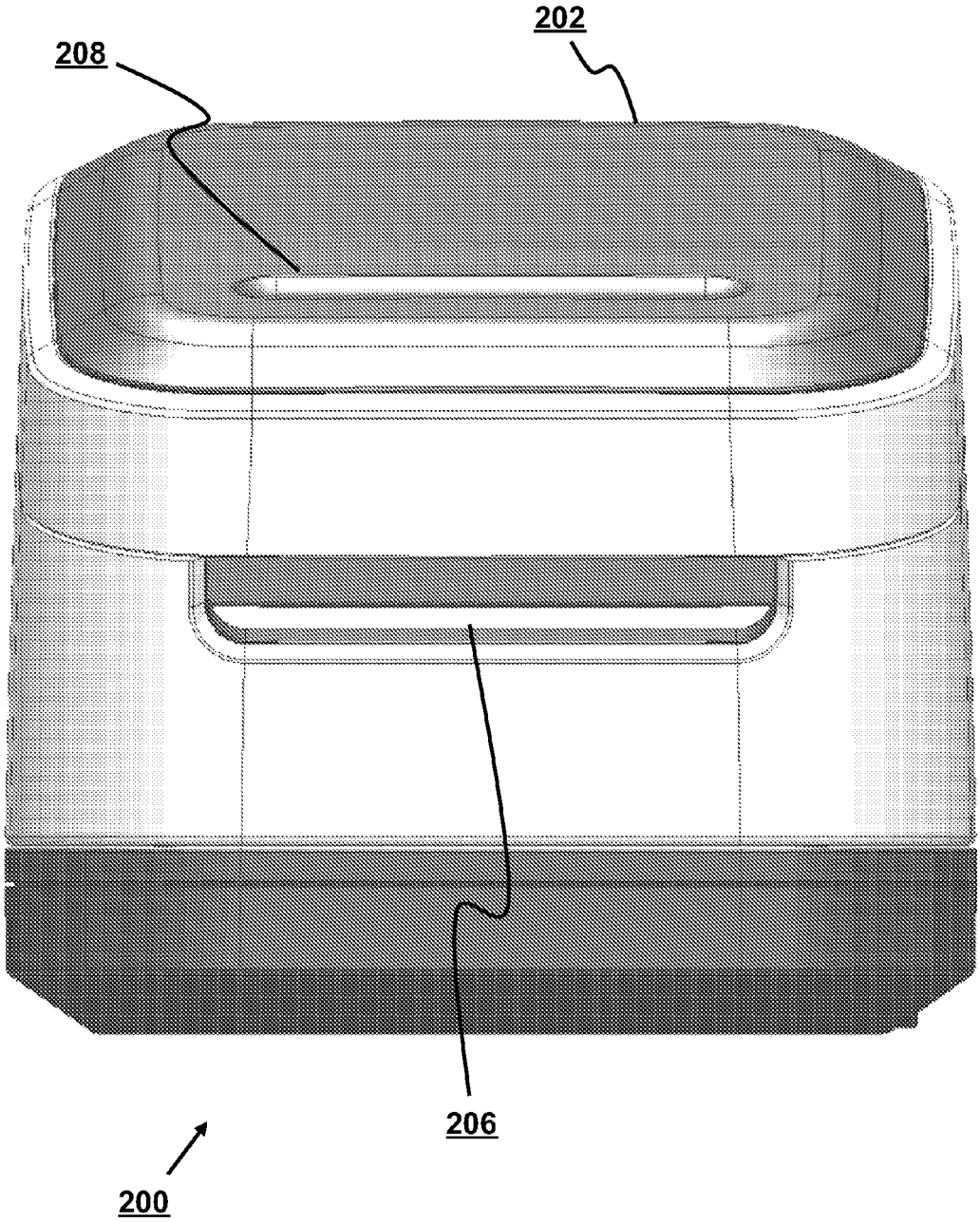

FIGS. 2F and 2G are back and front views, respectively, of the embodiment of a printer of FIG. 2A. As shown in FIG. 2F (with internal components removed), receptacle 222 may have recesses for receiving corresponding protrusions of a cassette or cartridge, allowing secure fit and automatic alignment.

Printers 100 and 200 may be used with various types of media, including black and white direct thermal media or full color direct thermal media, such as various media manufactured by ZINK Imaging, Inc.; plain paper media for black and white or inkjet or toner-based printing; thermal dye-sublimation printing or transfer printing; or any other type and form of media. Media may be of fixed or predetermined lengths, such as sheets of predetermined dimensions, or may be on continuous rolls in cassettes or cartridges for variable-length printing. In some embodiments, media may include an adhesive between a substrate and a disposable backing layer, allowing printing of labels or stickers. The media may also include transparent sections for self-laminating wire labels or similar uses. The media may be provided in any width. In some embodiments using cassettes or cartridges, rolls of media of predetermined width may be used and cut to desired lengths during printing. In other embodiments, longitudinal cutting mechanisms may be employed to cut a wide strip of media to a narrower width.

Figure 3A:
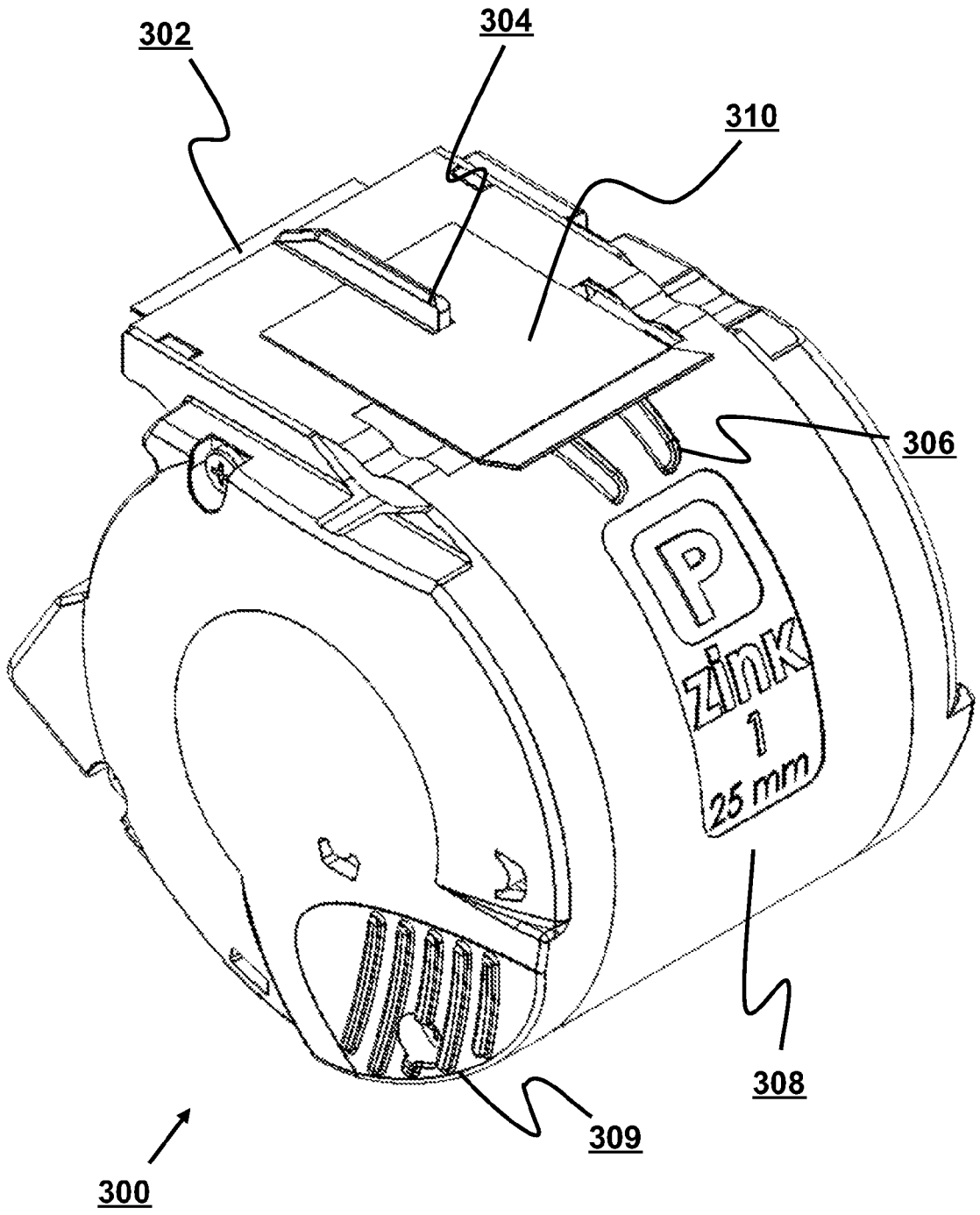
FIG. 3A is an isometric view of an embodiment of a printing medium cassette.

Referring now to FIG. 3A, illustrated is an isometric view of an embodiment of a printing medium cassette 300. Cassette 300 may comprise a shell of plastic or other material, and may be provided in multiple colors to denote type of media, such as adhesive or non-adhesive, or other cassette types, such as cleaning cassettes, discussed in more detail below. In some embodiments, the cassette 300 may comprise a central shell and two end caps. The shells may be provided in different widths, but use the same end caps, resulting in reduced manufacturing costs while allowing for multiple widths of media.

Cassette 300 may include a roll of media 302 (partially shown protruding from cassette 300 in FIG. 3A), which may be pushed or pulled by a printer 100, 200 from a media slot of cassette 300 via one or more rollers and/or gears. Media 302 may be of a predetermined width, such as ½", ⅜", 1", 2" or any other width, and may have an adhesive layer and disposable backing or no adhesive layer or backing. Media 302 may be a full color direct thermal or UV printing media, as discussed above, with a substrate and one or more layers impregnated with a color-forming dye.

Cassette 300 may include an alignment protrusion 304 for aligning and centering the cassette when inserted into a printer 100, 200. Protrusion 304 may prevent rotational torque along the vertical axis of the cassette when media 302 is being pulled from the cassette and/or aid in alignment of the media against a print head. Similarly, cassette 300 may include one or more additional protrusions or guides 306 for engaging a corresponding slot or guide of a printer 100, 200, to align the cassette when inserted into the printer. Although shown on top, in many embodiments, protrusions or guides 304, 306 may be on the sides and/or bottom of the cassette.

During manufacture, adhesive tape 310 or a similar material may be placed on cassette 300 in contact with both the shell of cassette 300 and media 302, for example, to prevent media 302 from accidentally being irretrievably rewound into the cassette. As shown in FIG. 3A, cassette 300 may include a window or opening within the case above the media 302, through which tape 310 may be stuck to media 302. Users may also view the media through the window to verify type, color, width, and/or amount remaining Tape 310 may be removed before use, and may be replaced by the user if the media is only partially used. This may not be necessary in all embodiments: if the media is only partially used and the cassette 300 removed from printer 100, 200, the media 302 may be left extending far enough from cassette 300 that it cannot easily slip inside, eliminating the need to replace tape 310.

Cassette 300 may include labeling 308 to indicate width of the media and/or type of media. For example, as discussed above, media may be adhesive or non-adhesive; black and white or color direct thermal media; partly or entirely transparent or self-laminating; be white or pre-colored for sublimation printing on a colored background; or may be a non-printing cartridge including a cleaning medium, discussed in more detail below, and may be provided in different widths. Cassette 300 may also be colored to indicate media type, such as blue for a cleaning cassette and green for a direct thermal color cassette, or any other color or combination of colors.

Figure 3B:
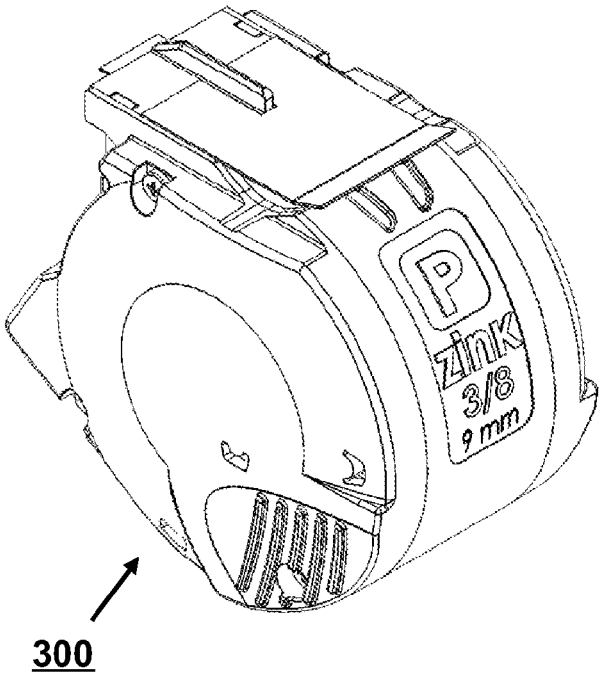
FIGS. 3B and 3C are isometric views of additional embodiments of the printing medium cassette.
Figure 3C:
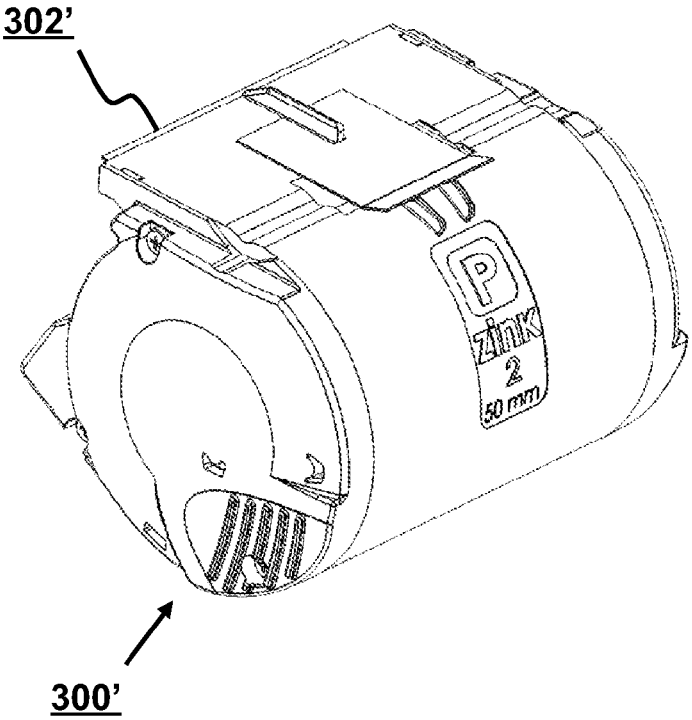

For example, shown in FIGS. 3B and 3C are isometric views of additional embodiments of the printing medium cassette 300. FIG. 3B shows a cassette 300 with ½" media. As shown and as discussed above, the center section of the case may be specific to the media, while the end caps may be identical for all cassettes. FIG. 3C shows a cleaning cassette 300', which may include a cleaning medium 302'. Cleaning medium 302' may comprise an abrasive, absorptive, microfiber, or similar material for removing particles, dirt, wax, or other buildup from a print head. In some embodiments, a printing medium may include a substrate with a rough coating on a reverse side of the printing surface. This may be an artifact of manufacture of the substrate, or may be added to increase stiffness of the substrate and/or prevent warping due to humidity or moisture. In some embodiments, the rough coating may increase a coefficient of friction of the surface, providing better traction during motion of the print media. Such a substrate may also be used as an abrasive cleaning material, with cleaning cassettes 300' including rolls of the media substrate, rolled in a reverse direction such that what is normally the non-printing side on the inner surface of the roll is instead on the outer surface of the roll. Such cleaning media may include the substrate without color-forming dye layers, for example, to reduce cost.

Referring back to FIG. 3A, to encourage users to grip the cassette 300 in a proper position for insertion into and/or removal from printer 100, 200, a cassette 300 may include a textured grip 309, which may be on one or multiple sides of cassette 300. For example, as shown in FIG. 3E and as discussed above, a cassette 300 may include a plurality of textured grips 309*a*-309*b*. Textured grip(s) 309 may comprise ridges, bumps, indentations, valleys, notches, or other features, and/or may comprise a high-friction material such as rubber. In one embodiment, a textured grip 309 may comprise one or more cutouts in a shell of cassette 300, which may reduce manufacturing costs.

Figure 3D:
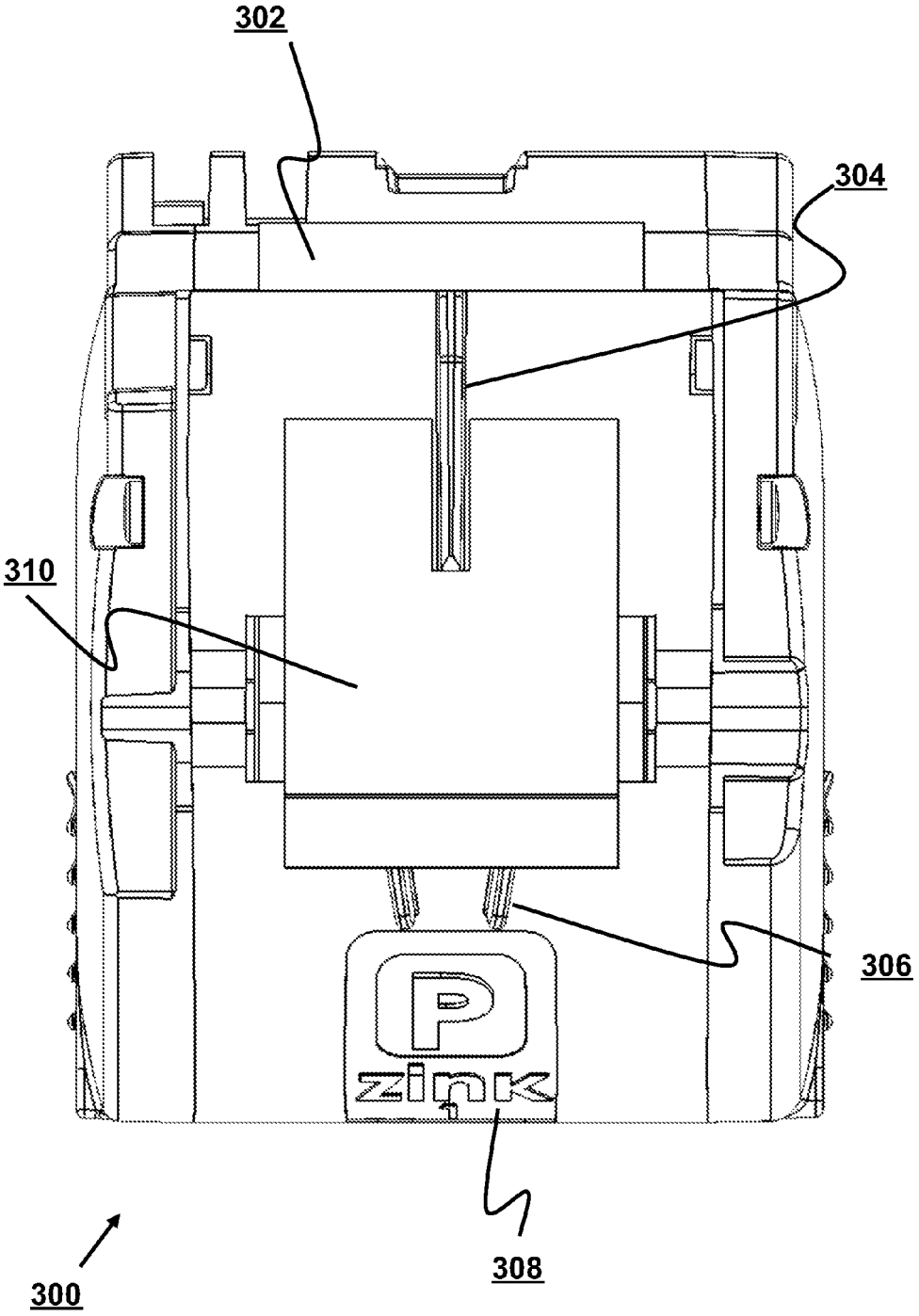
FIGS. 3D and 3E are top and bottom views, respectively, of the embodiment of a printing medium cassette of FIG. 3A.
Figure 3E:
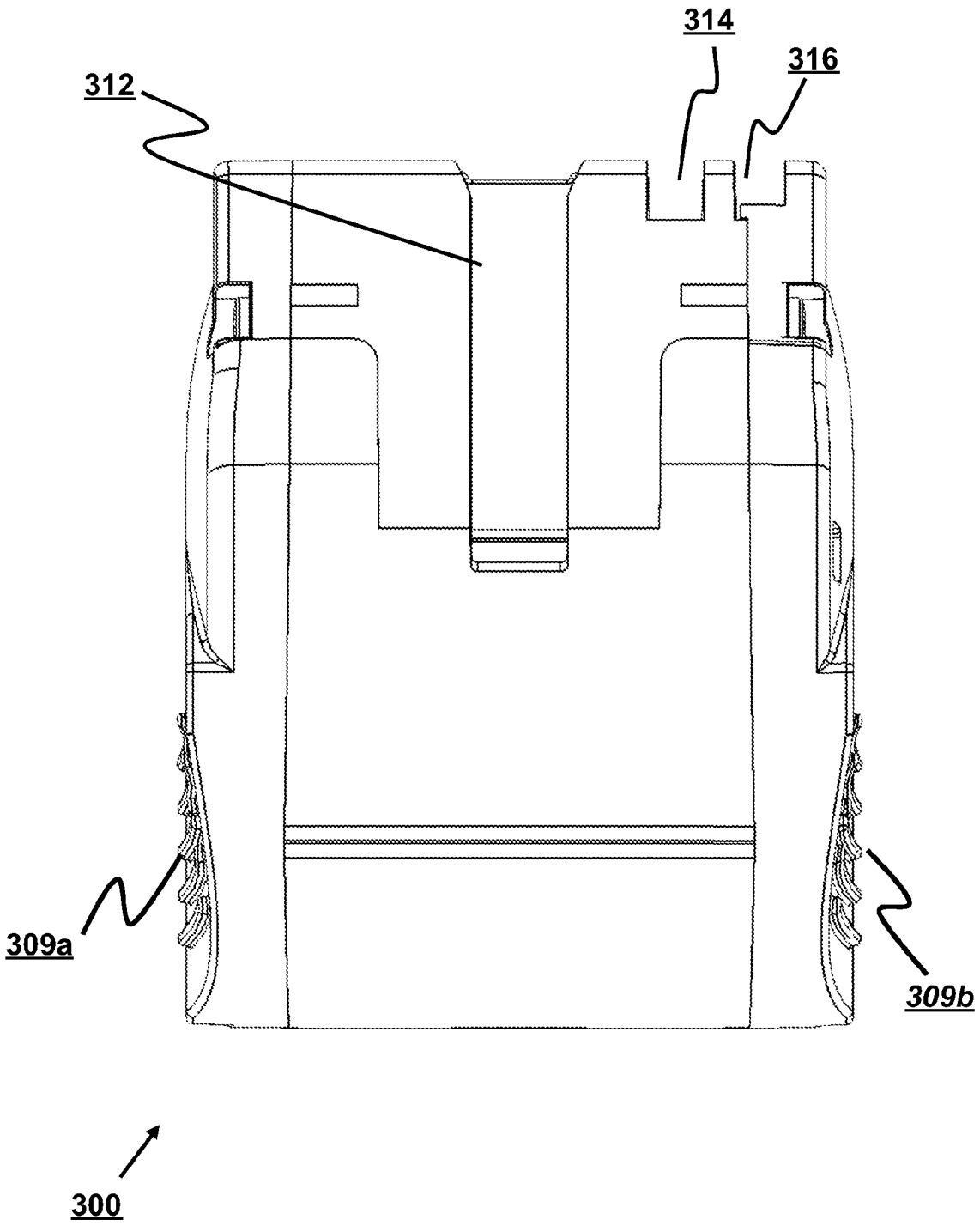

FIGS. 3D and 3E are top and bottom views, respectively, of the embodiment of a printing medium cassette 300 of FIG. 3A. As shown in FIG. 3E, the bottom of cassette 300 may include an alignment feature 312, such as a notch or slot to mate with a corresponding protrusion or ridge in a printer 100, 200, similar to alignment features 304, 306. The alignment features 304, 306, 312 may also be reversed. For example, cassette 300 can include a ridge or protrusion in place of slot 312 to mate with a corresponding slot in printer 100, 200.

To control brakes within the cassette that prevent media from moving in or out of the cassette unintentionally, a cassette 300 may include an opening 316 through which a brake lever (discussed in more detail below) may be released. Opening 316 may be near an edge or end cap of cassette 300, as shown in FIG. 3E. As discussed above, a cassette 300 may comprise a center shell portion which may be varied depending on media width and/or type, and end caps that may be common to all types of cassettes. Accordingly, the position of opening 316 may be different depending on the width of the cartridge. For example, referring to FIG. 3J, illustrated is a diagram of front views of three embodiments of printing medium cassettes showing different shell widths and different offsets of opening 316. A single shell size may be used for multiple media widths. For example, a first shell with a width of ½" may also be used for ¼" or ⅜" media, a second shell with a width of 1" may also be used for ¾" media, a third shell with a width of 2" may also be used for 1.5" media, etc. As shown, with a narrow shell as in the top embodiment, opening 316 is at a first, narrow position; with a medium shell, opening 316 is at a second position; and with a wide shell, opening 316 is at a third, wide position.

Some printers 100, 200 may accommodate these multiple positions of opening 316 by providing several corresponding levers at different positions corresponding to the varied positions of opening 316 with different width cassettes 300. For example, a printer 100, 200 may have three levers which may be simultaneously moved to engage a corresponding brake lever through an opening 316 of an inserted cassette 300, regardless of which cassette 300 is used. As these levers are of a length to extend into opening 316 to engage the brake lever, wider shells may include false openings 314 and 314' so as to provide a clear space for inner levers to move freely when wider cassettes 300 are inserted into the printer.

Figure 3F:
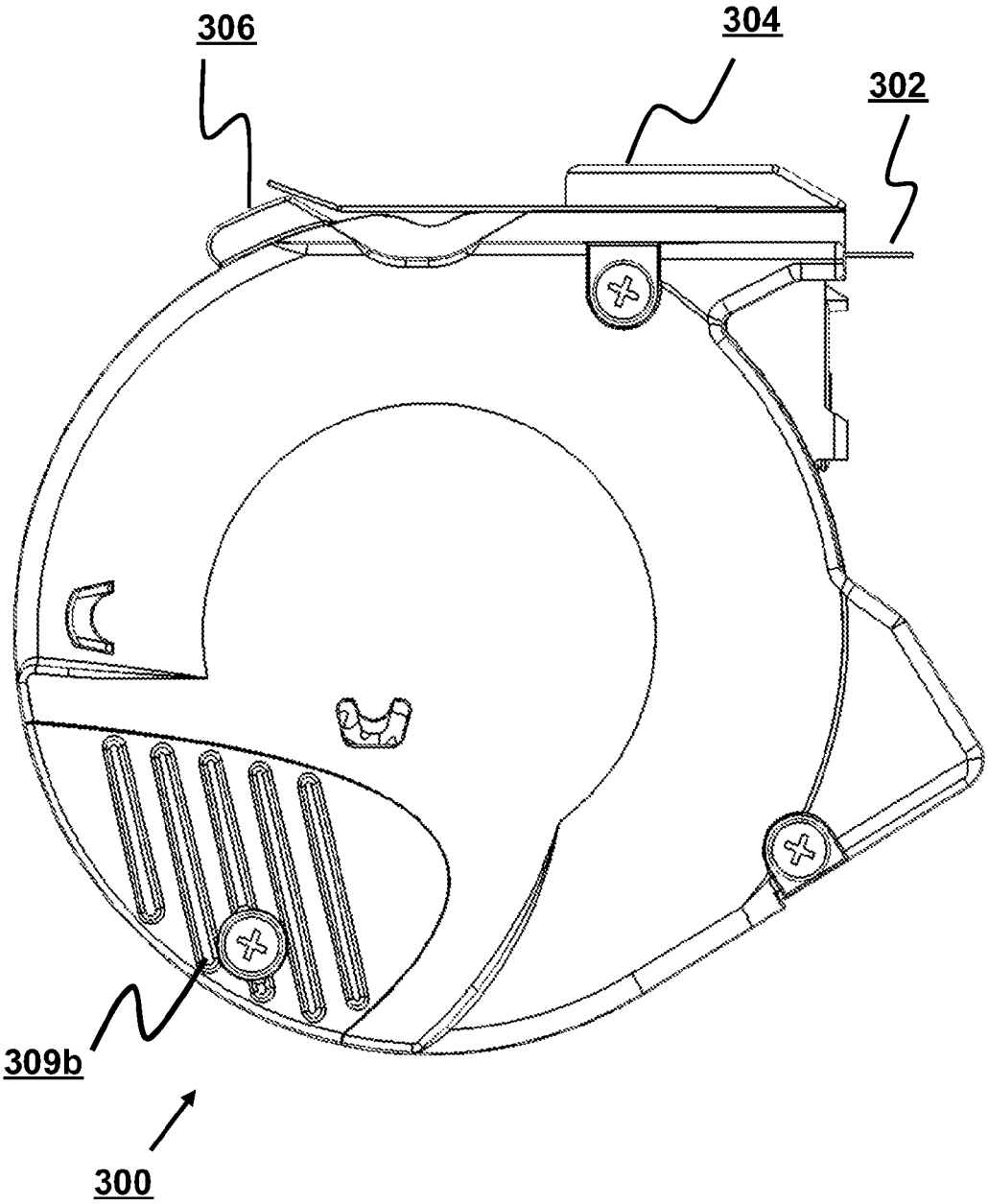
FIGS. 3F and 3G are left and right side views, respectively, of the embodiment of a printing medium cassette of FIG. 3A.
Figure 3G:
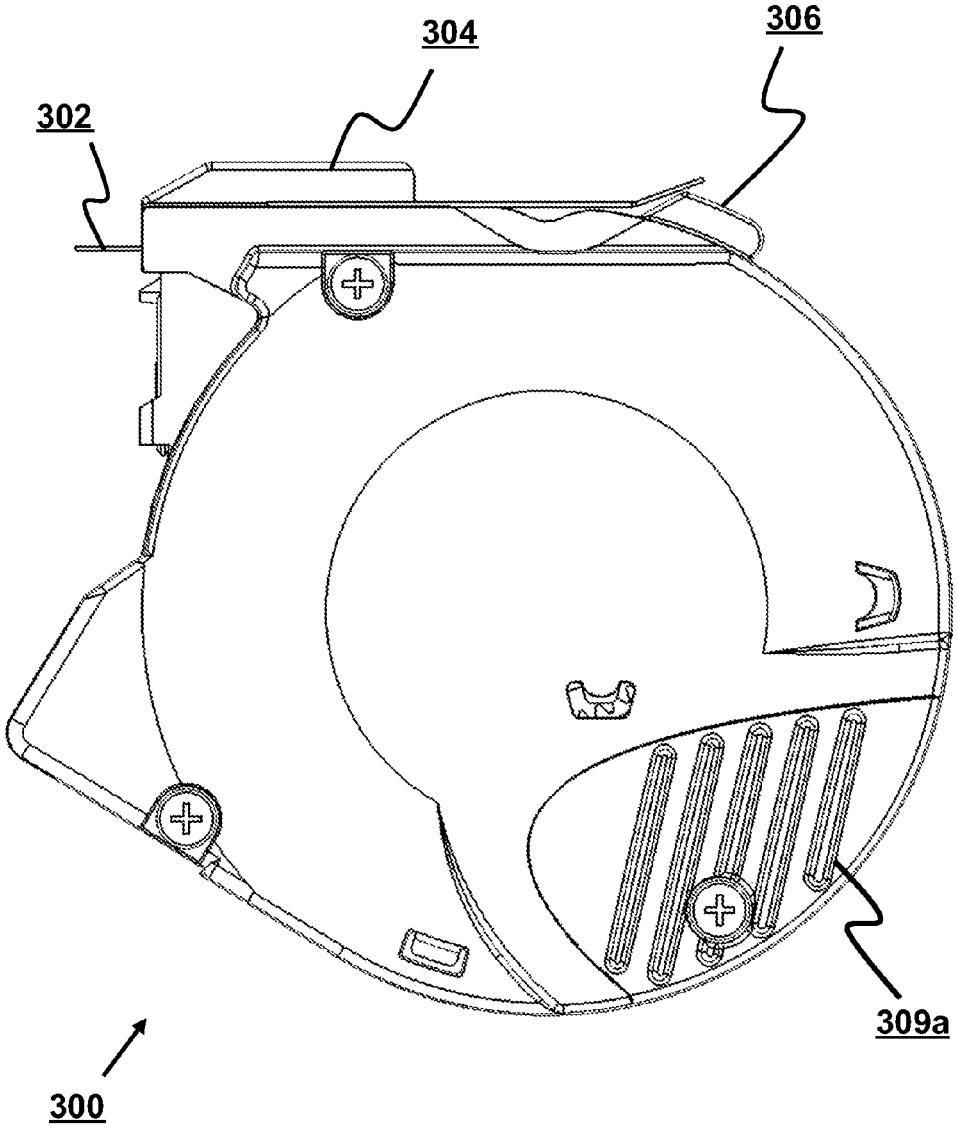

FIGS. 3F and 3G are left and right side views, respectively, of the embodiment of a printing medium cassette of FIG. 3A. As shown, end caps may be screwed on to the center shell via one or more screws. Other fasteners may be used, including pins, bolts, latches, toggles, or any other type and form of fastener, including adhesives. For example, an end cap may be glued onto the center shell during manufacture. This may prevent recycling and refilling of cassettes, which may or may not be desirable for commercial or environmental reasons.

Figure 3H:
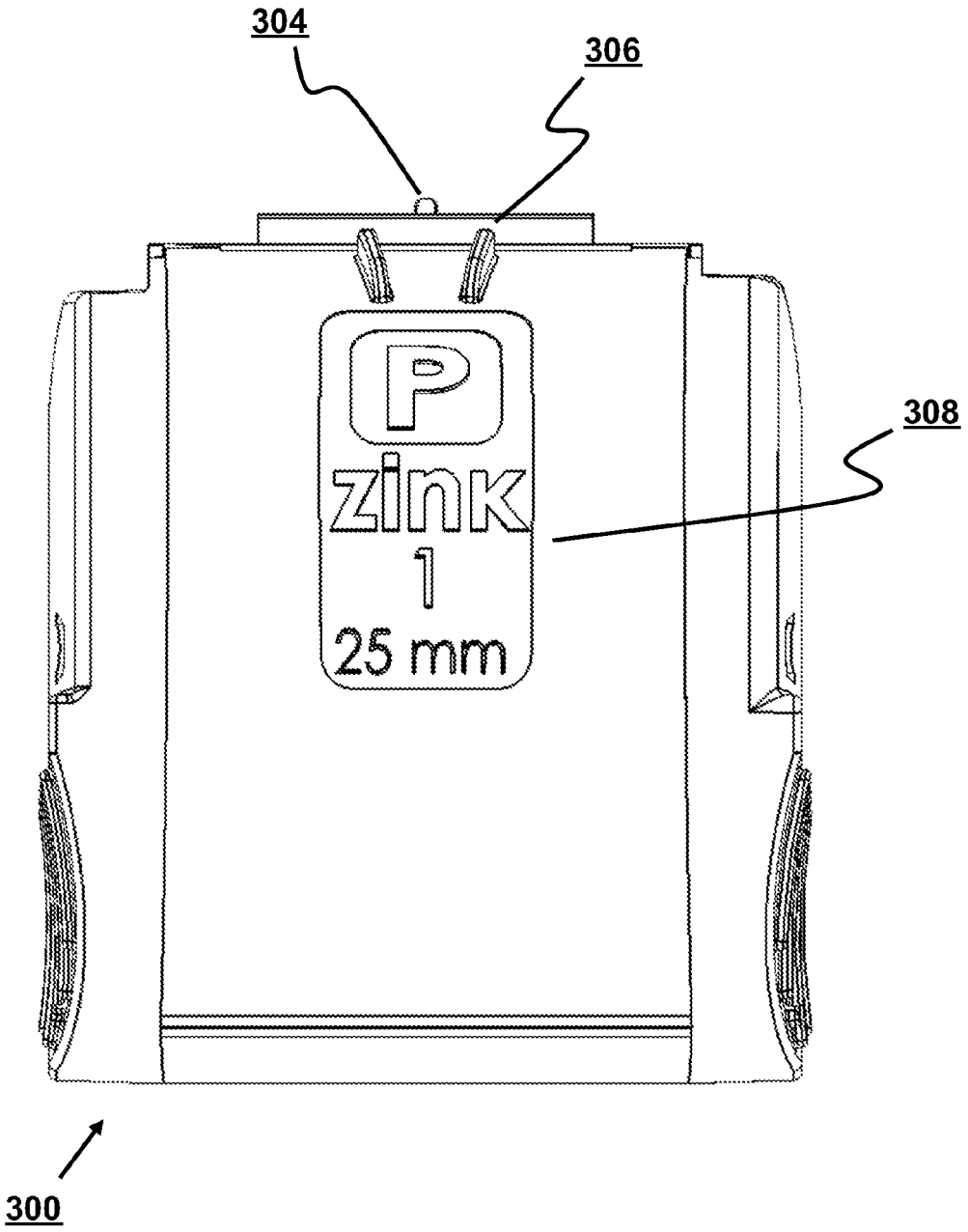
FIGS. 3H and 3I are back and front views, respectively, of the embodiment of a printing medium cassette of FIG. 3A.
Figure 3I:
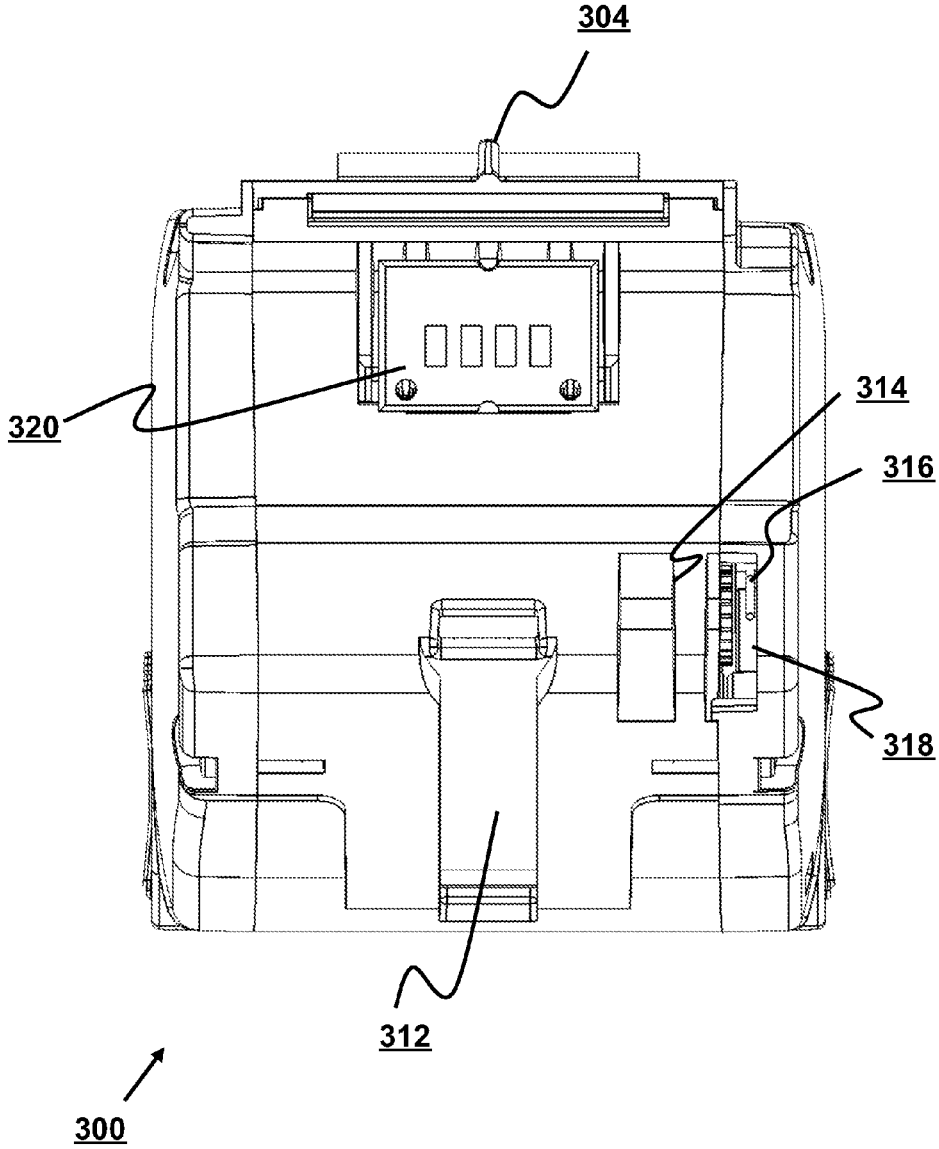
Figure 3J:
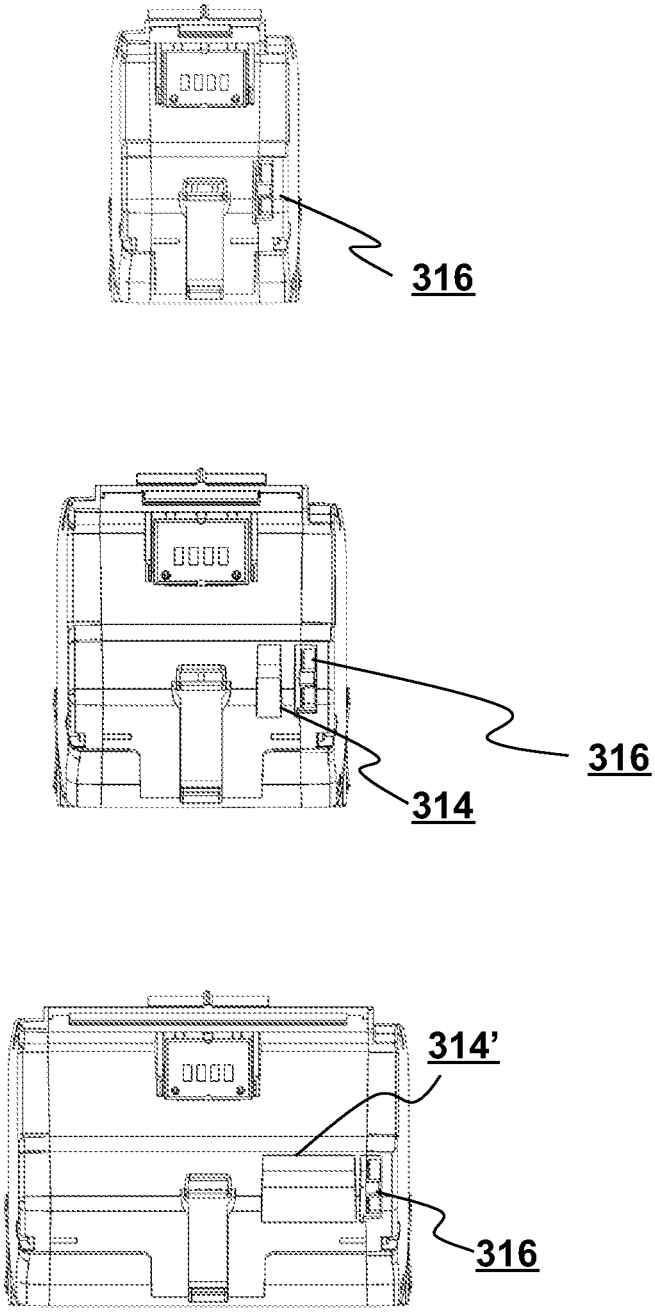
FIG. 3J is a diagram of front views of three embodiments of printing medium cassettes.

FIGS. 3H and 3I are back and front views, respectively, of the embodiment of a printing medium cassette of FIG. 3A. As shown in FIG. 3I, brake lever 318 may be visible through opening 316. As discussed above, the printer 100, 200 may have a corresponding lever that may depress brake lever 318 in order to release a brake or lock that prevents a spool of media 302 from rotating within cassette 300 and either retracting into the cassette or being pulled from the cassette accidentally.

Cassette 300 may include an identification module 320. Identification module 320 may comprise a storage device, such as flash memory, an EEPROM or other non-volatile memory, or any other type of hardware for storing an identification signal identifying the cassette 300. Although shown with electrical contacts, identification module 320 may comprise a radio-frequency identification (RFID) tag or similar near-field communication device.

Identification module 320 may be used by printer 100, 200 to automatically identify an inserted cartridge. For example, data stored in identification module 320 may include:

- an identification of data format, product revision, or other codes necessary to interpret other data;
- an identification of media width, such as ⅜", ½", ¾", 1", 1.5", 2", or any other width;
- an identification of whether the media has an adhesive backing and/or a type of adhesive, such as no adhesive, permanent adhesive, repositionable adhesive, low residue adhesive, or any other type;
- a media type identification, such as black and white, color, transparent, self-laminating, colored background for black and white printing, plain paper, or any other type of printing media; or whether the cassette is a cleaning cartridge, and/or an identification of a specific type of cleaning cartridge, such as abrasive, absorptive, microfiber, chemical impregnated, etc.;
- whether the media has a shoulder, and if so, the width of the shoulder. As discussed briefly above and discussed below in more detail, in some embodiments, media may include longitudinal kiss cuts defining shoulders, such as a kiss cut 0.125" from the edge of the media, or any other such width. Some embodiments of full-bleed printing may include printing an image on the media to overlap these kiss cuts slightly. The user may then peel the center portion from an adhesive backing, resulting in a printed image that extends across the entire width of the resulting printed media. Other embodiments may not require pre-cut shoulders;
- manufacturing details including date and time of manufacture, batch or lot, serial number, plant location, assembly line number, lane number for media that is manufactured in a wide spool and cut to final width as a number of "lanes", or any other type and form of manufacturing details;

configuration details, including required printer adjustments for thickness of the media, printing pulse times and/or temperatures for thermal printers, dot pitch information, ink absorption data for ink jet printers, or any other such data, including potentially different values for different speeds or modes of printing (e.g. high speed "draft" modes, normal speed, or low speed "fine" modes), cutter height or depth adjustments for kiss cutting or full cutting, or any other configuration information. In some embodiments, the configuration details may specify a function describing the temperature dependence and/or sensitivity of the media (for example, during printing, as the printer heats up, the thermal response of the media may change due to internal temperatures within the unit);

amount of media remaining in the cassette, which may be updated by the printer as media is printed;

configuration data for automatic image alignment (discussed in more detail below), including types of alignment markings, separation of alignment markings, height of alignment markings, lateral offsets of alignment markings, period or longitudinal length of alignment markings before repeat, longitudinal displacement of alignment markings, etc.; and diagnostic or error correction codes for the memory, including read counters, CRC check codes, offset values, parity bits, initialization flags, or any other information.

Data stored in identification module 320 may be stored as strings, flags, a bitmap, plaintext or alphanumeric data, or any other type and form of data. In some embodiments, identification module 320 may have additional storage for other data, including images, text, previously printed images or labels, image elements or themes, or other such data. Inclusion of such data may allow a manufacturer to sell branded media cassettes, loaded with both media and images or elements for printing, such as popular cartoon characters, device labels, or any other such data. Similarly, a manufacturer may include templates loaded on storage of the cassette, such as a template for a wire label of a predetermined length loaded onto a cassette with adhesive media with transparent portions for self-laminating wire labels.

Figure 3K:
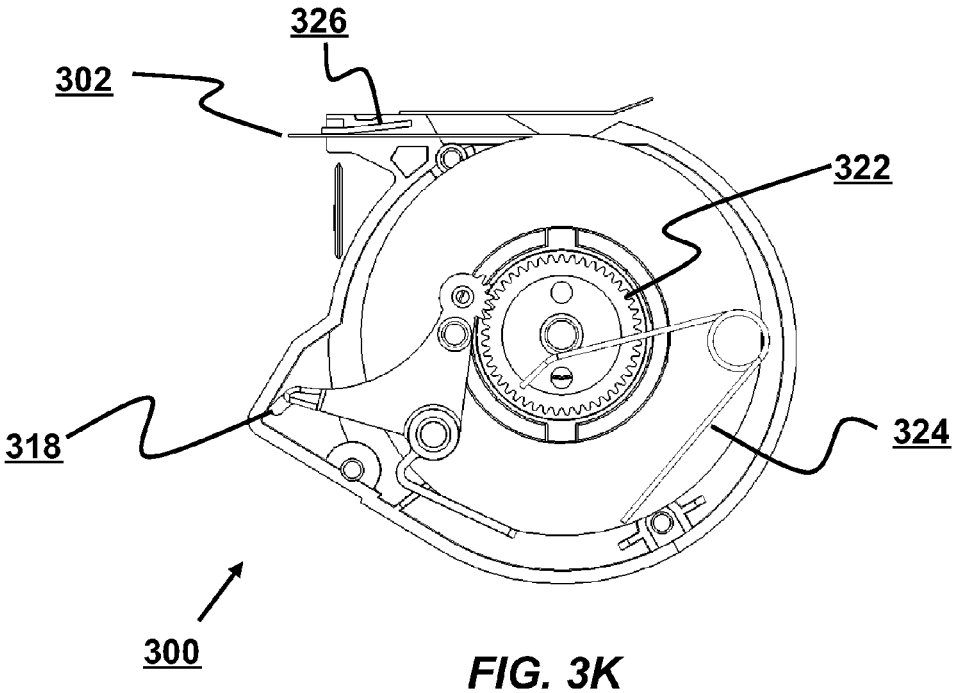
FIG. 3K is a right side view of the embodiment of a printing medium cassette of FIG. 3A with the outer shell removed.
Figure 3L:
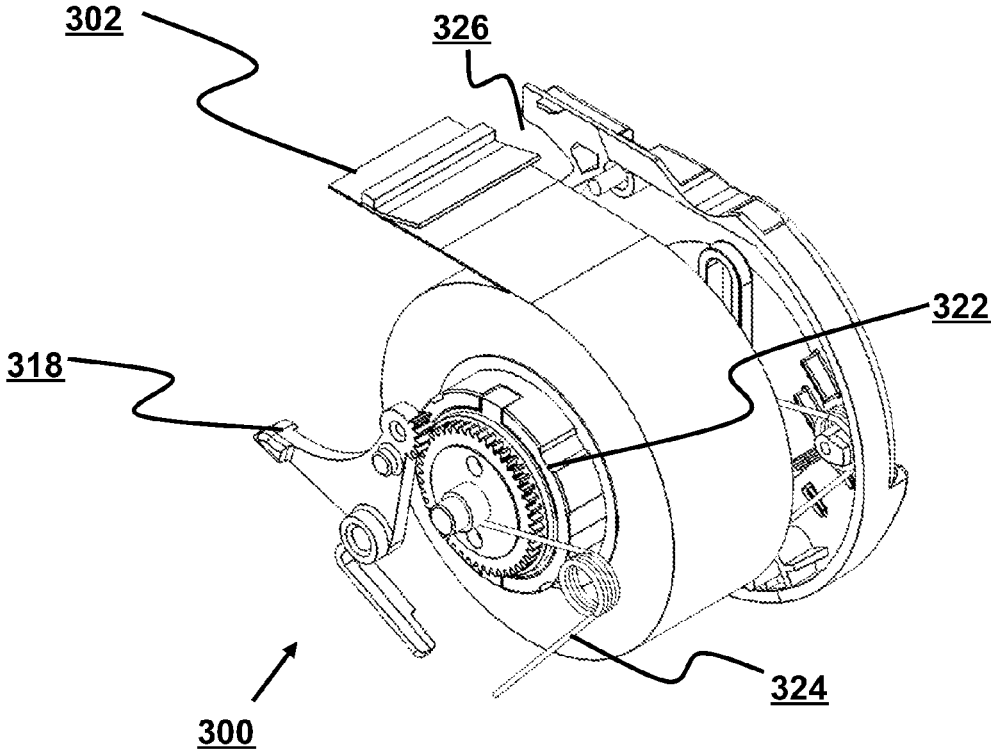
FIG. 3L is an isometric view of the embodiment of a printing medium cassette of FIG. 3A with the outer shell removed.

FIG. 3K is a right side view and FIG. 3L is an isometric view of the embodiment of a printing medium cassette of FIG. 3A with the outer shell removed to show internal components. As shown, a length of media 302 may be wound around a central axis or spool, which may be connected to a gear 322 or include teeth or other protrusions. In some embodiments, teeth of gear 322 may be symmetric, as shown, to provide equal resistance to forward or backwards motion of media 302 when the brake is engaged. In other embodiments, gear 322 may be a saw tooth or asymmetric shape to provide a ratcheting action, preventing reverse motion of media 302, while allowing forward motion, or vice versa.

Gear 322 may be engaged by brake lever 318, which may be manipulated by a corresponding lever of printer 100, 200 via an opening 316, as discussed above. As shown in FIG. 3K and FIG. 3L, in some embodiments, brake lever 318 may include a broadened or offset tip. This may prevent the lever of printer 100, 200 from being accidentally positioned beneath brake lever 318 during insertion of cassette 300 into the printer, preventing disengagement of the brake against gear 322. Brake lever 318 may be connected to a spring as shown to engage the brake when the lever of printer 100, 200 is released, or when a cassette 300 is removed from the printer, preventing extension or retraction of media 302.

Cassette 300 may include a cleaning pad 326. Cleaning pad 326 may comprise an abrasive material, absorptive material, microfiber material, felt fabric, or similar material for wiping foreign materials from the surface of media 302 prior to the media being moved into position beneath a print head of the printer. Cleaning pad 326 may be held under pressure against media 302, may be connected to a helical spring or leaf spring to hold the pad against media 302, or otherwise positioned to engage media 302. In some embodiments, cleaning pad 326 may prevent entry of dust into cassette 300, while in other embodiments, cassette 300 may have other openings (such as opening 316) that allow dust to enter. Accordingly, cleaning pad 326 may instead prevent exit of dust from cassette 300 into the body of a printer 100, 200 or from being carried by media 302 to a print head where it may disrupt printing or cause artifacts.

Figure 3M:
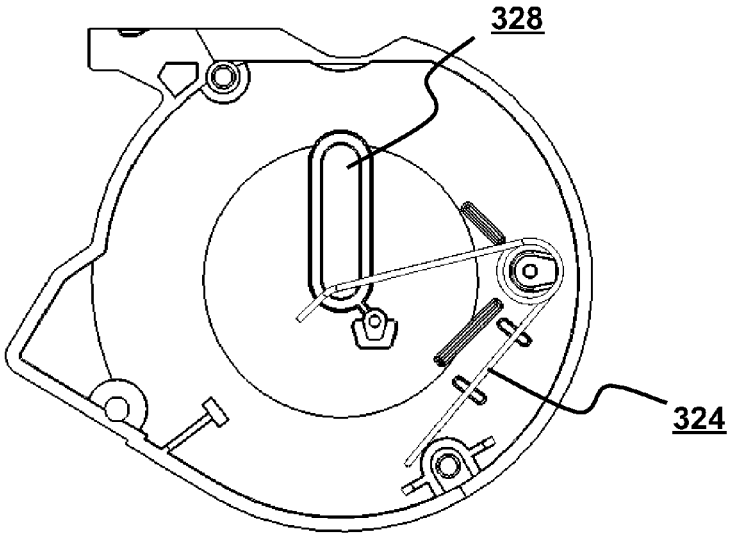
FIG. 3M is a side view of an outer shell component of the embodiment of a printing medium cassette of FIG. 3A.

As shown in FIG. 3K and FIG. 3L, the axis of the spool of media 302 may be in contact with spring 324. As media is removed from the cassette, the diameter of the spool of remaining media is reduced. If the axis of the spool remains in the same position in the center of cassette 300, the media may be forced to bend at the media exit slot of the cassette, increasing friction and back tension on the media during printing, and potentially causing creasing and visible artifacts in prints. Accordingly, to ensure that media exits in a direction tangent to the spool of remaining media, the axis of the spool may be elevated by a spring 324 (and potentially, a corresponding spring 324 symmetrically positioned against the axis on the opposing side of the spool of media). Shown in FIG. 3M is a side view of an outer shell component of the embodiment of a printing medium cassette of FIG. 3A, with the spool of media removed for clarity. As discussed above, media 302 may be wound around a spool of metal, plastic, or any similar material, which may have a protrusion to sit within slot 328 in each end cap of cassette 300. Spring 324 may be positioned to press against the protrusion, raising the axis of the media spool as media is used.

Figure 3N:
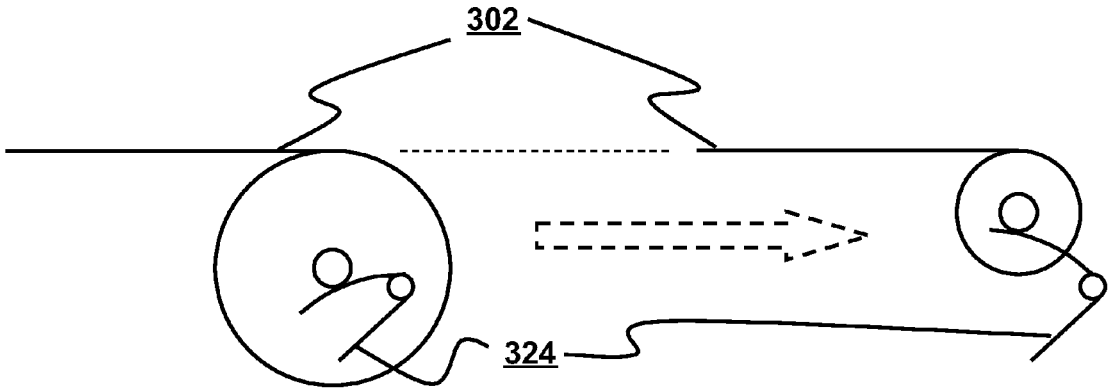
FIG. 3N is a diagram illustrating dynamic variation of an axis of a printing medium spool.

For example, referring to FIG. 3N, illustrated is a diagram illustrating dynamic variation of an axis of a printing medium spool. As shown on the left, when a spool of media 302 is full, spring 324 may be compressed and the media may exit the cassette in a tangent line (dotted line) to the spool. Similarly, as shown on the right, as the media is used and the diameter of the spool of remaining media is reduced, spring 324 may extend, raising the axis of the spool such that the media may still exit the cassette along the same tangent line to the spool. This reduces or eliminates sharp bends in the media, and reduces tension and friction that may cause visible artifacts in printing.

Figure 3O:
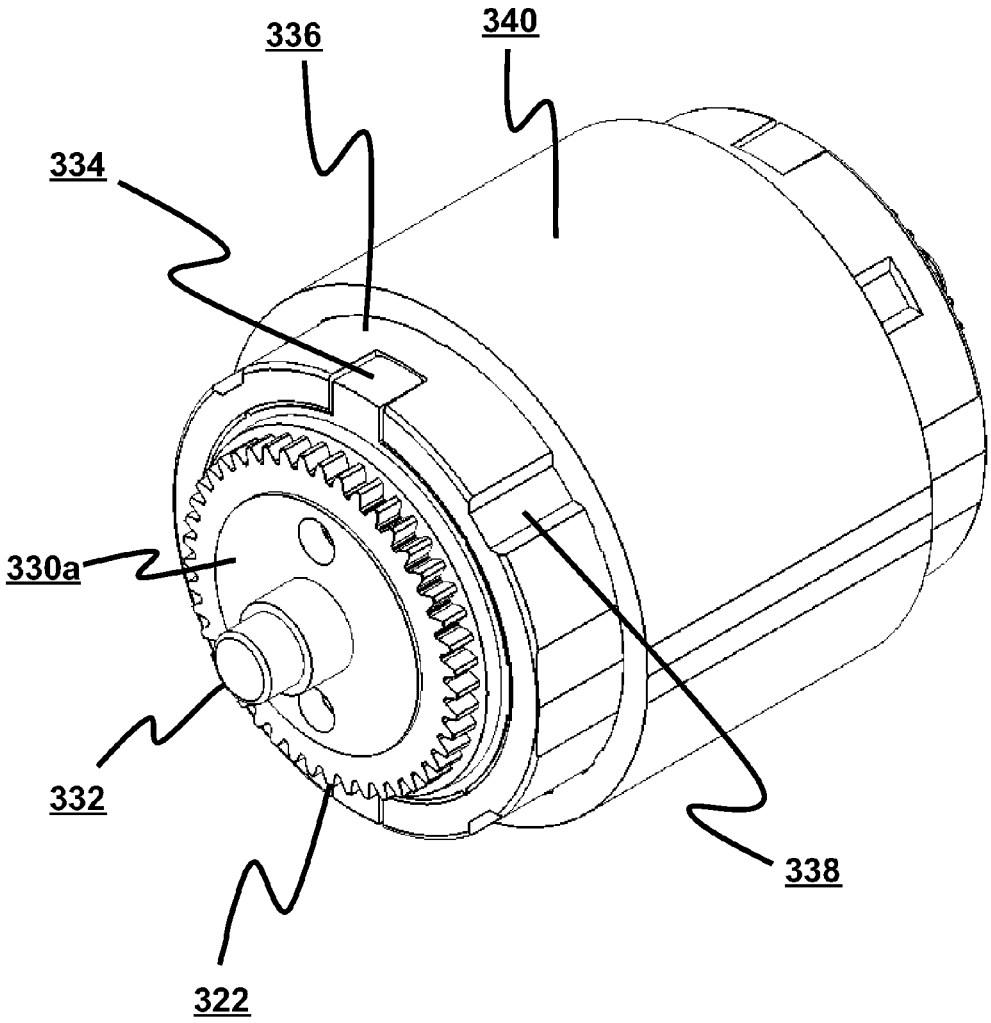
FIG. 3O is an isometric view of an embodiment of a spindle of a printing medium cassette.
Figure 3P:
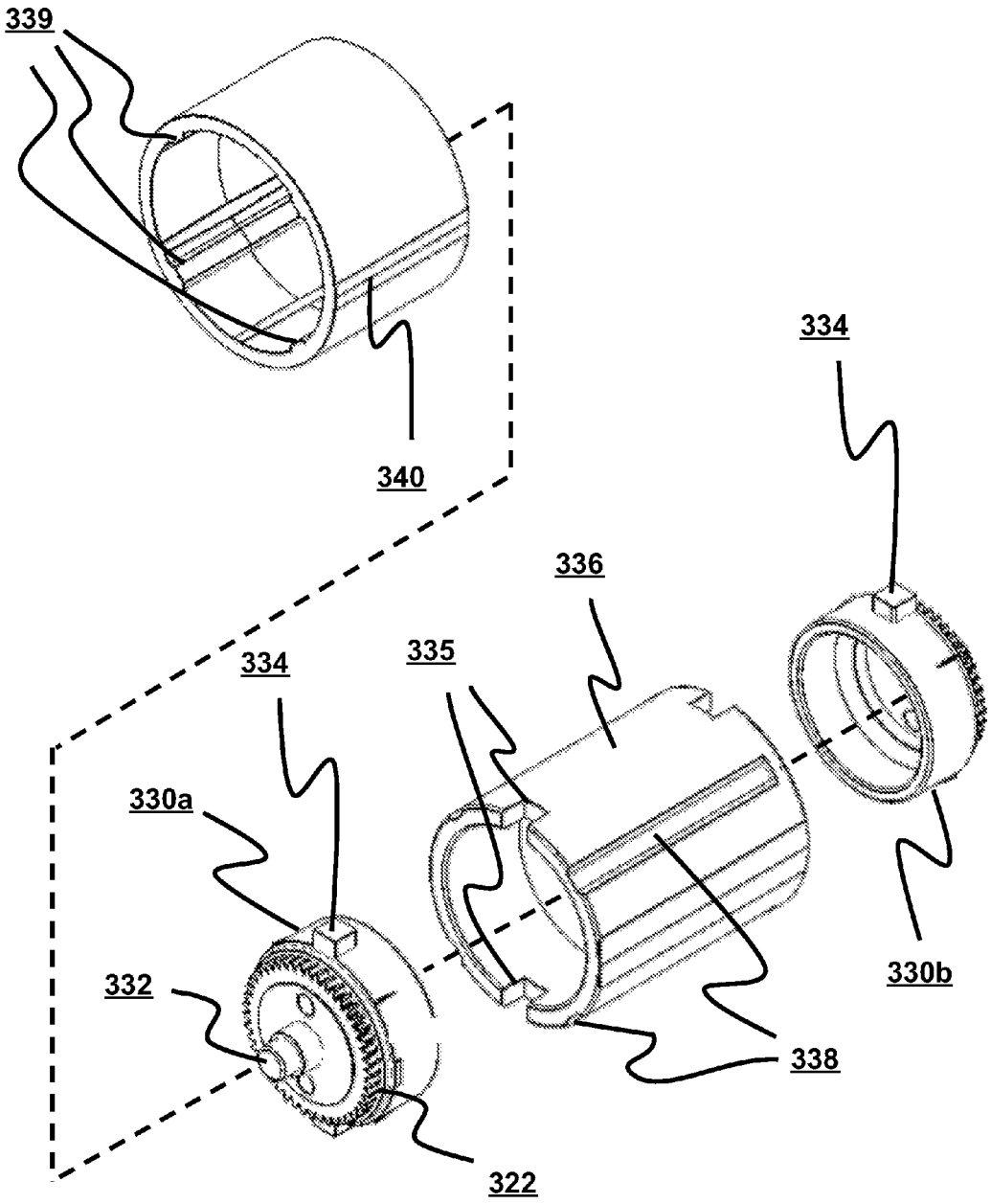
FIG. 3P is an exploded view of the embodiment of a spindle of FIG. 3O.

FIG. 3O is an isometric view of an embodiment of a spool or spindle in a cassette 300, and FIG. 3P is an exploded view of the embodiment illustrated in FIG. 3O. As shown, a spool or spindle may comprise a central portion 336 nested with end caps 330*a*, 330*b*. Each end cap 330*a*, 330*b* may include gears 322 discussed above, and include an axis 332 around which the spindle may revolve. As discussed above, each axis 332 may be elevated by a spring 324. Each end cap 330*a*, 330*b* may include one or more protrusions or keys 334 for locking into a corresponding notch or notches 335 of central portion 336. In other embodiments not illustrated, the central portion 336 may include said protrusions and the end caps may include corresponding notches. In still other embodiments, each of the end caps and central portion may comprise notches and/or protrusions. In yet still other embodiments, end caps 330*a*, 330*b* and central portion 336 may be manufactured as a single piece, and thus may not include protrusions 334 and notches 335 for alignment.

In some instances, media may be wound off-center around the central portion 336 of a spindle, resulting in lateral forces on the media during printing as the media rubs against a wall of the cassette. Accordingly, in some embodiments, the central portion 336 may be surrounded by a floating or sliding sleeve 340. Sleeve 340 may comprise a circular element with an interior diameter slightly larger than central portion 336, and a width of less than central portion 336. Sleeve 340 may comprise one or more internal protrusions 339 which may be mated with a corresponding one or more external notches 338 on central portion 336, such that the sleeve 340 may rotate with central portion 336 (and end caps 330*a*, 330*b*), but may freely slide laterally across central portion 336 (to the extent of the notch). During manufacture, the media may be wound around sleeve 340, and then installed on central portion 336. During use, the media and sleeve 340 may slide laterally within cassette 300 and/or may be pushed away from walls of the cassette 300, reducing or eliminating lateral forces on the media during printing that may cause visible errors. Although the media may not remain centered within the cassette during printing, various printing re-alignment methods discussed in more detail herein may be employed to ensure that printed images are centered on the media.

As media may be wound around sleeve 340, the central portion 336 does not necessarily need a substantial body to support the media, and may comprise a space frame or space structure rather than a solid surface. Accordingly, in another embodiment not illustrated, the central portion 336 and/or end caps 330*a*, 330*b* may comprise one or more holes or slots to reduce weight and material requirements, or may be formed of one or more curved members to support sleeve 340.

As noted, in some embodiments, the printers 100, 200 are multicolor direct thermal printers, and/or may utilize continuous-roll cassettes 300 of printing media 302. As used herein the terms "printing medium" and "direct thermal imaging member" are used interchangeably. In embodiments utilizing multicolor direct thermal printers, the printing medium 302 may comprise a substrate and one or more color-forming layers, each impregnated with a color forming dye, said dyes having various activation times and temperatures.

Direct thermal imaging is a technique in which a substrate bearing at least one color-forming layer, which is typically initially colorless, is heated by contact with a thermal printing head to form an image. In direct thermal imaging there is no need for ink, toner, or thermal transfer ribbon. Rather, the chemistry required to form an image is present in the imaging member itself.

In some embodiments, the direct thermal imaging member (i.e., printing media) 302 comprises three color-forming layers, each affording one of the subtractive primary colors, and is designed to be printed with a single thermal printing head. The topmost (relative to substrate 380 in FIG. 3Q) color-forming layer develops color in a relatively short period of time when the surface of the imaging member is heated to a relatively high temperature; the intermediate (relative to topmost and lowest color-forming layers) color-forming layer develops color in an intermediate length of time when the surface of the imaging member is heated to an intermediate temperature; and the lowest (closest to substrate 380 in FIG. 3Q) color-forming layer develops color in a relatively long period of time when the surface of the imaging member is heated to a relatively low temperature. Separating the color-forming layers are thermally-insulating layers whose thickness, thermal conductivity and heat capacity are selected so that temperatures reached within the color-forming layers may be controlled to provide the desired color by appropriate choices of heating conditions of the surface of the imaging member.

The composition of the thermally-insulating layers is chosen so as neither to compromise the chemistry responsible for formation of color in the color-forming layers nor to degrade the stability of the final image. Each color-forming layer typically comprises a dye precursor that is colorless in the crystalline form but colored in an amorphous form. Materials such as thermal solvents, developers or other additives may be incorporated into the color-forming layer to adjust the temperature at which color is formed, the degree of coloration that is achieved and/or the stability of the media and print.

Figure 3Q:
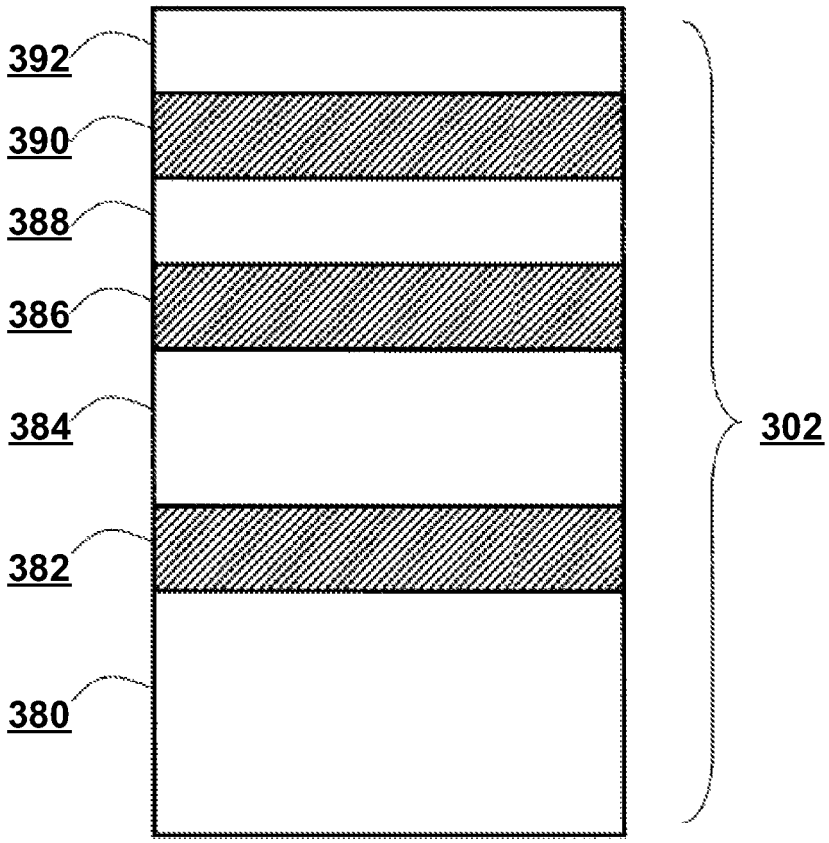
FIG. 3Q is a partially schematic, side sectional view of an embodiment of a multicolor thermal imaging member.
Figure 3R:
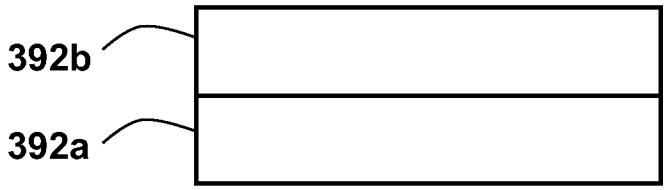
FIG. 3R is a partially schematic, side sectional view of an embodiment of an overcoat of a multicolor thermal imaging member shown in FIG. 3Q.

FIG. 3Q is a partially schematic, side sectional view of an embodiment of a multicolor thermal imaging member. As shown, a thermal imaging member or media 302 may include a substrate 380, that can be transparent, absorptive, or reflective; and three color-forming layers 382, 386, and 390, that when heated produce cyan, magenta and yellow coloration, respectively; thermally-insulating layers 384 and 388; and an overcoating 392 that protects and provides gloss to the surface of the imaging member making it durable and in some cases water resistant and/or provides lubrication during the printing process to minimize friction between the media and the thermal print head during printing. The overcoating 392 may comprise a single layer as shown in FIG. 3Q or two layers (392*a* and 392*b*) as shown in FIG. 3R.

Each color-forming layer can change color, e.g., from initially colorless to colored, where it is heated to a particular temperature referred to herein as its activating temperature.

Any order of the colors of the color-forming layers can be chosen. One preferred color order is as described above. Another preferred order is one in which the three color-forming layers 382, 386, and 390 provide yellow, magenta and cyan, respectively.

All the layers disposed on the substrate 380 are substantially colorless and transparent before color formation. When the substrate 380 is reflective (e.g., white), the colored image formed on imaging member 302 is viewed through the overcoating 392 (or overcoatings 392*a* and 392*b*) against the reflecting background provided by the substrate 380. The transparency of the layers disposed on the substrate ensures that combinations of the colors printed in each of the color-forming layers may be viewed.

Discussions of representative multicolor direct thermal printing media and the dyes used in such media are provided in the following commonly assigned U.S. Pat. Nos. 7,807,607, 7,829,497, 7,704,667, 7,176,161, 7,504,360, 6,951,952, 7,282,317, 7,279,264, 7,008,759, 7,282,317, 6,906,735, 6,801,233, 6,906,735, 7,166,558, 7,635,660, 7,504,360, and the published U.S. Patent Application No. US 2010/087316, each of which is incorporated herein by reference.

Representative Overcoatings for the Printing Media

Referring to FIG. 3Q and FIG. 3R, in some embodiments, the printing media comprises an overcoating 392, having a single layer, or overcoatings 392*a* and 392*b*, having two layers, that protect the surface of the imaging member and/or provide lubrication during the printing process. In some embodiments, the overcoating 392 or overcoatings 392*a* and 392*b* of the printing media described herein can be chosen from formulations I, II, and III described below:

Exemplary Overcoating I: A Single Overcoat Layer 392 Comprising an Aqueous Dispersible Polyisocyanate Component and One or More Reactive Hydroxyl and/or Amino Functional Components In some embodiments, the printing media described herein comprises a single overcoating layer 392 that includes a polyisocyanate and one or more reactive hydroxyl and/or amino functional components. Overcoating compositions of this type are designed to adhere to the printing media and provide the printing media with a protective layer and a contact point that does not stick, degrade, or deform upon contact with the high temperature print head of any of the thermal printers described herein.

In some embodiments, the overcoating layer comprising a polyisocyanate includes a reactive hydroxyl functional latex. In some embodiments, the overcoating layer comprising a polyisocyanate includes a reactive amino functional component. In some embodiments, the overcoating layer comprising a polyisocyanate includes both a reactive hydroxyl functional latex and a reactive amino functional component. Such overcoating layers also include lubricating components to reduce the friction between the media and the thermal print head during printing. Overcoating layers such as these provide water resistance, protection from handling (e.g., abrasion resistance and skin oil resistance), and allow the media to withstand the high temperatures of thermal printing. In some embodiments, the overcoating layer comprising a polyisocyanate prevents the media from deforming or sticking to a thermal print head upon exposure to heat, friction, humidity and pressure. In some embodiments, the overcoating layer comprising a polyisocyanate provides increased image stabilities.

The overcoating layer comprising a polyisocyanate can be applied as a single layer on top of the printing media. The polyisocyanate along with other components can be pot blended together prior to being applied to the printing medium. Alternatively, the polyisocyanate along with other components can be applied separately to the media as in-line blend streams during manufacture. In one embodiment the polyisocyanate is introduced into the coating fluid as an in-line blend stream just before the layer is applied to the substrate in the coating process. The in-line blend approach is particularly useful when the polyisocyanate and other components such as a hydroxyl functional latex or an amino functional component are highly reactive such that unwanted premature cross linking reactions would occur causing coating defects if they were pot blended together in the coating process. In some embodiments, the overcoating layer 392 comprising a polyisocyanate requires approximately 24 to 72 hours to cure after being coated onto the printing media.

Representative examples A and B of a single overcoating layer (I) comprising a polyisocyanate are shown below in Table 1.

TABLE 1

Exemplary overcoating (I) that includes a polyisocyanate and reactive hydroxyl functional latexes.

| Component | A (wt %) | B (wt %) |
|---|---|---|
| Neocryl XK101 | 34.1% | 0% |
| Carboset CR-717 | 0 | 34.1% |
| Zinc Stearate | 22.5% | 22.5% |
| SMA 1000MA | 5.9% | 5.9% |
| Rheolate 310 | 2.4% | 2.4% |

TABLE 1-continued

Exemplary overcoating (I) that includes a polyisocyanate and reactive hydroxyl functional latexes.

| Component | A (wt %) | B (wt %) |
|---|---|---|
| Zonyl FSN | 1% | 1% |
| Bayhydur 304 | 34.1% | 34.1% |

Neocryl XK101 is a hydroxyl functionalized latex available from DSM Inc.

Carboset CR-717 is a hydroxyl functionalized latex available from Noveon Inc.

Zinc Stearate is a melt lubricant available from Ferro Inc.

SMA 1000MA, available from Sartomer Inc., is a styrene maleic anhydride additive for anti-blocking, added before crosslinking Rheolate 310 is a rheology control additive available from Elementis Inc.

Zonyl FSN is a coating surfactant available from DuPont Inc.

Bayhydur 304 is a hydrophilically modified, aliphatic polyisocyanate available from Bayer Inc.

Exemplary Overcoating II: A Two Layer Overcoating System 392*a* and 392*b*, where One Layer 392*a* Includes a Polyisocyanate Along with One or More Reactive Hydroxyl Functional Latex Components and a Second Layer 392*b* Includes an Activator the Purpose of which is to Accelerate the Polyisocyanate Cross Linking Reactions in the First Layer.

In some embodiments, the media is coated with a two layer overcoating system 392*a* and 392*b* comprising a first layer 392*a* having a polyisocyanate along with one or more reactive hydroxyl functional latex components and a second layer 392*b* comprising a latex binder and a cross linker activator. The two overcoating layers are the top most layers in the multilayer imaging member. In one embodiment the second overcoating layer 392*b* containing the activator is positioned above the first polyisocyanate containing overcoating layer 392*a* (e.g., as a separate layer above the first overcoating layer). The second overcoating layer 392*b* may, in some embodiments, be referred to as a top coat, while the first layer 392*a* may be referred to as an overcoat. In some embodiments, the second layer 392*b* or top coat may contain a latex binder, a cross linker activator (e.g., Bacote 20), one or more meltable lubricants, and other coating additives. In particular, in many embodiments, Bacote 20 or similar crosslinker activators in the top coat may significantly increase the speed of polyisocyanate crosslinking reactions in the overcoat layer. In some embodiments the order of the two overcoating layers may be reversed with the polyisocyanate containing layer being the topmost layer.

This two layer overcoating system 392*a* and 392*b* improves the media manufacturing process by reducing the time required for the overcoating system to cure (i.e., cross link). As such, the two layer overcoating system prevents disruptions in the continuous process of coating the media and minimizes defects in the coated media. The two layer overcoating system also reduces the tackiness of the printing media during the period of time after the coating is complete to when the curing is complete. In particular, the two layer overcoating system, once fully cured, provides a surface of the media that does not stick to the thermal print head, degrade, or deform under printing conditions that include elevated temperatures and high humidity.

The components of each layer 392*a* or 392*b* can be pot blended before each layer is coated onto the media. Alternatively, the components of each layer can be applied by an in-line blend process, directly to the media as separate fluid streams. In one embodiment the polyisocyanate is introduced into the coating fluid as an in-line blend stream just before the layer containing it is applied to the substrate in the coating process. In some embodiments, the two layer overcoating system requires approximately 24 to 48 hours to cure.

Representative examples C-E of the second layer 392*b* or topcoat of the two layer overcoating system (II) (containing the cross linker activator) are shown below in Table 2. Representative examples F and G of the first layer 392*a* of the two layer overcoating system (II) are shown below in Table 3.

TABLE 2

Exemplary formulations for the second layer 392b or topcoat of the two layer overcoating system (II).

| Component | C (wt %) | D (wt %) | E (wt %) |
|---|---|---|---|
| NEOCRYL XK-101 | 21.04 | 21.04 | 21.03 |
| ZONYL FSN | 3.28 | 3.28 | 3.28 |
| Zinc Stearate | 24.42 | 29.42 | 18.21 |
| Erucamide | 5 | 0 | 11.21 |
| RHEOLATE 210 | 25.69 | 25.69 | 25.7 |
| BACOTE-20 | 20.57 | 20.57 | 20.58 |

Neocryl XK101 is a hydroxyl functionalized latex available from DSM Inc.

Zinc Stearate is a melt lubricant available from the Ferro Corporation.

Erucamide (PINNACLE® 2530) is a lubricant available from Lubrizol Inc.

Rheolate 210 is a rheology control additive available from Elementis Inc.

Zonyl FSN is a coating surfactant available from DuPont Inc.

Bacote 20 is an Ammonium Zirconyl Carbonate crosslinker activator available from Mel Chemicals Inc.

TABLE 3

Exemplary formulations for the first layer 392a of the two layer overcoating system (II).

| Component | F (wt %) | G (wt %) |
|---|---|---|
| NEOCRYL XK-101 | 29.80 | 33.65 |
| ZONYL FSN_10 | 1.40 | 1.40 |
| ADH | 8.07 | 0 |
| SMA 1000 MA | 0 | 1.00 |
| JEFFCAT Z130 | 0 | 0.30 |
| DZNST_A25 | 14.97 | 15.00 |
| DERUCA24 | 6.99 | 7.00 |
| RHEOLATE 210 | 8.98 | 8.00 |
| Bayhydur 304 | 29.80 | 33.65 |

ADH is adipic acid dihydrazide.

Neocryl XK101 is a hydroxyl functionalized latex available from DSM Inc.

Zinc Stearate is a melt lubricant available from Ferro Inc.

Erucamide (PINNACLE® 2530) is a melt lubricant available from Lubrizol Inc.

SMA 1000MA, available from Sartomer Inc., is a styrene maleic anhydride additive used for anti-blocking before the crosslinking step is completed.

Jeffcat Z130 is a catalyst from Huntsman Inc.

Rheolate 210 is a rheology control additive available from Elementis Inc.

Zonyl FSN is a coating surfactant available from DuPont Inc.

Bayhydur 304 is a hydrophilically modified aliphatic polyisocyanate available from Bayer Inc.

Exemplary Overcoating III: An Ultra-Violet (UV) Curable Overcoating

In some embodiments, the printing media includes an overcoating (III) layer 392 that is formulated to be UV curable. UV curable overcoating provides excellent water resistance and also helps provide a media surface that does not stick to the thermal print head, degrade, or deform under printing conditions that include elevated temperatures and high humidity.

In some embodiments, the overcoating layer 392 is formulated to be UV curable by adding UV curable monomers or oligomers to the overcoating and subsequently exposing the overcoating to UV light. The UV curable monomers or oligomers may further include photoinitiators, lubricants, and surfactants well known to the skilled artisan. The UV cured overcoating can be formulated from 100% solids or a solvent based gravure coating, or as a solvent slot coating, that cures upon exposure to UV light. The UV cured overcoating layer 392 provides excellent water resistance, thermal printing performance, and gloss characteristics. The UV curable overcoating layer 392 can be cured with an H bulb on a Fusion UV system.

Representative examples H-J of UV curable overcoatings (III) 392 are shown below in Table 4.

TABLE 4

Exemplary UV curable overcoatings (III).

| Component | H (wt %) | I (wt %) | J (wt %) |
|---|---|---|---|
| Chivacure 184 | 1.6 | 1.6 | 1.6 |
| Chivacure BMS | 1.8 | 1.8 | 1.8 |
| Zink Stearate | 10 | 5 | 10 |
| SR802 | 10 | 20 | 20 |
| SR368D | 25 | 10 | 10 |
| SR506 | 20 | 20 | 0 |
| CN990 | 10 | 25 | 25 |
| SR238 | 25 | 20 | 35 |

SR802 is an alkoxylated diacrylate monomer available from Sartomer Inc.

SR368 is a tris(2-hydroxy ethyl)isocyanurate triacrylate monomer available from Sartomer.

SR238 is a 1,6-hexanediol diacrylate monomer available from Sartomer.

SR506 is an isobornyl diacrylate monomer available from Sartomer.

CN990 is a siliconized urethane acrylate oligomer available from Sartomer.

Chivacure 184 is 1-hydroxy-cyclohexyl-phenyl ketone (HCPK).

Chivacure BMS is (4-(4-methylphenylthio)phenyl)phenylmethanone.

Zinc Stearate is a meltable lubricant available from Ferro Inc.

Figure 4A:
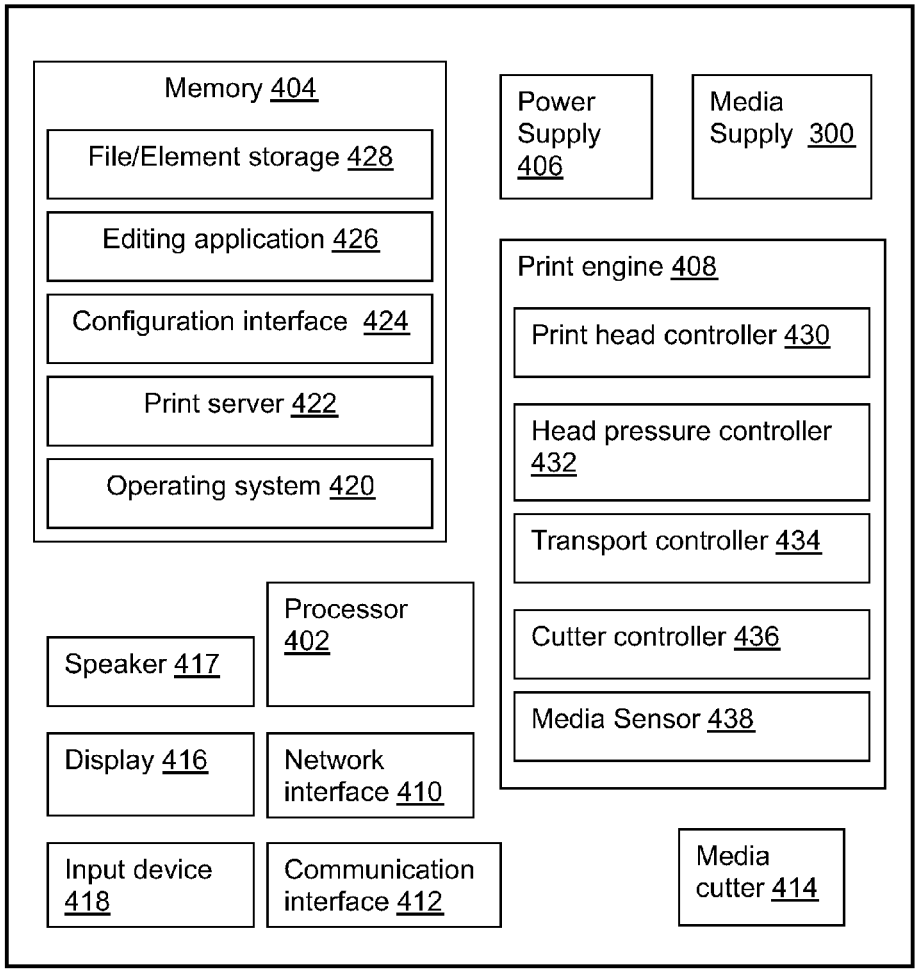
FIGS. 4A and 4B are block diagrams of an embodiment of a printer.
Figure 4B:
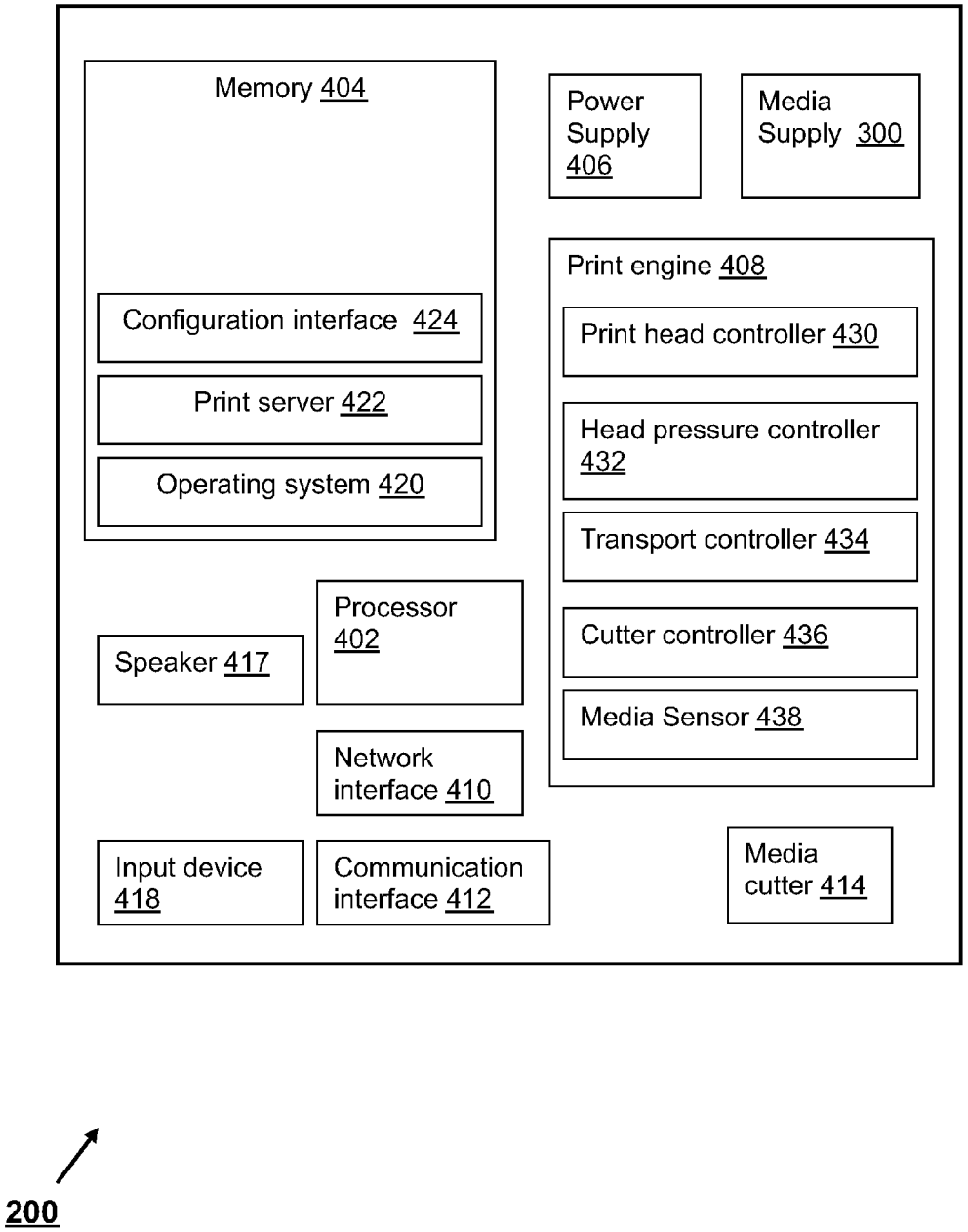

Referring now to FIGS. 4A and 4B, illustrated are block diagrams of embodiments of printers 100, 200. As shown, a printer 200 may lack one or more features present in printer 100, such as a multi-touch capacitive input device, a display, an editing application, and file storage. These features may be fulfilled by other computing devices, such as smart phones or tablet computers. For example, a user may download an editing application for their tablet computer, which may communicate with a printer 200 to print images, wirelessly or via a wired connection or other means.

A printer may include a processor 402. Processor 402 may be any type and form of processor or microprocessor, such as those manufactured by Intel Corporation of Mountain View, Calif.; those manufactured by Motorola Corporation of Schaumburg, Ill.; the ARM processor and Tegra system on a chip (SoC) manufactured by Nvidia of Santa Clara, Calif.; those manufactured by Apple Inc. of Cupertino, Calif. or Samsung Electronics of Korea, such as the A4, A5, or A5X SoC; those manufactured by International Business Machines of White Plains, N.Y., such as the POWER7 processor; or those manufactured by Advanced Micro Devices of Sunnyvale, Calif.; or any other processor capable of operating as described herein. The processor 402 may utilize instruction level parallelism, thread level parallelism, different levels of cache, and multi-core processors. An example of a multi-core processor is the AMD Phenom IIX2 or Intel Core i5 or Core i7. Processor 402 may comprise logic circuitry that responds to and processes instructions fetched from memory.

The printer may include memory 404. Memory 404 may comprise one or more storage devices, including random access memory for execution of processes, or non-volatile storage for retaining applications, data, operating systems, or other elements. For example, memory 404 may include one or more hard disk drives or redundant arrays of independent disks or flash memory elements for storing an operating system and other related software, and for storing application software programs. Memory 404 may include one or more hard disk drives (HDD); optical drives including CD drives, DVD drives, or Blu-Ray drives; solid-state drives (SSD); USB flash drives; or any other device suitable for storing data. Memory 404 or a portion of memory 404 may be non-volatile, mutable, or read-only. Memory 404 may be internal or external to the printer. For example, in one embodiment of the latter, memory 404 may comprise a flash memory storage device, such as an SD card inserted into a card reader of the printer. Memory 404 may further include remote storage devices that connect to the printer via a network interface such as the Remote Disk for the MacBook Air provided by Apple Inc. or other network storage devices. Memory 404 or a portion of memory 404 may also be one or more memory chips capable of storing data and allowing any storage location to be directly accessed by processor 402. For example, such memory or a portion of memory 404 may be volatile and faster than storage memory. Memory 404 may comprise Dynamic random access memory (DRAM) or any variants, including static random access memory (SRAM), Burst SRAM or SynchBurst SRAM (BSRAM), Fast Page Mode DRAM (FPM DRAM), Enhanced DRAM (EDRAM), Extended Data Output RAM (EDO RAM), Extended Data Output DRAM (EDO DRAM), Burst Extended Data Output DRAM (BEDO DRAM), Single Data Rate Synchronous DRAM (SDR SDRAM), Double Data Rate SDRAM (DDR SDRAM), Direct Rambus DRAM (DRDRAM), or Extreme Data Rate DRAM (XDR DRAM). Memory 404 may be based on any of the above described memory chips, or any other available memory chips capable of operating as described herein.

The printer may include a power supply 406. Power supply 406 may comprise any type and form of power supply, including one or more batteries or battery packs, including user replaceable batteries and non-user replaceable batteries. As discussed above, batteries may be accessible via a compartment or access panel of the printer, may be in a separate package that may be clipped on or connected to the printer, or may be installed within the printer in a non-user replaceable manner. The power supply 406 may comprise an alternating current or direct current power supply, such as a switched-mode power supply, linear power supply, or other power supply. In some embodiments, power supply 406 may include both batteries and an AC or DC power supply, allowing for both portable use and long term use with external power, as well as recharging of batteries. The power supply 406 may supply power to computing elements such as processor 402 and memory 404 and display devices, as well as printing elements such as a print head and media transport or a print engine 408. The printer may include multiple power supplies for redundancy and/or efficiency. For example, a low power supply may be used to power low-power computing elements, and a high power supply may be used to power heaters and mechanical transport elements.

The printer may include a print engine 408. Print engine 408 may comprise one or more processors, integrated circuits, signal processors, or other hardware or logic elements for controlling a print head and/or transport elements of a printer. For example, the print engine 408 may include a processor for controlling pulses (e.g. electrical pulses) transmitted to resistive heaters of a thermal print head, or for advancing media. The print engine 408 may further include graphics processors for performing various processing steps on an image to be printed, including stretching, dithering, anti-aliasing, color correction, corrections to contrast or brightness, stitching, or other such processes. For example, due to the expense and difficulty of creating large format thermal print heads, the printer may include multiple thermal print heads arranged in an overlapping configuration to print across media that is wider than a single print head. Print engine 408 may divide images for printing by each print head, as well as applying stitching techniques to reduce or eliminate visible artifacts or banding in the stitched or overlap area. Print engine 408 may also control one or more mechanical portions of the printer, such as transport motors, tension motors, cutters, ejection mechanisms, or other such elements. Although shown separate from processor 402, in many embodiments, print engine 408 may comprise functions and logic executed by processor 402, which may reduce expenses at the cost of some efficiency or processing speed.

In some embodiments, a print engine 408 may include a print head controller 430, a head pressure controller 432, a transport controller 434, and/or a cutter controller 436. Controllers 430-436 may comprise hardware, software executed by a processor of print engine 408, or a combination of hardware and software. For example, controllers 430-436 may comprise subroutines, services, threads, or modules executed by print engine 408. In some embodiments, a print engine 208 may further comprise a media sensor 438.

In some embodiments, a print head controller 430 may comprise logic for controlling one or more print heads or elements of one or more print heads, such as resistive elements of a thermal printer. Print head controller 430 may comprise functionality for stitching images between a plurality of print head elements; controlling pre-heating functions; triggering pulses for a thermal printer; adjusting position, density, or other features of an image during printing; or performing other calculations and functions for printing an image.

A head pressure controller 432 may comprise logic for controlling a motor or other element for adjusting pressure of a print head against a platen during printing. As discussed in more detail herein, in many embodiments of printers that may utilize different widths of media, it may be desirable to adjust pressure of the head against the platen to provide full width printing while preventing printing on the platen roller itself.

A transport controller 434 may comprise logic for adjusting a transport to advance and/or retract media. For example, transport controller 434 may control rollers to advance media for cutting, and then retract the media to allow printing across the cut to provide full bleed images, as discussed in more detail herein. In some embodiments, transport controller 434 may track the rotational position of a platen roller. For example, the platen roller may not be uniform or may have defects along its surface due to manufacturing tolerances. The transport controller 434 may monitor the position of the platen, such as via a sensor or by monitoring rotation of a gear connected to the platen directly or via a chain of gears in an integer relationship, such that rotation of the gear may directly correlate to a rotational position of the platen. The transport controller 434 may notify the print head controller 430 and/or head pressure controller 432 that a platen or other transport defect will cause a potential print defect at an identified time or printing location, such that controllers 430, 432 may compensate.

A cutter controller 436 may comprise logic for controlling one or more cutters or motors connected to cutting levers, including a kiss cutter or full cutter. The cutter controller 436 may communicate with the transport controller 434 to ensure proper positioning of media for cutting, and for indicating a cut is complete such that the media may be advanced or retracted.

Print engine 408 and/or printer 100, 200 may include a media sensor 438. Media sensor 438 may comprise an optical sensor, physical sensor, or any other type and form of sensor for detecting media 302 and/or a pattern 1000, 1100 imprinted on media 302 for tracking purposes and discussed in more detail below. In many embodiments, media sensor 438 may be positioned underneath media 302 or on a side opposite that of a print head or printing surface of media 302. Media sensor 438 may be used to identify entry of media 302 into the printing apparatus, and/or may be used to identify markers indicating that the end of the roll of media in the cartridge or cassette is approaching, such as double lines, lines in a different color, patterns, or other indicators.

The printer may include one or more network interfaces 410. Network interfaces 410 may include, without limitation, telephone lines, Ethernet interfaces to a local area network (LAN) or wide area network (WAN), broadband connections (e.g., ISDN, Frame Relay, ATM, Ethernet-over-SONET, ADSL, VDSL, BPON, GPON, fiber optical including FiOS), wireless connections (e.g. radio frequency, cellular, BlueTooth), or some combination of any or all of the above or other interfaces, such as ThunderBolt, FireWire, or serial or parallel interfaces of any type. Connections can be established using a variety of communication protocols (e.g., TCP/IP, ARCNET, SONET, SDH, Fiber Distributed Data Interface (FDDI), IEEE 802.11a/b/g/n/ac, CDMA, GSM, WiMax and direct asynchronous connections). A network interface 410 may comprise a built-in network adapter, network interface card, PCMCIA network card, ExpressCard network card, card bus network adapter, wireless network adapter, USB network adapter, cellular modem, WiFi access point or wireless network interface or any other device suitable for interfacing the printer to any type of network capable of communication and performing the operations described herein. Network interface 410 may execute a network stack providing communications via one or more OSI layers, and may perform various processing functions including compression and decompression, encryption and decryption, acceleration, tunneling, caching, buffering, multiplexing, connection pooling, or any other type and form of communications processing.

Multiple network interfaces 410 may be bridged. For example, a printer may include a wired interface to a switch or router and a wireless interface acting as a WiFi access point, and may bridge between the interfaces to provide network access to other computing devices. In other embodiments, network interfaces 410 may not be bridged. For example, a printer may include a first network interface providing a WiFi access point through which a computing device may connect to provide configuration commands to the printer. The configuration commands may cause the printer to reconfigure a second network interface to join an existing wireless network to serve as a network printer. This may allow for easy configuration of a "headless" printer or printer without a display or input device such as a printer 200. In a similar embodiment, the printer may include one wireless network interface which may be configured as a WiFi access point. The user may connect, via a computing device, to the printer and provide configuration commands to the printer. The printer may then reconfigure the wireless network interface to join an existing wireless network. As discussed above, the printer may include a button or control to reset the wireless network interface or return the printer to an access point mode.

The printer may also include one or more communications interfaces 412. Communication interface 412 may include any type of wired or wireless communication interface for direct connection to a computing device, such as a serial or parallel connection, a USB interface, FireWire interface, ThunderBolt interface, or any other type and form of connection interface for transferring data between the printer and a computing device. For example, the printer may connect to a desktop computer via a USB cable and may appear to applications and the operating system of the desktop computer as a USB printing device.

The printer may include a media cutter 414, which may comprise one or more cutters, including full cutters or kiss cutters as discussed above. A cutter 414 may include a rotary cutter, scissors or guillotine cutter, or any other type and form of cutter or cutting mechanism. A cutter 414 may be configured to cut laterally across media, or may be configured to cut longitudinally along media. A single cutter 414 may be configured to cut to a first depth in the media to perform a kiss cut and configured to cut to a second depth through the media to perform a full cut, or kiss cutting and full cutting may be provided by separate cutters 414.

The printer may include a display 416, such as an LCD display, LED or OLED display, eInk display, or any other type and form of display. Display 416 may be coupled with an input device 418, such as a multi-touch capacitive LCD touch screen. In other embodiments, the printer may connect to an external display 416, such as an external CRT or LCD screen or micro- or pico-projector, or any other type of display. Input device 418 may include one or more buttons, capacitive sensors, resistive or capacitive touch screens, keypads or keyboards, joysticks, stylus or pen input devices, trackballs, pointers, directional buttons, or any combinations of these or other input devices. In some embodiments, the printer may connect to an external input device 418 such as a BlueTooth or USB keyboard. The printer may also include a speaker 417 for providing audio feedback, such as clicks for a virtual keyboard, beeping or other alert noises, or similar sounds.

The processor 402 of a printer may execute one or more applications, services, servers, daemons, routines, subroutines, or other executable logic or code. For example, processor 402 may execute an operating system 420. Operating system 420 may comprise an operating system, such as the iOS system provided by Apple Inc., Android operating system provided by Google Inc., the Windows Mobile or Windows Phone operating systems provided by Microsoft, or one of the variants of Embedded Linux or Linux, or any other type and form of embedded, real-time, proprietary, open-source, mobile, or other operating system for controlling access to resources and scheduling tasks.

The printer 100, 200 may execute a print server 422. Print server 422 may be an application, service, server, or other executable logic for receiving printing commands and data files, including text and/or images, from clients such as desktop computers, tablet computers, laptop computers, and smart phones. Print server 422 may support any type and form of printing protocol including internet printing protocol, line printer daemon protocol, NetWare, NetBIOS/NetBEUI, JetDirect, or any other type of protocol. Print server 422 may include a buffer or storage for storing images or files for printing, and may include queuing or spooling functionality.

The printer 100, 200 may execute a configuration interface 424. Configuration interface 424 may comprise an application, server, service, or other executable logic for receiving configuration information from a user. For example, configuration interface 424 may include a web server and a configuration page provided by the web server. A user may connect a computing device to a WiFi access point provided by network interface 410 and may direct a browser to open the configuration page. The user may then provide configuration commands, such as printing default settings or commands to join a network provided by an external wireless router.

The printer 100, 200 may execute an editing application 426. Editing application 426, discussed in more detail below, may comprise an application allowing WYSIWYG generation and editing of images or labels for printing, and saving and retrieval of images and/or elements to a portion of memory such as file storage 428. Editing application 426 may provide templates or pre-printed images, and/or may allow for purchase of such elements, templates, and images from an online store.

As discussed above, some printers such as printer 100 may include a user interface and display. On such printers, a user may directly select a wireless configuration screen or menu and request the printer to join a network provided by a wireless router. However, on other printers such as printer 200 that do not include a display, the user may not be able to directly select existing networks or enter passwords if required. Accordingly, in some embodiments of the latter, a wireless network interface of the printer may provide a wireless access point. The user may connect to the printer's wireless network and select another existing network provided by another device or router for the printer to join. The printer may reconfigure the wireless network interface, or configure a second wireless network interface, and join the selected network, allowing network devices to print via the printer.

Figure 4C:
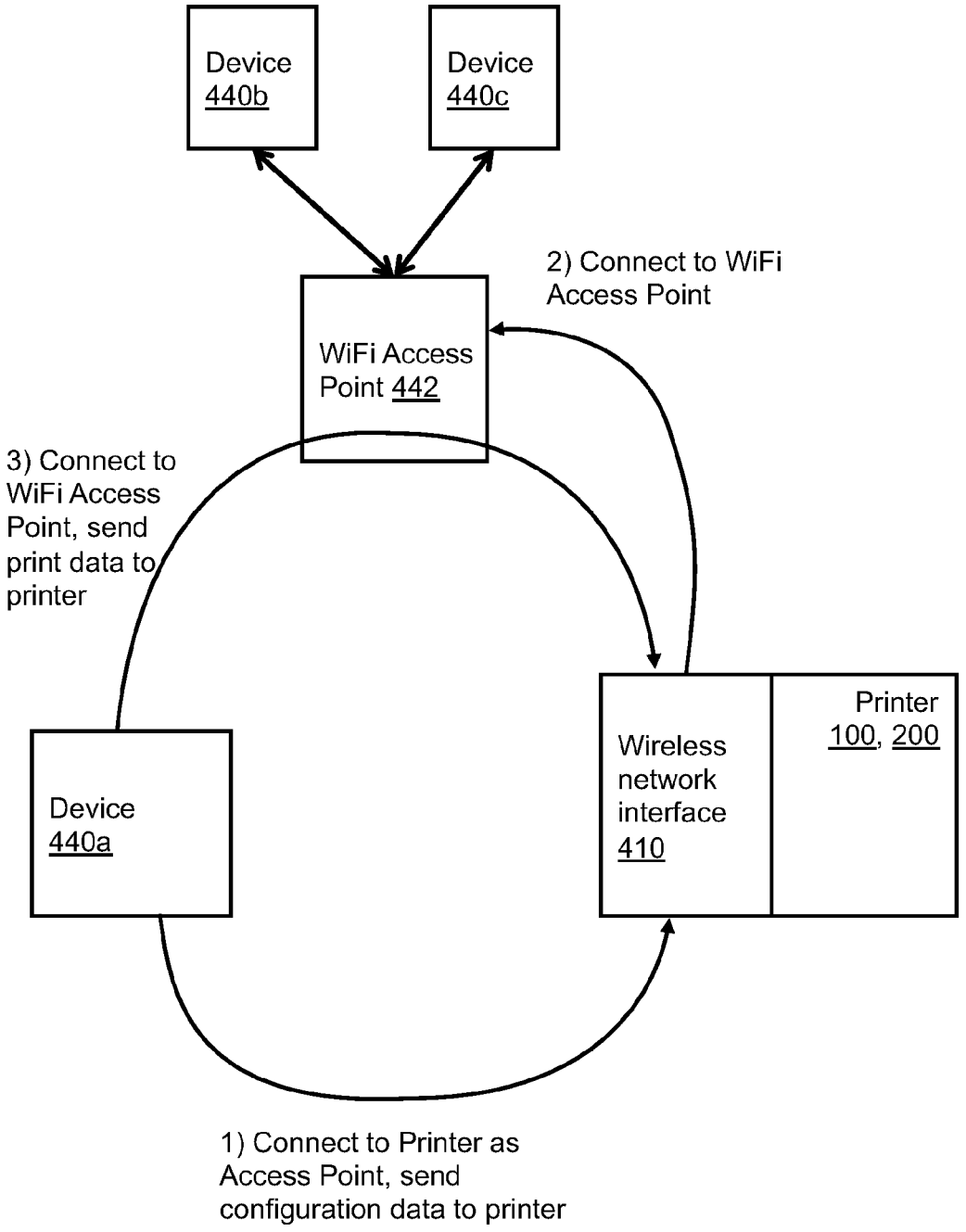
FIG. 4C is a flow diagram of an embodiment of configuration of a printer to join an existing wireless network.

Referring now to FIG. 4C, a flow diagram illustrates an embodiment of configuration of a printer to join an existing wireless network. A printer 100, 200 including a wireless network interface 410 may have the network interface set to provide a WiFi access point. The access point may require a password to connect, or may be an open access point. At step 1, a device 440*a* such as a tablet computer may connect to the network provided by the network interface 410. As discussed above, the user may launch a web browser or other application to view a configuration page of the printer 100, 200. The user may provide configuration details, such as network name of a network provided by a WiFi access point 442 or external router; WEP, WPA or other network password; login credentials or a username and password; domain or workgroup name; IP address; or any other type and form of configuration information.

At step 2, the printer may configure the wireless network interface 410 to join the network provided by the WiFi access point 442. In embodiments in which the printer has a single wireless network interface 410, the printer may reconfigure the interface to join the network provided by access point 442 as a client. This can disconnect device 440*a* from the network provided by the wireless network interface 410. In other embodiments, the printer may have multiple wireless network interfaces 410, and may configure a second network interface to join the WiFi access point while the first remains in an access point mode. The second interface may be bridged to the first, allowing the user to access the network provided by the WiFi access point 442 without having to reconfigure their device 440*a*. In a similar embodiment, the user may connect a computing device to the printer via a communication interface, such as USB, to configure the wireless network interface 410. Once configured and joined to the network of WiFi access point 442, the printer may bridge the communication interface and network interface and provide wireless communications for the computing device of the user. In other embodiments, at step 3, the user may connect their device to the WiFi access point 442 and print via the wireless network to the printer 200. Similarly, other devices 440*b* and 440*c* may also print via the wireless network to printer 200.

Figure 5A:
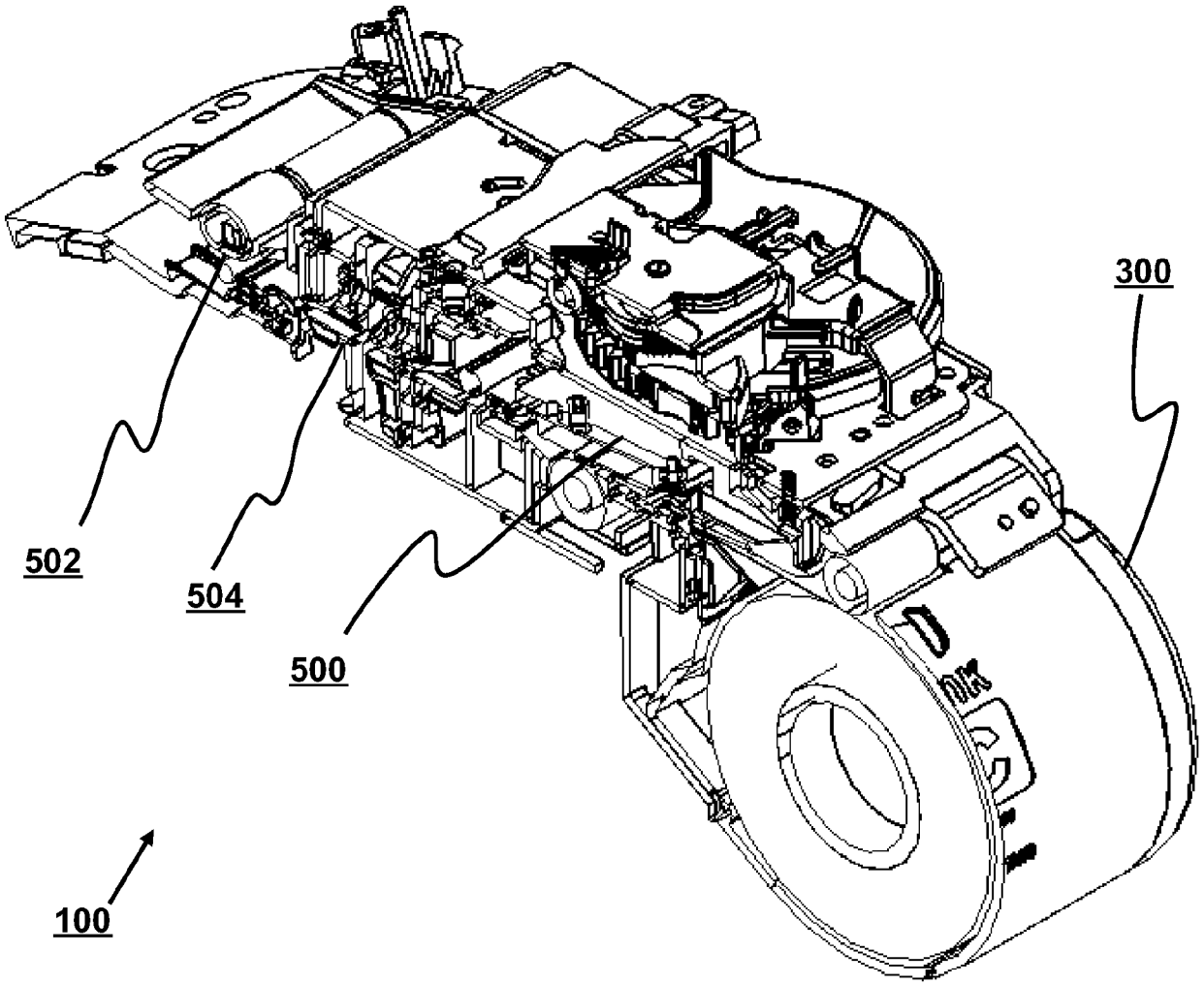
FIG. 5A is an isometric view of an embodiment of a transport of a printer.
Figure 5B:
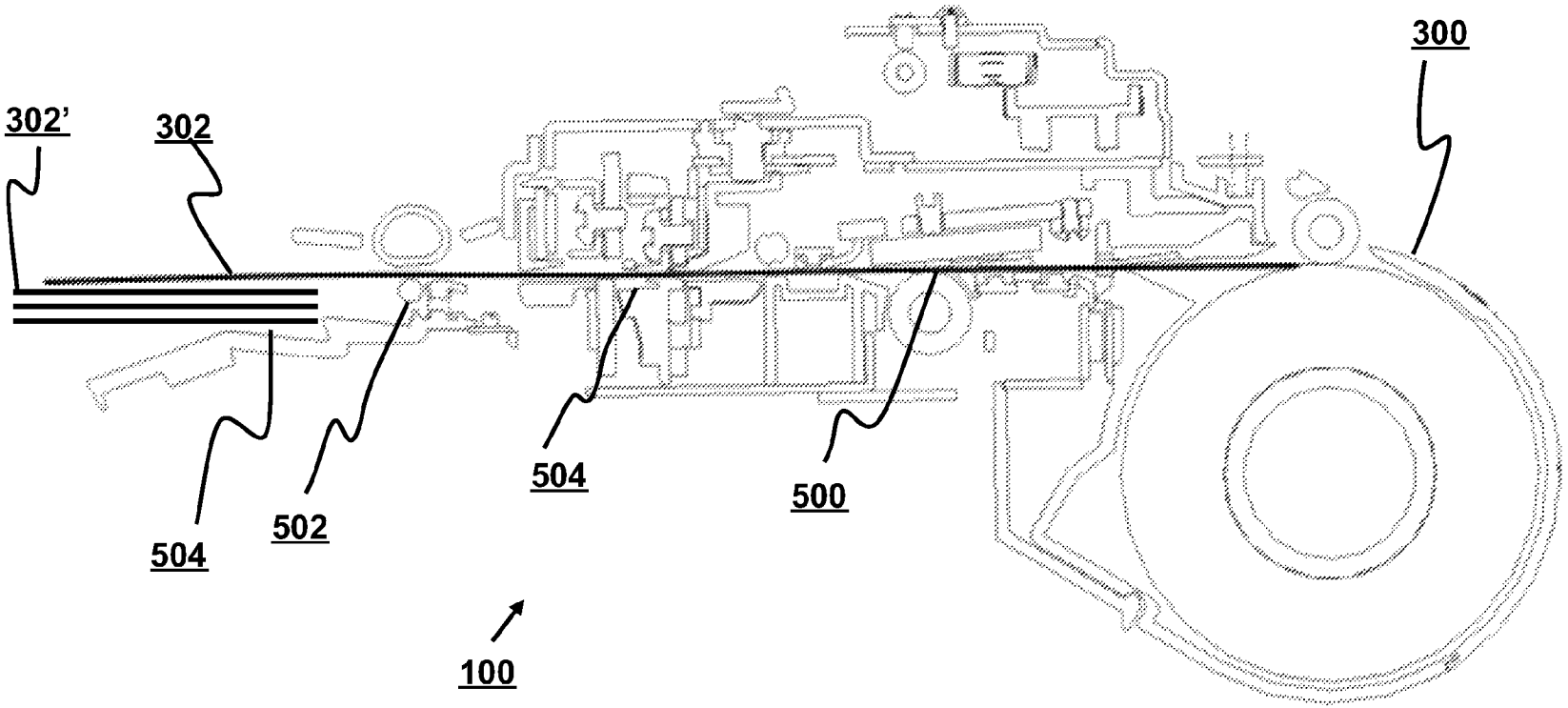
FIG. 5B is a cutaway view of the embodiment of the transport of the printer of FIG. 5A.

FIG. 5A is an isometric view of an embodiment of a transport of a printer, such as printer 100, including a cassette 300. The view has been cutaway to show internal components, including print head 500, auto-ejection system 502 and cutter 504, and is provided to show context for FIG. 5B, which is a cutaway view of the transport from the side. As shown, media 302 passes from cassette 300 between a print head 500 and platen roller, past cutting mechanism 504 and to auto-eject mechanism 502. In some embodiments, a printer may include a catch tray 504 for catching previously-printed, cut, and ejected media 302'.

Figure 6A:
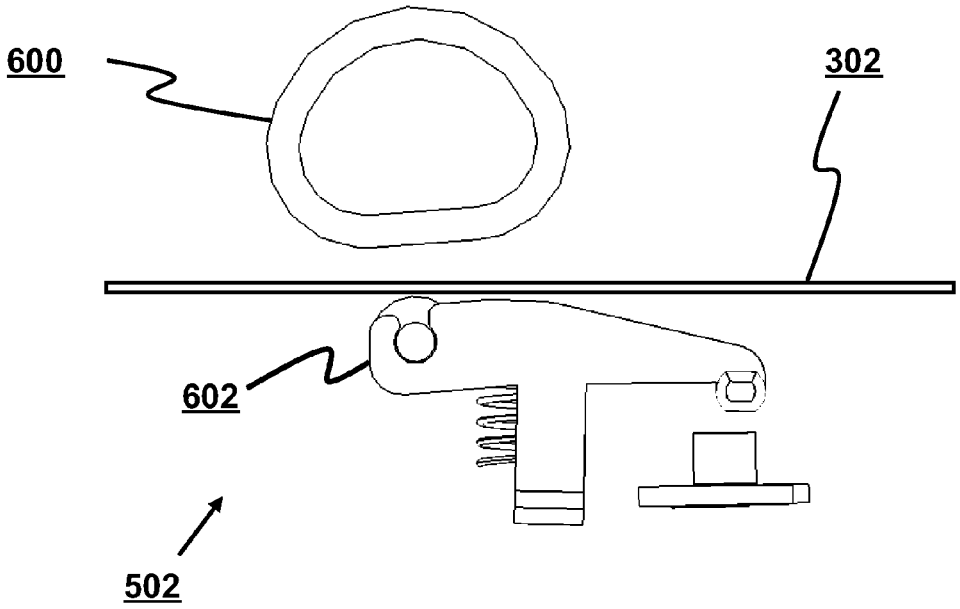
FIGS. 6A and 6B are side views of an embodiment of an automatic ejection mechanism in a printing position and an ejection position, respectively.
Figure 6B:
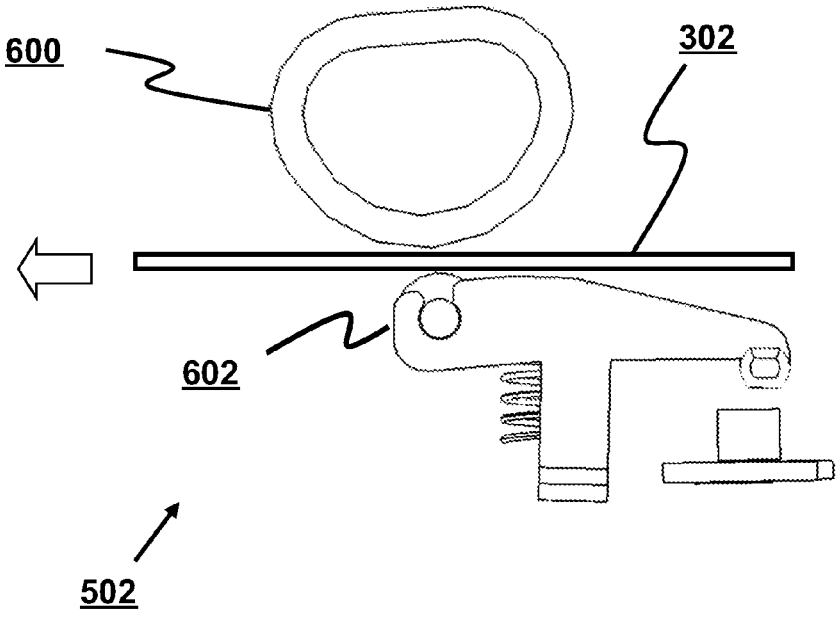

Referring first to auto-eject mechanism 502, illustrated in FIGS. 6A and 6B are side views of an embodiment of an automatic ejection mechanism in a printing position and an ejection position, respectively. The ejection mechanism 502 may include a roller 600 and a platen 602. Roller 600 may comprise a high friction material or material with a higher coefficient of friction than smooth plastic, such as rubber or a rubberized material having a static frictional coefficient greater than 0.5. Different materials may also be employed, such that roller 600 may comprise a material or combination of materials with a static frictional coefficient greater than or less than 0.5. Platen 602 may be a flat shelf, roller, skid or slide plate, or any similar surface that the media 302 may freely slide against, such as a non-rotating platen. In many embodiments, platen 602 may have a low coefficient of friction so as to not resist advancement of media 302, such as a static frictional coefficient less than 0.5, less than 0.2, or any other such value.

As discussed above, during printing and depending on the length of the image to be printed, media 302 may be advanced past the print head 500 and through the automatic ejection mechanism 502. For example, the distance between the print head 500 and ejection mechanism 502 may be three inches in one embodiment. If an image is longer than three inches, then even if the media is cut immediately prior to printing and printing begins at the cut, the media will be between roller 600 and platen 602 during printing of part of the image. If roller 600 and platen 602 are both contacting the media, then the added friction may create a back pressure or tension on the media, even with freely-rotating rollers. This friction may result in stuttering, jerking, or slipping of the media, resulting in visible artifacts or banding during printing.

Accordingly, to avoid such artifacts, roller 600 may have a non-circular or D-shaped profile as shown, and may be rotated to the position illustrated in FIG. 6A creating a space between roller 600 and platen 602 such that media 302 is not in contact with the roller and platen simultaneously. To eject the media 302 after printing is complete and the media has been cut, roller 600 may be rotated to the position shown in FIG. 6B to engage media 302 against platen 602. The roller 600 may continue being rotated to advance the media 302. As the roller 600 has a non-circular profile, such advancement of the media may be in stages, with the media being advanced a distance roughly equal to the circumference or length of the circular portion of roller 600.

In some printers, the print head may be significantly smaller than the media, and may be mechanically moved across the media to print each line. For example, many inkjet printers move an inkjet cartridge across a page of media, advancing the media line by line to print an image. Such implementations allow for many different widths of media, but add expense and suffer from reduced printing speed and potential mechanical problems. In other printers, the print head may be equal in size to the media. For example, a direct thermal printer for a cash register may have a width equal to a roll of thermal media to be printed. Such implementations may be cheap and efficient, but require fixed-width media, reducing flexibility of use.

Problems appear when a wide print head is used with narrow media. Specifically, an ink print head, such as an inkjet or dot matrix printer may deposit ink on a platen roller beyond the bounds of the narrow media to be printed on, if the travel of the print head is not carefully controlled. Such ink may transfer from the roller to wider media when inserted into the printer, resulting in smudging. Similarly, with a stationary print head, such as in thermal printer, the print head may transfer heat to the platen roller, degrading the rubber material and/or reducing efficiency of thermal transfer.

In some embodiments of printers, a print head such as a thermal print head may be bowed or have a curvature in a direction perpendicular to the plane of the media to be printed. This may be due to the method of manufacture or installation of the print head. By dynamically adjusting the pressure of a deflectable platen roller against the print head, the bow may be used to eliminate contact between the print head and roller at locations beyond the width of media.

Figure 7A:
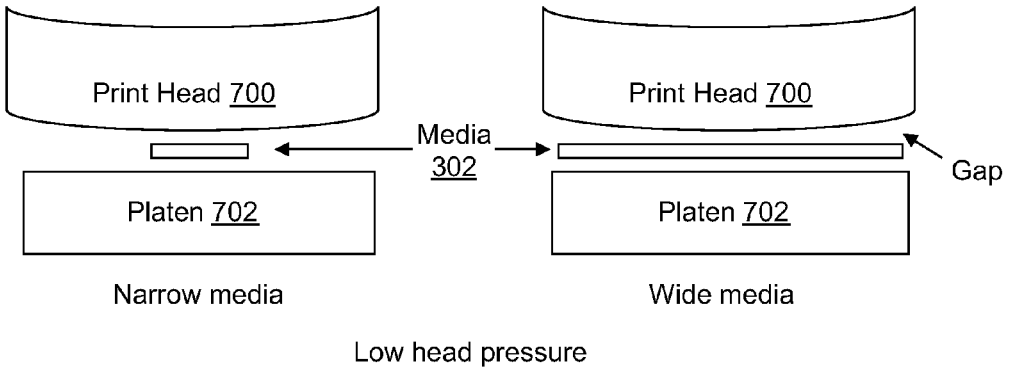
FIGS. 7A-7C are diagrams of embodiments of curved or bowed print heads under low head pressure, high head pressure, and variable head pressure, respectively.
Figure 7B:
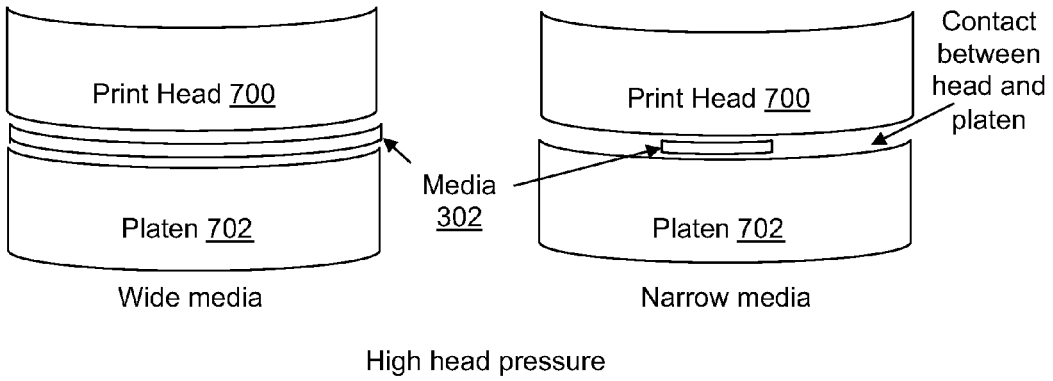
Figure 7C:
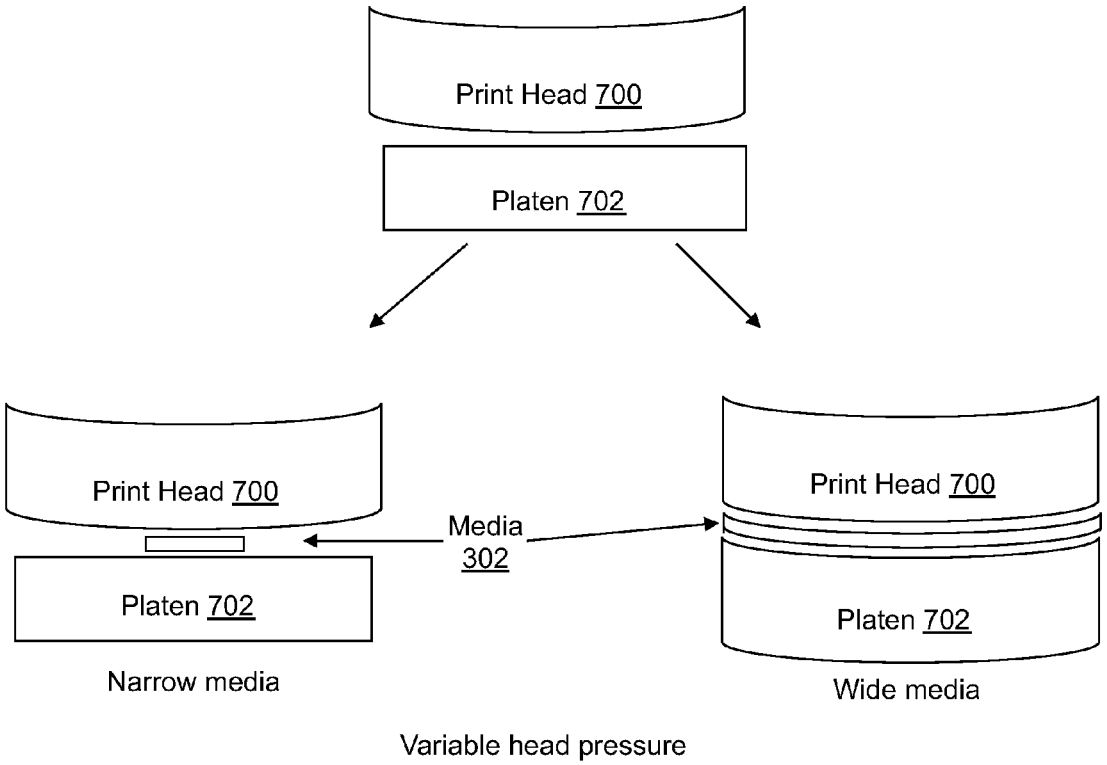

For example, FIGS. 7A-7C are diagrams of embodiments of curved or bowed print heads under low head pressure, high head pressure, and variable head pressure, respectively, viewed from a position in the direction of travel of media (i.e. viewing the media end-on). The platen 702 may comprise a deflectable or compressible material, such as rubber, and the print head 700 may comprise a thermal print head, or any other type of print head that directly contacts the print media. As shown in FIG. 7A, a bowed print head 700 may be positioned over a platen 702 with media 302 between the print 700 head and platen 702. At low head pressure, the platen 702 may not be deflected a significant amount. Accordingly, the bow will result in sections of the print head 700 beyond the width of media 302 not being in contact with the platen 702. However, with wide media 302 and low head pressure, the print head 700 may not fully contact the media 302, resulting in density variation of the printed image across the media 302.

Conversely, at high head pressure as shown in FIG. 7B, the platen 702 may be significantly deflected. With wide media, the print head 700 can fully contact the media 302, resulting in a consistent image. However, with narrow media, the print head 700 may contact platen 702, resulting in the problems discussed above.

Accordingly, variable head pressure may be applied as in FIG. 7C to achieve the best of both situations. With narrow media, head pressure may be reduced to reduce deflection of the platen 702, resulting in the print head 700 bowing away from the platen 702 beyond the width of the media 302. With wider media, head pressure may be increased to increase deflection of the platen 702, forcing the media 302 into full contact with the print head 700. In some embodiments, the pressure may be varied to provide a constant pressure per unit width of media 302. For example, the pressure may be x for half-inch media, 2x for one inch media, and 4x for two inch media, resulting in a constant x/half-inch pressure regardless of media width. In other embodiments, the pressure may be varied in geometric or non-linear means, for example, due to a platen 702 that increasingly resists deflection as pressure is applied.

In some embodiments, head pressure may be adjusted via a screw, attached to the head and threaded through a hole on a supporting frame, or conversely attached to a frame and in contact with the head. The screw may be rotated to vary the bow of the print head. The screw may be adjusted via a motor, in some embodiments. In other embodiments, the screw position may be fixed or calibrated during manufacture and other means may be used for variable head pressure. For example, in one embodiment, the print head may be moved via one or more levers and/or motors against a fixed platen and/or deformable platen having a fixed axis or fulcrum. In another embodiment, the print head may be fixed to the frame and an axis or fulcrum of the platen may be adjusted to provide variable pressure on media between the platen and the print head. For example, the platen may comprise a platen roller, and the axis of the roller may be adjusted by one or more levers supporting the axis. The levers may be moved by a motor to vary the position of the platen roller, moving the roller towards the head to increase pressure or away to decrease pressure. In other embodiments, the platen may comprise a flat or bent plate, such as a spring steel plate. The fulcrum of the plate or a spring support for the plate may be moved via a lever such that the plate presses harder or softer against media and the print head. In some embodiments, the pressure may vary in a linear relationship to the position of the axis or fulcrum of the platen, while in other embodiments, the pressure may vary in a geometric or fashion (such as a platen that increasingly resists deformation as it is deflected, e.g. with a force of $F=\frac{1}{2}kx^2$ with k depending on the material of the platen and x representing the change in position of the platen; or any other such relationship).

As discussed above, many types of media may include a non-adhesive backing. For example, such media may be used for photos, cards, framed pictures, coupons, receipts, or other uses where an adhesive is either not desirable or is irrelevant. For such uses, a printer may employ a full cutter to be able to cut a continuous spool of media to any length according to the printed image. In other uses, the media may include an adhesive, such as for stickers, labels, or similar uses. During manufacture, a thin backing may be applied to the media, such as a paper layer, to cover the adhesive. A user may peel the backing from the media, exposing the adhesive, and allowing the media to be fixed to a surface. To aid in peeling the media, as well as to perform full-bleed printing as discussed herein, the printer may include a kiss cutter that may cut through the media to the depth of the backing, but leaving the backing uncut or partially uncut. The resulting tab may be used to peel off the backing to expose the adhesive.

Figure 8A:
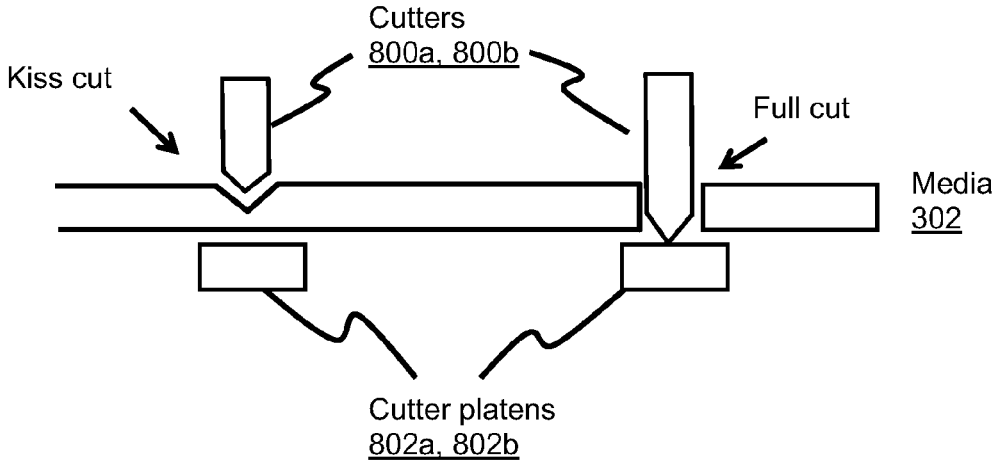
FIG. 8A is a diagram of an embodiment of kiss cutting and full cutting a printing medium.

For example, shown in FIG. 8A is a diagram of an embodiment of kiss cutting and full cutting of a printing medium 302. A kiss cutter 800*a* may be fixed to cut partly through a segment of media held against a platen 802*a*, while a full cutter 800*b* may be allowed to cut fully through the media

Figure 8B:
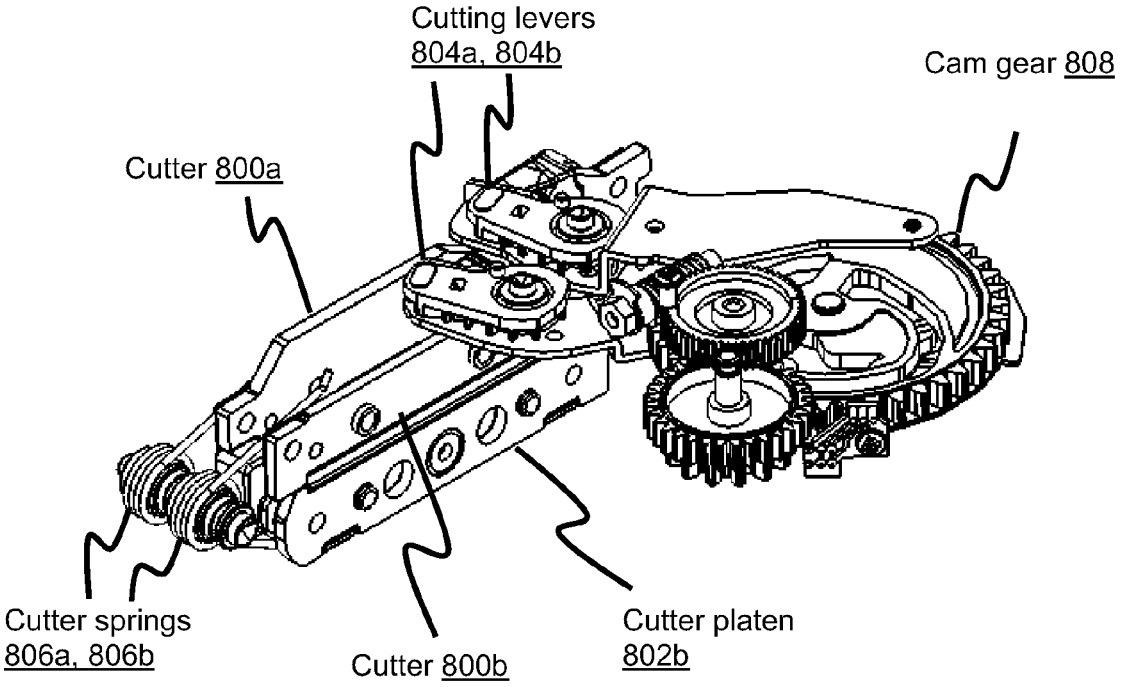
FIG. 8B is an isometric view of an embodiment of a cutting mechanism of a printer.

802*b*. Similarly, shown in FIG. 8B is an isometric view of an embodiment of a cutting mechanism of a printer. Although cutters 800*a*-800*b* shown in FIG. 8B are guillotine or partial-scissor cutters, different types of cutters may be used including rotary cutters or any other type and form of cutter. Each cutter 800*a*-800*b* may be connected to a cutter spring 806*a*-806*b* configured to return the cutter to an open position when cutting lever pressure is released.

As shown in FIG. 8B, in one embodiment of a cutting mechanism, a motor may rotate a cam gear 808. The motor may include a worm gear or similar gear to provide a high-torque force on cutters 800*a*-800*b* via cutting levers 804*a* or 804*b*. In one embodiment, as shown, one cutting lever may attach to a track on top of cam gear 808 while another cutting lever may attach to a track on the bottom of cam gear 808. Thus, the cam gear 808 may include multiple tracks for followers of levers 804*a*-804*b*, configured to allow the cam gear to be moved into a default non-cutting position, a first kiss cutting position, and a second full cutting position. For example, the cam gear 808 may be moved clockwise from a neutral position to engage one lever and counter-clockwise from the neutral position to engage the other lever.

Figure 8C:
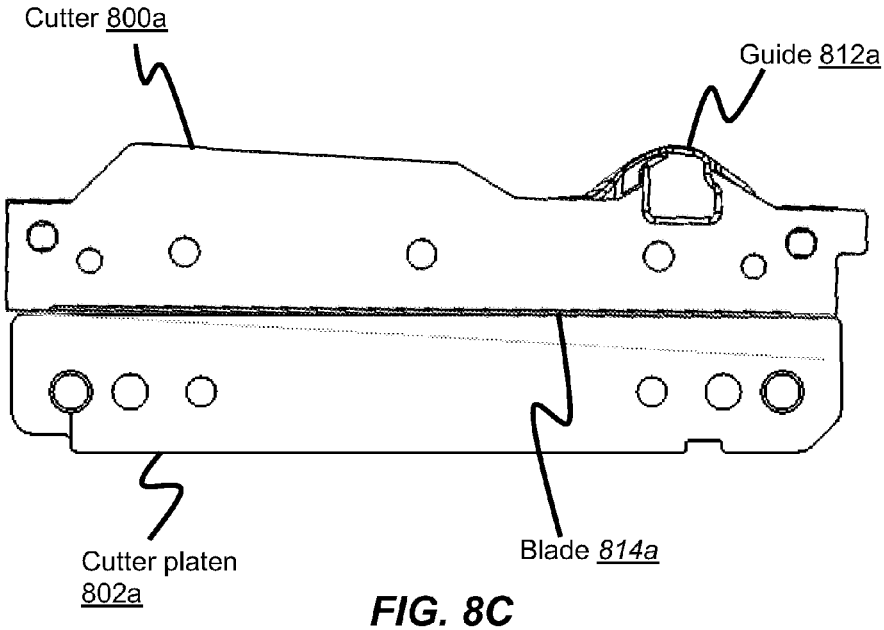
FIGS. 8C and 8D are diagrams of a kiss cutter and a full cutter of the cutting mechanism of FIG. 8B.
Figure 8D:
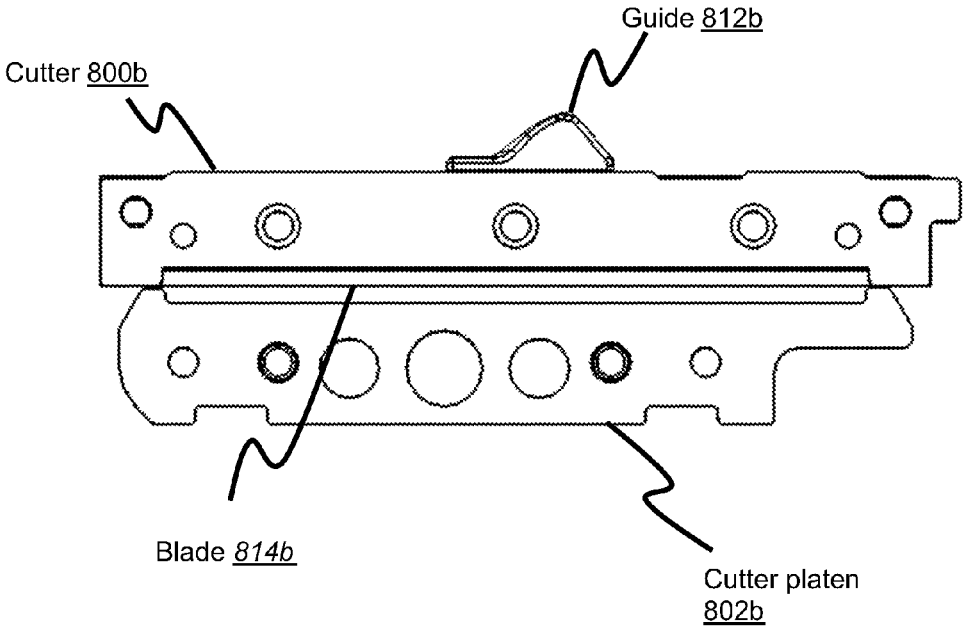

FIGS. 8C and 8D illustrate embodiments of a kiss cutter and a full cutter, respectively, viewed end-on or from the direction of transit of the media. Each cutter 800*a*-800*b* is illustrated in a closed or cutting position. Each cutter may include a guide 812*a*-812*b*, against which a cutting lever 804*a*-804*b* may press to lower cutter 800*a*-800*b* to cut with blades 814*a*-814*b* against cutter platen 802*a*-802*b*. As shown, guides 812*a*-812*b* may be offset from each other. This allows separation of levers 804*a*-804*b* to prevent interference, and also allows for greater force to be applied on cutter 800*a* due to the greater distance of guide 812*a* from an axis or fulcrum of cutter 800*a*. A greater force may be needed for kiss cutting, for example, because the blade may need to cut across the entire width of the media simultaneously, rather than cutting completely through a first part of the media closer to the axis before reaching a second part farther from the axis.

Figure 9A:
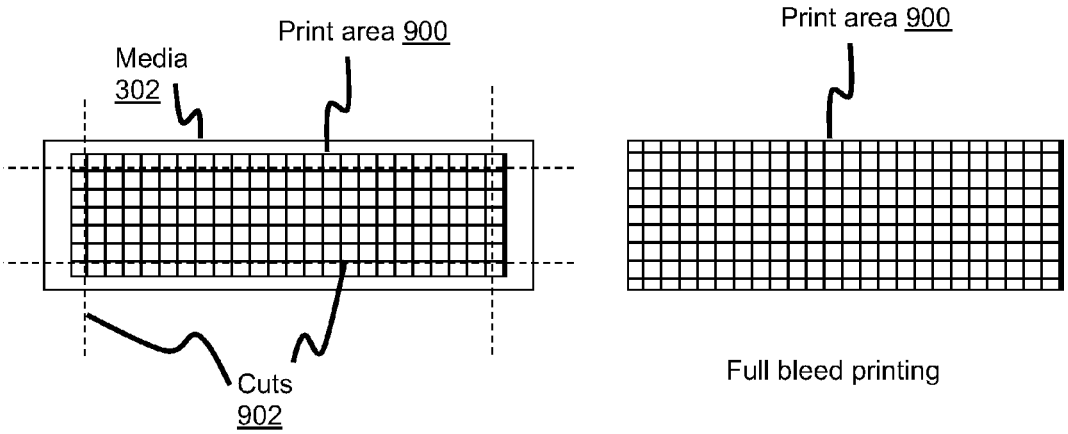
FIG. 9A is a diagram of media illustrating embodiments of full bleed printing.

As discussed above, printing may be referred to as full-bleed if a printed image extends to the edge of the resulting media. Many printers may be unable to print full bleed images, for example, because of a need to avoid spilling ink onto a platen roller or avoid applying heat to the edges of media that may cause them to curl. Kiss cutting and/or full cutting may be used to achieve full-bleed printing. For example, as shown in the left hand diagram of FIG. 9A, an image 900 may be printed on media 302 with unprinted area (white space) around the printed area 900. Cuts 902 may be made within the print area 900 to achieve a full-bleed image, albeit one narrower than the original width of media 302. The cuts may be full cuts, or may be kiss cuts and the center printed section may be peeled out or removed by the user. Longitudinal kiss cuts may be cut in the media during manufacture or cut via rolling cutters while advancing the media, with lateral cuts performed during printing. This may allow for dynamic variation of the length of printed media while still providing full-bleed printing.

Other printers may not need additional lateral space for a print area 900. For example, in some embodiments of direct thermal printers, the print head may extend past the media 302 and be able to print to the edge (and/or slightly beyond the edge) of the media, providing full-bleed printing across the width of the media. Although this may result in heat being transferred from the print head to a platen roller, undesirable effects may be mitigated through variable head pressure as discussed above. However, due to the need for the print head to be in position above the media 302 when printing is started, the printer cannot directly create an image that extends to the cut edge of the media (because the print head would have to start printing before the media reaches the print head, the media could skip or jam against the lowered print head). Accordingly, in some embodiments, kiss cutting and full cutting of the media may be used to allow full bleed printing in a longitudinal direction.

Figure 9B:
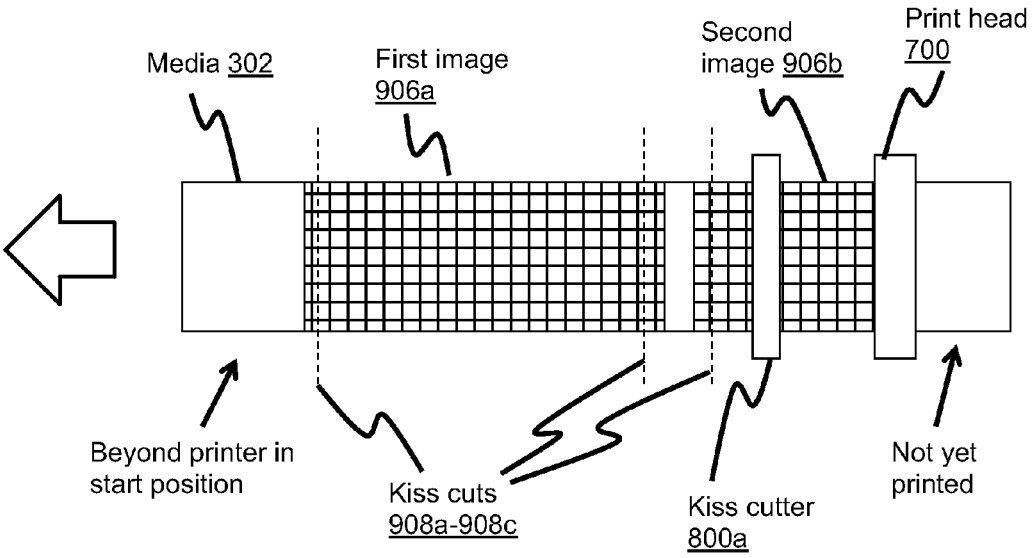
FIG. 9B is a diagram of media illustrating an embodiment of full bleed printing via kiss cuts.

For example, referring first to FIG. 9B, illustrated is a diagram of media illustrating an embodiment of full bleed printing via kiss cuts. As shown, media 302 may pass under a print head 700 for printing a first image 906*a* and second image 906*b*, and a kiss cutter 800*a* which may make kiss cuts 908*a*-908*c* to allow full bleed printing. Each image 906*a*-906*b* may be slightly stretched or have a portion of the image extended, or each image 906*a*-906*b* may be slightly cropped during cutting. This may reduce visual distortions in the edges of the printed image, at the expense of losing a small strip of the image at each longitudinal end.

As shown, the media 302 may have a portion that is beyond the print head 700 in a start position. Depending on the cutter design, the printer may begin printing the first image 906*a* and may perform the first kiss cut 908*a* during printing. However, in many embodiments, the media must be stopped prior to cutting, or the cutting blade may cause a stutter or jerk in the print, resulting in a visual artifact or band. The media may be advanced to the position for cutting, held still while the cut is performed, and then advanced to print the rest of the image, but this may also result in visual artifacts as the speed of the media past the print head 700 may not be constant.

Accordingly, it may be desirable to perform the first cut 908*a* prior to printing. For example, the printer may advance the media 302 such that a start point on the media is beneath the kiss cutter 800*a*. The cutter may perform the kiss cut, and the media may be retracted or rewound to return the start point to the print head 700 or slightly beyond the print head. The printer may then print the entire first image 906*a*. After printing, the media may be advanced such that the kiss cutter 800*a* may perform cut 908*b*. To print a second image, the media may be advanced again to perform cut 908*c*, and then rewound to allow printing of second image 906*b*. After printing, each full bleed image 906*a*, 906*b* may be peeled from a backing of the media. To ensure proper advancement and retraction, during manufacture and calibration of the printer, the distance between a cutter 800*a*, 800*b* and the print head 700 may be measured and recorded, such that the printer may advance and retract the media properly.

Figure 9C:
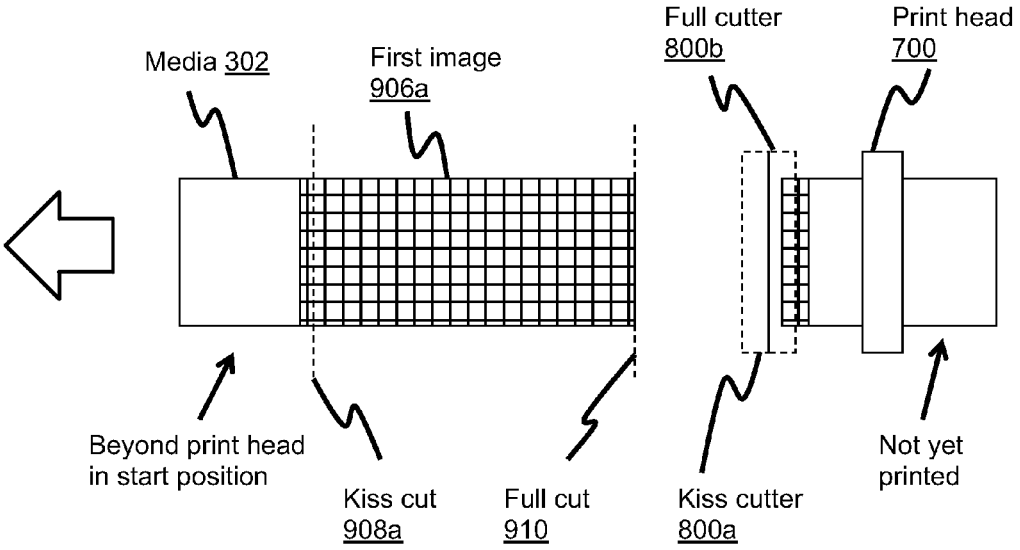
FIGS. 9C and 9D are diagrams of media illustrating an embodiment of full bleed printing via full cuts.
Figure 9D:
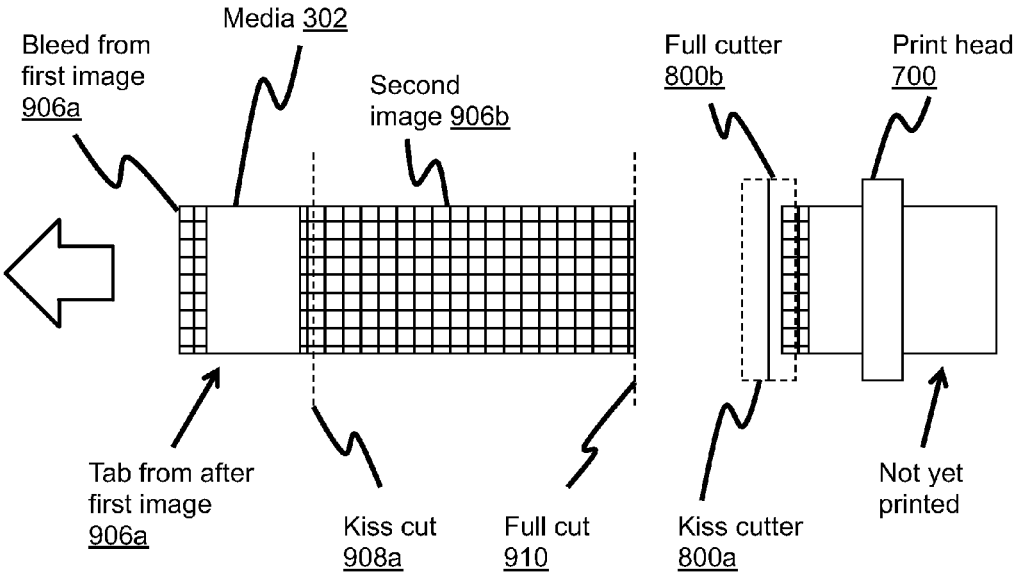

Thus, as shown in FIG. 9B, kiss cuts may be used for full bleed printing when printing several images in series. This may be useful when printing labels or stickers where multiple images will be printed. However, it may not always be desired to print multiple images. Accordingly, a full cut may be used in place of cut 908*b*, releasing first image 906*a*, and creating a tab for full-bleed printing of the next image. FIGS. 9C and 9D are diagrams of media illustrating an embodiment of full bleed printing via full cuts. As shown in FIG. 9C, the process for printing a first image 906*a* may be the same as the process illustrated in FIG. 9B. The media may be advanced and a first kiss cut 908*a* performed. The media may be retracted to a starting position before the kiss cut, and the first image 906*a* may be printed. After printing, the media may be advanced such that the end of the image 906*a* is just before the full cutter 800*b*, and the media may be cut with a full cut 910 and ejected from the printer. To print a subsequent image, as shown in FIG. 9D, the process may repeat. The tab beyond the first kiss cut 908*a*, blank in FIGS. 9B and 9C, may include the bleed from the first image 906*a* left by the full cut in FIG. 9C. Accordingly, waste of media may be reduced, while still enabling full-bleed printing.

Figure 9E:
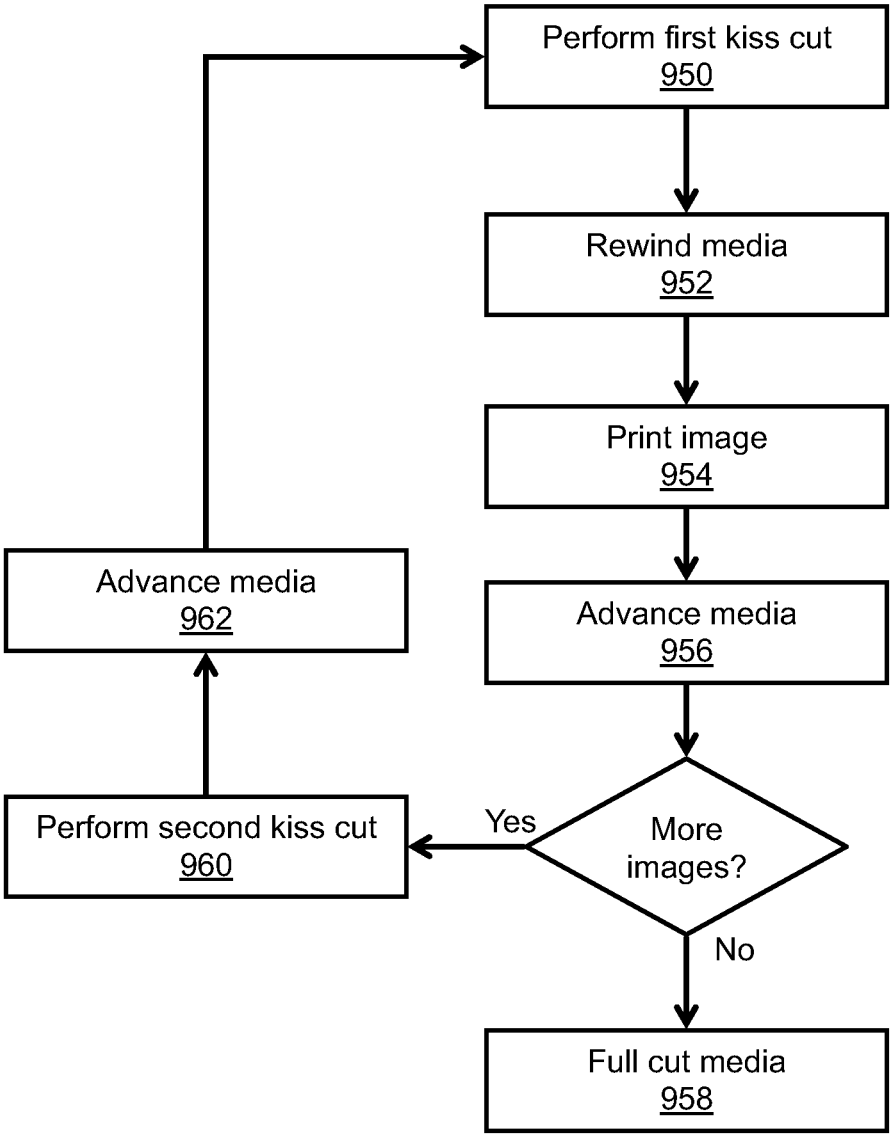
FIG. 9E is a flow chart of an embodiment of a method of full bleed printing.

FIG. 9E is a flow chart illustrating a method of full bleed printing as discussed above. At step 950, the printer may perform a first kiss cut. The printer may advance the media beyond the print head to a predetermined distance to perform the kiss cut, such as the distance between the print head and the kiss cutter. In some embodiments, the printer may advance the media an additional distance over the distance between the print head and the kiss cutter. This may be done to ensure that the media may be retracted so that the kiss cut is past the print head, without the end of the media reaching the print head. In other embodiments, the media may be advanced a distance less than a distance between the print head and kiss cutter to allow for a retraction distance to move the kiss cut beyond the print head. In yet another embodiment, the printer may detect the end of the media and perform the kiss cut at a predetermined distance from the end of the media.

At step 952, the media may be rewound or retracted so that the print head is positioned at a point before the kiss cut. This will allow printing of the image to begin prior to the kiss cut and overlap the kiss cut, ensuring full bleed printing. The retraction distance may be greater than the distance between the kiss cutter and the print head. In many embodiments, a portion of the media may still be under the print head after retraction, allowing printing without concern about binding or catching against the print head or platen.

At step 954, the printer may print the image. The image may be of any length, and may be dynamically adjusted. For example, as discussed in more detail below, an image may have dimensions of width a and length b, defining an aspect ratio of a:b. Responsive to the width a of media in a cassette inserted into the printer, the length b may be dynamically adjusted to maintain the aspect ratio, allowing the same image to be printed without distortion on any size of media. The image may be text and/or graphics, and may be black and white and/or color.

At step 956, after printing the entire image, the printer may advance the media. The printer may advance the media by a distance less than the distance between the print head and a cutter, such as a kiss cutter or full cutter. This ensures that the cutter will cut through a printed region of the media, ensuring full bleed printing. For example, if there are no subsequent images queued for printing on the same length of media, at step 958, the printer may perform a full cut on the media. Accordingly, at step 956, the printer may advance the media to a distance less than the distance between the print head and the full cutter. Conversely, if there are subsequent images to be printed, then at step 956, the media may be advanced to a distance less than the distance between the print head and the kiss cutter. In both instances, the distance may be a predetermined distance less than the distance between the print head and the corresponding cutter, such as 1 millimeter less, 2 millimeters, or any other value.

As discussed above, if there are no subsequent images to be printed, then at step 958, the media may be fully cut, and the cut segment may be ejected from the printer. Alternately, if there are subsequent images to be printed, then at step 960, the printer may perform a second kiss cut. The media may then be advanced at step 962 by a second predetermined distance to create the tab, as discussed above. The second predetermined distance may be quite small, as a large tab may not be needed between images. Rather, in such instances, the tab may be used merely to provide separation between the kiss cuts to prevent bleed from the first image from interfering with the second image (and preventing bleed from the second image from interfering with the first image). Steps 950-962 may be repeated iteratively for additional prints.

As discussed above, in many embodiments, media cassettes may be provided in various widths, background colors, may have precut lengths, pre-printed borders or label elements, or may include other features. In practice, a user may remove and replace cassettes either when empty of media or while still partially full, to utilize a different width or type of media. Typically, printer heads are in fixed positions relative to the path of media as it advances through the printer from the cassette. Other implementations of printers may have heads that may move across a predetermined path relative to the media, and while having variable positions, may still require alignment with the media. For example, to print properly aligned images with the media (for example, for printing from edge to edge, known as "full bleed" printing), the relative positions of the media and the printing heads must be tightly controlled.

Figure 10A:
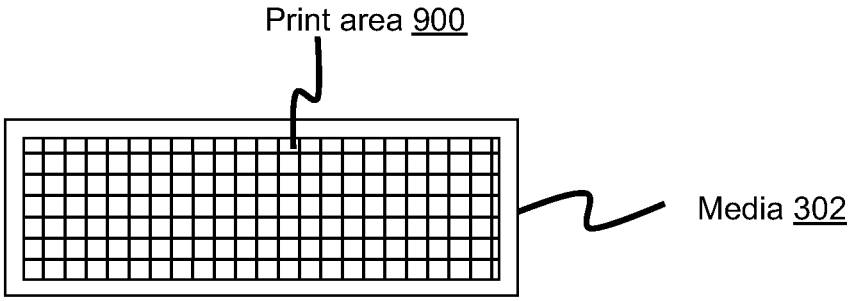
FIG. 10A is a diagram of examples of bordered, full bleed, and misaligned full bleed printing.
Figure 10A:
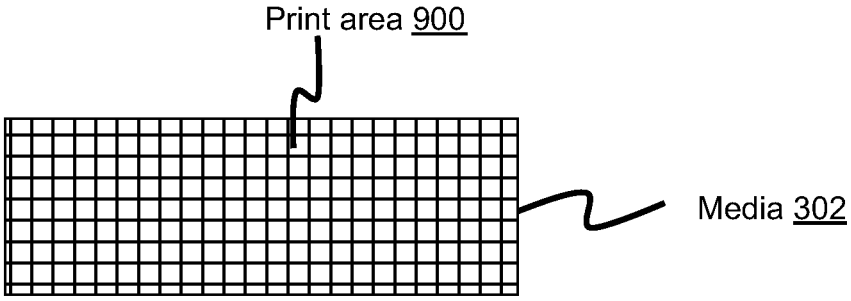
Figure 10A:
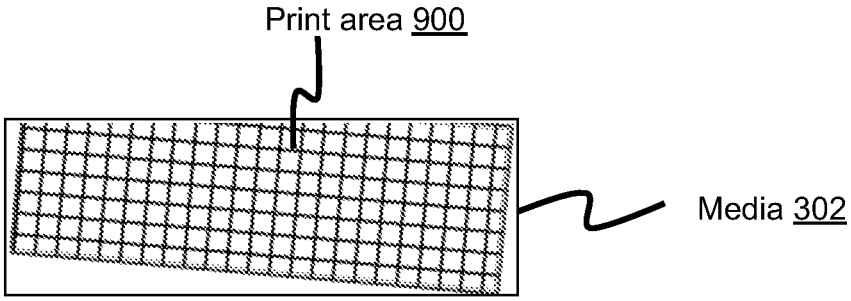

Referring now to FIG. 10A, illustrated is a diagram of examples of (a) bordered, (b) full bleed, and (c) misaligned full bleed printing. Bordered printing involves printing a print area 900 in an area smaller than the area of the media 302. Bordered printing is frequently the result of design constraints, such as the need to have media 302 gripped by rollers, guides, or other mechanisms at an edge prior to printing, or where a print head is smaller than the width of the media 302. Full-bleed or borderless printing allows the print area 900 to extend to the edges of the media 302. In some embodiments, full-bleed printing may be accomplished by trimming a border from a bordered print, by removing a center portion of a printed label or image, or other such methods. In other embodiments, full-bleed printing may be accomplished by moving a print head across the width of the media as the media is advanced, as is typical in ink jet printers, or by having a print head with a length greater than the width of the media, such as in some embodiments of direct thermal printers.

Printing full-bleed images across the width of media, and particularly media that may be significantly smaller than the width of the print head, may require control over lateral displacement of the media and/or control over displacement of the print image within the print head. For example, with a two inch print head and half-inch media, the media may be centered on the print head, or may be displaced from center by a significant amount due to slipping in the transport, misalignment, or other variations. As shown and exaggerated for clarity, with misaligned full bleed printing, the print area 900 may extend off the media 302, resulting in unintentional printing on the platen or other surfaces in inkjet, die diffusion thermal transfer, or similar systems, and misalignment of the image on the media 302. The media may be rotated as shown, and/or may be laterally offset, resulting in an unprinted edge. Similarly, in thermal printing, misalignment may result in undesirable heating of the platen, or heating of print elements that are not in contact with and able to dissipate heat into the media, resulting in higher print element temperatures than desired.

A mechanical solution to this alignment or tracking problem, such as guide rails for the media, may be difficult to implement if the printer has to deal with different size cassettes with multiple media widths and frequent swapping of these cassettes by the user. The usual solution of having a fixed width edge guide to steer the media as it is transported from the opening of the cassette to the print-head to the exit chute is not possible in such scenarios. Variable width edge guides that adjust to the width of the inserted media cassette may not be feasible to implement in an inexpensive printer and do not eliminate the problem completely. Furthermore, manufacturing tolerances in the slitting of the media and the printer parts that mate with the cassette also make it impractical for a purely mechanical solution to be effective.

If the tracking of the media is not controlled at it passes under the print-head, the printed image will move with respect to the edges of the media. For full bleed images, this leads to a loss of image content near one edge or the other. For other label images with a frame around the central content, the variable placement with respect to the media edges is readily noticeable to the user and results in unacceptable quality prints. One solution is to track the edge of the media as it passes under the print-head and then electronically shift the image such that the relative position of the image with respect to the edges of the media stays constant. This requires a dedicated sensor that is dynamically positioned as a new cassette is loaded by the user. The dedicated sensor and its variable positioning leads to increased hardware cost and makes this a less desirable option.

Instead of expensive dedicated sensors, inexpensive sensors may be employed with the use of a tracking pattern that is preprinted on media. Specifically, a pattern may be printed on the back side of the media that may comprise distinct features at angles to each other, such as horizontal and diagonal lines of a "Z" pattern. A sensor such as an optical media-detect sensor may register the distinct features of the pattern as the media is translated along the print path. As the sensor traverses the length of the media, the distance between the distinct features of the pattern varies continuously. The difference of this distance encodes the cross-web position of the media as it passes under the sensor while their sum provides invariance to the translation speed v of the media.

Figure 10B:
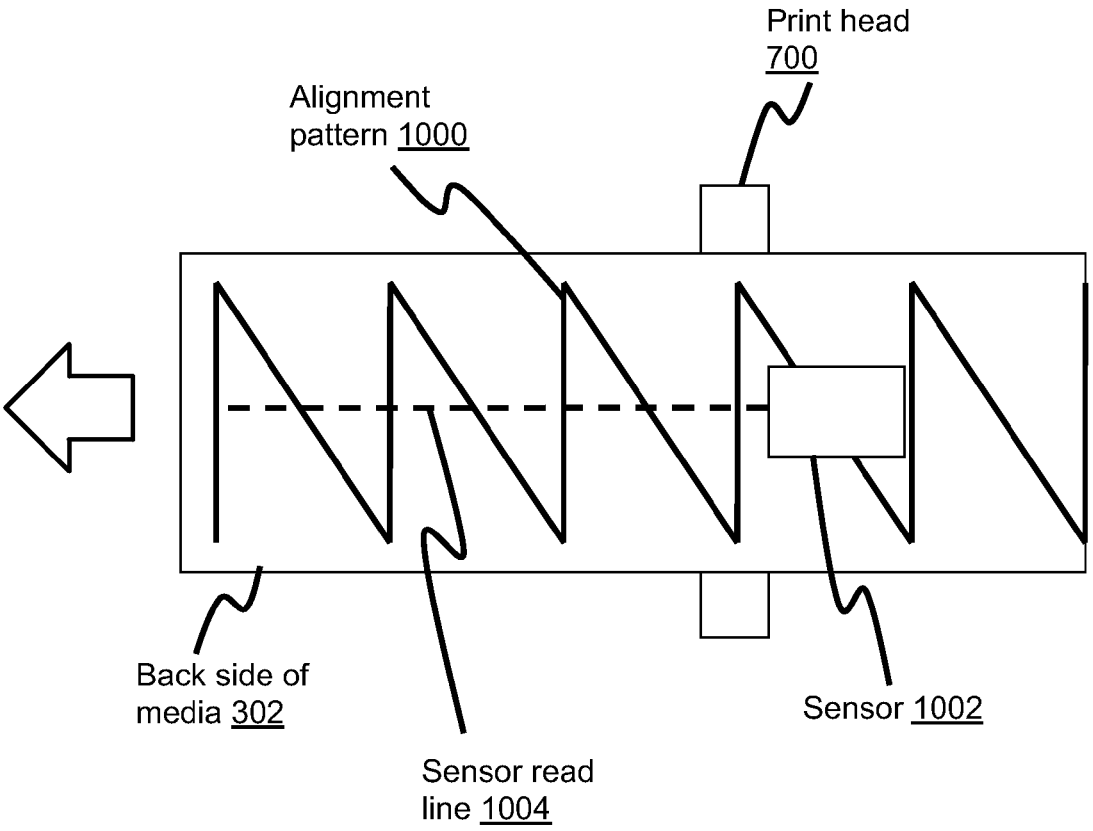
FIG. 10B is a diagram of an embodiment of an alignment pattern and system for dynamically aligning a printed image on a printing medium.

Referring now to FIG. 10B, illustrated is an embodiment of such an alignment pattern 1000 and sensor 1002 for dynamically aligning a printed image on a printing medium. The alignment pattern 1000 may be printed on the media during manufacture, and may comprise a saw tooth or Z-shaped pattern, a V-shaped pattern, an X-shaped pattern, or any other pattern with at least two non-parallel lines or segments. Although shown as solid lines, the pattern may include open lines or shapes, symbols, dashed lines, colored lines, or any other type and form of patterns. The pattern may comprise a visible or optically detectable pattern, or may comprise a magnetically detectable pattern (such as via a ferrous material impregnated in the substrate of the media), an ultra-violet luminescent pattern, or any other type of pattern. Correspondingly, sensor 1002 may comprise an optical sensor, a magnetic sensor, a capacitive sensor, a Hall effect sensor, or any other type and form of sensor, and may include components for exciting alignment pattern 1000 for detection.

Figure 10C:
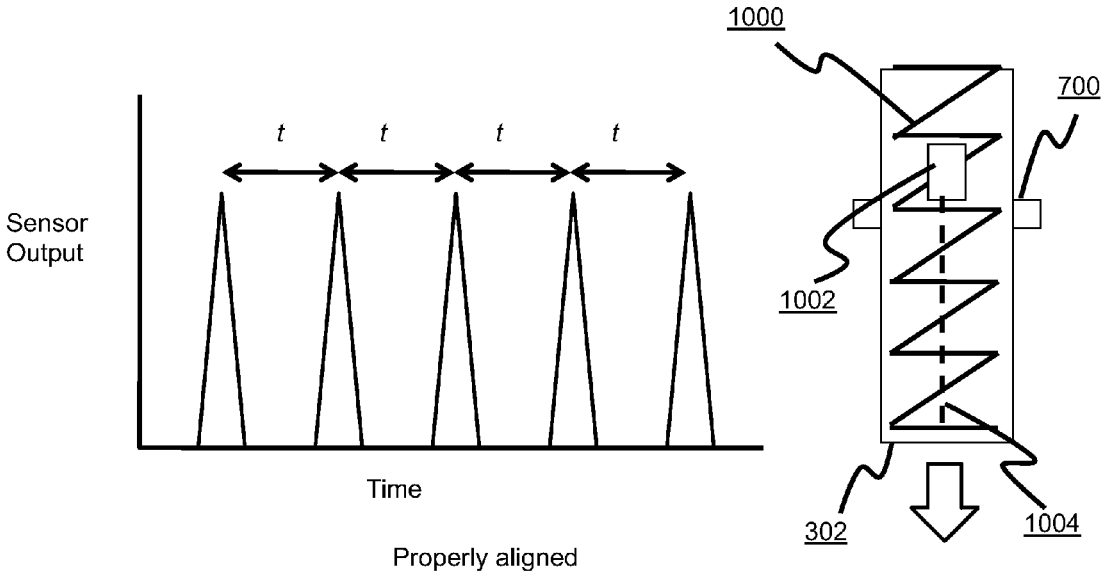
FIGS. 10C and 10D are diagrams illustrating sensor outputs detecting alignment patterns of properly aligned and misaligned media, respectively.

As shown, as the media passes the sensor 1002, the sensor may detect printed and non-printed areas of the pattern along a straight read line 1004. Referring now to the graph of FIG. 10C, with the media traveling at a constant speed during printing and properly aligned, the sensor will detect a consistent pattern. With the Z-shaped alignment pattern 1000, the sensor output will show peaks with constant frequency as shown. Other patterns may produce other patterns of peaks, but will have similar detectable output patterns indicating alignment. Although discussed in terms of time, because the media is traveling at a constant speed, the sensor output may also measure sensor output along a distance or length of media.

Figure 10D:
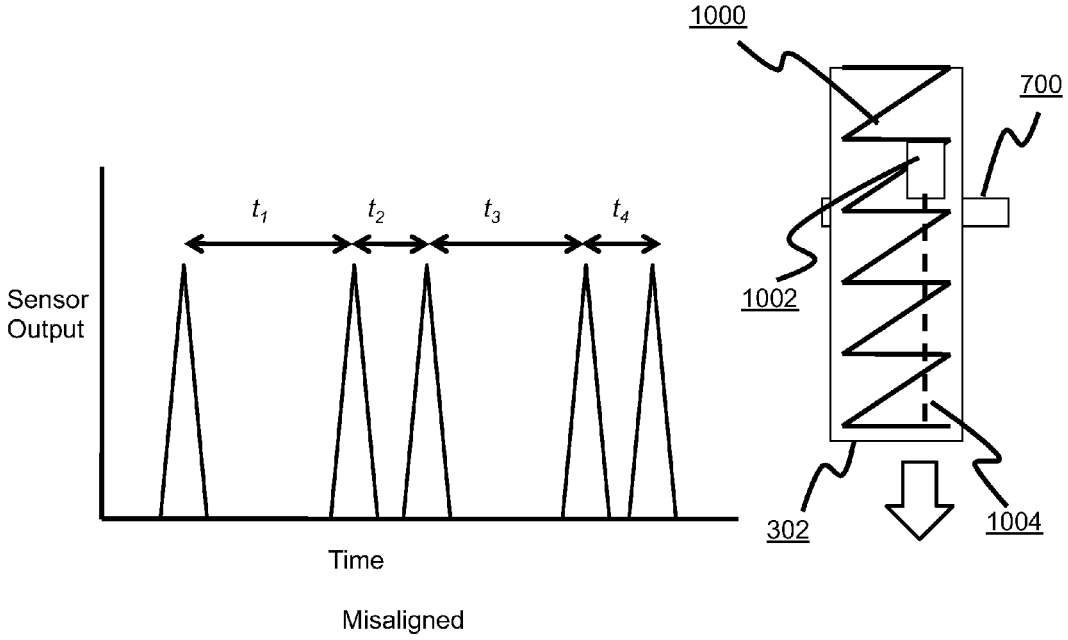

Conversely, with the media out of alignment as shown in FIG. 10D, the sensor output will show peaks with varying frequency or with unequal temporal spacing. The difference $t_1-t_2$ (or an average of the differences) can be proportional to an offset distance from the aligned position, and thus may be used to determine an offset of the media in pixels, millimeters or other dimensions. During printing, the difference or average time difference may be continuously monitored and the printer may adjust the output of the print head (e.g. adjusting a pulse stream sent to resistive heaters of a print head to shift the pulses to other resistive heaters that are laterally displaced an amount corresponding to the shift of media, or directing a print head motor moving an ink jet print head to adjust the start position of each line of the image) to ensure that the output image is centered on the media.

Figure 10E:
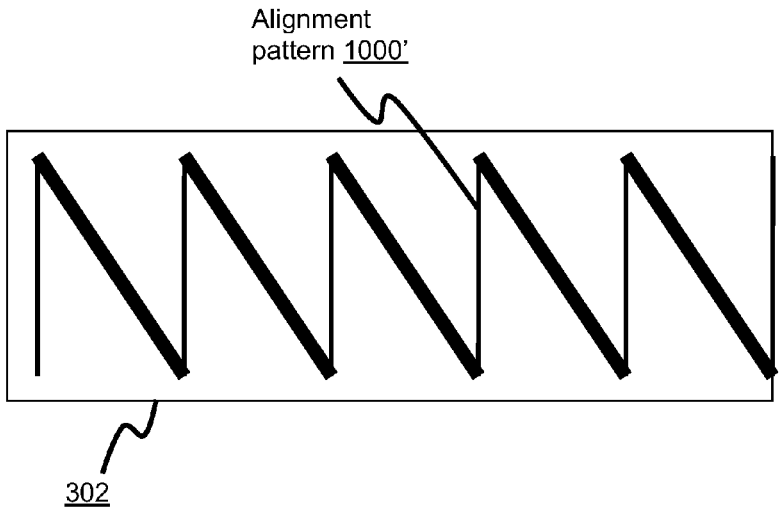
FIGS. 10E and 10F are diagrams illustrating another embodiment of an alignment pattern and sensor output.
Figure 10F:
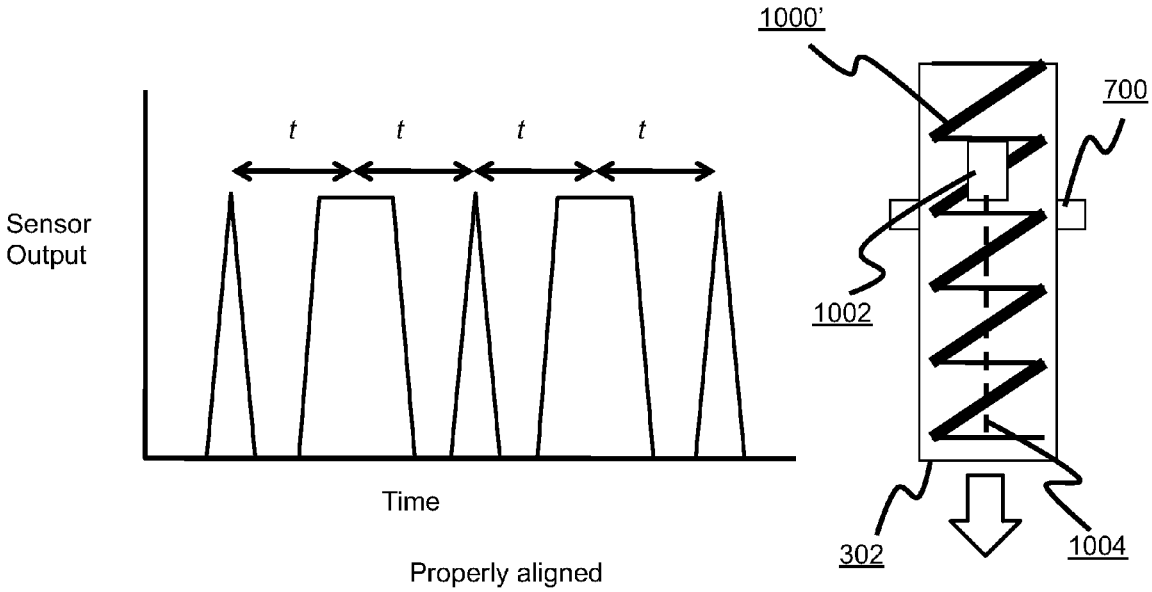

Due to the symmetry of lines in the example pattern used for FIG. 10D, while the absolute value of the difference $t_1-t_2$ may be proportional to the lateral displacement of the media, the displacement can be to the left or the right, if the sensor output cannot be used to directly distinguish horizontal lines from diagonal lines, for example. Accordingly, in some embodiments, an alignment pattern may include different sizes of lines or otherwise distinct lines to allow an alignment system to distinguish between a lateral displacement in one direction and a lateral displacement in another (e.g., opposite) direction. For example, FIGS. 10E and 10F are diagrams illustrating such an alignment pattern 1000' and the corresponding sensor output, respectively. As shown, alignment pattern 1000' may include diagonal lines that are wider than horizontal lines. The sensor may have a longer sustained output for the diagonal lines as shown, or in some embodiments may have a higher amplitude output for the diagonal lines. Accordingly, a positive difference $t_1-t_2$ may indicate an offset in one direction and a negative difference $t_1-t_2$ may indicate an offset in the opposite direction.

Figure 10G:
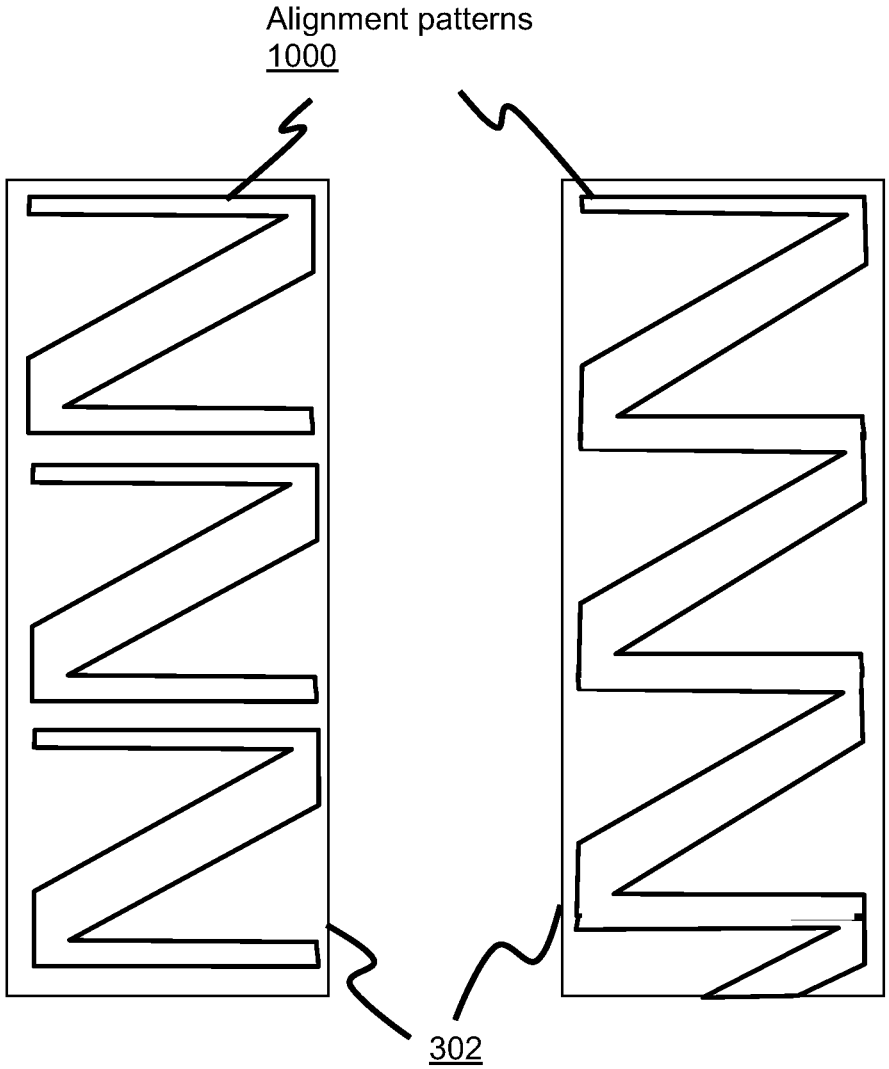
FIG. 10G is a diagram of yet another embodiment of an alignment pattern.

Other alignment patterns may be used incorporating the above features. For example, FIG. 10G illustrates examples of other embodiments of alignment patterns 1000. Other alignment patterns may include manufacturer identification or codes, branding, or other designs. For example, a manufacturer may make a cassette with memory storing templates and image elements for stickers involving a superhero, and the alignment pattern may comprise an image of the superhero in flight along a diagonal direction or a logo along another diagonal or horizontal direction. In some embodiments, any figure with a pattern such that every line or slice along the direction of travel of the media is unique may be used to directly determine a lateral offset of the media, as a sensor reading each slice will output a different and distinct output signal. The sensor output may be less stable than with a continuous black line, but still easily detectable compared to a white or neutral surface of the alignment pattern.

Figure 10H:
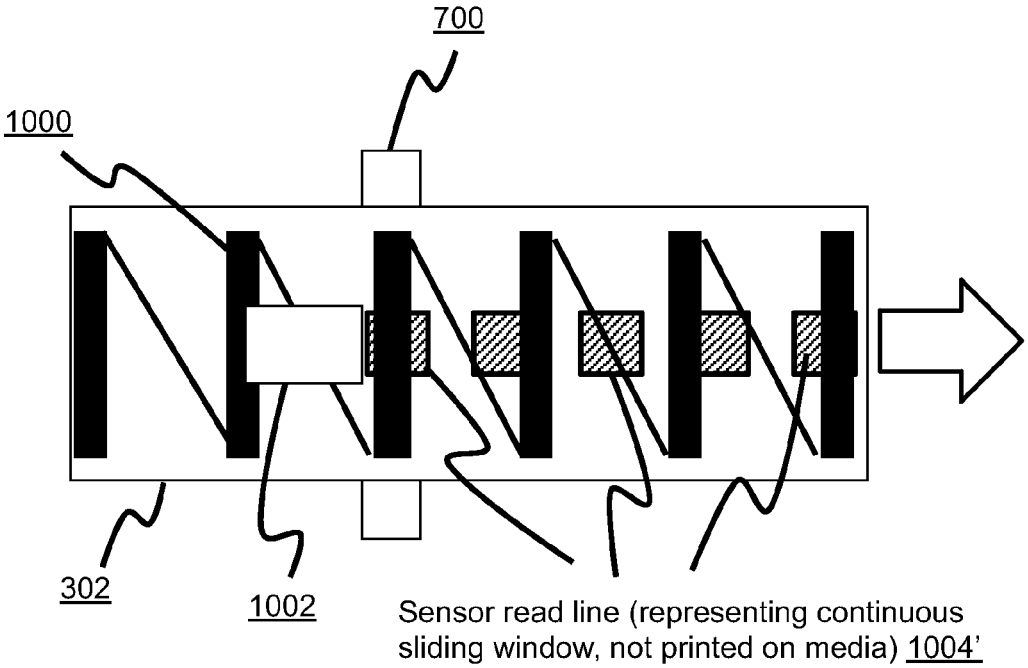
FIG. 10H is a diagram illustrating sensor outputs with a sensor aperture larger than an alignment pattern feature.
Figure 10H:
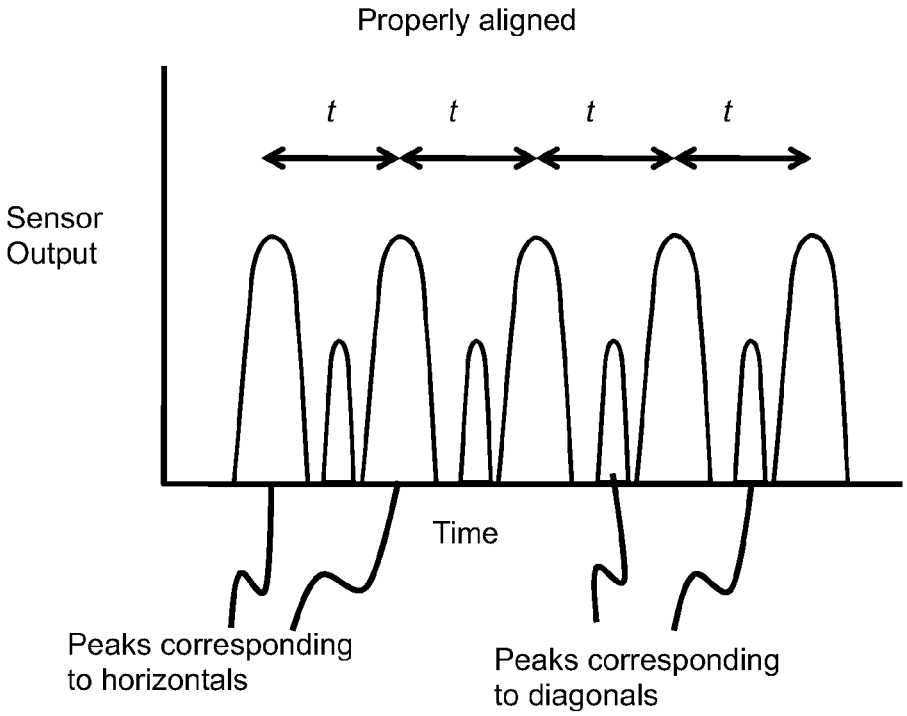

In many embodiments, a sensor 1002 may have an aperture larger than an alignment pattern feature. For example, an alignment pattern 1000 may include lines of, for example, 1 mm in width. However, an optical sensor with an aperture of, for example, 5 mm, may be used in some embodiments. Accordingly, in such embodiments, the sensor will not reach full saturation during scanning Illustrated in FIG. 10H is a diagram illustrating sensor outputs with a sensor aperture (illustrated via large dashed line 1004') larger than an alignment pattern feature. As shown, as the media 302 is moved beneath a window of sensor 1002, the sensor output will climb as more of a dark feature of pattern 1000 is within the window, and fall as the pattern feature is moved beyond the window. Accordingly, the sensor output may rise and fall in a gentler curve than depicted in FIGS. 10C to 10F. The sensor output may be averaged over time, or a derivative of the output may be calculated, to identify peaks representing features of pattern 1000.

As shown, in many embodiments, due to a difference in thickness between horizontal elements and diagonal elements in the alignment pattern and the sensor aperture being larger than pattern elements, amplitude of the sensor output when reading the wider features may be higher than amplitude of the sensor output when reading narrow features. These differences in amplitude may be used to determine whether the sensor is reading a horizontal feature or diagonal feature of the pattern, by identifying whether the amplitude of the sensor output is above or below a threshold. The threshold may be predetermined, or may be dynamically determined based off of average values or a weighted average of one or more previous readings, or other similar algorithms.

Figure 10I:
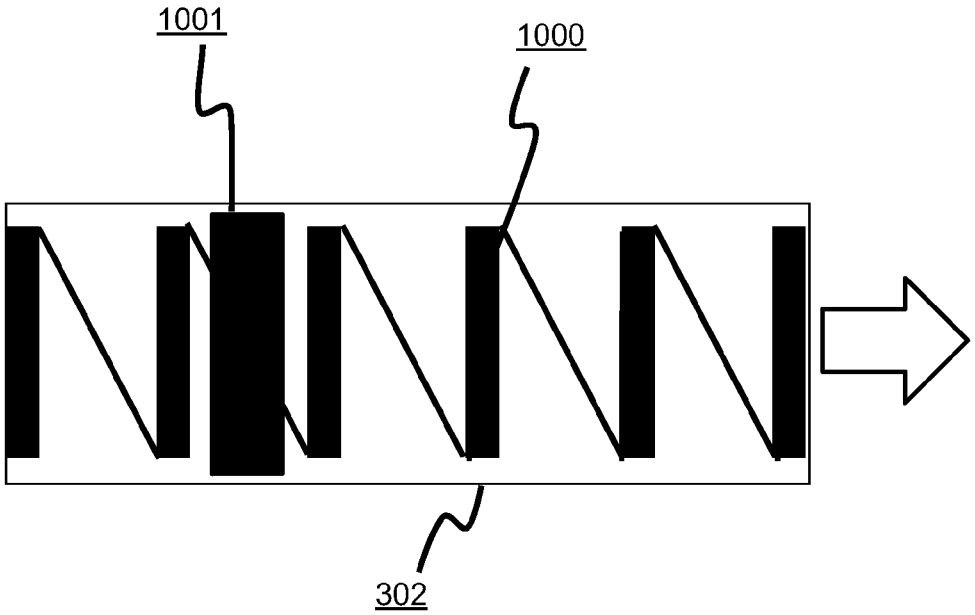
FIG. 10I is a diagram illustrating sensor outputs and end-of-roll detection with a sensor aperture larger than an alignment pattern feature.
Figure 10I:
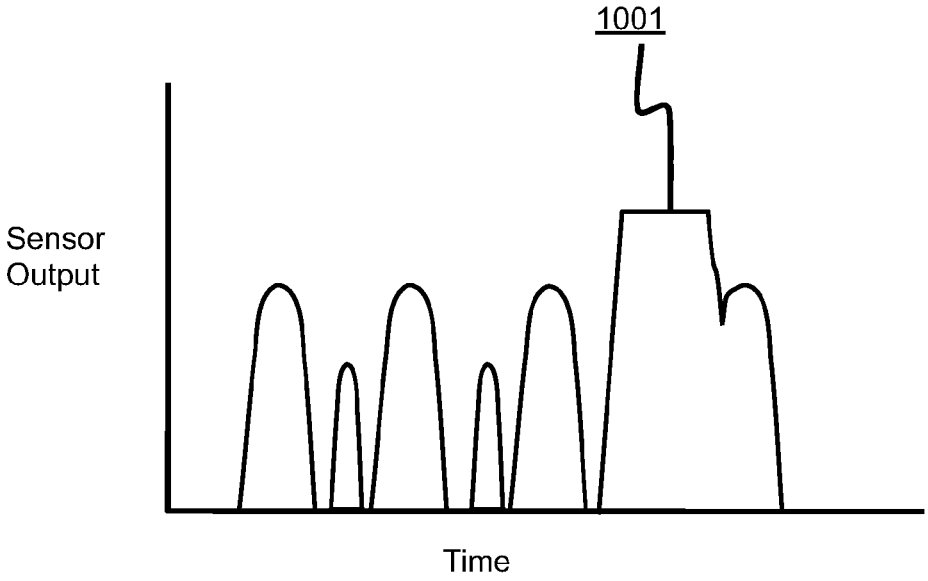

In some embodiments utilizing a sensor with a wider aperture than normal alignment pattern features, an alignment pattern may include a wider feature to represent an approaching end of the roll of media. The printer 100, 200 may use the end of roll detection to prevent printing an image that is longer than the remaining length of blank media. FIG. 10I is a diagram illustrating sensor outputs and end-of-roll detection with a sensor aperture larger than normal alignment pattern features. As shown, an alignment pattern 1000 may include a large feature 1001, such as a wide horizontal band, stripes, a logo, or other pattern that is distinct from other features in the alignment pattern 1000. Feature 1001 may be printed on the roll after the media has been manufactured, during cutting of a large length of media to proper size for each cassette. Accordingly, feature 1001 may be asynchronous with alignment pattern 1000 and may be printed at a predetermined position from the end of the cut media. The feature 1001 may be larger than the sensor aperture, or may be smaller than the sensor aperture but larger than other alignment features in the pattern 1000, such that the sensor is fully saturated and/or the sensor output is higher when scanning the feature 1001 than when scanning other features.

Figure 11A:
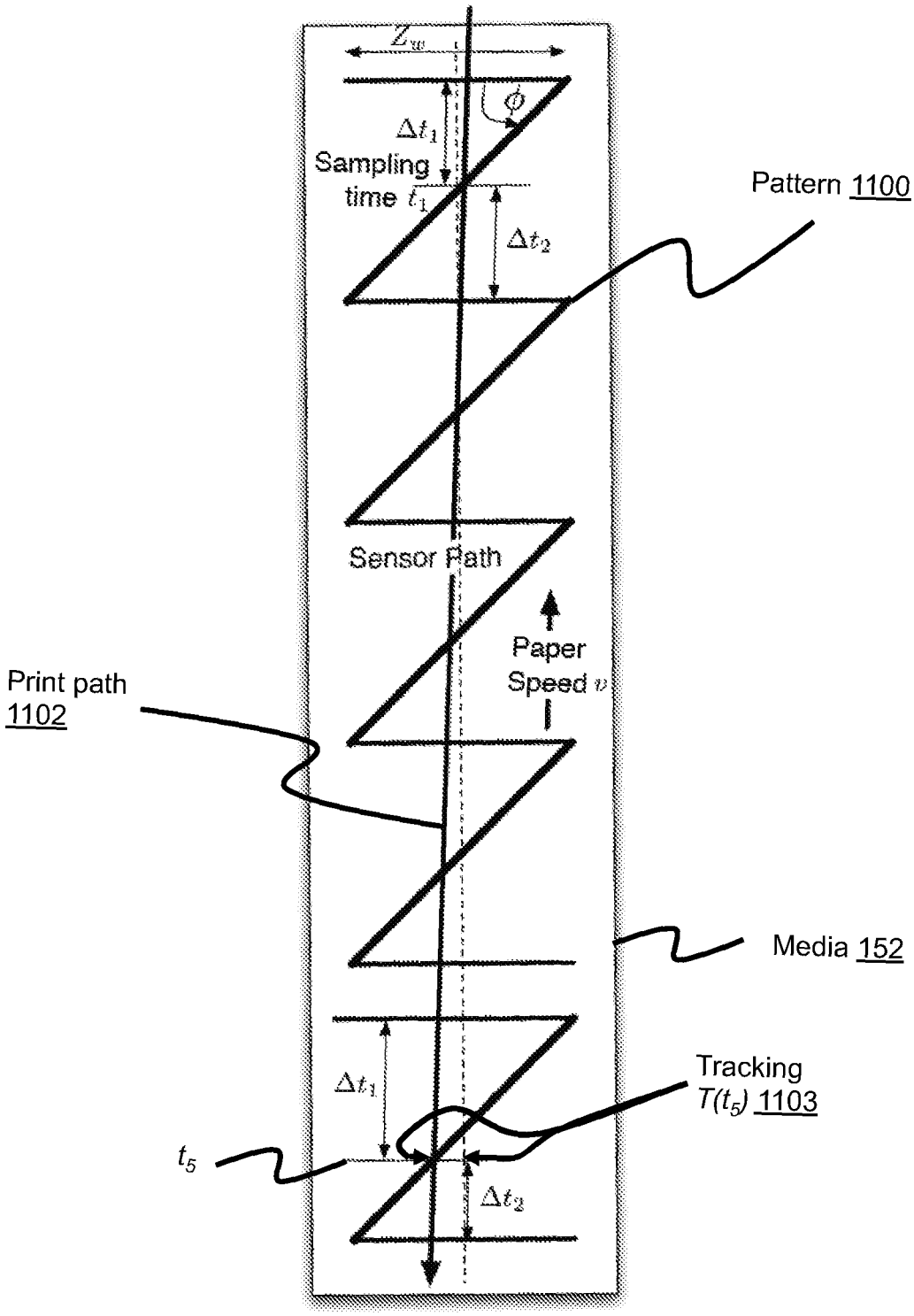
FIG. 11A is an illustration of an embodiment of a media tracking pattern.

To further illustrate media and printing alignment, FIG. 11A illustrates an exemplary embodiment of a pattern 1000, specifically example pattern 1100 in a "Z" shape centered on the back of the media for tracking purposes. Although shown in a Z pattern, any other pattern can be used with a first line or section distinct from a second line or section. A sensor such as an optical paper-detect sensor (not illustrated) may register the horizontal and diagonal lines of the "Z" pattern as the media is translated along the print path 1102. In the example shown, the media 302 is skewed with respect to the normal transport direction by 2 degrees. As the media deviates from the center of the print path, the distance between each pair of consecutive horizontal and diagonal lines changes. Specifically, when the media is centered under the sensor and the pattern 1100 is centered on the media, the distance between a first horizontal line and a diagonal line, and the distance between the diagonal line and a second horizontal line, are equal. Although discussed in terms of distance, this distance may also be interpreted as a time, such that when the media is travelling at a constant speed and the media and pattern are centered, the time between sensor readings of the first horizontal line and diagonal line, and the diagonal line and the second horizontal line, are equal. When the media is offset, as shown in FIG. 11A, however, these distances or times will no longer be equal: a large distance or time between a first horizontal line and diagonal line will be followed by a correspondingly short distance or time between the diagonal line and the second horizontal line, or vice versa. The difference of these distances or times is proportional to the cross-web position of the media as it passes under the sensor, and may be used to detect skew or translation. Advantageously, the sum of these distances is insensitive to offset and skew (if the skew is small), and may be used to determine or verify the speed v of the media. As shown in FIG. 11A, in some embodiments, different line thicknesses may be used for the horizontal and diagonal line to facilitate their classification, discussed in more detail below.

Let $\Delta t_1$ and $\Delta t_2$ denote the time elapsed between registering a horizontal line followed by a diagonal line and a diagonal line followed by a horizontal line respectively. Although measured as a series of discrete values upon reading each line, $\Delta t_1$ and $\Delta t_2$ may be thought of as points on a smooth time-dependent curve. Thus, for example, tracking T(t) 1103 (such as the illustrated distance between horizontal arrows $T(t_5)$ 1103 at $t_5$) represents the cross-web distance between the center of the print-head (or location of the sensor) and the center of the "Z" pattern, and may be determined directly at points corresponding to detected lines, or may be interpolated at any point (e.g. $t_5$) based on the smooth time-dependent curve. Letting $Z_w$ represent the width of the "Z" pattern 1100 and $\phi$ represent the angle between the horizontal and diagonal line, the value of T(t) can be computed from the geometry of the pattern as follows:

$$\begin{aligned} T(t) &= \bar{v}(t)\Delta t_2\cot(\phi) - \frac{1}{2}Z_w \\ &= \frac{Z_w\tan(\phi)}{\Delta t_1 + \Delta t_2}\Delta t_2\cot(\phi) - \frac{1}{2}Z_w \\ &= \frac{Z_w}{2}\frac{\Delta t_2 - \Delta t_1}{\Delta t_1 + \Delta t_2} \end{aligned} \quad \text{Eq. (1)}$$

where $\bar{v}(t)$ is the average media speed computed using the time needed to traverse the length of the "Z". Note that the tracking is defined to be positive when the media tracks to right looking from the print side of the media with its leading edge on the top. The maximum tracking range obtained by this pattern is $\pm Z_w/2$ although in practice it is reduced by the size of point spread function (PSF) of the optical sensor since the horizontal and diagonal lines will not be resolved at the extreme ends. The angle $\phi$ does not explicitly appear in the final expression of Eq. (1) but its effect can be analyzed by computing the tracking given a constant media speed $\bar{v}$ independent of time t. In this case, $$T(t) = \frac{1}{2}\bar{v}\cot(\phi)(\Delta t_2 - \Delta t_1) \quad \text{Eq. (2)}$$

Let $\delta x$ denote the root-mean-square (RMS) noise in determining the location of the individual lines of the "Z". Eq. (2) may then be used to determine the RMS noise $\delta T$ and the signal-to-noise ratio (SNR) of the tracking signal:

$$\delta T = \sqrt{\frac{3}{2}}\,\delta x\cot(\delta\phi)(\Delta t_2 - \Delta t_1) \quad \text{Eq. (3)}$$

$$SNR = \frac{T}{\delta T} = \sqrt{\frac{2}{3}}\,\frac{T}{\delta x}\tan(\phi)$$

SNR scales with $\tan(\phi)$, such that small values of $\phi$ result in reduced SNR for the tracking signal. However, small values of $Z_w\tan(\phi)$ increase the sampling frequency of the tracking, yielding a better reconstruction of the dynamic tracking when it is quickly varying. Accordingly, there is a design trade-off, in which both $\phi$ and $Z_w$ are design parameters controlling a balance between tracking range, dynamic reconstruction, and SNR.

Let y denote the signal amplitude measured by the optical sensor. Although the measurements are made in time as the media moves by the sensor, the measurements may also be represented as functions of distance down the media x. Accordingly, y(t) and y(x) may be used interchangeably assuming $x=\bar{v}t$, where $\bar{v}$ is average speed of the media transport, to convert between time and distance.

Figure 11B:
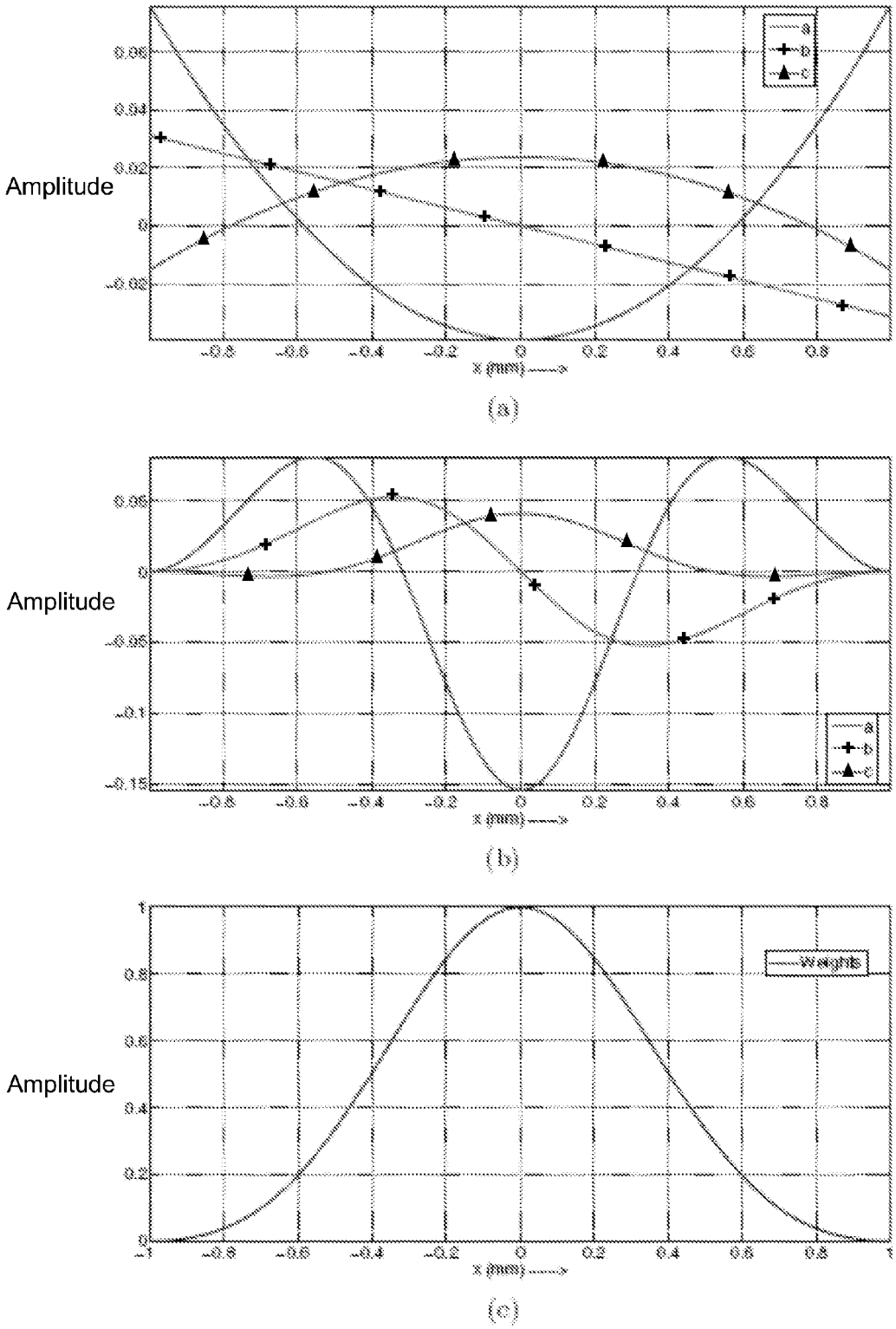
FIG. 11B depicts plots of exemplary embodiments of finite impulse response filter coefficients and a Blackman window weight graph for an embodiment of a media tracking system.
Figure 11C:
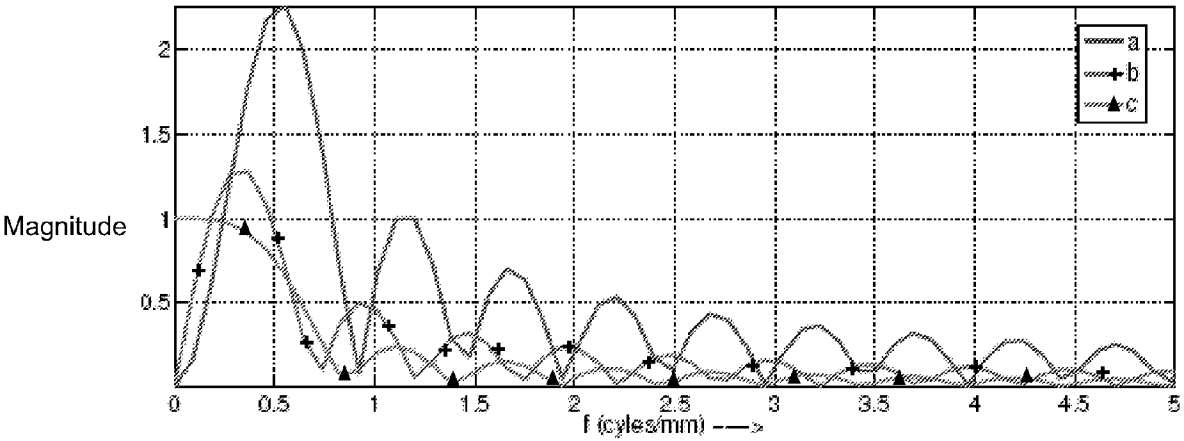
FIG. 11C depicts plots of exemplary embodiments of frequency response of unweighted and weighted filters of a media tracking system.
Figure 11C:
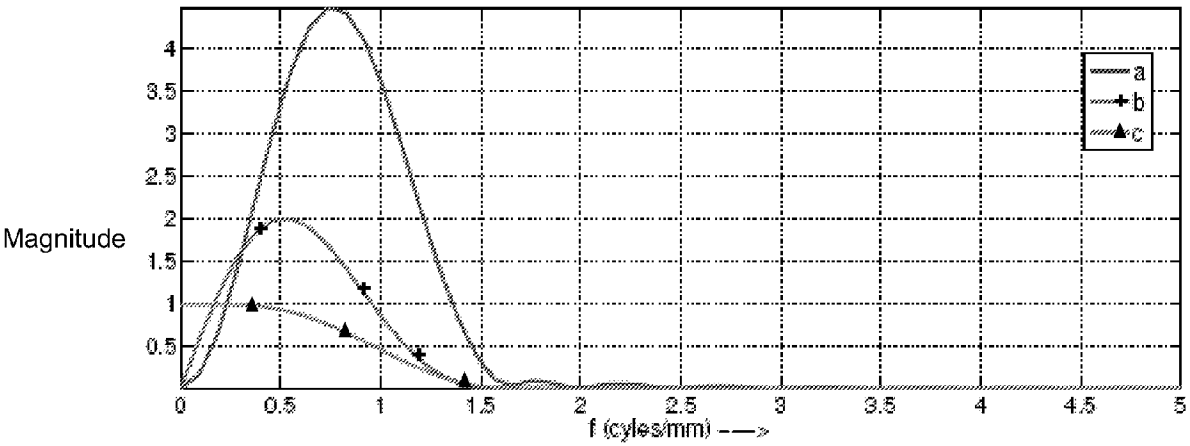
Figure 11D:
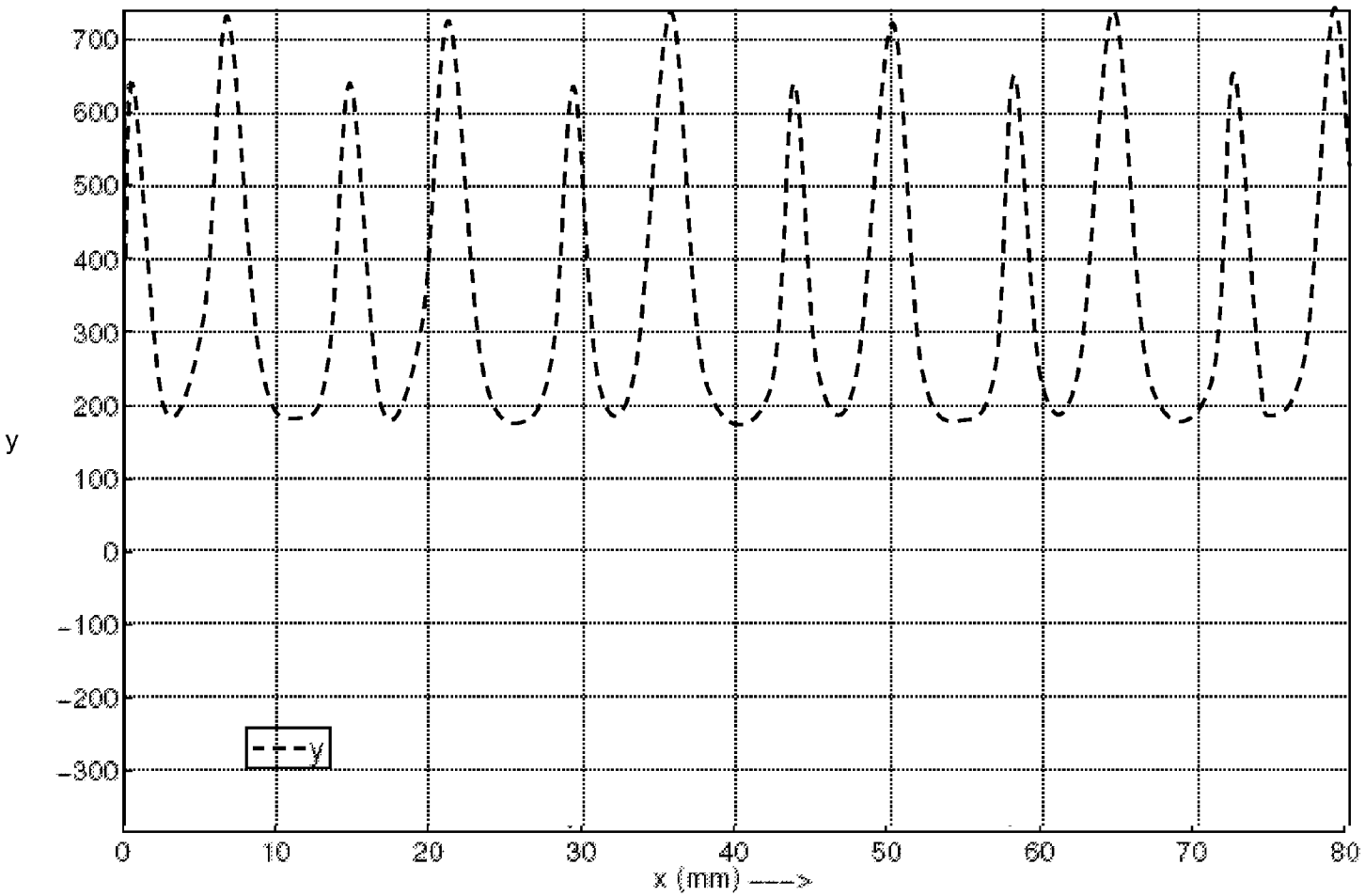
FIGS. 11D and 11E are plots of an example of sensor output during tracking of media utilizing an embodiment of a media tracking pattern, and the results of filtering operations performed on the sensor output.

Referring briefly ahead, FIG. 11D illustrates a typical trace y recorded by the sensor (dashed line). There are peaks in the amplitude of the measured signal when the sensor passes over the horizontal and diagonal lines of the Z's printed on the media 302. The following discussion deals with modeling the signal in the vicinity of these peaks, detecting and localizing the peaks, classifying them into horizontal or diagonal lines, and computing and predicting the dynamic tracking of the media as it passes under the head.

Signal Model

In many embodiments, the signal from the sensor may be digitized to form a stream of digital samples representative of the sensor output. In the presence of noise, detecting the peaks by simply comparing the value of each sample to its immediate neighbors to determine a local maxima is not robust. Instead, in some embodiments, a model is employed to smooth out the measurements facilitating a robust detection and localization of the peaks. Let $q(\bullet,x_0)$ denote a second order polynomial around location $x_0$ given as $$q(x,x_0)=a(x_0)(x-x_0)^2+b(x_0)(x-x_0)+c(x_0) \quad \text{Eq. (4)}$$

The coefficients a(•), b(•), and c(•) are parameters of the polynomial and are adjusted for each location $x_0$ such that $$y(x)\approx q(x,x_0), x\in \mathcal{N}(x_0) \quad \text{Eq. (5)}$$

where $\mathcal{N}(x_0)$ denotes a set of x values in the local neighborhood of $x_0$. Using Eqs. (4) and (5), the polynomial coefficients can be interpreted as $$a(x_0) = \frac{1}{2}\frac{d^2 q(x, x0)}{dx^2}\bigg|_{x=x_0} \approx \frac{1}{2}\frac{d^2 y(x)}{dx^2}\bigg|_{x=x_0} \quad \text{Eq. (6)}$$

$$b(x_0) = \frac{d q(x, x0)}{dx}\bigg|_{x=x_0} \approx \frac{d y(x)}{dx}\bigg|_{x=x_0} \quad \text{Eq. (7)}$$

$$c(x_0) = q(x_0, x_0) \approx y(x_0) \quad \text{Eq. (8)}$$

Therefore $c(x_0)$ may be considered the smoothed modeled value of the measurement at $x_0$, $b(x_0)$ the first derivative, and $a(x_0)$ half of the second derivative of the model curve. The model may be accordingly described as a truncated Taylor series representation of the measurements. Enforcing the relationship of Eq. (5) in a least-squares sense, the estimation of the coefficients at each location $x_0$ is given as $$\{\hat{a}(x_0), \hat{b}(x_0), \hat{c}(x_0)\} = \min_{a,b,c} \sum_{x\in N(x_0)} (y(x) - a(x_0)(x - x_0)^2 - b(x_0)(x - x_0) - c(x_0))^2 \quad \text{Eq. (9)}$$

Let $\Delta x$ denote the sampling interval in x for the measurements. The neighborhood $\mathcal{N}(x_0)$ is defined to be 2N+1 samples around $x_0$, i.e., $$\mathcal{N}(x_0)=\{x:|x-x_0|\leq N\Delta x\} \quad \text{Eq. (10)}$$

Then the least-squares solution to Eq. (9) can be written in closed form as $$\begin{pmatrix} \hat{a}(x_0) \\ \hat{b}(x_0) \\ \hat{c}(x_0) \end{pmatrix} = (A^t A)^{-1} A^t \vec{y}(x_0) \quad \text{Eq. (11)}$$

where the matrix A is given as $$A = \begin{pmatrix} (N\Delta x)^2 & -N\Delta x & 1 \\ \vdots & \vdots & \vdots \\ \Delta x^2 & -\Delta x & 1 \\ 0 & 0 & 1 \\ \Delta x^2 & \Delta x & 1 \\ \vdots & \vdots & \vdots \\ (N\Delta x)^2 & N\Delta x & 1 \end{pmatrix} \quad \text{Eq. (12)}$$

and the vector $\vec{y}(x_0)$ contains the local sampling of y $$\vec{y}(x_0) = \begin{pmatrix} y(x_0 - N\Delta x) \\ \vdots \\ y(x_0 - \Delta x) \\ y(x_0) \\ y(x_0 + \Delta x) \\ \vdots \\ y(x_0 + N\Delta x) \end{pmatrix} \quad \text{Eq. (13)}$$

To obtain the smoothed measurements and its derivatives given by Eqs. (6)-(8), an efficient method is needed to compute the solution of Eq. (11) at every location. Towards this end, note that the matrix $$F=(A^t A)^{-1} A^t \quad \text{Eq. (14)}$$

is independent of the location $x_0$ and therefore only needs to be computed once and stored for subsequent use. Also, even though the data model is non-linear in x, the solution is linear in the measurements and is obtained by a dot-product of the rows of the matrix F with a sliding window of the measurements given by $\vec{y}(x_0)$. This can be implemented as a 2N+1 tap finite impulse response (FIR) filter on the stream of incoming measurements. Additional computational savings result from the fact that the filters are symmetric about their center point by construction. Using this property, each filtered data point can be obtained with only N multiplies and 2N adds.

The FIR filters are obtained from the rows of the matrix F, with each row reversed in the order of elements. Plot (a) in FIG. 11B shows an example of what these filters look like for a 2 mm neighborhood and $\Delta x$=0.021 mm, although other values may be used.

In practice, the quadratic fit to the measurements gets progressively worse as N increases. Consequently, it is desirable to deemphasize the influence of the data points further away from the center point. In some embodiments, this is accomplished by a weighting function that modulates the cost of the error in the least-squares fitting process as a function of distance from $x_0$. This may be referred to as applying a windowing function to the measurements. In one embodiment, a Blackman window is applied for the weights w(•) given as $$w(n) = \begin{cases} 0.42 - 0.5\cos(\pi n/N) + 0.08\cos(2\pi n/N) & 0 \le n \le N \\ w(2N-n) & N+1 \le n \le 2N \end{cases} \quad \text{Eq. (15)}$$

Let W denote the diagonal matrix constructed from the weights $$W = \begin{pmatrix} w(0) & & 0 \\ & \ddots & \\ 0 & & w(2N) \end{pmatrix} \quad \text{Eq. (16)}$$

The filter matrix F for solving the weighted least-squares solution to Eq. (9) may be expressed as $$F=(A^tWA)^{-1}A^tW \quad \text{Eq. (17)}$$

Plot (b) in FIG. 11B shows an example of what the weighted filters look like for the same 2 mm support and using the Blackman window shown in plot (c) of FIG. 11B.

Comparing plots (a) and (b) of FIG. 11B, the weighted filters gradually taper off to zero at the two ends of the fitting region. Since the filtering operation is essentially recomputing the fit to the quadratic function at each sample, the gradual taper helps to smooth out the changes in quadratic coefficients from one sample to the next, making the local fit in one region transition smoothly to the local fit in the neighboring regions. This behavior is corroborated by analyzing the frequency response of the two set of filters. Plots (a) and (b) of FIG. 11C show the frequency response of the unweighted and weighted filters respectively. The unweighted filters have side lobes that extend to the high frequency regions whereas the weighted filters smoothly cut-off in this region. These side lobes will tend to let in more noise, especially for the a filter. The frequency response also gives an insight into what each filter represents. The c filter is essentially a low-pass filter with cut-off frequency of ½ cycle/mm corresponding to the 2 mm support. It gives a smoothed version of the noisy measurements. The a and b filters are band-pass in nature with the second derivative a filter having a larger pass-band than the first derivative b filter.

Figure 11E:
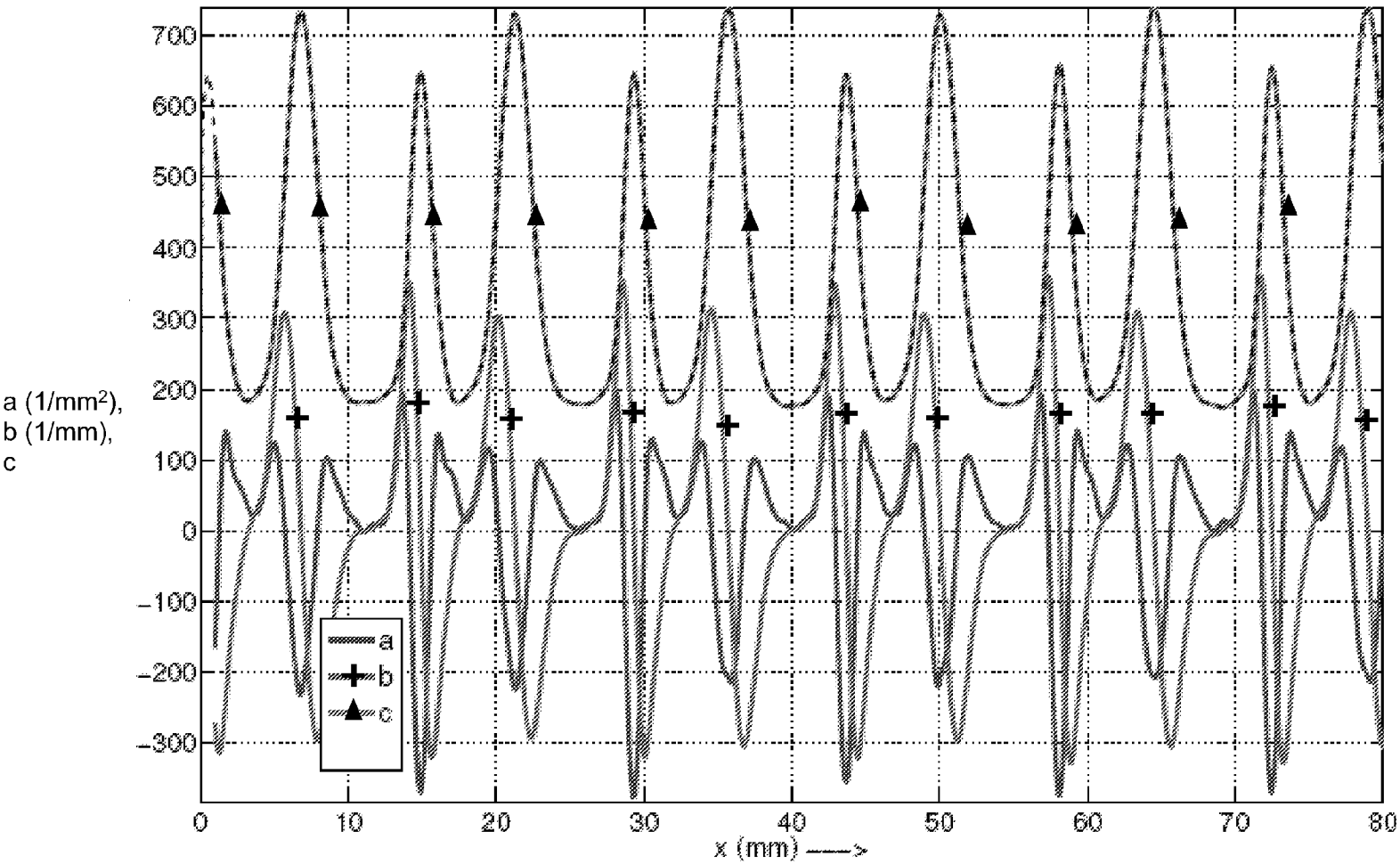
Figure 11F:
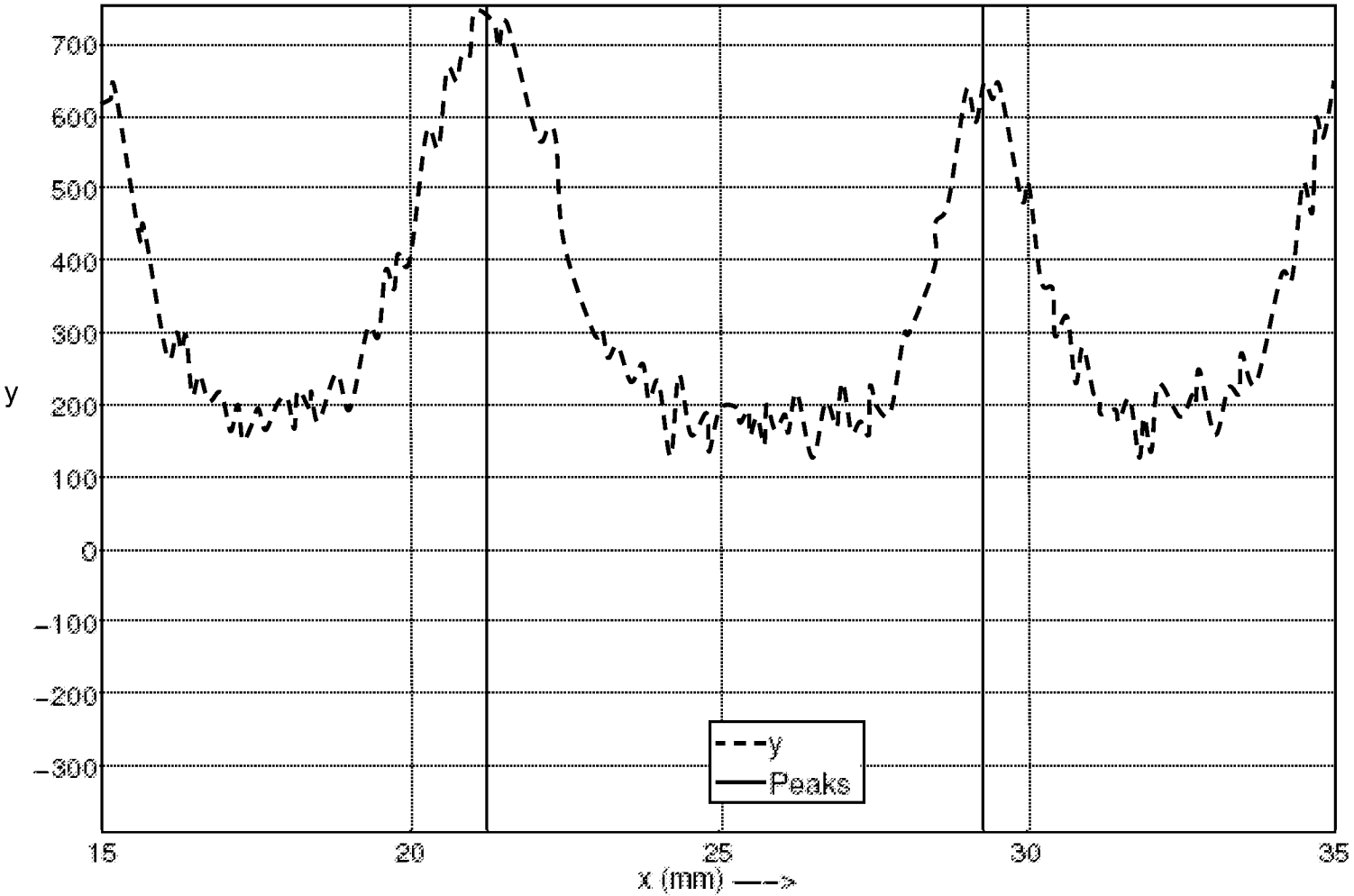
FIGS. 11F and 11G are plots of an enlarged portion of the exemplary sensor plot of FIG. 11D and the results of filtering operations with added noise.
Figure 11G:
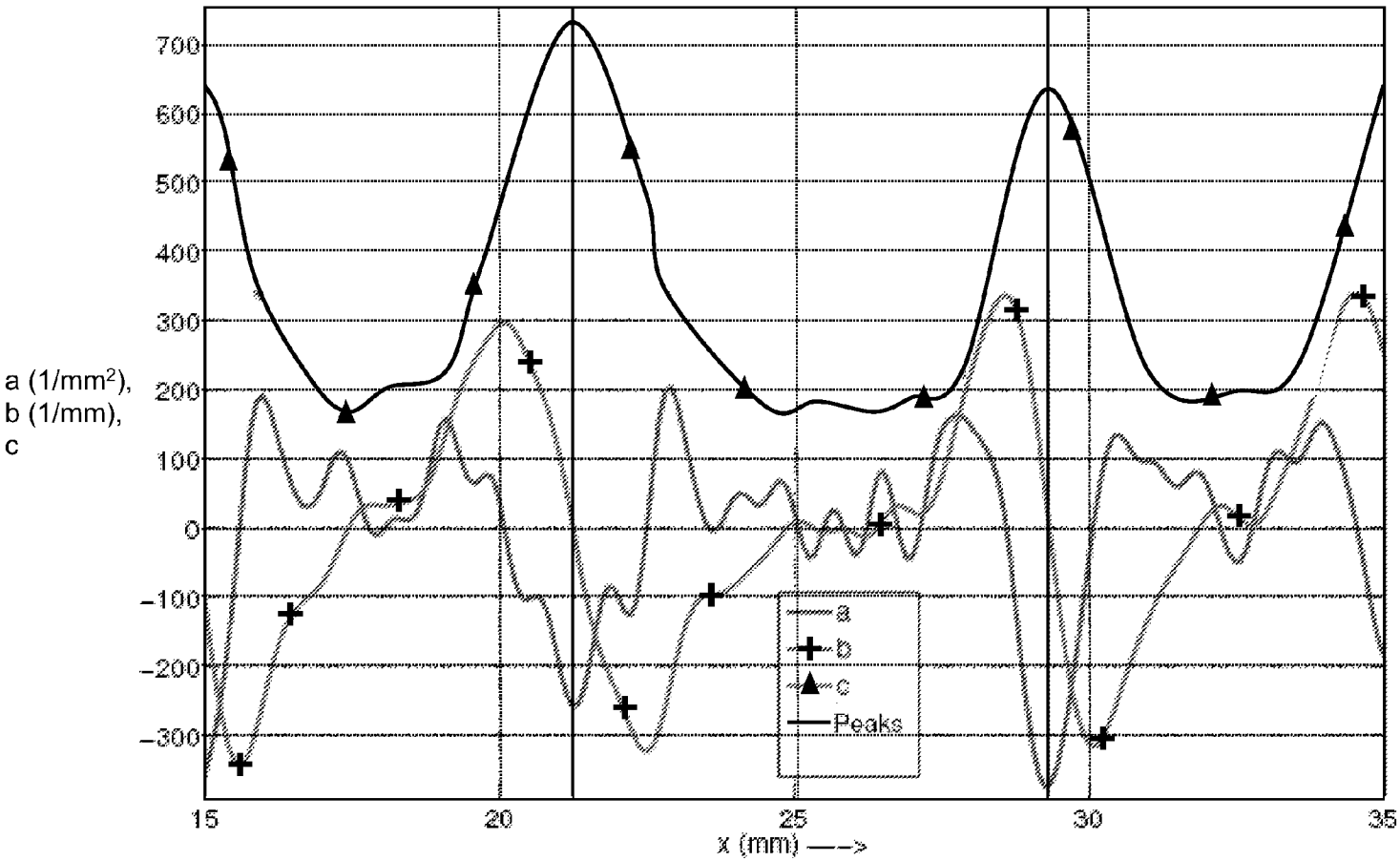

FIG. 11E illustrates exemplary results of the filtering operation using the weighted filters on a typical trace recorded by the optical sensor in an example printer 100. The data is sampled with $\Delta x$=0.098 mm and the filter support is 2 mm yielding a 21 tap FIR filter, although any other values may be used. Since the trace is relatively noise free, the response of the c filter is almost coincident with the raw data y. Note how the first derivative b filter has a zero crossing whenever the measurement y has an extrema. The second derivative a filter indicates whether the extrema is a maxima or a minima. To demonstrate the noise rejection capabilities of the filters, FIG. 11F illustrates an enlarged portion of the original trace with some noise added to the raw measurement y and the peak locations marked for the original trace via vertical lines. In this case, as shown in FIG. 11G, c reconstructs the original noise free measurements. The b filter has a zero-crossing precisely at the peak location of the noise free measurement. The a filter is negative at the peak location signaling a maximum.

Peak Detection and Localization

Ideally, the first derivative will be zero and the second derivative will be negative only at a peak location. However, in practice, this is not sufficient as seen in FIGS. 11F and 11G. For example, zero-crossings in the b plot may also occur in flat response regions larger than the support of the filter (e.g. around x=25 mm in FIG. 11G). However, if the response is flat relative to the support of the filter, the a values at these zero-crossings will also be small compared to the a values at the peak. Accordingly, let $x_l$ and $x_r$ be any two consecutive sampling locations ($x_r - x_l = \Delta x$). Then peaks may be detected via a detection condition:

$$\text{Peak detected: } b(x_l)b(x_r)<0, a(x_l)<<0, a(x_r)<<0 \quad \text{Eq. (18)}$$

In one embodiment, peaks may be detected through interpolation of the b values, by fitting a straight line to b between $x_l$ and $x_r$ and determining the exact location $x_p$ of the zero-crossing of the peak as follows:

$$x_p = x_l - \frac{b(x_l)\Delta x}{b(x_r) - b(x_l)} \quad \text{Eq. (19)}$$

This method works well when the sampling interval $\Delta x$ is small enough that b can be approximated as a straight line between the two samples.

However, when the sampling interval is large, in many embodiments higher accuracy may be achieved by determining the maxima of the fitted model $q(\bullet, x_l)$ and $q(\bullet, x_r)$. Setting the first derivative of Eq. (4) to zero and solving for x yields:

$$x_{p_l} = x_l - \frac{b(x_l)}{2a(x_l)}, \quad x_{p_r} = x_r - \frac{b(x_r)}{2a(x_r)} \quad \text{Eq. (20)}$$

In general, the location of the maxima may differ slightly between the two consecutive fits at $x_l$ and $x_r$. Accordingly, in some embodiments, the average of $x_{pl}$ and $x_{pr}$ may be used to find the peak $x_p=(x_{pl}+x_{pr})/2$.

Figure 11H:
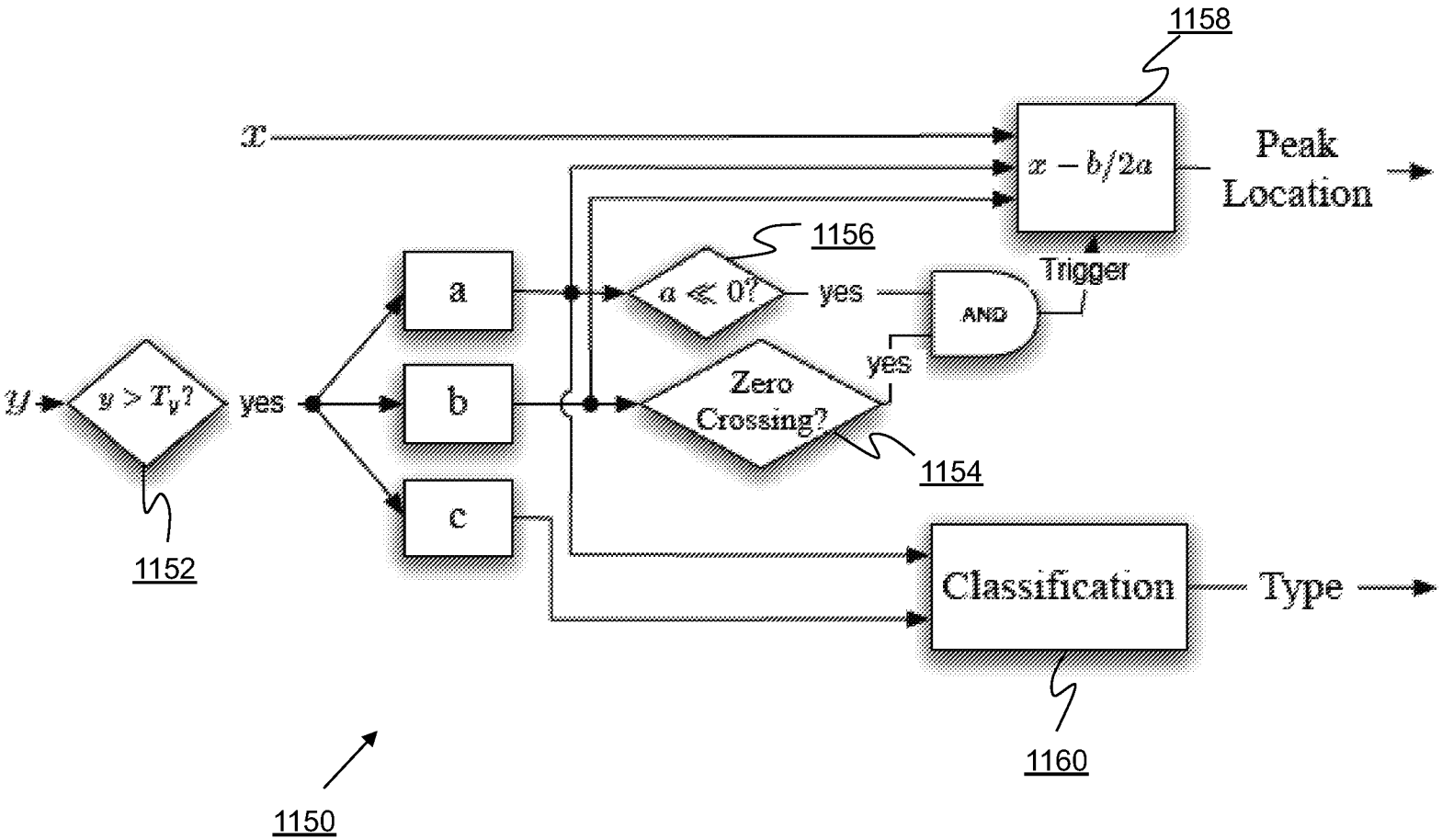
FIG. 11H is a block diagram of an embodiment of a peak detection and localization algorithm.

FIG. 11H is a block diagram of one embodiment of a peak detection and localization algorithm 1150. To reduce computation, in some embodiments, the signal y is only processed through the filters when it is greater than a predetermined threshold $T_y$ at step 1302. In some embodiments, to find a zero crossing, only the b filter needs to be computed at step 1154. Once a zero-crossing in b is detected, a can be computed at step 1156 to test whether it is a peak (a<<0). If a peak is detected, the location is refined to pinpoint the peak at step 1158.

Once a peak location is determined, in some embodiments, both the a and c values may be passed to the classification module at step 1160 for determining whether the peaks correspond to a horizontal or a diagonal line of the Z pattern.

Peak Classification

In some embodiments, the detected peaks may need to be classified as a horizontal or a diagonal line of the "Z" pattern, for example, to detect whether lateral displacement of the media is to the left or right. In some embodiments, as discussed above, the horizontal and diagonal lines may have different thicknesses. In other embodiments, other distinct features may be used, such as patterning or saturation of the line. Depending on the thickness of these two line types or other such features and the shape of the aperture of the optical sensor, both the amplitude and the width of the recorded peaks may vary between horizontal and diagonal lines. The c coefficient captures the amplitude while the second derivative a captures the width and the curvature of the peak. In some embodiments, these two coefficients, a and c, computed at the peak locations may be used as features to classify the peaks.

If the "Z" pattern is clean with no extraneous marks such as smudges or dirt on the media 302 and the amplitude of the tracking is not large enough such that the horizontal and diagonal lines merge at the corners of the "Z", then a two-class Bayes classifier or similar algorithm may be applied. If dirt or other unintended markings on the media are present, then the sensor may register a peak that does not correspond to the horizontal or diagonal line. In such instances, a multi-class classification algorithm, discussed in more detail below, may be applied.

Two-Class Bayes Classifier

Let $\mathcal{C}$ denote a feature vector made up of the set of valid classes. For the two class problem, $\mathcal{C}=\{\text{'d'}, \text{'h'}\}$, where 'd' and 'h' denote the diagonal and horizontal line class respectively. Let $\hat{l}_p$ denote the estimated line type for the $p^{th}$ peak located at $x_p$ and let $$\vec{f}_p = \begin{pmatrix} a(x_p) \\ c(x_p) \end{pmatrix} \quad \text{Eq. (21)}$$

denote the feature vector made up of the "a" and "c" coefficients described above. The minimum classification error may be obtained by maximizing the posterior probability of the line type, given the observed features $$\hat{l}_p = \underset{l \in C}{\operatorname{argmax}} \mathcal{P}(l \mid \vec{f}_p) \quad \text{Eq. (22)}$$

Using Bayes rule and taking the logarithm of Eq. (22), the equation $$\hat{l}_p = \underset{l \in C}{\operatorname{argmin}} (-\ln \mathcal{P}(\vec{f}_p \mid l) - \ln \mathcal{P}(l)) \quad \text{Eq. (23)}$$

is obtained where P(l) denotes the a priori probability of line type l.

The probability distribution of the features given the line type may be modeled as a multi-variate Gaussian distribution. Letting $\vec{m}_l$ denote the mean value of the feature vectors, and $\Sigma_l$ denote the covariance matrix of the Gaussian distribution for lines of type l, the general form of the decision boundary of Eq. (23) for Gaussian distributions may be $$(\vec{f}_p - \vec{m}_d)^t \sum_d^{-1} (\vec{f}_p - \vec{m}_d) - (\vec{f}_p - \vec{m}_h)^t \sum_h^{-1} (\vec{f}_p - \vec{m}_h) + \ln \frac{|\sum_d|}{|\sum_h|} - 2\ln \frac{\mathcal{P}(d)}{\mathcal{P}(h)} \underset{h}{\overset{d}{\lesseqgtr}} 0 \quad \text{Eq. (24)}$$

where the $p^{th}$ line is assigned the type $\hat{l}_p$=d (diagonal) when the < inequality is satisfied and $\hat{l}_p$=h (horizontal) when the > inequality is satisfied. This is a quadratic function in feature space. If the covariance of the two class distributions can be modeled to be equal, $\Sigma=\Sigma_d=\Sigma_h$, then the decision boundary simplifies to a line in feature space $$2(\vec{m}_h - \vec{m}_d)^t \sum^{-1} \vec{f}_p + \vec{m}_d^t \sum^{-1} \vec{m}_d - \vec{m}_h^t \sum^{-1} \vec{m}_h - 2\ln \frac{\mathcal{P}(d)}{\mathcal{P}(h)} \underset{h}{\overset{d}{\lesseqgtr}} 0 \quad \text{Eq. (25)}$$

Figure 11I:
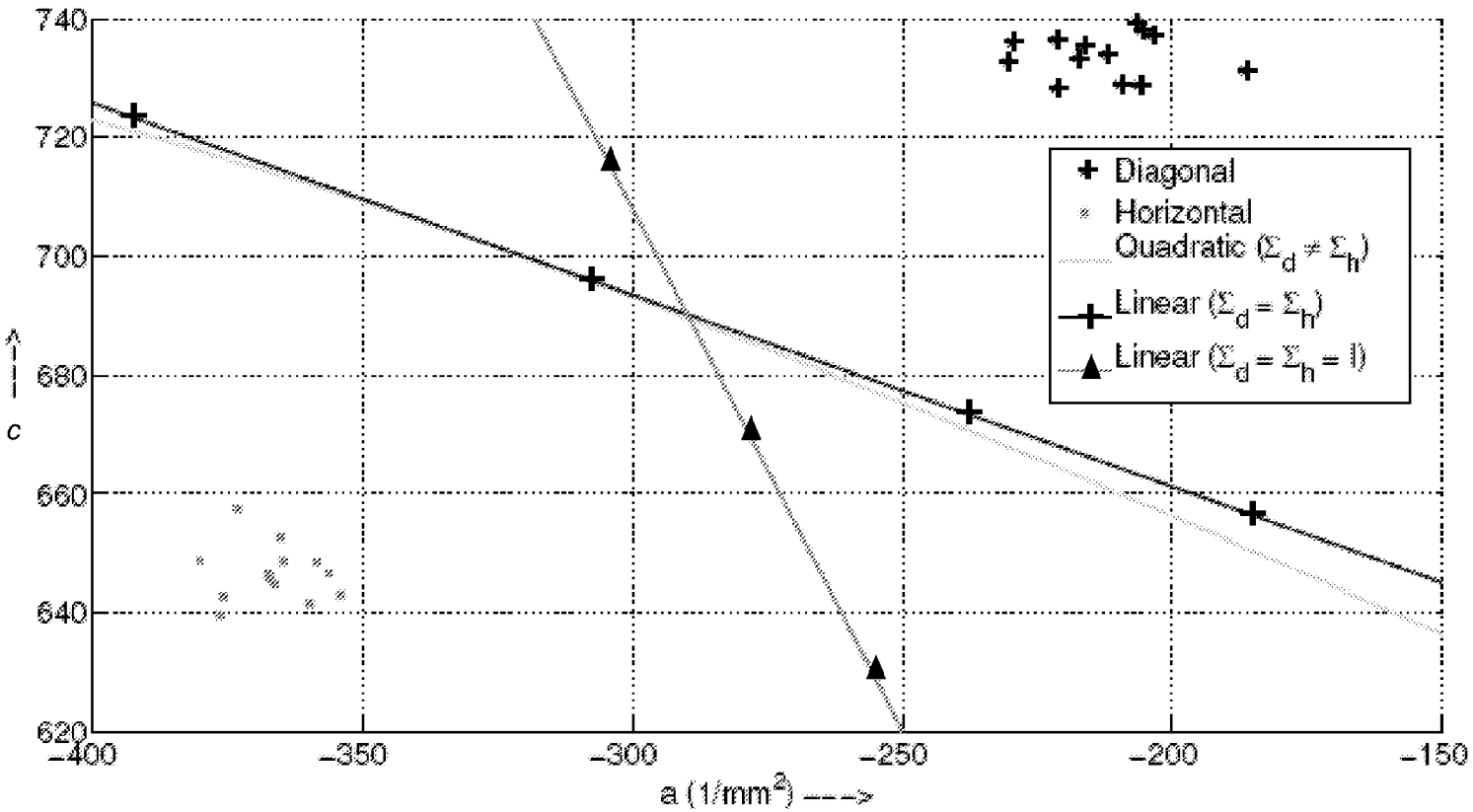
FIG. 11I is a plot of the peaks of the exemplary plot of FIG. 11D, plotted in a and c feature space.

FIG. 11I is an exemplary graph showing the peaks of the example in FIG. 11D plotted in a and c feature space. In this particular case, the diagonal and horizontal line types separate very cleanly using these features. Also shown are the decision boundaries of three classifiers based on different assumptions on the co-variance matrix of the line type distributions, discussed in more detail below. The most general case given by Eq. (24) assuming the covariance matrices are different for the two class distributions results in a quadratic decision boundary. The more restrictive case given by Eq. (25) shows a linear decision boundary based on the assumption of equal covariance matrices. In this particular example, the individual covariance matrices were each set equal to the average of the two. The resulting linear decision boundary is quite close to the more accurate quadratic decision boundary, implying that, for this example, the covariance matrices of the two classes were similar. Contrasting this with the linear boundary generated with the identity matrix I as the covariance, one sees a sub-optimal classifier given the quite different noise variance in the a and c features (the a feature values are much noisier than the c features). An identity covariance matrix results when the two features a and c are uncorrelated and have equal variances. From the classification perspective, the absolute variances of the two features is irrelevant; only their ratio matters, which is unity in the case of the identity matrix.

Multi-Class Problem

In some embodiments, if there is dirt or other unintended markings on the media, the sensor may register a peak that does not correspond to the horizontal or diagonal line. Forcing the classification to either of the two known classes may result in an error and throw the tracking estimate off. The probability distribution of the all the peaks that are not the horizontal or the diagonal line is unknown and cannot be quantified using the two-class algorithm discussed above. Instead, in such embodiments, a threshold may be applied to the likelihood of a peak corresponding to the two known classes. The unknown class 'u' is chosen when these likelihoods fall below the threshold. The classification to the known classes is then the same as discussed above. The overall decision rule is given as $$\hat{l}_p = \begin{cases} \text{'u'} & \max_{l \in C} \mathcal{P}(\vec{f}_p \mid l) < \text{Threshold} \\ \operatorname{argmax}_{l \in C} \mathcal{P}(l \mid \vec{f}_p) & \text{otherwise} \end{cases} \quad \text{Eq. (26)}$$

For the special case of equal a priori probabilities and diagonal covariance matrices, the classification rule reduces to computing and comparing weighted distances of the sample to the class means as follows:

$$\hat{l}_p = \begin{cases} \text{'}u\text{'} & \min_{l\in C}\left(\vec{f}_p - \vec{m}_l\right)^t \sum^{-1}\left(\vec{f}_p - \vec{m}_l\right) > \text{Threshold} \\ \operatorname{argmin}_{l\in C}\left(\vec{f}_p - \vec{m}_l\right)^t \sum^{-1}\left(\vec{f}_p - \vec{m}_l\right) & \text{otherwise,} \end{cases} \quad \text{Eq. (27)}$$

Leveraging a Priori Information

The "Z" pattern by itself in the absence of dirt or other unintended marks yields a very predictable pattern of alternating horizontal and diagonal lines. The a priori probability P(l) discussed above considers each peak in isolation and completely ignores this correlation. Leveraging this information can significantly improve classification accuracy in the presence of noise.

Let $\vec{l}_{1,n}=(l_1, \ldots, l_n)$ denote the vector of line types for lines with indices 1 to n. The joint probability of the line types may be modeled by the Markov chain $$\mathcal{P}\left(\vec{l}_{1,n}\right) = \mathcal{P}(l_1)\prod_{p=2}^{n}\mathcal{P}(l_p \mid l_{p-1}) \quad \text{Eq. (28)}$$

Figure 11J:
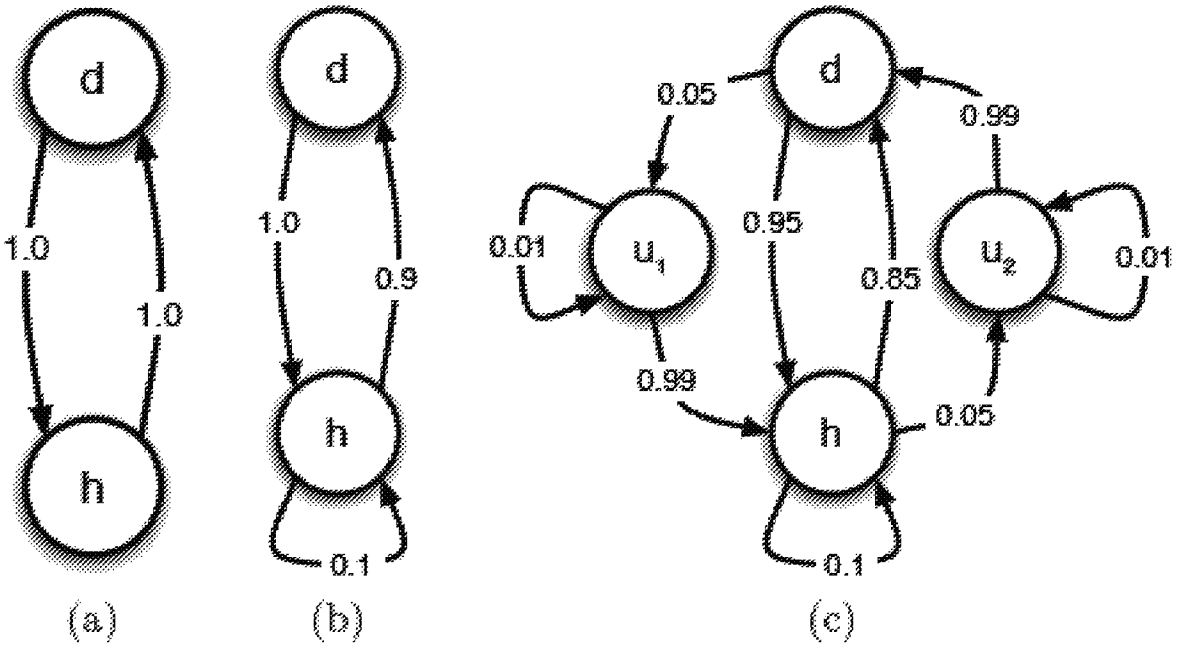
FIG. 11J depicts various embodiments of state transition diagrams for a media tracking system.

The model is thus completely defined by transition probabilities from the state at index p to index p+1. FIG. 11J is an illustration of exemplary state transition diagrams for such transition probabilities. The simple two-class problem is shown in diagram (a) of FIG. 11J with embodiments utilizing a continuous "Z" pattern. Diagram (b) of FIG. 11J illustrates embodiments utilizing a "Z" pattern with occasional breaks, such that a transition from a horizontal line to a horizontal line is possible. For the example shown, this kind of transition occurs 10% of the time, although other values may be used. Whether the "Z" pattern is continuous or not depends on the method used to print the pattern. For example, in some embodiments, breaks may be required in the pattern if the circumference of the roller that prints the pattern on media 302 is not an integral multiple of the length of the "Z", such that the pattern may not be readily repeated. For example, the pattern may be printed via a flat printing plate wrapped around a drum and clamped or glued in place. The plate may have an unprinted margin, and/or the attachment method may result in a gap when the plate is used to print along a continuous strip of media. In such cases, it is assumed that the "Z" before the break is printed in its entirety and a gap is left in the pattern. In other embodiments, the pattern may be engraved on a sleeve, via a laser or similar means, that may be used as or placed around the drum, resulting in no margin or gap.

Diagram (c) of FIG. 11J illustrates a state transition example which accounts for observing peaks due to dirt or unintended marks or the possibility that the diagonal and horizontal line types merge if the tracking drifts to the extreme edge of the "Z" pattern. In the example shown, this can occur 5% of the time, although other values may be used. The class for this unknown line type is denoted as '$u_1$' or '$u_2$' depending on whether it occurs after observing a 'd' or an 'h' respectively. The class is divided into two since the subsequent transition is almost always to a valid line type opposite to the valid line type observed previously. The likelihood of observing another invalid line type when in states '$u_1$' or '$u_2$' is typically very small.

For best performance, the classification needs to be done for a block of line types rather than one at a time. However, waiting to classify a peak until additional peaks are observed may result in a delay that may be unacceptable in a real-time tracking application (although it may be used in an off-line initialization sequence). The block classifier is obtained as $$\hat{\vec{l}}_{1,n} = \arg\max_{l_1,\ldots,l_n}\mathcal{P}\left(\vec{l}_{1,n} \,\middle|\, \vec{f}_1, \ldots, \vec{f}_n\right) = \arg\min_{l_1,\ldots,l_n}\left(-\ln\mathcal{P}(l_1) - \sum_{p=2}^{n}\ln\mathcal{P}(l_p \mid l_{p-1}) - \sum_{p=1}^{n}\ln\mathcal{P}\left(\vec{f}_p \,\middle|\, l_p\right)\right) \quad \text{Eq. (29)}$$

The optimization of Eq. (29) may involve evaluating $d^n$ class assignments to $\vec{l}_{1,n}$, where d is the number of possible classes. This can be reduced to $O(d^2n)$ computations employing a Viterbi algorithm that does a forward pass keeping track of d paths that achieve the maximum probability through the n stages and a backward pass to compute the optimal class assignments.

For reduced block sizes, the probabilities may be conditioned on the class determinations for the previous indices. For a block size of 1, the Bayes classifier is given as $$\hat{l}_p = \arg\max_{l_p\in C}\mathcal{P}\left(l_p \,\middle|\, \vec{f}_p, \hat{l}_{p-1}\right) = \operatorname{argmin}_{l_p\in C}\left(-\ln\mathcal{P}\left(\vec{f}_p \,\middle|\, l_p\right) - \ln\mathcal{P}\left(l_p \mid \hat{l}_{p-1}\right)\right) \quad \text{Eq. (30)}$$

Comparing to Eq. (23), the a priori probability P(l) is simply replaced by the transition probability from the previously determined optimal class to the current class. Note that Eq. (23) when computed on the model shown in diagram (a) of FIG. 11J ends up ignoring all data for p>1 and just resorts to alternating class assignments after making a determination for the optimal class at p=1 based on the data for that index. On the other hand, Eq. (29) when implemented using the Viterbi algorithm will evaluate the data probabilities for two alternative assignments to $\vec{l}_{1,n}$ each with alternating class assignments, but with two distinct phases, and choose the one that has the greater probability.

Figure 11K:
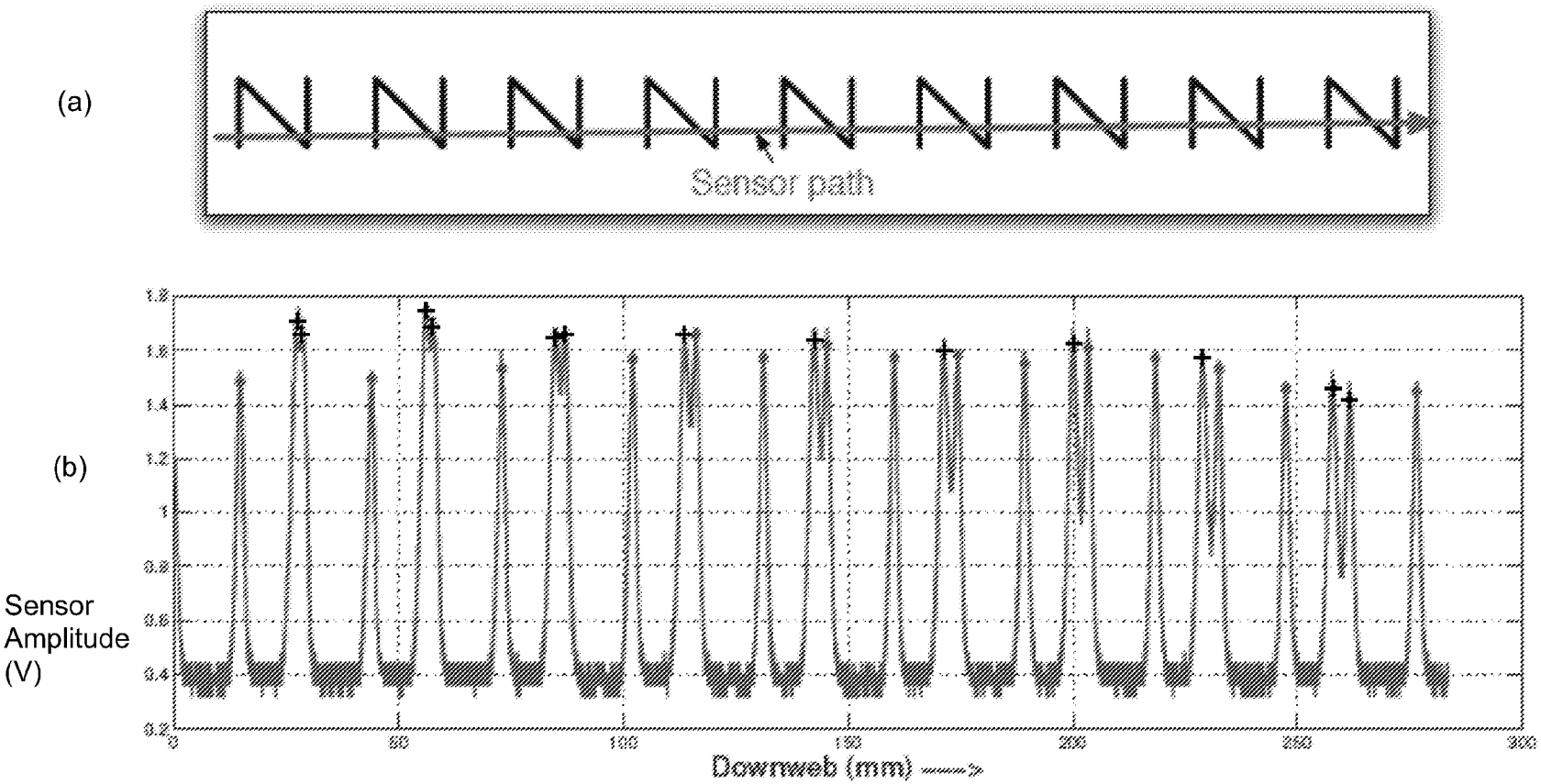
FIG. 11K depicts various embodiments of (a) an example of a discrete Z pattern and the sensor path with extreme tracking, and (b) an example of the voltage recorded by the sensor (line) and peaks (circles and crosses) identified by an embodiment of the system and methods discussed herein.

At (a), FIG. 11K depicts an embodiment of an example of a discrete Z pattern and the sensor path with extreme tracking that illustrates the shortcomings of the one-at-a-time classifier method of Eq. (23). The sensor signal for this example is collected using a pattern of distinct Z's with gaps between them as shown in FIG. 11K(a). The horizontal and diagonal line thickness are the same so the peaks need to be classified solely on the basis of the a coefficients. In some embodiments, if the aperture of the sensor is circular and line thickness of the horizontal and diagonal lines are the same, the amplitude of the peaks will not be different.

The resulting signal is shown in the exemplary plot of FIG. 11K(b), showing the voltage recorded by the sensor (line) and peaks (circles and crosses) identified by the classifier. The paper has tracked to an extreme location as shown by the sensor path resulting in the diagonal peaks merging with the horizontal peaks in the first half of the recording. The peaks get progressively more resolved in the latter half of the recording as the media tracks towards the center. The peak finding algorithm is able to resolve all the peaks (marked by crosses and circles).

Figure 11L:
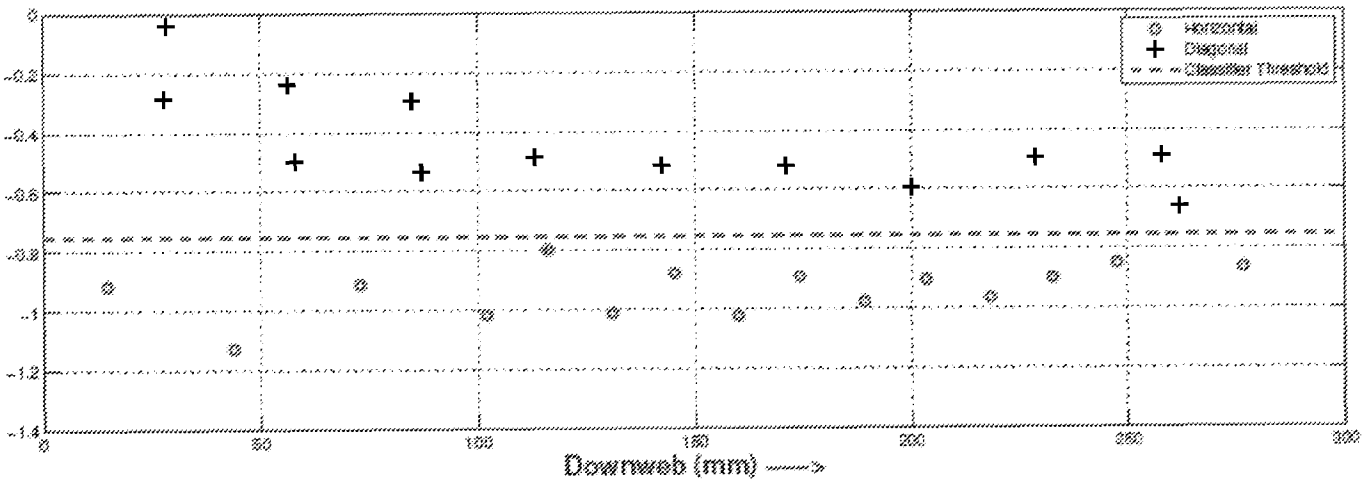
FIG. 11L depicts various embodiments of (c) a coefficients computed for each of the peaks and classified one at a time using an example of modeled Gaussian distributions as shown in (d)
Figure 11L:
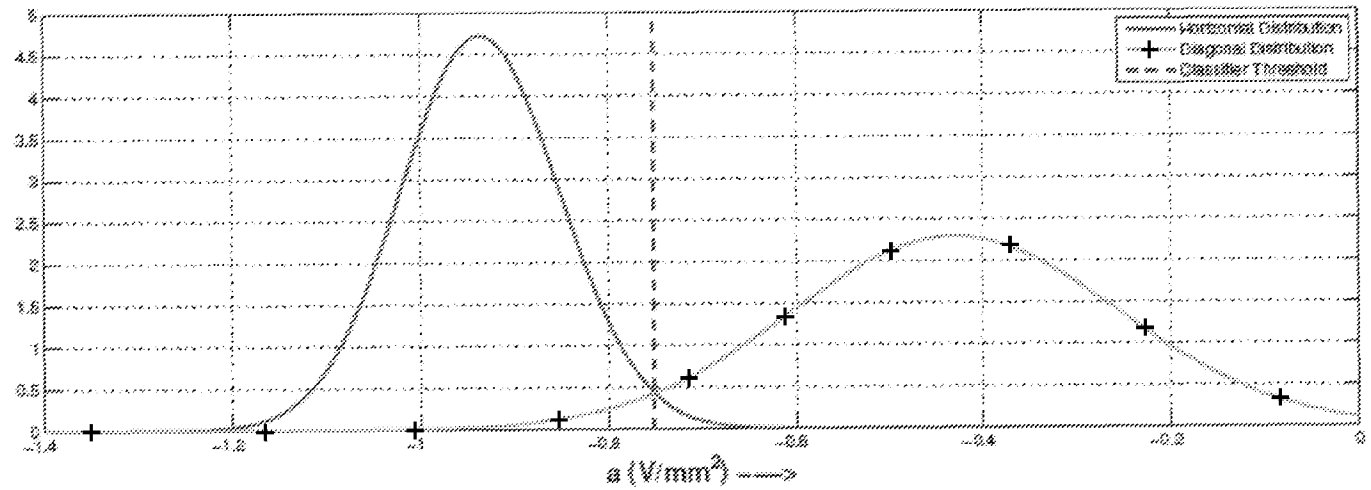

The a coefficients of each of the peaks are plotted in FIG. 11L(a), with circles representing coefficients for horizontal lines, and crosses representing coefficients for diagonal lines. The dashed line of FIG. 11L(a) and FIG. 11L(b), discussed in more detail below, illustrates a threshold for the classifier, determined as the a value where the two classes have the same probability. In an off-line initialization sequence, the probably distribution of the two classes will not be known and may need to be estimated from this data. A clustering algorithm such as k-means can be used to sub-divide the a coefficients into two groups. The probability distribution for each of the two horizontal groups can then be computed as discussed below.

Figure 11M:
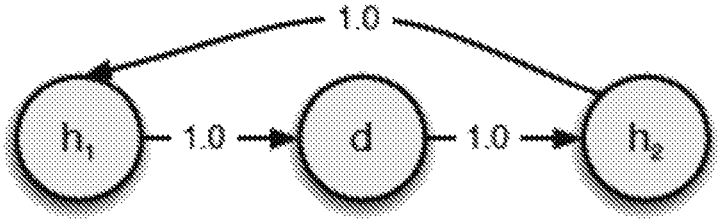
FIG. 11M depicts an embodiment of a state transition diagram for classification of lines.
Figure 11N:
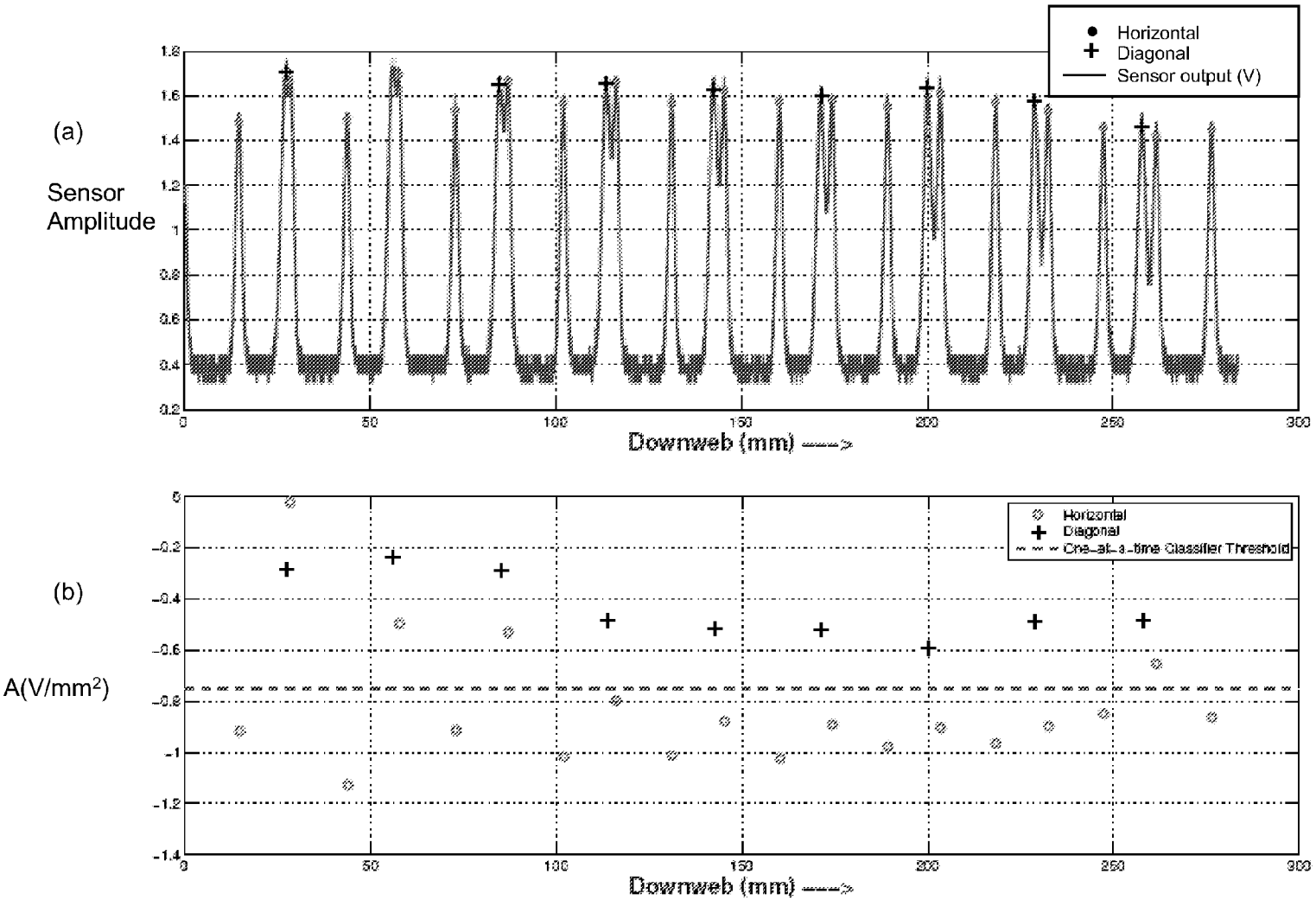
FIG. 11N depicts (a) the sensor signal of FIG. 11K(a) labeled using a classification determined by an embodiment of a Markov chain a priori model discussed herein, and (b) a plot of a values of each of peak labeled by class.

FIG. 11L(b) shows the estimated Gaussian distributions for the horizontal (solid line) and diagonal (line with crosses) classes. Since this is a one-dimensional classification problem with only one feature, the decision boundary is a simple threshold obtained as the value of a where the probability of the two classes are equal, illustrated as the dashed line in FIGS. 11L(a) and 11L(b). The resulting classification misclassifies a number of the horizontal peaks as diagonal peaks. The a values of the horizontal peaks are artificially elevated due to the merging of the peaks and fall in the region occupied by the diagonal peaks. Accordingly, in such embodiments using the classifier of Eq. (23), it may not be possible to correctly classify all the peaks correctly, because the classifier only looks at one sample at a time and classifies it based on the two class distribution. To remedy this, in some embodiments, a priori knowledge of the repeating patterns of horizontal and diagonal lines may be leveraged. For the distinct Z pattern of FIG. 11K(a), the leading and trailing horizontal lines of each "Z" may be represented by two distinct classes, namely '$h_1$' and '$h_2$', yielding the state transition diagram of FIG. 11M. Probability distributions for the two horizontal line classes are the same even though they are two separate classes from the perspective of the Markov chain model. Using the probability distributions estimated in FIG. 11L(b) and employing the Viterbi algorithm to solve Eq. (29), one may obtain the exemplary classification shown in FIG. 11N. For clarity, the '$h_1$' and '$h_2$' classes are combined into a single horizontal class. FIG. 11N(a) is a plot illustrating that all the horizontal (circle) and diagonal (cross) peaks of the recorded signal of FIG. 11K(a) are now properly classified. FIG. 11N(b) plots the a values with their corresponding labels. Utilizing the a priori information thus provides an advantage as a values deep in the region occupied by the diagonal line class are still classified as horizontal lines to yield a consistent pattern of horizontal and diagonal lines. In this case, information is being passed forward and backward in time to maximize the probability of the pattern as a whole. The unambiguous classification in the latter half of the signal where the peaks are better resolved helps in the classification of the earlier half where the peaks are merged and hard to resolve. In some embodiments, this method may be employed only in an off-line initialization sequence to learn the classification parameters and compute an initial offset to be used in subsequent printing. In such embodiments, the classification results are not time critical and the entire recording can be classified at once. In real-time applications, the Markov chain a priori model may still be employed but the block sizes may be kept small such that the delay in obtaining tracking information can be managed.

Classifier Parameter Estimation

To compute the data probabilities, mean and covariance parameters of the Gaussian distribution for each class are utilized. These can be estimated from sample averages given labeled training data in which the class of each line type is known. Given n labeled samples, the mean and covariance estimators are $$\hat{\vec{m}}_l = \frac{1}{N_l}\sum_{p=1}^{n} \mathcal{I}_l(\hat{l}_p)\vec{f}_p,\ l \in \mathcal{C} \qquad \text{Eq. (31)}$$

$$\hat{\sum_l} = \frac{1}{N_l}\sum_{p=1}^{n} \mathcal{I}_l(\hat{l}_p)\left(\vec{f}_p - \hat{\vec{m}}_l\right)\left(\vec{f}_p - \hat{\vec{m}}_l\right)^t,\ l \in \mathcal{C} \qquad \text{Eq. (32)}$$

where the indicator function $$\mathcal{I}_l(k) = \begin{cases} 1 & k = l, \\ 0 & k \neq l, \end{cases} \qquad \text{Eq. (33)}$$

and $N_l$ denotes the number of samples of class l out of the n samples, $$N_l = \sum_{p=1}^{n} \mathcal{I}_l(\hat{l}_p) \qquad \text{Eq. (34)}$$

Adaptive Classifier

In typical usage, the characteristics of the printer transport and the response of the optical sensor may drift with time. Each run of the media may also have variations in the printed "Z" pattern. Both of these factors may cause the class distributions in feature space to vary over time. Consequently, in some embodiments, it may be desirable to dynamically update the parameters of the classifier to track these changing characteristics. This can be done by using the previously classified samples as ground truth. As long as the parameters do not change abruptly, this circular method of the using the classifier to classify the samples and then using the classified samples to update the classifier parameters does not pose any problems. The mean estimator $\hat{\vec{m}}_1$ of each class l given by Eq. (31) can be adapted to update when a new sample arrives with class $\hat{l}_n$=l as $$\begin{aligned} \hat{\vec{m}}_l(n) &= \frac{1}{N_l}\sum_{p=1}^{n-1} \mathcal{I}_l(\hat{l}_p)\vec{f}_p + \frac{1}{N_l}\vec{f}_n \\ &= \frac{N_l - 1}{N_l}\hat{\vec{m}}_l(n-1) + \frac{1}{N_l}\vec{f}_n \end{aligned} \qquad \text{Eq. (35)}$$

Eq. 35 is thus a weighted sum of the previous mean estimate and the new sample. However, the contribution of the new samples to the class mean are reduced in weight as more samples are collected and $N_1$ increases. In order to make this computation adaptive, the result of Eq. (35) is replaced by:

$$e^{-1/\tau}\hat{m}_l(n-1) + (1 - e^{-1/\tau})\vec{f}_n \qquad \text{Eq. (36)}$$

This is a recursive update yielding a one-tap infinite impulse response (IIR) filter with $\tau$ as a constant that determines the number of samples it takes to erase the memory of the previous samples. Small values of $\tau$ enable the filter to adapt quickly to newer samples whereas large value does the opposite. Note that the update does nothing, $\hat{\vec{m}}_1(n)=\hat{\vec{m}}_1(n-1)$, when $\hat{l}_n \neq l$. Similarly, the IIR filter for the covariance matrix can be obtained from Eq. (32) as $$\hat{\sum_l}(n) = \begin{cases} e^{-1/\tau}\hat{\sum_l}(n-1) + (1-e^{-1/\tau})\left(\vec{f}_n - \hat{\vec{m}}_l(n)\right)\left(\vec{f}_n - \hat{\vec{m}}_l(n)\right)^t & \hat{l}_n = l, \\ \hat{\sum_l}(n-1) & \hat{l}_n \neq l. \end{cases} \quad \text{Eq. (37)}$$

Tracking Prediction

In some embodiments, once a diagonal line is identified in between two horizontal lines, the tracking can be computed using Eq. (1). This gives a discrete sampling of the continuous tracking of the media at the location of the diagonal line as follows:

$$\hat{T}_p = \frac{Z_\omega}{2}\frac{x_{p+1}+x_{p-1}-2x_p}{x_{p+1}-x_{p-1}}, \quad \{\forall\, p\colon \hat{l}_{p-1} = \text{'}h\text{'}, \hat{l}_p = \text{'}d\text{'}, \hat{l}_{p+1} = \text{'}h\text{'}\} \quad \text{Eq. (38)}$$

In some embodiments, the estimate above may be delayed with respect to where the print head is printing due to a need to wait to complete the "Z". It may also be discrete as samples are obtained only at the diagonal line locations. Accordingly, it may be preferable to generate a continuous estimate that predicts the tracking in the future to minimize the tracking error appearing on the print. This may be achieved in two parts: a model based predictor that predicts the tracking in the future that may be discontinuous as new samples come in and an IIR filter that smoothly incorporates this potentially discontinuous predictor into a smooth continuous estimate of the tracking.

In some embodiments, the tracking predictor may be based on a polynomial model fitted to the last r discrete estimates of the tracking obtained using Eq. (38). The support r of the model-based predictor controls how quickly the predictor adapts to changing tracking estimates. For book keeping purposes, a time varying set $T_t$ may include the last r tracking estimates at any given time t and their corresponding locations. The set $T_t$ may be updated whenever a new tracking estimate is available with the latest value replacing the oldest value in the set such that the number of elements in the set remains constant at r.

The order of the fitted polynomial is another design parameter; higher order polynomials can give better fits to the tracking estimates of the past but in general do not give robust prediction estimates for the future. For this reason, in some embodiments, linear fits (i.e. first order) may be employed. If the support r is chosen small enough to ensure that the tracking is more or less linear over this support, the model will provide sufficient accuracy for the tracking data and robust prediction capability. The parameters of the linear fit, namely, slope s and offset o can be obtained by a least-squares fit to the data in $T_t$. The parameters will therefore be functions of time t and change abruptly when a new tracking estimate becomes available and $T_t$ is updated. The model-based tracking predictor is given as $$\hat{T}_m(x)=\hat{s}(\mathcal{T})x+\hat{o}(\mathcal{T}) \quad \text{Eq. (39)}$$

explicitly showing the dependence of the estimate parameters, $\hat{s}$ and $\hat{o}$ on time t via the set $T_t$. Note that this predictor will most probably be discontinuous in x when a new tracking estimate is obtained and the parameters of the fit are recomputed. To obtain a smooth continuous prediction, $\hat{T}_m(x)$ is fed into a one tap IIR filter that operates at the sampling interval $\Delta x$ as $$\hat{T}(i\Delta x)=e^{-\Delta x/\beta}\hat{T}((i-1)\Delta x)+(1-e^{-\Delta x/\beta})\hat{T}_m(i\Delta x) \quad \text{Eq. (40)}$$

where $\beta$ is the space constant of the IIR filter in distance units and controls how quickly the filter reacts to changes in $\hat{T}_m(\bullet)$. It trades off the bias versus variance of the tracking prediction.

Figure 11O:
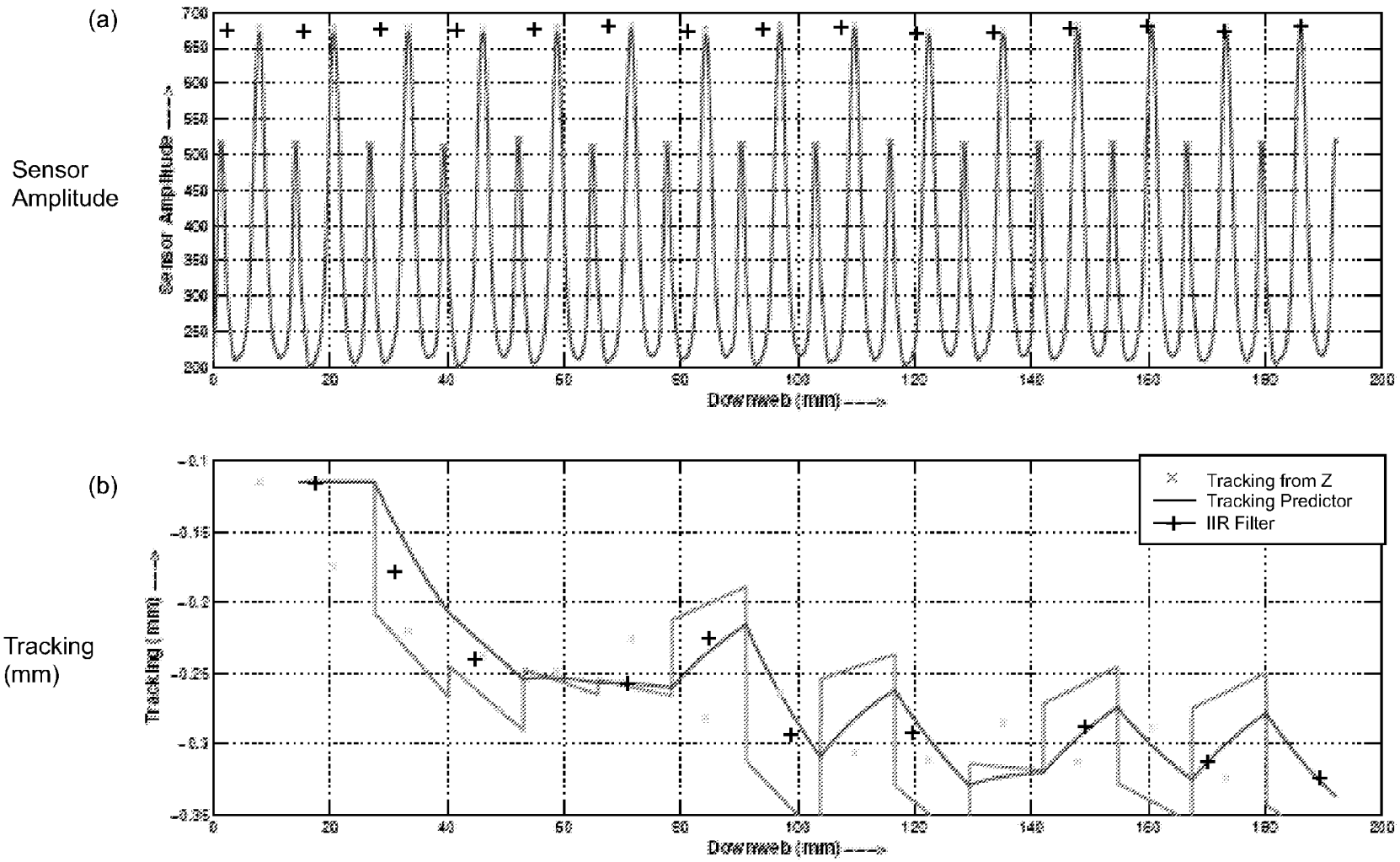
FIG. 11O-11P depict a plot of an exemplary signal recorded by a sensor when reading an embodiment of a tracking pattern, and tracking estimates of the signal using various window sizes.
Figure 11P:
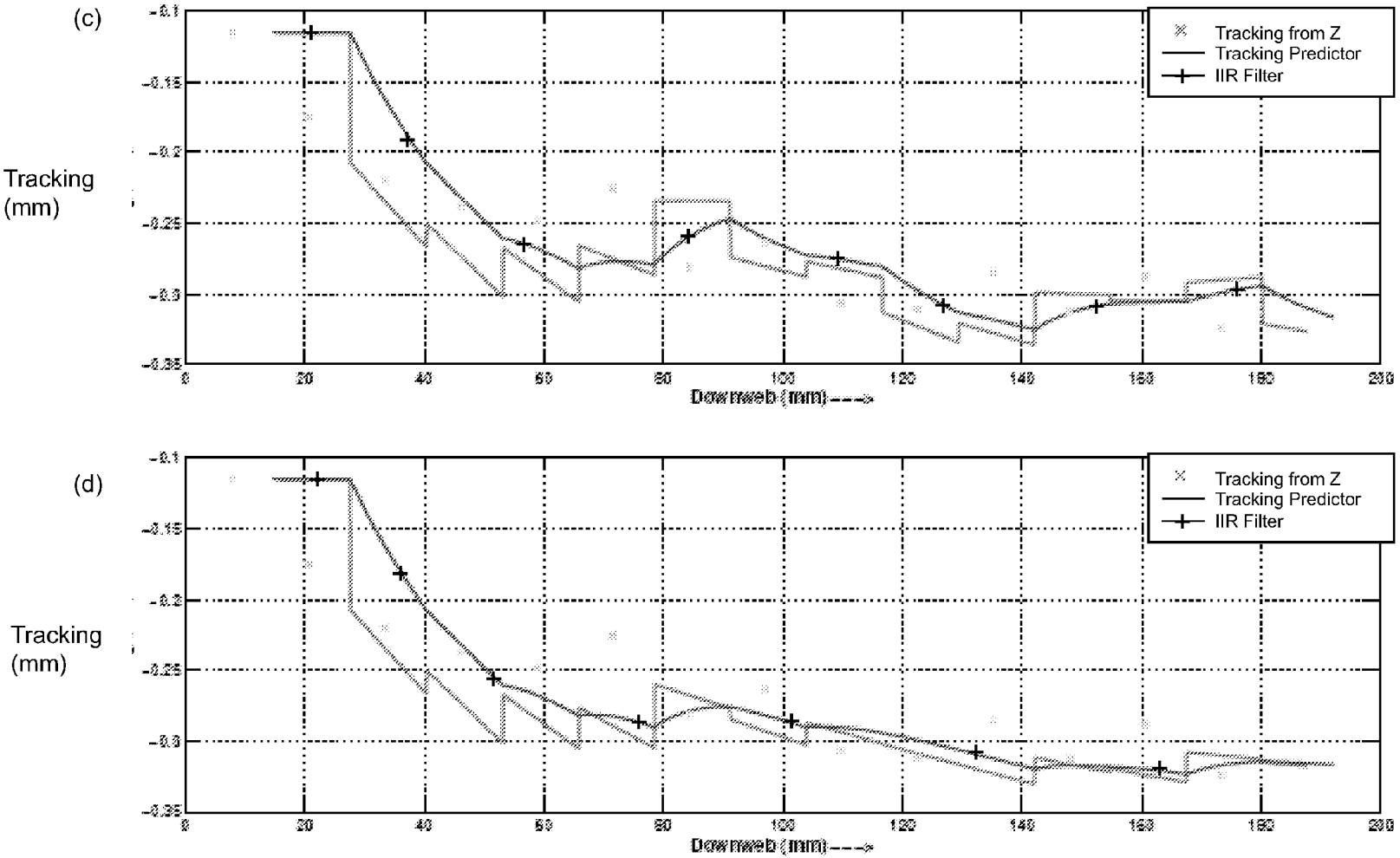

FIGS. 11O-11P illustrate an example of the how the design parameter r affects the tracking predictor. Plot (a) in FIG. 11O shows an exemplary signal recorded by a sensor when reading an embodiment of the "Z" pattern on the media 302 along with the location of the detected peaks marked with a cross for the "diagonal" line and a dot for the "horizontal" line. For each of the diagonal peaks, a discrete tracking estimate is obtained at that location as shown in plot (b) of FIG. 11O and plots (c) and (d) of FIG. 11P. The solid line in these plots shows the model-based linear predictor and the line marked with crosses shows the final IIR filtered values. As seen from the plots the linear predictor is discontinuous whenever a new tracking estimate is obtained. Note that the discontinuity occurs at the location of the horizontal peak where the "Z" pattern is completed and the tracking estimate $\hat{T}_p$ can be computed as in Eq. (38). The distance between the discontinuity and the preceding diagonal sample shows the delay in receiving the tracking estimate. In this example, the size of the "Z" is 12.7 mm and therefore the delay on average is 6.35 mm (distance between the horizontal and the preceding diagonal peak). Plot (b) of FIG. 11O and plots (c) and (d) of FIG. 11P illustrate the role of the support parameter r in the response of the predictor and the final continuous estimate. For example, plot (b) of FIG. 11O has a small support with r=2 samples resulting in the predictor bouncing around a lot more as new samples come in whereas plot (d) of FIG. 11P has a large support with r=8 samples that makes the predictor more smooth in its response, albeit with a larger bias. The predictor in plot (c) of FIG. 11O strikes a good balance between the two in terms of bias and variance with r=4 samples. However, other values of r may be used in other embodiments. The space constant $\beta$ of the IIR filter was fixed at 10 mm in all these plots. Increasing $\beta$ will have an effect similar to that of r making the final estimate more smooth while increasing the bias.

While estimating the parameters s and o of the linear predictor, in some embodiments, the tracking estimate data in $T_t$ may be weighted to give more weight to the more recent estimates as compared to the older estimates. This improves the accuracy of the predictor as the most recent samples better reflect what the estimate is going to be in the future. $[1-r^2/(r+1)^2,\ 1-(r-1)^2/(r+1)^2,\ \ldots,\ 1-1/(r+1)^2]$ was used as the weighting for the r samples ordered from oldest to most recent.

When first starting up, in many embodiments, the print engine will not have any tracking data available to estimate the parameters of the linear predictor. It will also take time to have the full complement of r samples for the full support of the predictor. So in the initial portion of the prediction, the print engine works with whatever number of samples are available until reaching the support of r samples after which it starts to discard the older samples from T. This is seen in plot (b) of FIG. 11O and plots (c) and (d) of FIG. 11P. In these examples, the first sample becomes available when the printer is at x≈15 mm and the second one at x≈27.6 mm. Before the first sample, the print engine has no data and cannot predict the tracking. Between the first and the second sample, the print engine has a zeroth order predictor pegged at the value of the first sample. From the second sample onwards, the print engine has a linear predictor. As more samples come in, the support of the predictor grows until reaching r samples and stays constant from then on. The IIR filter is initialized as $$\hat{T}(i_0\Delta x)=\hat{T}_m(i_0\Delta x) \quad \text{Eq. (41)}$$

where $i_0$ is the first sample index where the predictor $\hat{T}_m$ has valid data.

Dithering and Quantization

To compensate for the tracking of the media, in some embodiments, the print engine may shift the printed image by the amount predicted by the IIR filter $\hat{T}$ of Eq. (40). This shift may be implemented by re-interpolating the image on a grid displaced from the original grid by the predicted tracking $\hat{T}$. However, this re-interpolation may be quite computationally intensive to perform for every line of the image. To reduce the computational burden, in some embodiments, the image shifts may be limited to a full pixel or a half pixel shift. However, such shifts may be more readily apparent to the eye. To mask these shifts, in some embodiments, the print engine may employ a technique known as dithering in which a high frequency noise pattern is added to the tracking estimates before quantization. This may effectively achieve finer quantization intervals leveraging the smoothing that will be performed by the eye when the print is viewed.

Let d be the length of the dither pattern and D denote the array of dither (noise) values. Let ΔT denote the quantization interval. The quantized tracking estimate $\overline{T}(i\Delta x)$ is given as $$\overline{T}(i\Delta x)=\left\lfloor \frac{\hat{T}(i\Delta x)}{\Delta T}+D[i \bmod d]\right\rfloor \Delta T \quad \text{Eq. (42)}$$

Figure 11Q:
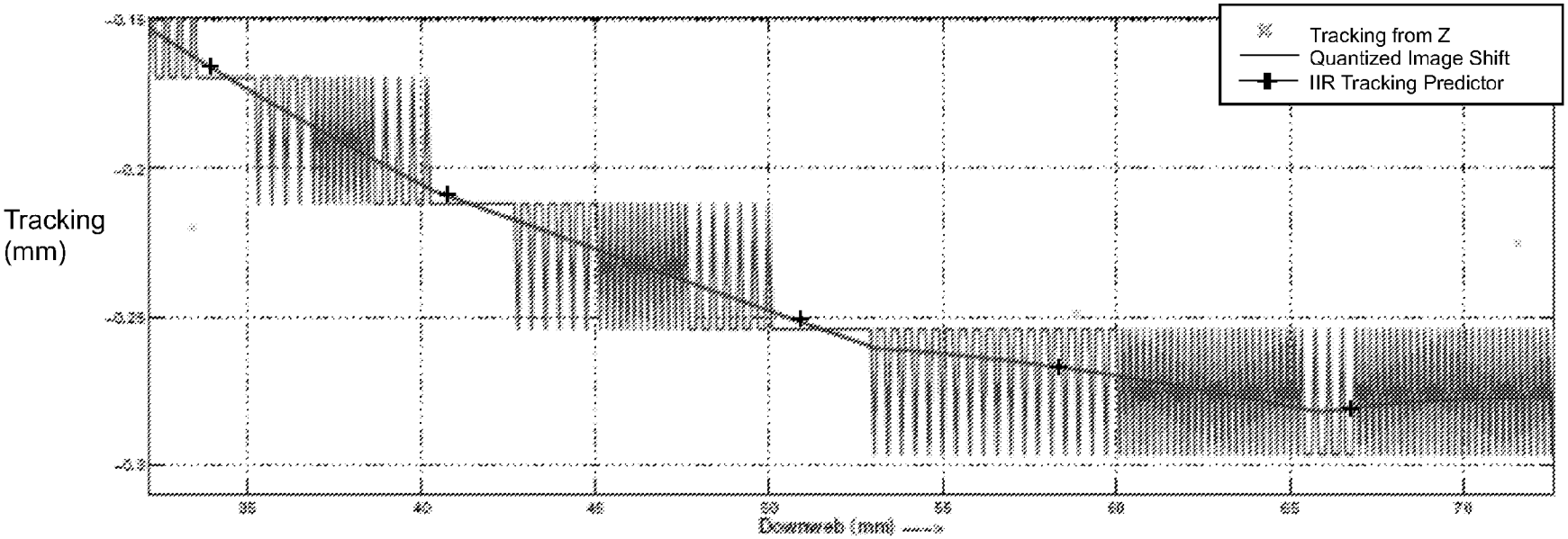
FIG. 11Q is a plot illustrating an exemplary embodiment of a tracking estimate with dithering and quantization applied.
Figure 11R:
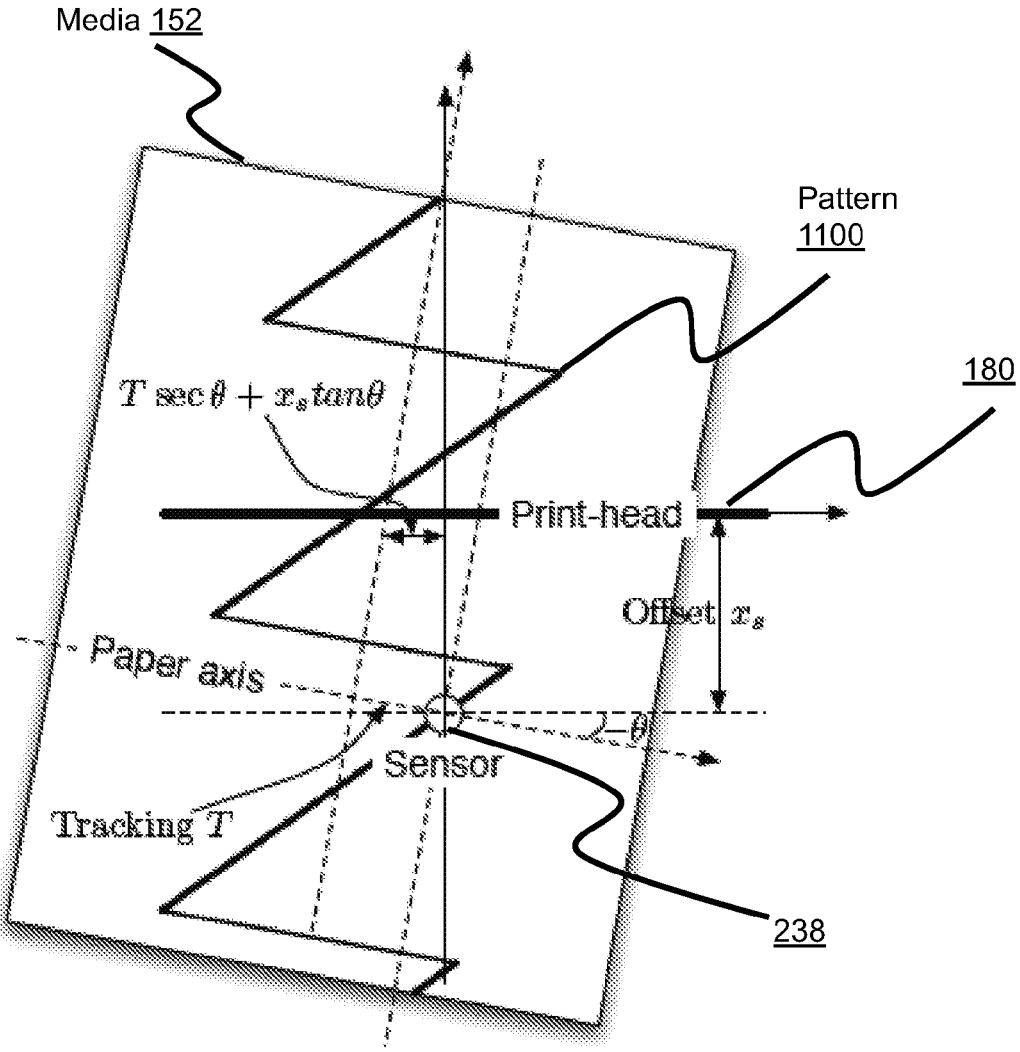
FIG. 11R is an illustration of an embodiment of a media tracking pattern with a sensor offset.

FIG. 11Q is an illustration of a blown up portion of the exemplary tracking predictor of plot (c) of FIG. 11L with dithering and quantization applied. Here ΔT=0.0423 mm corresponding to a 600 dots per inch (DPI) pixel, although other intervals may be used. In the example illustrated, the dither pattern was chosen to be [0.875; 0.375; 0.625; 0.125] with size d=4, although other values could be employed. As seen from the plot, the quantized signal transitions through 4 different patterns as the underlying signal moves from one quantization level to another. Specifically, as shown, the signal may be flat (e.g. at the range from 41-42.5 mm in FIG. 11Q); may be a 75% duty-cycle pulse train (e.g. from 42.5-45 mm); may be a 50% duty-cycle pulse train (e.g. from 45-47.5 mm); or may be a 25% duty cycle pulse train (e.g. from 47.5-50 mm). This effectively boosts the quantization levels by 4 and reduces the perceived quantization interval to 0.0106 mm. As shown, the signal pattern may repeat as the underlying signal continues through various quantization levels. Different dither patterns may yield different signal patterns.

Errors in Tracking Measurements

In some embodiments, the tracking set T(t) as measured by the optical sensor may differ from the true tracking of the media with respect to the print-head due to positioning errors in the sensor and the "Z" markings on the media. This leads to a static and dynamic tracking offset in the measurements; the former can be corrected via a calibration whereas the latter may not be as easily corrected and could result in an uncontrolled error. Systems and methods for addressing these errors are discussed below, in which $T_p(t)$ is used to denote the true tracking of the print with respect to the print head.

Sensor and "Z" Pattern Offset

Although in many embodiments the Z's or similar pattern are intended to be centered on the media and the optical sensor designed to be centered with respect to the print head, in practice, this might not be so given some tolerance in the printing of the Z's as well as manufacturing tolerances in the printer hardware. Let $T_z$ and $T_s$ denote the cross-web offset between the center of the media and the "Z" pattern and the center of print-head and the sensor respectively. The offset $T_z$ is positive when Z's are shifted right with respect to the center of the media 302 when viewed from the underside (the side on which the Z's are printed) of the media with the leading edge of the print at the top. The offset $T_s$ is positive when the sensor is shifted right with respect to the print head when viewed from the print-side and the leading edge of the print at the top. With this sign convention, $T_z$ and $T_s$ will be additive offsets to the measured tracking to obtain the final tracking of the print with respect to the print-head. Eq. (43) discussed below lists these as static offsets in the tracking measurements that can be calibrated out for each printer and media run.

In addition to the cross-web offset $T_s$, the sensor will generally have an offset in the down-web direction denoted as $x_s$, as it may not be physically coincident with the print head in some embodiments (for example, a platen may be coincident with the print head to support media 302 during printing). In other embodiments, the sensor may be coincident with the print head, where media 302 is not required to be supported during printing. In practice, this offset may be quite large since the optical sensor may perform multiple functions (e.g. as a paper sensor) and its position may be chosen to optimize some other functionality. This down-web sensor offset can manifest itself as a tracking offset when the media is fed at an angle to the print-head. For example, FIG. 11N illustrates an example scenario where the sensor 438 is upstream of the print-head 180 and the media 302 is being fed at angle −θ to the print-head 180. By construction, the tracking signal T(t) gives the distance of the sensor from the center of the Z's along the paper axis. Using geometry, the print engine can then figure the true tracking $T_p(t)$ at the print-head 180 as $$T_p(t)=T(t)\sec\theta(t)+\underbrace{x_s\tan\theta(t)}_{dynamic\ offset}+\underbrace{(T_s+T_z)}_{Static\ Offset} \quad \text{Eq. (43)}$$

The measurements are both scaled and offset from the true value. In general, angle θ may vary during the print leading to a dynamic offset and scaling in the tracking values. In many embodiments, it may not be possible to measure the angle θ with a single sensor. In such embodiments, if it is assumed that angle θ is the sole source of the media tracking offset (as opposed to lateral translation), we may estimate θ from the measurements as $$\hat{\theta}=\frac{dT(x)}{dx} \quad \text{Eq. (44)}$$

and correct for this error as well. In many embodiments, the offset $x_s$ may be quite small to minimize the magnitude of the error.

Z Pattern Offset Calibration

The printed Z offset can be estimated by scanning the back side of the media as discussed above. Although it's possible that the offset $T_z$ can vary down the length of the media, typically, the offset may be lateral and lack any angular component. Accordingly, in such instances, the offset may remain more or less constant within some tolerance and the print engine may just estimate the average offset once per coated lane of the media.

Figure 11S:
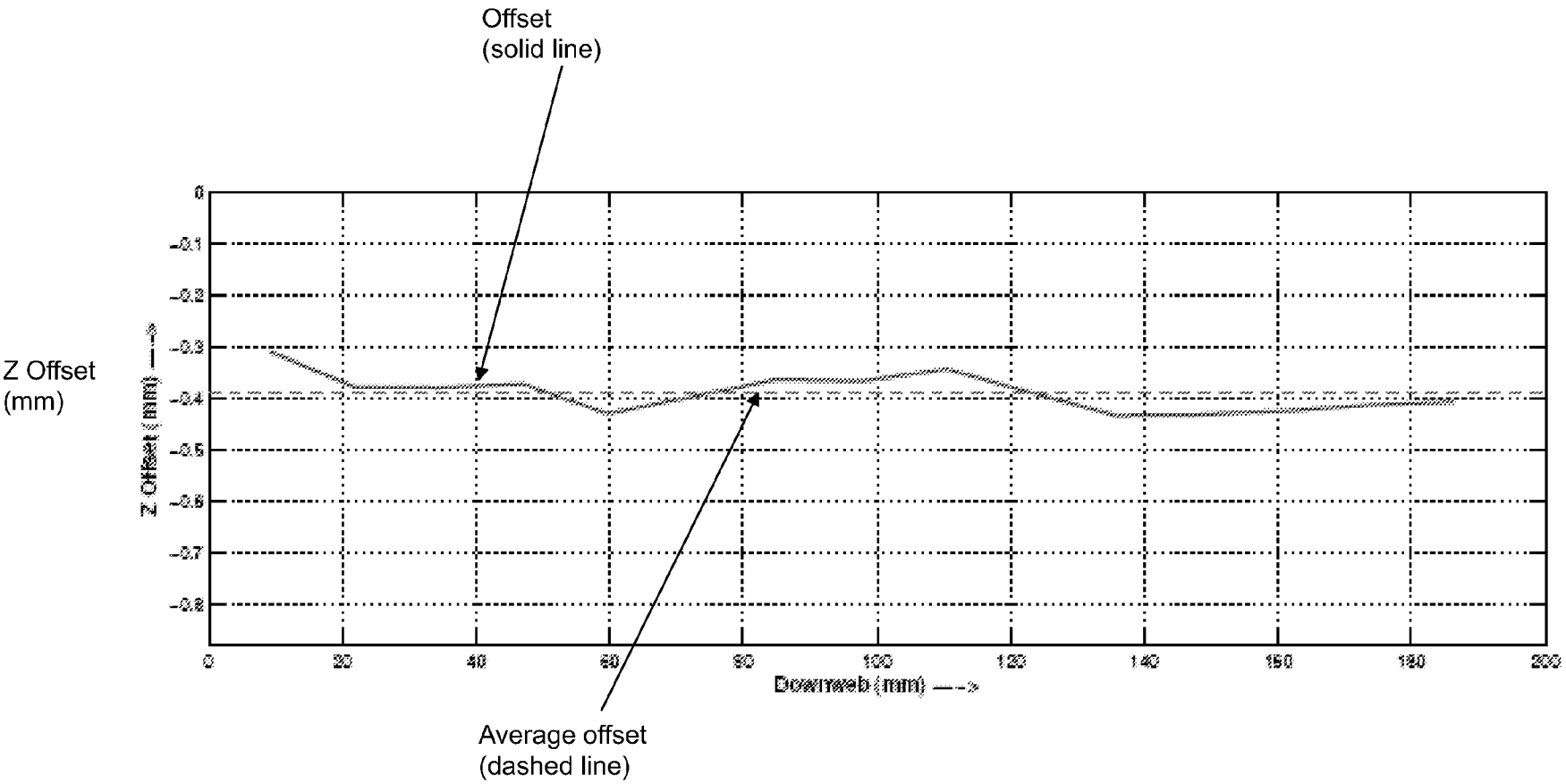
FIG. 11S is a plot of an example of an estimated offset of an exemplary media tracking pattern illustrated in FIG. 11R.
Figure 11T:
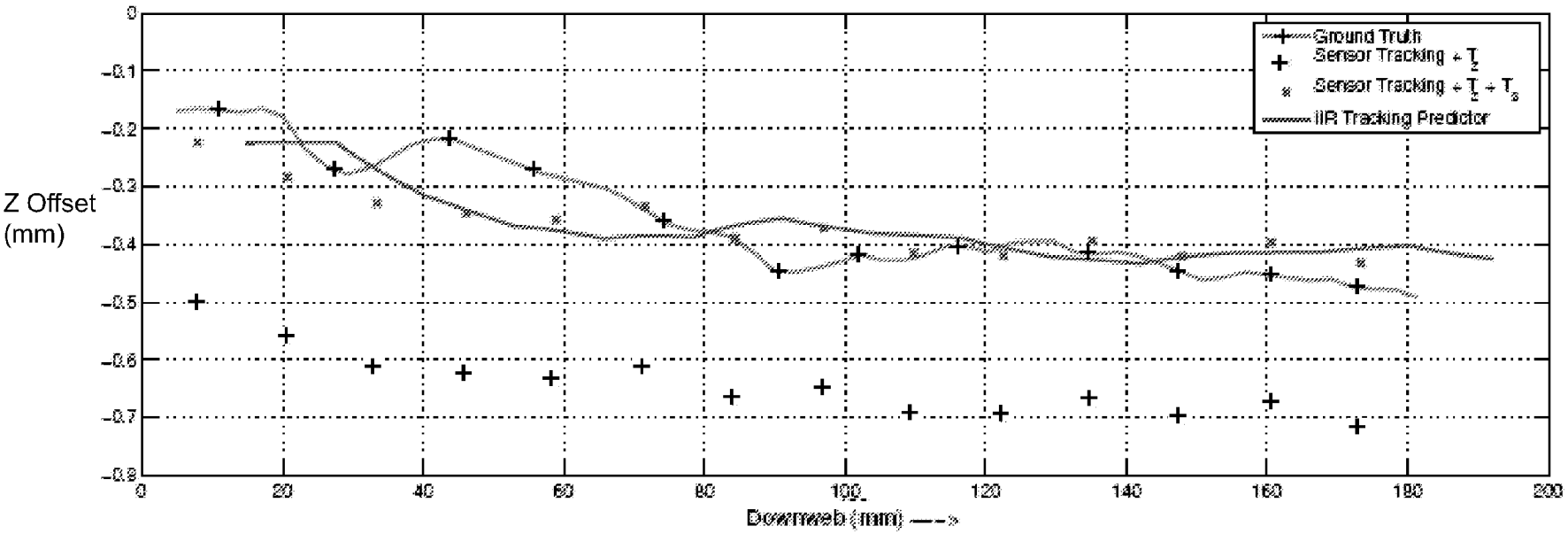
FIG. 11T is a plot showing sensor offset calibration and prediction accuracy for an exemplary media tracking pattern illustrated in FIG. 11R.
Figure 11U:
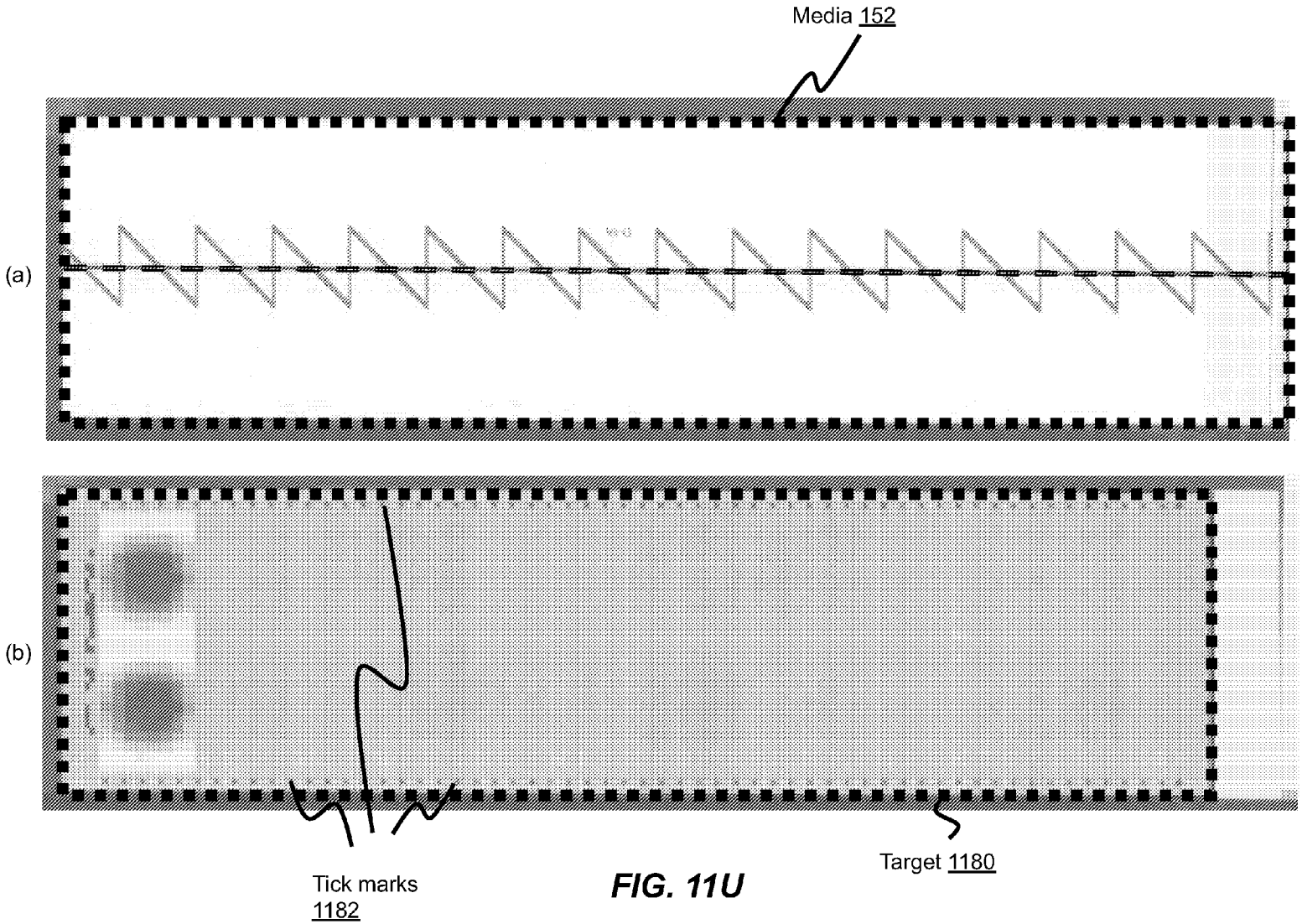
FIG. 11U is an illustration of an exemplary media tracking pattern and an exemplary calibration image for use in a media tracking system.

Referring briefly ahead to FIG. 11U, illustrated in (a) is an exemplary scan of the back side of the media 302. Image processing has been employed to localize the edges of the media (shown in thick black dotted lines). The media 302 has been cut with longitudinal edges in parallel. This a priori knowledge adds robustness to the edge detection process. Once the edges are localized, a 1-dimensional "Z" signal is extracted along the center line (shown as dashed line) and the position of the horizontal and diagonal lines are determined as discussed above. By measuring the distances between the diagonal and horizontal lines, the pattern off sets can be determined similar to the tracking algorithm. Returning to FIG. 11S, illustrated is the estimated "Z" pattern offset for the scan. The offsets (solid line) vary in the example by approximately ±0.05 mm along the length of the media from the mean offset $\hat{T}_z$ (dashed line)=−0.39 mm.

Sensor Position Calibration

In order to calibrate the cross-web position of the sensor, the true tracking $T_p(\bullet)$ is measured in addition to the tracking measured by the sensor. Briefly referring to FIG. 11U, illustrated at (b) is a scan of a printed target 480 that allows measurement of the true tracking of the sensor for calibration of the print engine. This image has tick marks 482 at known positions on the left and right sides of the image that are arranged to be centered with respect to the image.

Once the image 1180 is printed and scanned, image processing is employed to localize the edges of the prints (shown as black large dotted lines) and the tick marks 1182 (shown as grey dots.) The longitudinal edges of image 1180 are again constrained to be parallel. By measuring the distance of the grey dots 1182 with respect to the dotted black lines, the true tracking experienced by the print $\hat{T}_p$ can be estimated. The sensor offset can then be computed from Eq. (42) as $$\hat{T}_s = \text{mean}(\hat{T}_p(\bullet)) - \text{mean}(\hat{T}(\bullet)) - \hat{T}_z \qquad \text{Eq. (45)}$$

where it is assumed that the media angle into the print head $\theta \approx 0$.

FIG. 11T illustrates an example of the ground truth tracking (line marked with crosses) estimated from image (b) of FIG. 11U that includes the printed "Z" pattern offset $\hat{T}_s$ estimated as discussed above (crosses). The mean difference between these two functions represents the sensor offset $T_s$=0.28 mm using Eq. (45). The tracking estimate from the sensor when corrected with all of the calibrated offsets along with the final predictor is also shown (solid line). The root mean square (rms) value of the prediction error is ±0.058 mm in the example illustrated.

Figure 12:
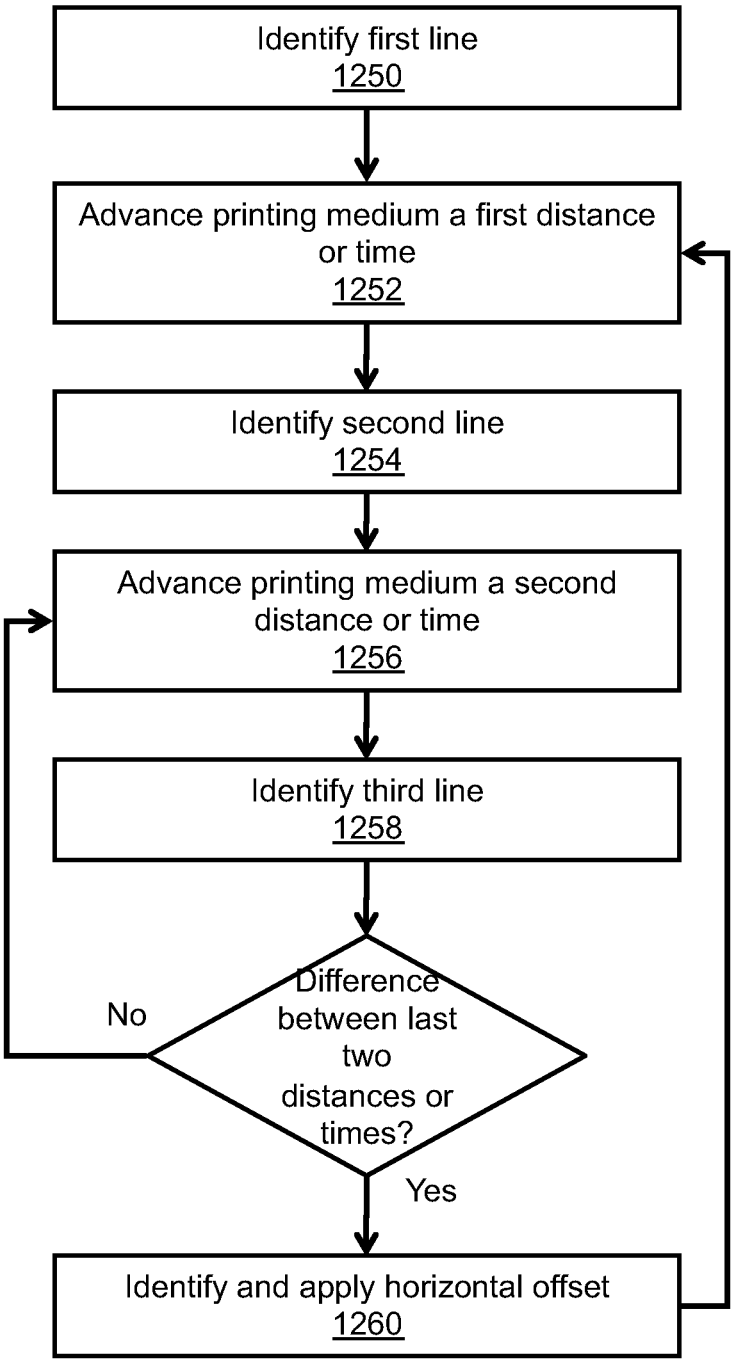
FIG. 12 is a flow chart of an embodiment of dynamic print alignment.

FIG. 12 is a flow chart of an embodiment of dynamic print alignment. At step 1250, the printer may identify a first line of an alignment pattern. The printer may utilize an optical sensor, magnetic sensor, or any other type and form of sensor as discussed above. The printer may identify the first line responsive to a sensor output exceeding a predetermined threshold, or may identify the first line responsive to a change in sensor output over a time period exceeding a threshold. For example, inexpensive or noisy sensors may be used in some implementations where accuracy is not required. Because the sensor output may be moderate while detecting a white or neutral background, instead, the printer may look for a steep change in sensor value to detect the line. For example, a derivative of the sensor output may be calculated and the printer may identify the first line responsive to a change in the derivative exceeding a threshold. Various algorithms may be used to filter the sensor data to detect signals indicative of lines. The alignment pattern may comprise two non-parallel lines, separated by a predetermined distance at a predetermined position of the printing medium. For example, as discussed above, the alignment pattern may comprise a Z with horizontal and diagonal lines, the horizontal and diagonal lines having a predetermined size and thus a predetermined distance between the horizontal and diagonal lines at the centerline of the media. The Z may also be offset to one side or the other due to manufacturing tolerances, and the cassette may be encoded with a value representing a difference between a location of the centerline of the pattern and a centerline of the media. For example, the Z pattern may be printed off-center by 2 mm, and the cassette may be encoded with instructions to print at a default 2 mm offset, further adjusted based on the dynamic alignment methods discussed herein. The pattern may also be printed along an edge of the medium, and the predetermined position may be, for example, a line along the edge of the media. For example, the pattern may be a series of X's, with a predetermined distance between the tips of each X at the edges of the media. One of skill in the art may readily appreciate that other patterns and predetermined distances and positions may be employed.

At step 1252, the printer may advance the printing medium by a first distance or for a first time period. The printer may advance the printing medium by a predetermined distance or may continuously advance the medium at a set speed during printing, which may be dependent on print settings (e.g. draft or fine mode).

At step 1254, the printer may identify or detect a second line. In some embodiments, the sensor output for the second line may have a higher or lower amplitude, or may have a longer or shorter sustained output, which may allow the printer to distinguish between the first line and second line in the alignment pattern. In some embodiments, the printer may skip steps 1256 and 1258, as the distance between two successive lines may be enough to identify an offset and direction, depending on the pattern.

At step 1256, the printer may advance the printing medium by a second distance or for a second time period, as discussed above, and at step 1258, the printer may identify or detect a third line. The printer may determine if there is a difference between the first time period or distance and second time period or distance. If there is no difference, then the printer may identify the media as being properly aligned, and repeat steps 1256-1258. If there is a difference, then the printer may identify the horizontal offset proportional to the difference between the first time period and second time period. As discussed above, in embodiments with a distinct first line and second line, the printer may further identify the direction of the offset based on whether the difference is positive or negative. The printer may apply a horizontal shift in printing of the image at step 1260 corresponding to the offset and repeat steps 1252-1256.

Although discussed above with the alignment pattern centered on the media, the alignment pattern does not necessarily have to be centered. For example, if the alignment pattern is offset to one side during manufacture, the memory of the cassette may be configured with a default offset value for the cassette which may be added to or subtracted from any identified offset determined by the printer via the alignment pattern. For example, if the alignment pattern is 15 pixels to the left of center of the media, then a +15 modifier may be stored on the card and added to an identified offset of −15 if the media is properly aligned, resulting in a net of zero and not causing the printer to adjust printing output. Thus, centering of the alignment pattern need not actually be necessary during manufacture or printing, provided it is consistent within the roll of media.

In some embodiments of printers 100, 200, the printer may heat up during use. For example and as discussed above, a thermal printer may heat up resistive print elements to print pixels and/or activate color-forming dyes in a print medium. Additionally, to print quickly, the thermal printer may preheat the print elements to a temperature above ambient temperature but below a temperature at which a first color-forming dye is activated, reducing the amount of additional energy needed to print a pixel. For example, if a first color-forming dye becomes activated at a temperature of 90 degrees Celsius for a predetermined time, by preheating print elements to a temperature of, for example, 30 degrees Celsius, the printer need only raise the elements another sixty degrees to begin printing the pixel rather than the seventy degrees needed from a room temperature of 20 degrees Celsius. Although this may seem like a minor difference, it may be important for high speed printing, particularly with dyes that require heat at an activation temperature for an extended period of time. Because the ambient temperature is closer to this activation temperature, the dye may be raised to activation temperature more quickly, resulting in reduced or eliminated activation of other dyes as heat transfers through the medium). Similarly, ink jet printers may include heating elements to heat ink to ensure proper flow. However, if the ambient temperature around the print head becomes too high and/or if the heating elements or print head cannot shed heat quickly enough, a thermal printer may be unable to avoid printing a pixel where a blank space is required or pixels may be oversaturated or performance of electronic components in the print head such as driver chips may degrade, or a lower-activation temperature color may be accidentally activated while printing a pixel of a higher-activation temperature color, or ink may congeal, and the printer may have to pause before printing to cool off or delay printing the subsequent print. Although referred to as overheating, in many embodiments, such temperatures may not cause damage to the unit but may degrade printing quality. For example, if the ambient temperature within a thermal printer is too high, color-forming dyes in the media may be activated by such ambient temperature, resulting in oversaturated colors, spurious colors, darkening, or other undesirable visual artifacts. Accordingly, many printers incorporate a heat sink or reservoir to transfer heat from the print head.

Figure 13A:
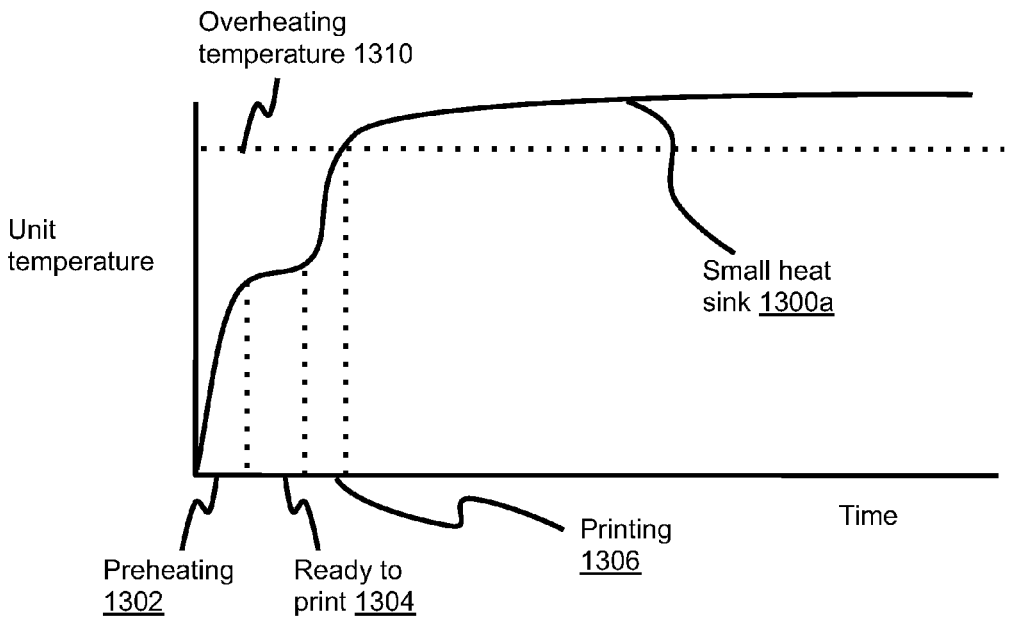
FIGS. 13A and 13B are time-temperature graphs of embodiments of a printer with no heat sink and an oversized heat sink, respectively.
Figure 13B:
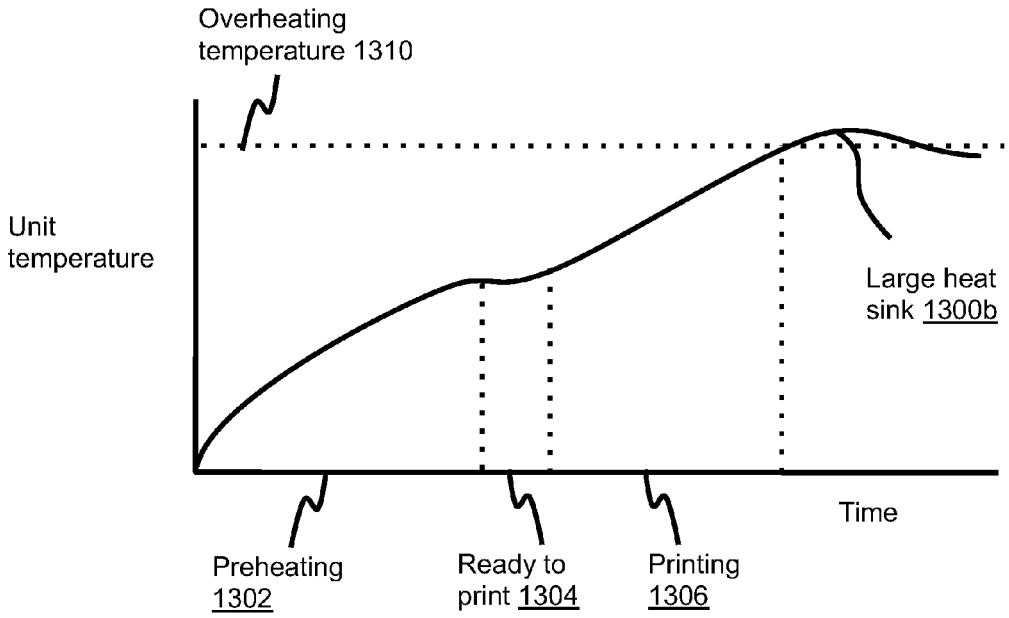

If the printer's heat sink is undersized, the printer may overheat quickly, resulting in reduced printing time before pausing to cool. However, if the heat sink is oversized, the printer may take a long time to preheat one or more print elements. For example, illustrated in FIG. 13A is a time-temperature graph of an embodiment of a printer utilizing no heat sink or an undersized heat sink. As shown, during preheating 1302, a head temperature 1300*a* may rise quickly to a temperature at which the printer is ready to print 1304. However, during printing 1306, the head temperature 1300*a* similarly rises quickly and reaches an overheat temperature 1310 at which the printer must pause to cool down. Conversely, illustrated in FIG. 13B is a time-temperature graph of an embodiment of a printer utilizing a large heat sink. While the printer has an extended printing time 1306, preheating 1302 takes a similarly long time, which may annoy or frustrate users.

Figure 13C:
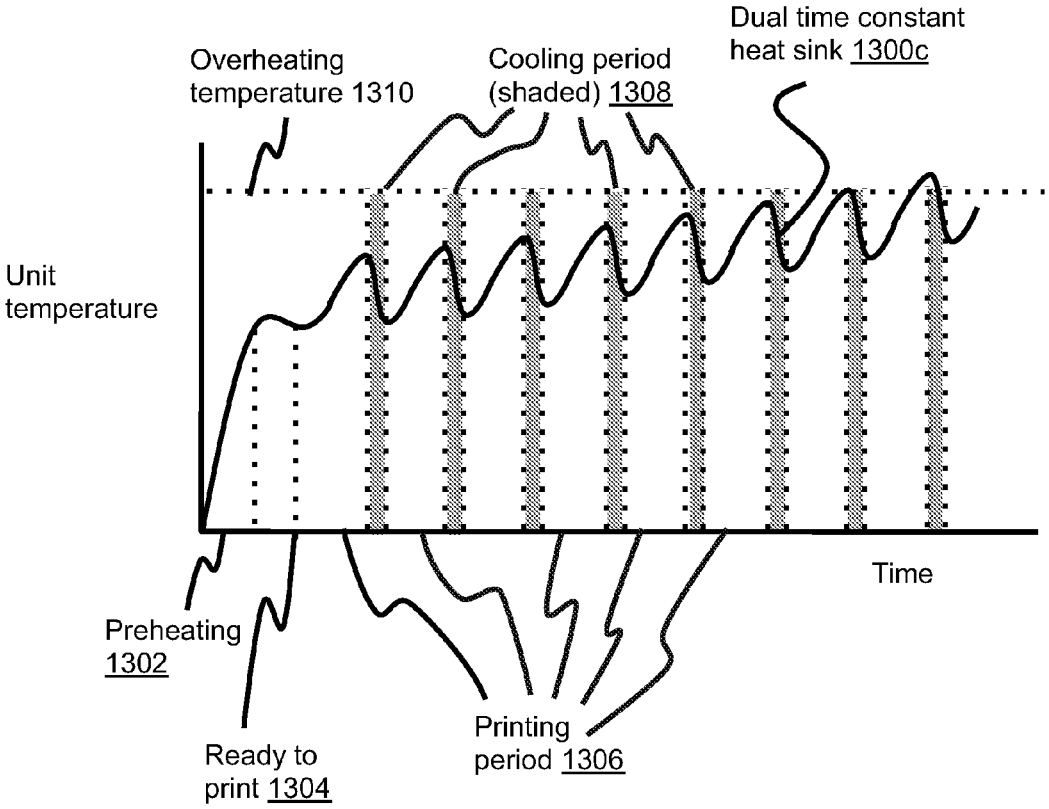
FIG. 13C is a time-temperature graph of an embodiment of a printer with a dual time-constant heat sink.

To solve these contrasting requirements of quick-preheating and slow-overheating, a hybrid heat sink or dual time-constant heat sink 1300*c* may be employed. The print head heat sink or a portion of the heat sink in contact with the print head with a first time constant may allow a head temperature to rise quickly to a first temperature allowing quick preheating. As shown in FIG. 13C, during printing periods 1306, the temperature of the print head may rise sharply. However, during cooling periods 1308 (illustrated as shaded bands), the print head heat sink may shed heat relatively quickly into a larger heat reservoir or portion of the heat sink having a second time constant, reducing temperature of the print head, and allowing a longer overall printing time. Furthermore, because typical printing does not require full saturation of every pixel, the print head will typically not be heated to overheating temperature 1310 during a first printing period 1306 (e.g. during printing of a first label), and thus may cool substantially during non-printing intervals as shown in FIG. 13C. A user may thus be able to print a large number of labels before the unit needs to pause for cooling. Additionally, because of the large heat sink or heat sink reservoir, during such required pauses for cooling after overheating 1310, the temperature of the print head and ambient temperatures in the printer may quickly drop, resulting in shorter required pauses.

Additionally, during printing of images that have different densities laterally across the media, the print head may heat unevenly, with one end of the print head being hotter than the other end, or one position on the print head may have a temperature different from another position, complicating control of print density. Accordingly, a hybrid heat sink or print head heat sink having a fast time-constant in the vicinity of the heaters may allow heat to diffuse quickly across the print head, reducing or eliminating these temperature variations.

Figure 13D:
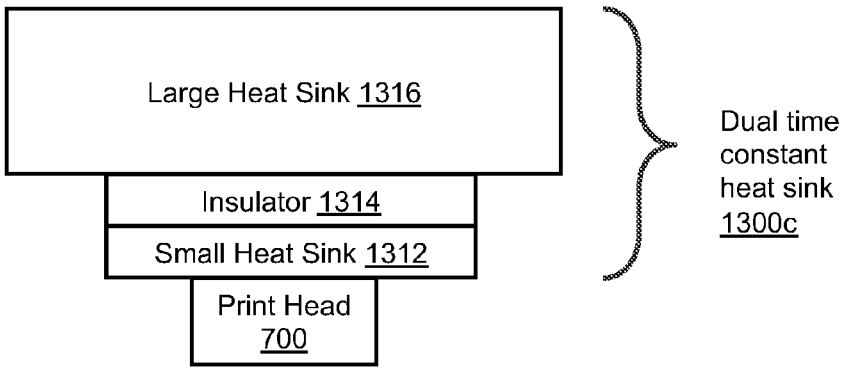
FIG. 13D is a diagram illustrating an embodiment of a dual time-constant heat sink.

FIG. 13D illustrates one embodiment of a hybrid or dual time-constant heat sink. As shown, a print head 700 may be connected or attached to a small heat sink or print head heat sink 1312. The small heat sink 1312 may comprise aluminum or other materials or combinations of materials with a high thermal conductivity, and may have a small volume, such that the small heat sink 1312 may have a low thermal capacity or may quickly reach the temperature of the print head 700. The small heat sink 1312 may be connected to a large heat sink or thermal reservoir 1316 via an insulator 1314. Large heat sink 1316 may also comprise aluminum or other materials or combinations of materials with a high thermal conductivity and may have a large volume and/or large surface area or a high thermal capacity to allow absorption and release of heat. For example, large heat sink 1316 may have fins for radiative cooling.

Insulator 1314 may comprise any type and form of static or dynamic thermal insulator for preventing or resisting the initial flow of heat from small heat sink 1312 to large heat sink 1316. For example, in one embodiment, insulator 1314 may comprise an air gap. Large heat sink 1316 may be separated from small heat sink 1312 by the air gap during preheating, and when the printer is ready to print, the large heat sink 1316 may be moved into position against small heat sink 1312. This may require an additional motor or lever to move the heat sink. In other embodiments, a bimetallic strip or passive thermosensitive switch attached to the small heat sink 1312 or print head may bend due to a rise in temperature and contact large heat sink 1316, providing a path for shedding excess heat. In other embodiments, magnets or electromagnets may be employed to move large heat sink 1316 and small heat sink 1312 into contact.

In other embodiments, insulator 1314 may comprise a material with a low thermal conductivity or conductivity lower than that of aluminum, such as brass, nickel, iron, steel, plastic, glass, or any other type and form of material or combination of materials. For example, insulator 1314 may have a thermal conductivity of between 0.1 and 0.6 W/mK, compared to a thermal conductivity of around 200 W/mK for aluminum alloys. In use, the small heat sink 1312 may quickly heat up with the print head 700 during use. Insulator 1314 may prevent energy from flowing quickly into large heat sink 1316. However, once the printer has overheated and printing is paused, the large heat sink 1316 may quickly shed heat, reducing the time during which the printer needs to be paused. Additionally, in practice and when not printing fully saturated images, as the print head 700 is not on at all times, the large heat sink 1312 provides significant cooling of the print head 700 after each print, increasing the time for the print head to reach the overheating temperature 1310.

In still other embodiments, insulator 1314 may comprise a controllable heat pipe or other such element allowing the heat sink to be "switched" on and off, or enabled or disabled dynamically for preheating or printing. For example, flow of a cooling fluid within a heat pipe may be throttled to control cooling.

As discussed above, some printers may include auto-ejection mechanisms to eject printed and cut media. However, in some embodiments, for example due to the small size of the printer, it may not be practical to include an ejection mechanism. For example, some versions of printer 200 may not include an auto-ejection mechanism. Cut media may fall freely from the media ejection slot of the printer, or may be retained within or rest inside the printer. This may cause a problem in unattended printing if full cuts are used, rather than the multiple image kiss cut method discussed above. For example, if a user is printing several images from a tablet computer with full cuts after each image, a previously printed and cut image may impede the forward progress of media during printing. This may cause slippage or stuttering, resulting in visual artifacts or banding on the printed image. Accordingly, with such printers, it may be desirable to ensure that the user is physically present at the printer after printing and cutting the image and may remove the printed media from the printer.

Figure 14A:
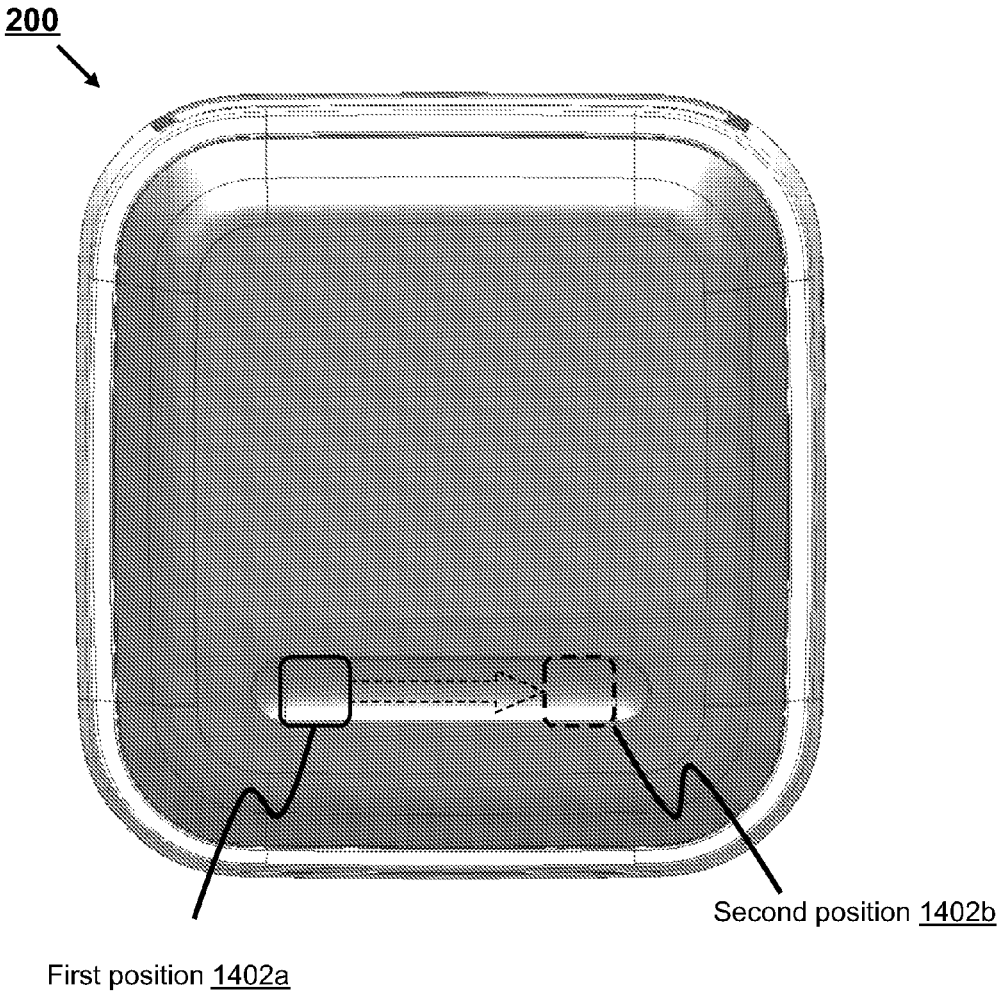
FIG. 14A is a diagram of an embodiment of a manually triggered cutting mechanism.

One method of ensuring the user is at the printer may include requiring the user to perform a gesture or movement to cut the media, such as a swipe-to-cut gesture. FIG. 14A is a diagram of a user-triggered cutting mechanism. A printer 200 may include a cut sensor, or a slot or channel with multiple sensors. The sensors may comprise capacitive sensors, optical sensors, resistive sensors, or any other type and form of sensor and/or switch or button. The channel may further include one or more lights or LEDs to light when a corresponding sensor is activated. A user may move their finger from a first position 1402*a* corresponding to a first sensor to a second position 1402*b* corresponding to a second sensor. If the printer detects successive activation of each sensor within a predetermined time period, the printer may interpret the sensor input as a swipe gesture, and execute a full cut in the media, including advancing or retracting the media to position the media under a full cutter as discussed above. The cut sensor may include one or more intermediate sensors between the first position 1402*a* and 1402*b*. For example, the sensor channel may include three sensors, and the printer may detect successive activation of a left sensor, middle sensor, and right sensor within the predetermined time period to identify a swipe gesture. The printer may be configured to identify the swipe gesture responsive to left-to-right activation of the sensors, right-to-left activation, or both. In some embodiments, the printer may include a physical slider that the user may move from the first position 1402*a* to the second position 1402*b*. Such slider may not be connected to the cutter mechanically, but instead activate one or more contacts or switches which may be interpreted by the printer as a cut command.

Figure 14B:
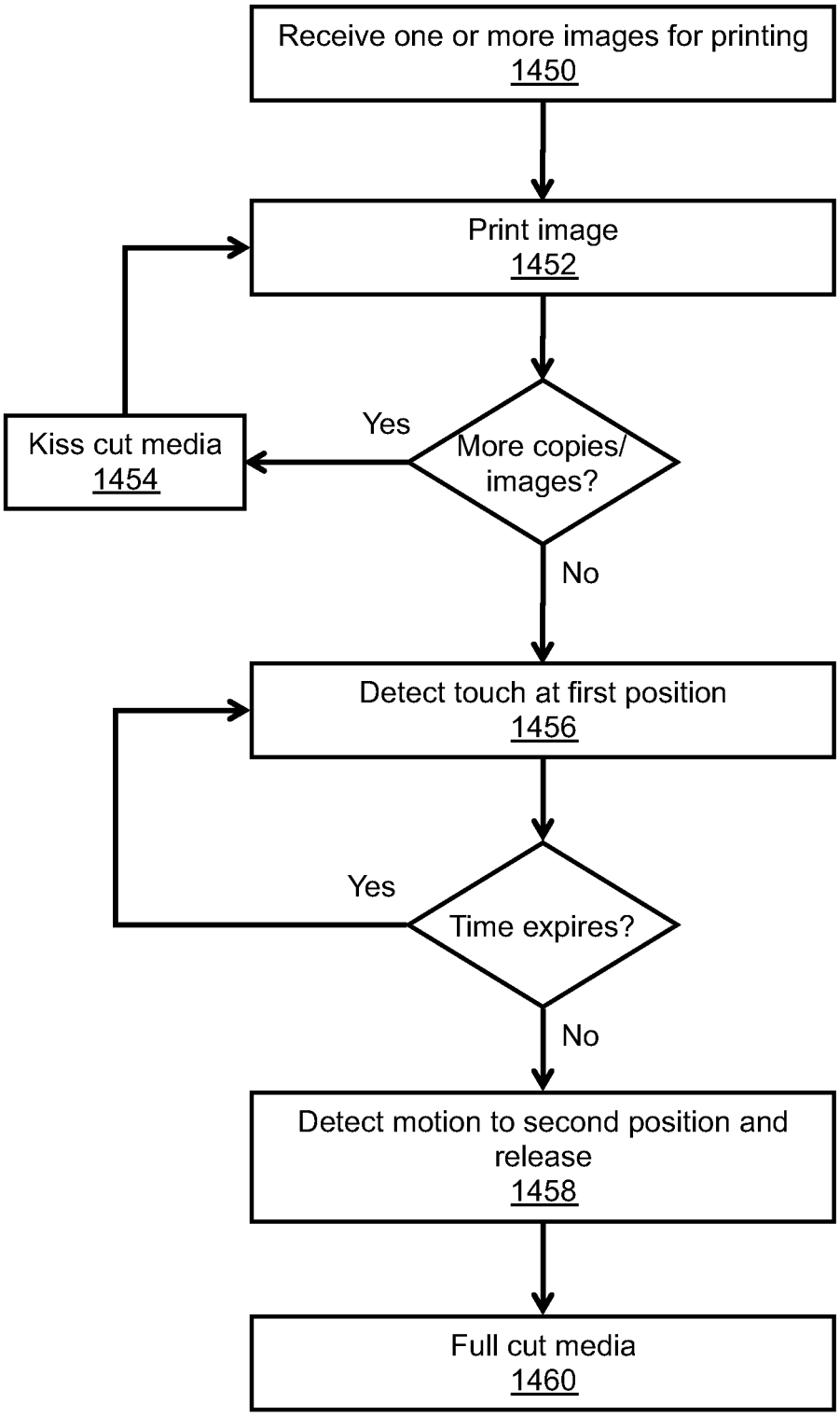
FIG. 14B is a flow chart of an embodiment of printing multiple images with a manually triggered cutting mechanism.

Referring now to FIG. 14B, illustrated is a flow chart of a method of printing multiple images with a manually triggered cutting mechanism. At step 1450, the printer may receive an image for printing. The image may be an image edited on the printer, or may be an image created, generated, downloaded, and/or edited and transmitted from a second device, such as a tablet computer, smart phone, laptop or desktop computer, or any other type and form of device. The printer may receive one image or may receive multiple images and queue subsequent images for printing. The printer may also receive a command to print multiple copies of any image. At step 1452, the printer may print the first image, using any of the techniques discussed above.

As discussed above, if the printer receives multiple images for queuing and printing or is commanded to print multiple copies of an image, the printer may kiss cut the media at step 1454 and advance the media for printing a subsequent image. The printer may repeat steps 1452-1454 for any additional images or copies. In some embodiments, the printer may receive additional images while printing, and may thus repeat steps 1450-1454 as necessary.

At step 1456, the printer may detect activation or touch of a first sensor at a first position. Upon detecting release or deactivation of the first sensor, indicating that the user's finger has moved from the sensor, the printer may initiate a countdown timer of a predetermined time or duration, such as 3 seconds, 5 seconds, or any other value. If no activation of a second sensor at a second position is detected before the timer expires, then the printer may return to step 1456 and wait for activation of a sensor again. In some embodiments, the printer may include multiple sensors and look for release or deactivation of a first sensor and activation of a second sensor within a short time period, and then deactivation of the second sensor and activation of a third sensor within another short time period. Thus, the timer may be reset or multiple timers may be used.

If at step 1458 the printer detects activation of a second sensor at a second position (or motion of the user's finger via multiple sensors or a slider as discussed above to the second position), the printer may, at step 1460, perform a full cut on the media. As discussed above, performing the full cut may comprise advancing or retracting the media into position for cutting. Because the user has just performed the swipe gesture, the user is in physical proximity to the printer at the time of cutting media and may manually remove the media from the printer's media ejection slot.

Additionally, if multiple images are queued for printing, such as multiple address labels, the printer may perform kiss cuts between each image as discussed above. However, at any point during printing, the user may perform the swipe gesture or activate the sensors to command the printer to cut the media. Responsive to detecting the activation or gesture, after completing printing of any currently printing image, the printer may perform a full cut rather than a kiss cut, and then continue printing the queued images or copies. This may allow a user to begin using a cut strip of printed labels while the printer continues with the queue.

Figure 15A:
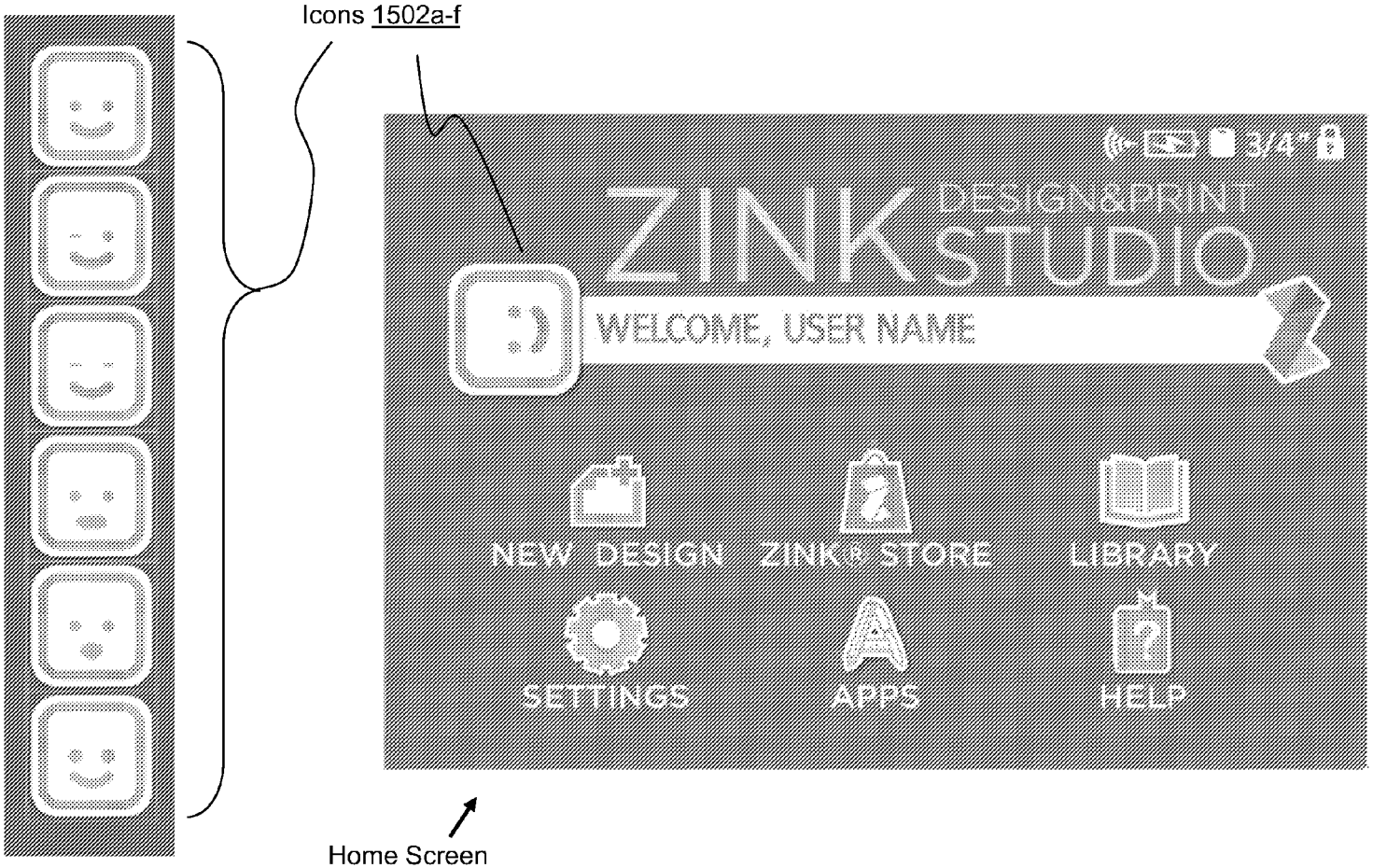
FIGS. 15A-15P are illustrations of an exemplary user interface.
Figure 15B:
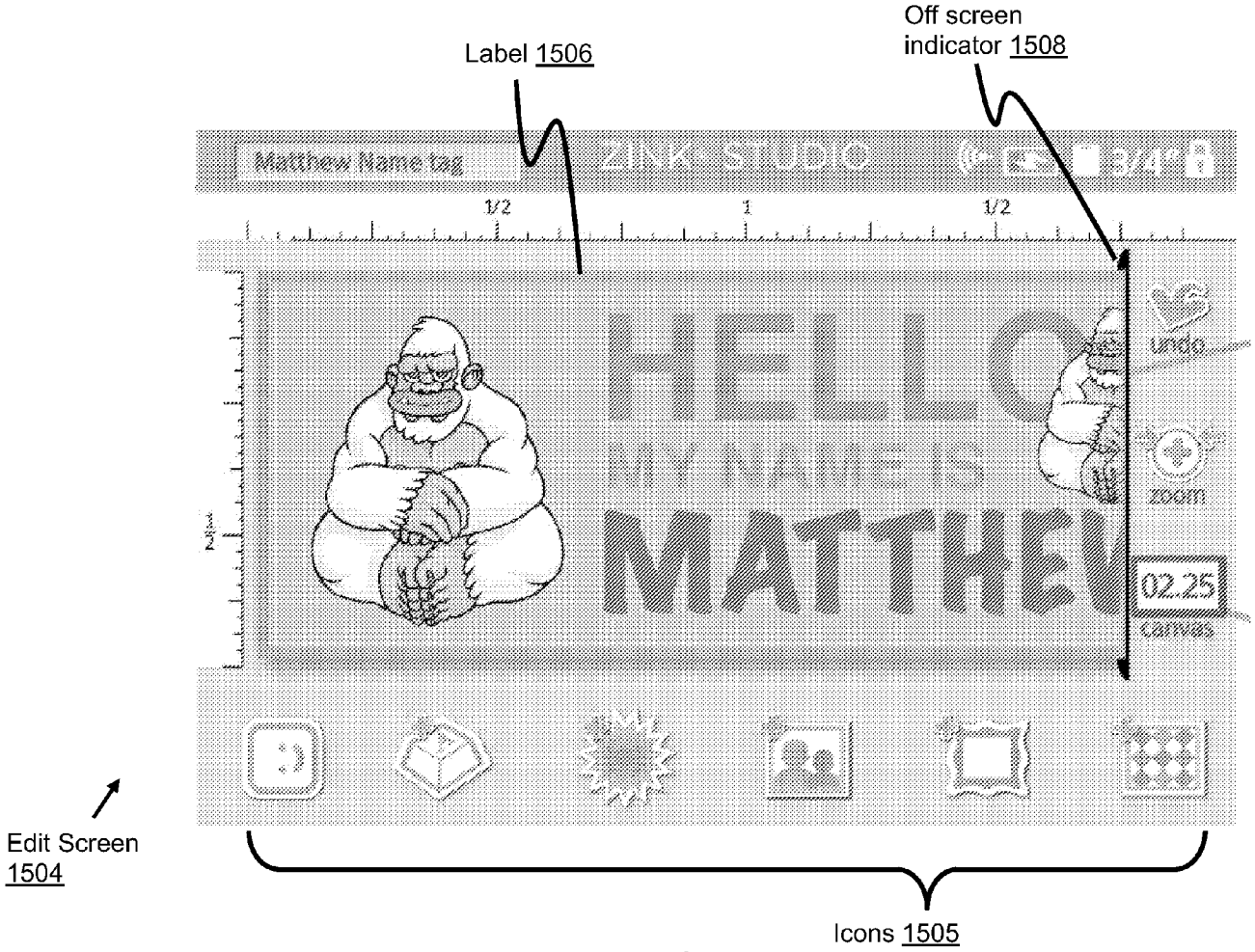
Figure 15C:
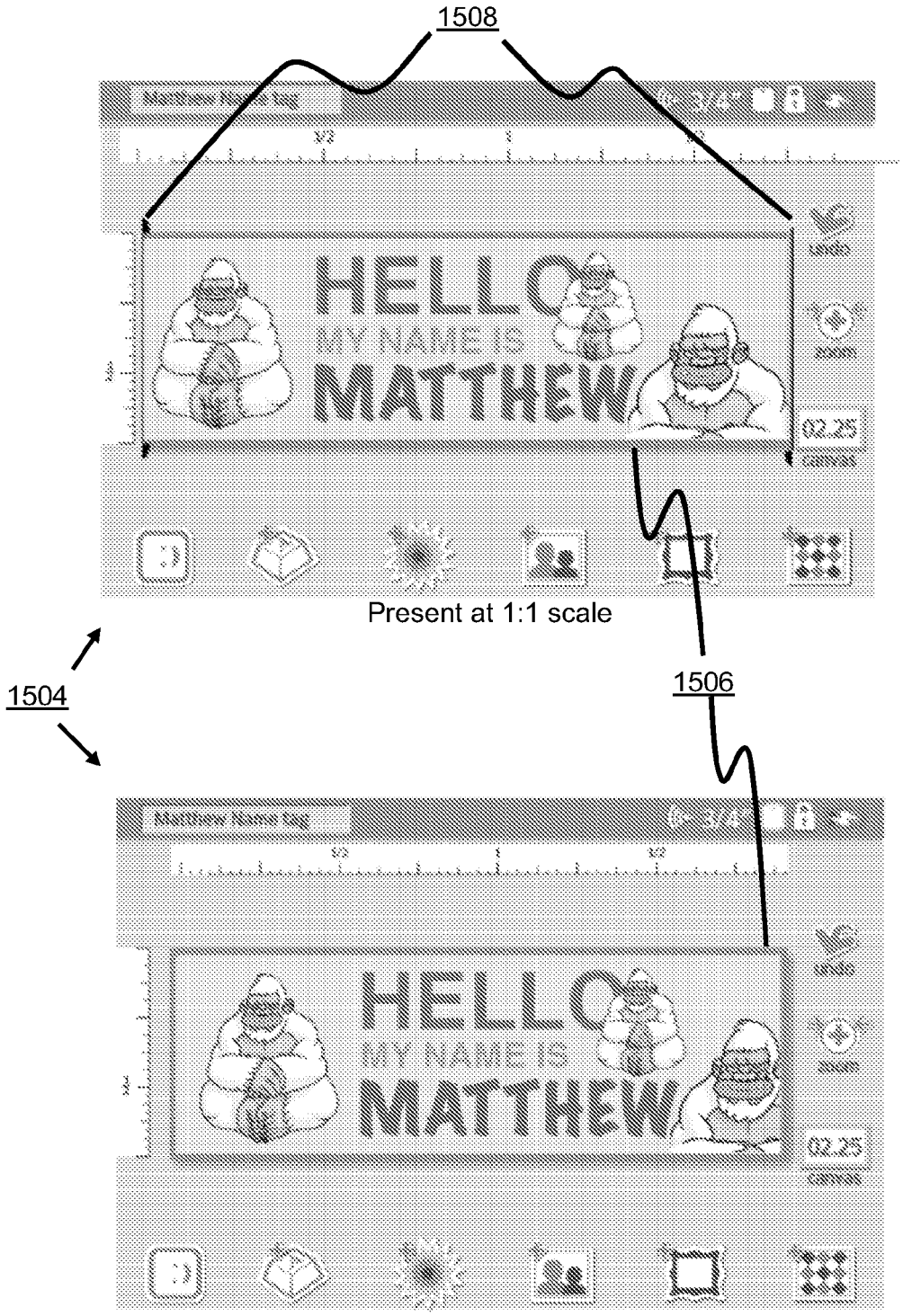
Figure 15D:
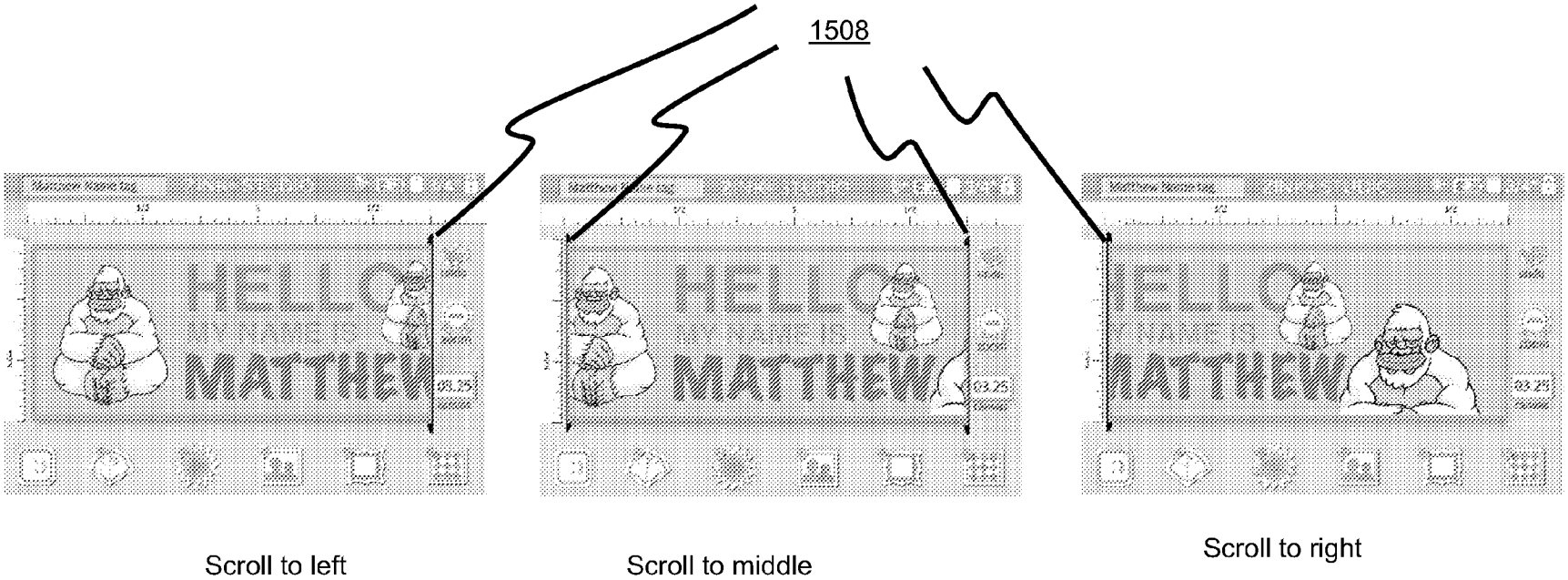
Figure 15E:
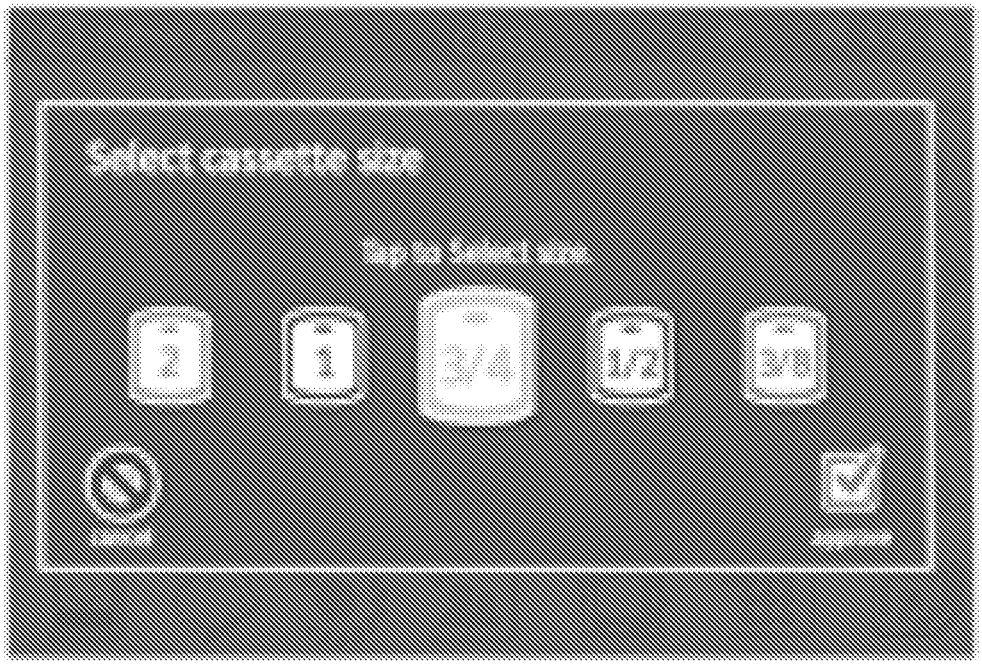
Figure 15F:
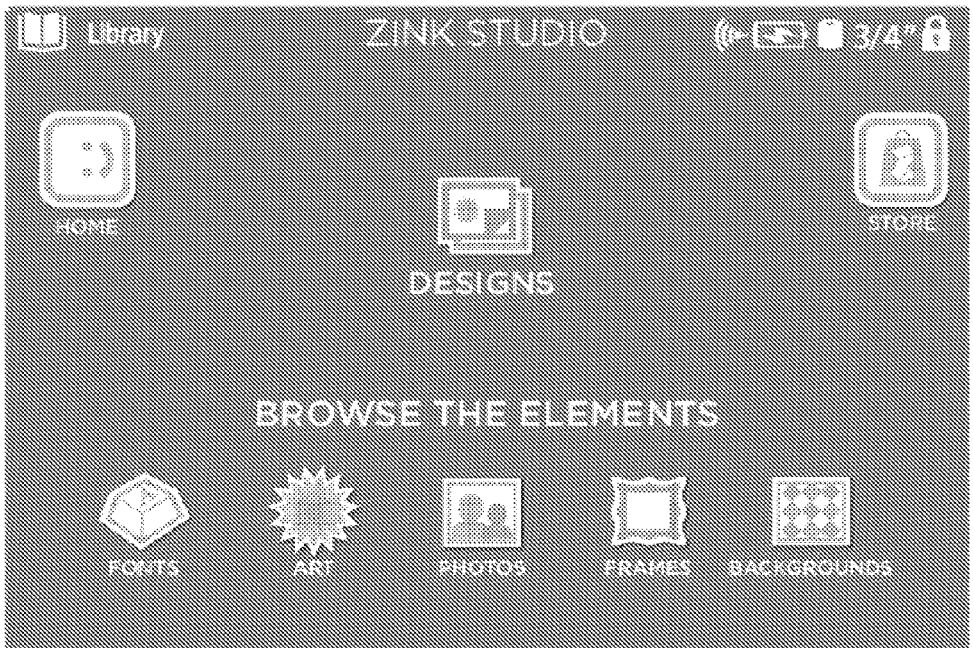
Figure 15G:
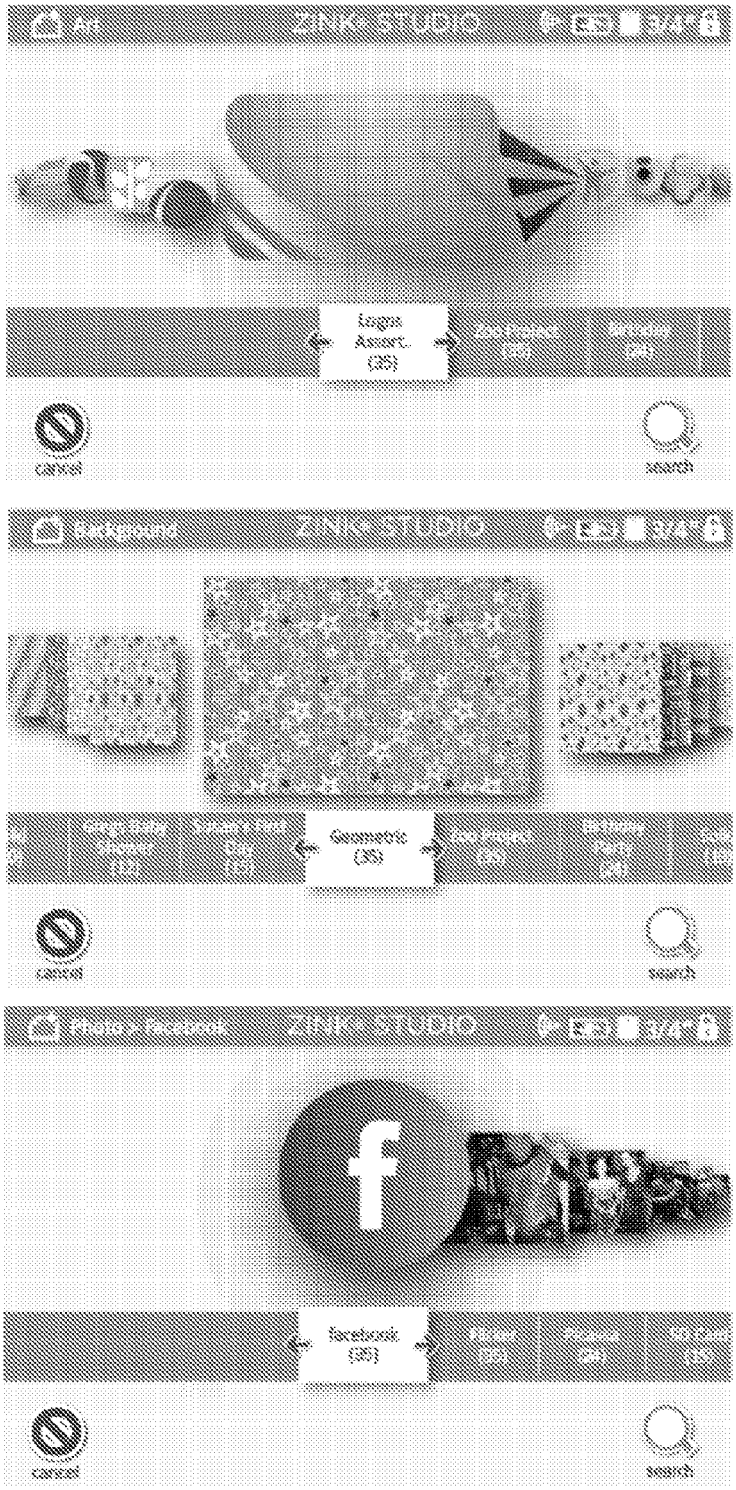
Figure 15H:
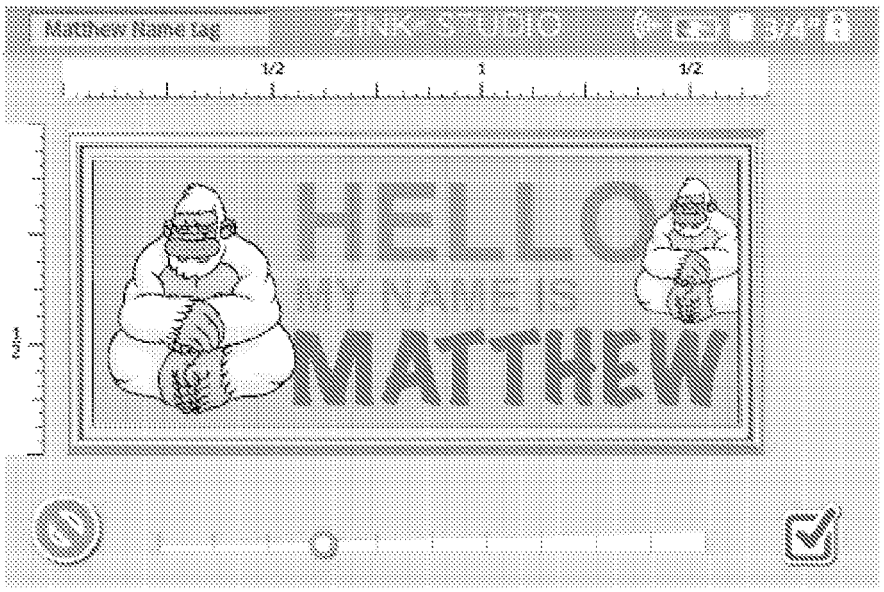
Figure 15I:
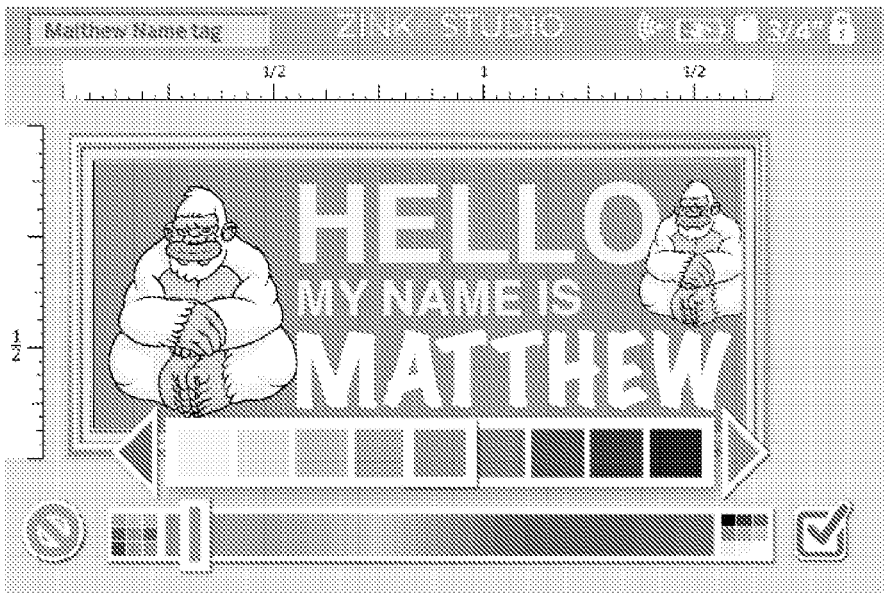
Figure 15J:
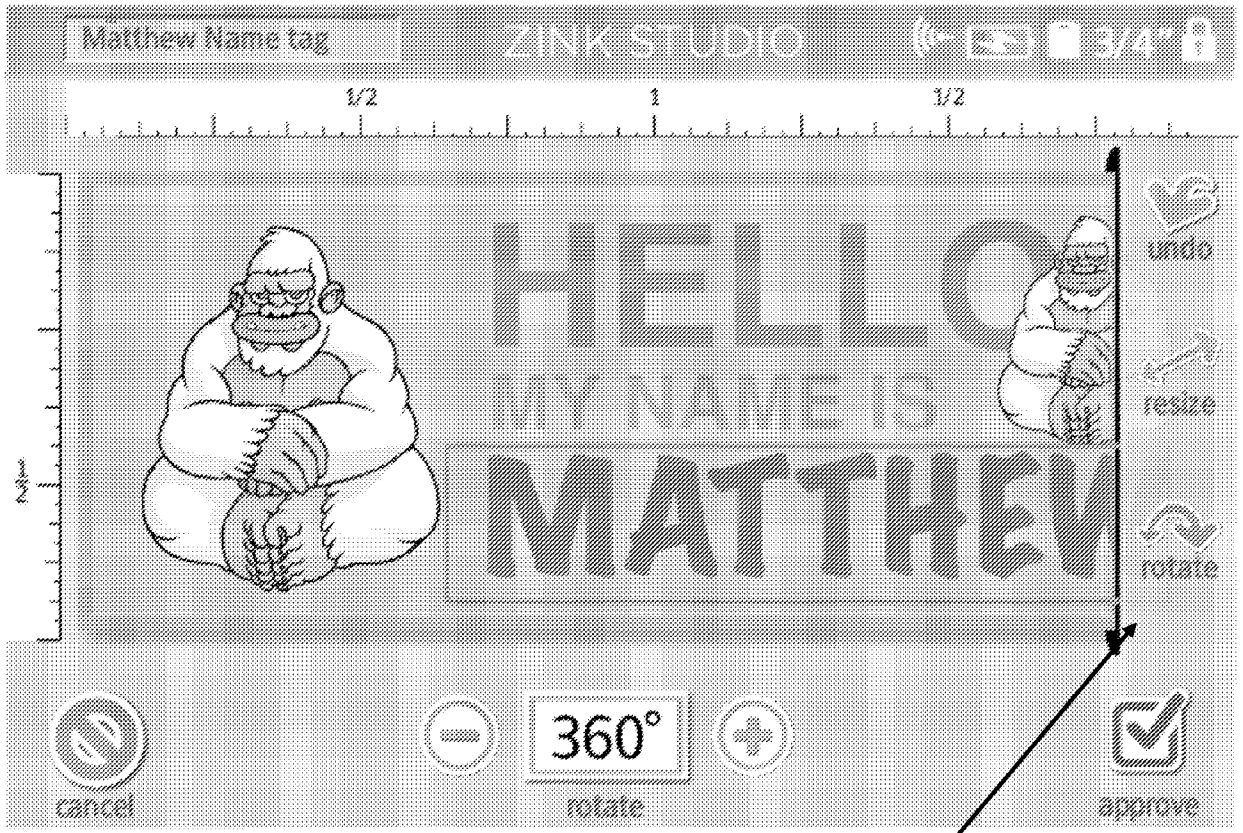
Figure 15K:
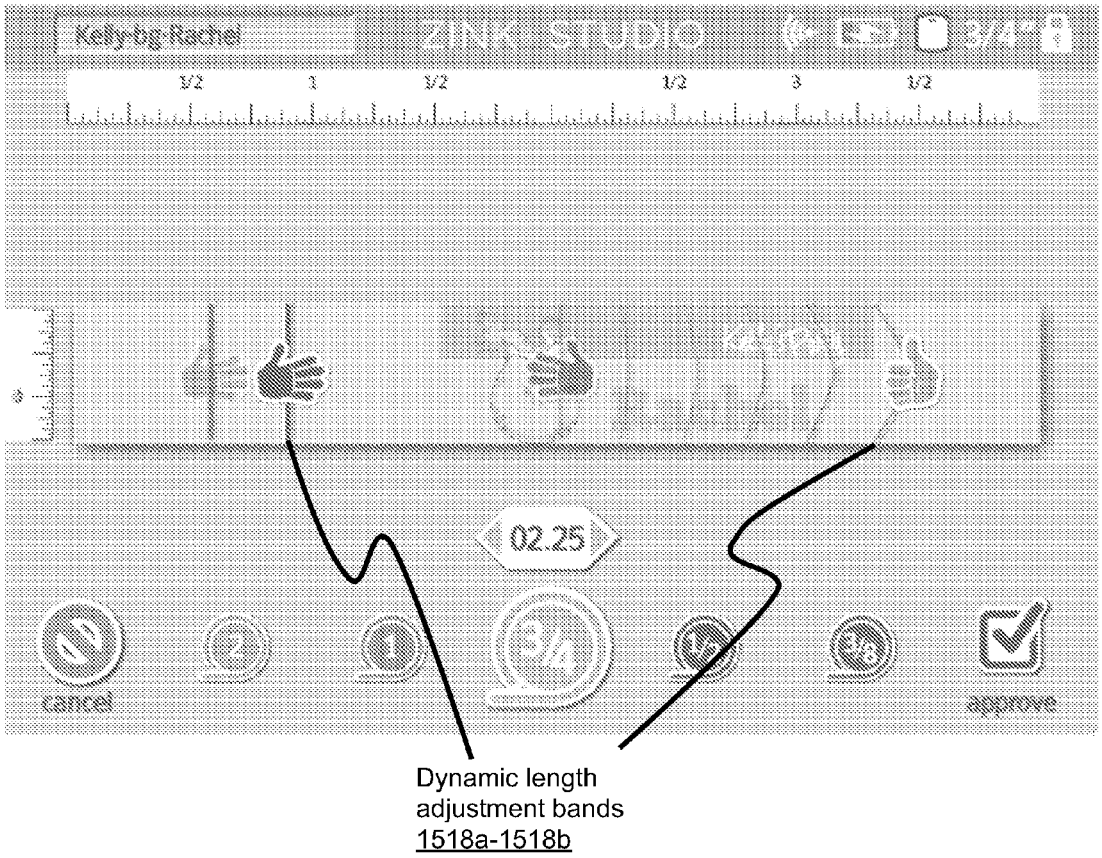
Figure 15L:
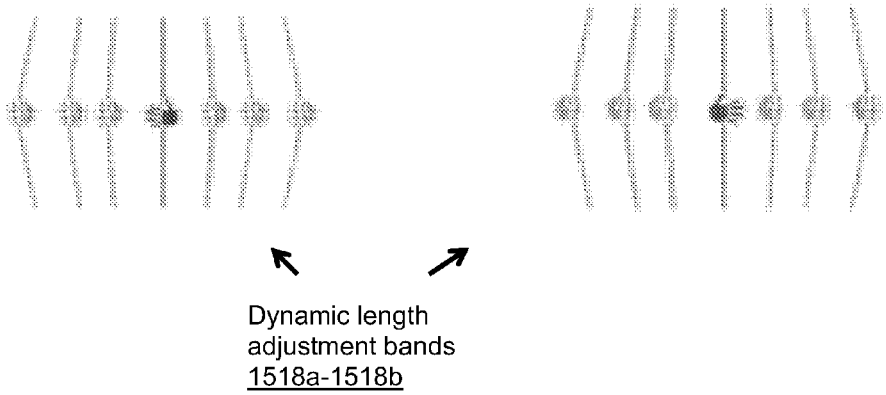
Figure 15M:
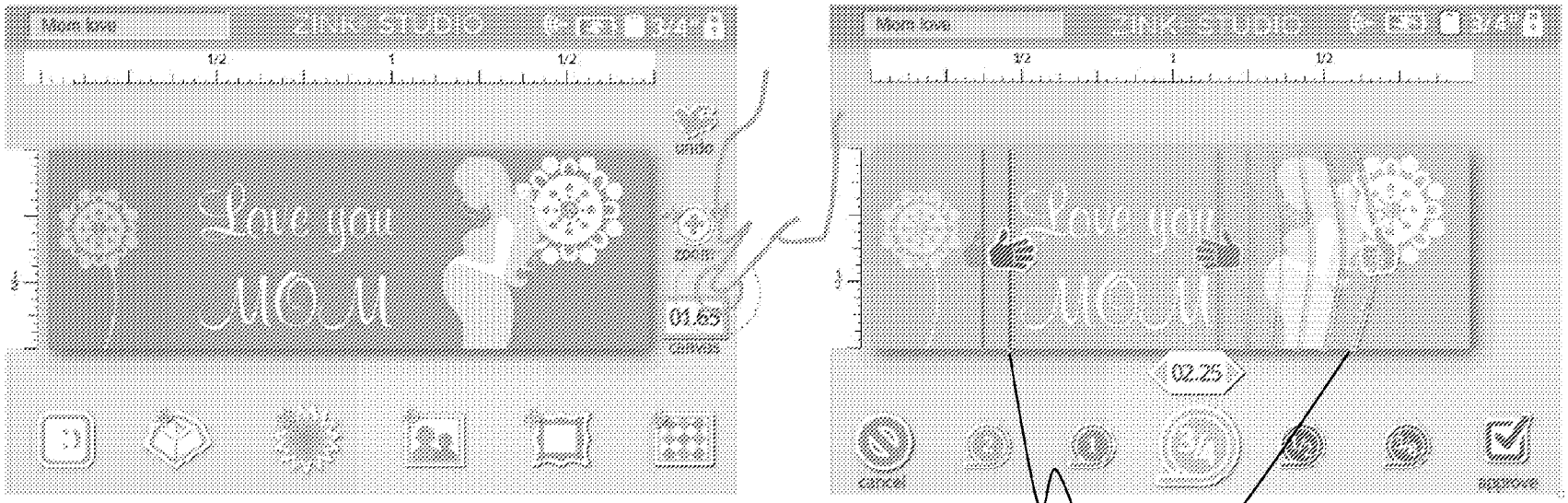
Figure 15N:
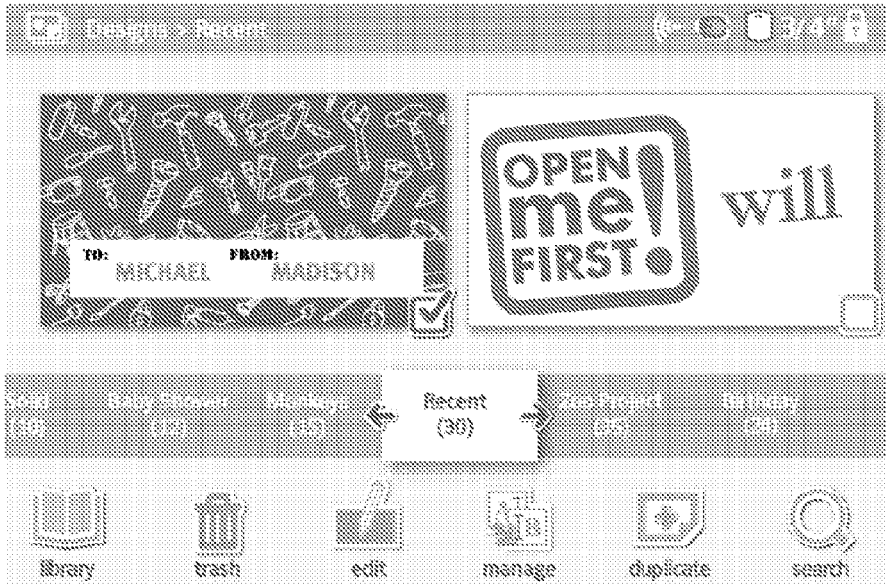
Figure 15O:
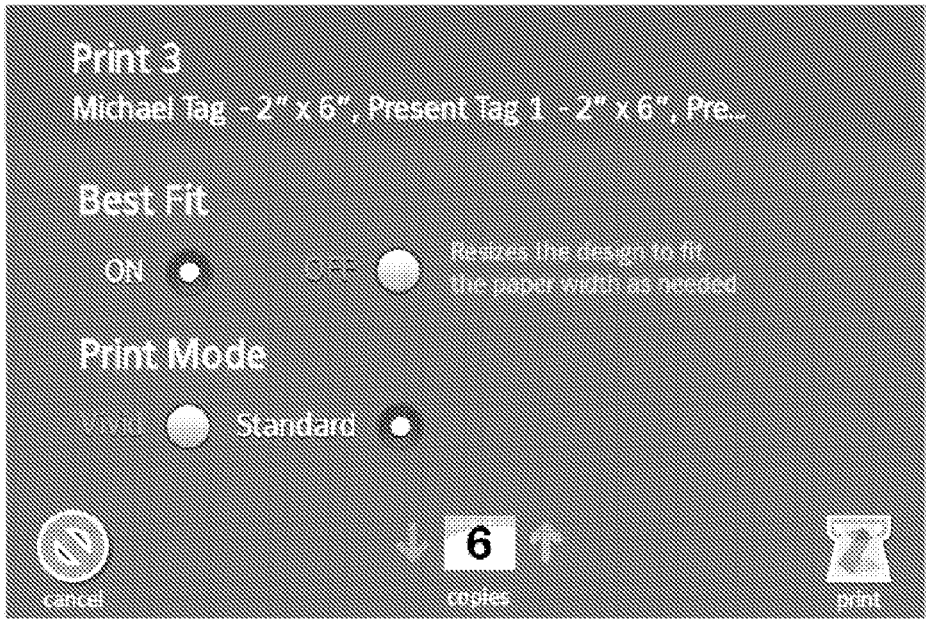
Figure 15P:
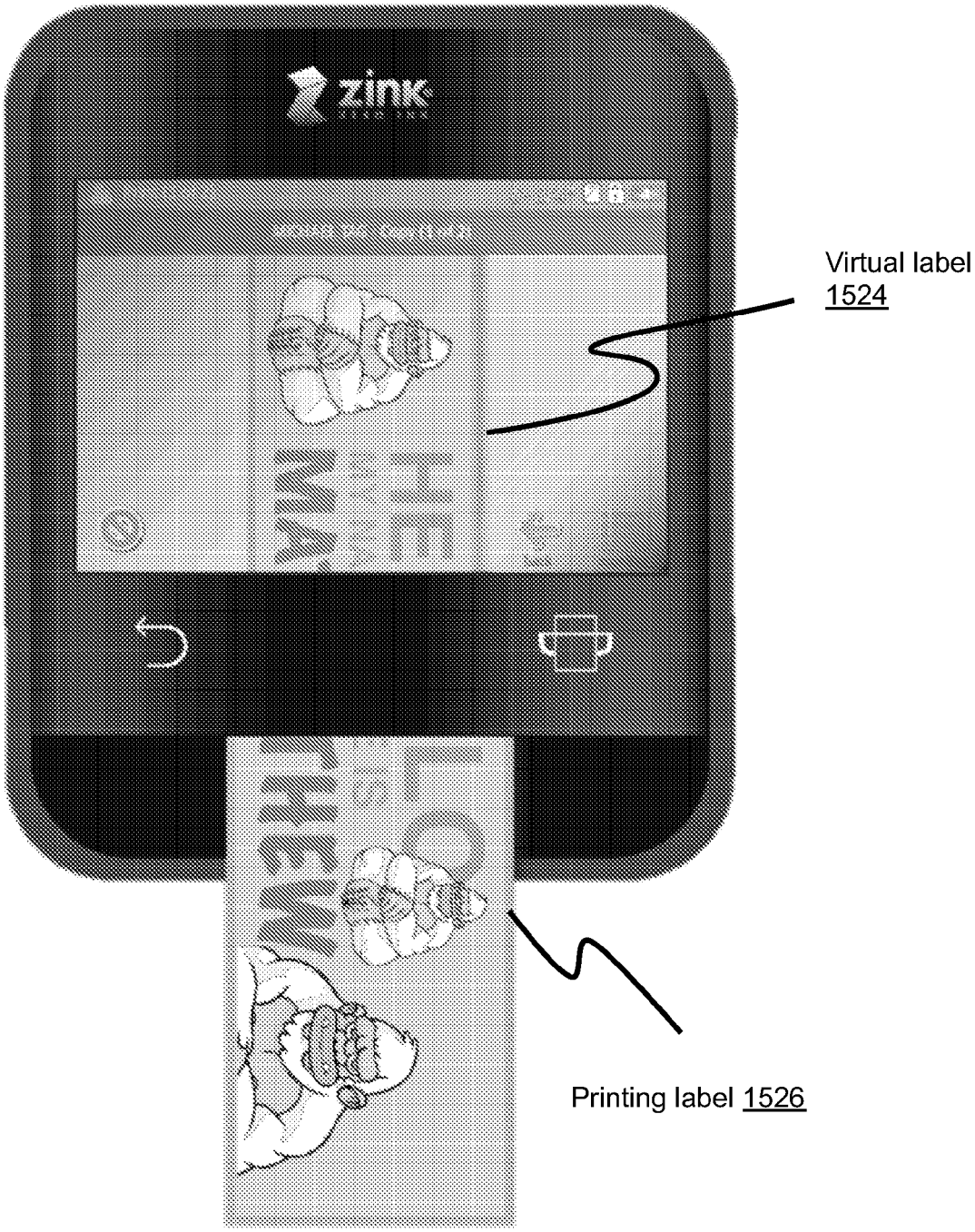

FIGS. 15A-15P are illustrations of an exemplary user interface that may be displayed on a display of a printer 100, or may be provided by a web browser and/or application of a tablet computer, such as a tablet computer, smart phone, or laptop or desktop computer. The application may comprise a native application (e.g. an iOS app for an Apple iOS device), an application provided by a web browser such as a Flash application or HTML5 application, an interactive web site, or any other type and form of application. The application may comprise multiple sub-parts or other applications. For example, as shown in FIG. 15A, the application may include a home screen 1500 for navigation among multiple applications such as an editing application, an interface for an online store, a library application, a configuration application, a help application, or other applications. These applications may be separate or may be part of the application providing the home screen 1500. The home screen may include an avatar or icon representing an avatar, which may be animated, as with icons 1502*a*-1502*f*. For example, icons 1502*a*-1502*f* may be rotated or alternated to make the avatar appear to talk or blink. Such animation may be done in conjunction with audio playback, such as a recorded message or text-to-speech output.

In some embodiments, a home button on a printer, such as button 118 shown in FIG. 1H, may be used to return to the home screen 1500. In other embodiments, a return or home button may be displayed in the application or in a sub-application, or a gesture may be used to return to the home screen 1500, such as a four-finger swipe to one side or up or down.

The application may include an edit screen 1504, as shown in FIG. 15B, which may allow for WYSIWYG editing of an image or label 1506. Icons 1505 may presented for adding elements, photos, borders, text, or patterns to the image, as well as modifying length or width of the image. The image may be shown in a 1:1 scale view or a scaled view in which the entire image fits on the display. In the 1:1 scale view, if the image extends beyond the display, an off screen indicator 1508 may be displayed to indicate that the image extends farther than the screen can show. A user may use a gesture to scroll the image, such as a two or three-finger scroll.

For comparison, these views are shown in FIG. 15C. On the top, the image is displayed in a scaled or fit to length mode in which the entire image 1506 is displayed, while on the right, the image is displayed at a 1:1 scale and extends off the left and right of the display. In the fit to length mode, the aspect ratio of the image may be preserved. For example and as shown, the height or width of the image may be reduced to preserve the ratio between the height and the scaled length. As shown in FIG. 15D, off screen indicators 1508 may be removed or displayed as the image is scrolled to the left or right.

In some embodiments, images may be of an explicit width (e.g. 1 inch), and may be printed only on media of that width or larger. In other embodiments, images may be scaled automatically to match the media inserted into the printer. For example, an image may be created of width x and length y. Width x may be dynamically set before printing to the width of the media in an inserted cassette, and length y may be dynamically calculated based on the aspect ratio. The image may be scaled appropriately and printed as a full-bleed image on the media, regardless of media width. Combining these embodiments, the image may also be generated with an explicit width and scaled if necessary if the inserted media does not match the selected width. For example, referring to FIG. 15E, the application may provide a label width selection screen 1510, which may allow a user to select a width for the label or image.

As discussed above, a user may add elements, such as photos, backgrounds, or art or clip-art to an image. Referring now to FIG. 15F, a library element selection screen 1511 may allow a user to select fonts, art, photos, frames, backgrounds, or other such elements, as well as connect to an online store to purchase additional elements. Referring now to FIG. 15G, shown are exemplary element selection screens 1512*a*-1512*c* that may be presented to the user after selecting an element type from screen 1511. The user may select from a category (e.g. "monkeys" or "logos") and visually browse stored elements in that category. The user may use a gesture, such as a swipe, to flip through the index of elements. Categories may also indicate locations, such as a hardware location of stored photos (e.g. in an SD card or in memory of the printer or device), or an online storage or storage associated with an account such as a social network account, a web based image, data, document, file, or video hosting or sharing account or service, or any other type of online data storage.

To facilitate easy, intuitive editing, dynamic sliders may provide a user the ability to modify border sizes or color selection. For example, referring to FIG. 15H, a dynamic border width selection screen 1514 may allow a user to dynamically adjust a border or frame around an image while viewing the result of the adjustment in real time. Similarly, as shown in FIG. 15I, a user may dynamically adjust colors, such as background colors via a dynamic color selection screen 1516. The screen may allow selection of favorite or recently used colors, or may provide a slider for dynamic modification of a color. As shown, in one embodiment, a user may move a slider to adjust hue, and then select saturation and lightness/value via a palette of varying tiles within the hue. Alternately, the slider may be used to select lightness or value with the palette displaying hue and saturation, or the slider may be used to select saturation with the palette displaying hue and value. Other color selection methods may be used, including color wheels or pickers. The color of the selected element may be dynamically modified in real-time as the user selects colors, allowing for easy editing.

As shown in FIG. 15J, various editing controls 1517 may be displayed when a user selects an element within an edit screen 1504. For example, as shown, a user may select an element such as a text box (e.g. the text "Matthew", shown with a selection box around it in FIG. 15J). The element may be dragged around on the screen by the user for placement, and may be rotated and/or resized. In some embodiments, the user may use gestures for editing, such as a pinch gesture to resize the element or a two-finger rotate gesture for rotation, while in other embodiments, the user may use a control 1517 to allow precise resizing or rotation, either via direct entry of a value (e.g. 90 degrees, or 3 inches of width) or via plus and minus controls. As shown, in some embodiments, the user may be provided controls for approving or canceling modification to an element, or incrementally undoing edits.

As discussed above, a user may enter a default width for creation of an image or may create an image with a default width of x or a similar variable. The user may enter an explicit value for the length of the image, such as 2 inches or 4 inches, or may utilize dynamic length adjustment bands 1518*a*-1518*b* to stretch the image, as shown in FIG. 15K. Dynamic length adjustment bands may be displayed responsive to a gesture by the user, such as a pinch gesture, or may be displayed response to selection of a button, such as an edit length button. The bands, sometimes referred to herein as suspenders, may be displayed over the image as shown. The user may drag a band 1518*a* or 1518*b* to enlarge or reduce the image in the corresponding direction. For example, the user may select the left band 1518*a* and drag to the left to enlarge the image to the left. The user may also select the left band 1518*a* and drag to the right to reduce the image from the left. Enlarging or reducing the image may result in extending or shrinking the background of the image and/or borders and themes associated with the entire image. Elements may be moved within the image, rather than being stretched. For example, if an image includes a photo of a cat on the left side of the image or label, and the user extends the label to the left, the photo of the cat may move to the right, rather than being stretched out of proportion. Similarly, if the label is reduced from the left, the photo may move back to the edge of the image. In some embodiments, further reduction will result in the photo or element being pushed to the right along with the border of the image, while in other embodiments, the photo or element will "fall off" the label and be deleted or moved to a non-printing area. The image may be re-extended to return the photo or element.

When the image is shown in a fit to length mode, as discussed above, dragging a band 1518*a*, 1518*b* will change the aspect ratio of the image, causing the displayed width to enlarge or shrink proportionally. Alternately, when the image is shown in a 1:1 scale mode, dragging a band or suspender may cause the image and elements of the image to scroll off the screen, as discussed above.

As shown in FIG. 15L, bands 1518*a* and 1518*b* may appear to stretch as the user moves each band, providing visual feedback. The speed of enlargement or reduction of the image may be proportional to the amount that a band is pulled or deflected from the default position. This may allow for quick or coarse adjustments and fine adjustments intuitively. As shown in FIG. 15M, in some embodiments, a user may select a resize canvas control to cause bands 1518*a*-1518*b* to appear, allowing the user to extend or shrink the length of the label. Similarly, once the user selects the control, icons may appear to allow the user to select different label widths.

Edited images may be saved to be printed or edited at a later time. FIG. 15N illustrates an example of a library selection screen 1520 for selecting saved images for editing. Images may be organized in folders manually by the user, or dynamically. For example, a folder may be dynamically updated with recently edited or printed images, or images including a certain element or elements or theme.

Images may be printed, either from the editing screen 1504 or library selection screen 1520, such as by pressing a print button on the printer (e.g. print button 120 in FIG. 1H) or a print button in one of screens 1504 or 1520. In instances in which the application is executed by another device, such as a tablet computer, printing may comprise transmitting the image to the printer. Various protocols may be used, including protocols and functions provided by the computer, such as Apple's AirPrint for iOS devices. In some embodiments, images may be provided to the printer as a bitmap or data file via a representational state transfer (REST) command such as an HTTP POST command including the bitmap, or via another protocol such as internet printing protocol (IPP) or any other such protocols.

As shown in FIG. 15O, responsive to a user request to print the image, a print screen 1522 may be shown. Print screen 1522 may allow the user to select a number of copies to print. Print screen 1522 may also allow the user to select a print mode or speed, such as draft, standard, or vivid or fine mode. Higher level modes may be slower, but have a higher number of pixels per inch or greater color saturation. For example, with a direct thermal printer, a draft print may be significantly faster, but not allow as much energy to be transferred to the medium to fully activate a color forming dye. However, this may be adequate for some uses, such as temporary coupons or nametags. Print screen 1522 may also allow the user to select an option that automatically resizes the image. As discussed herein, an image may be created with a predetermined width such as 1 inch. The user may select to print the image without resizing such that, for example, the image appears with a half-inch of space above and below the image when printed on 2 inch media. The user may alternately select to resize the image as shown, such that, for example, the image is doubled in both width and length, maintaining the original aspect ratio and proportions of elements within the image.

As shown in FIG. 15P, in some embodiments, printing may include displaying a virtual label 1524 corresponding to the real printed label 1526. As the real label 1526 is printed, the printer may advance the virtual label 1524 on the screen such that the virtual label appears to be extended from the media ejection slot of the printer. This may provide a more intuitive indicator of printing progress and remaining time than a progress bar or timer.

It should be understood that the systems described above may provide multiple ones of any or each of those components and these components may be provided on either a standalone machine or, in some embodiments, on multiple machines in a distributed system. The systems and methods described above may be implemented as a method, apparatus or article of manufacture using programming and/or engineering techniques to produce software, firmware, hardware, or any combination thereof. In addition, the systems and methods described above may be provided as one or more computer-readable programs embodied on or in one or more articles of manufacture. The term "article of manufacture" as used herein is intended to encompass code or logic accessible from and embedded in one or more computer-readable devices, firmware, programmable logic, memory devices (e.g., EEPROMs, ROMs, PROMs, RAMs, SRAMs, etc.), hardware (e.g., integrated circuit chip, Field Programmable Gate Array (FPGA), Application Specific Integrated Circuit (ASIC), etc.), electronic devices, a computer readable non-volatile storage unit (e.g., CD-ROM, floppy disk, hard disk drive, etc.). The article of manufacture may be accessible from a file server providing access to the computer-readable programs via a network transmission line, wireless transmission media, signals propagating through space, radio waves, infrared signals, etc. The article of manufacture may be a flash memory card or a magnetic tape. The article of manufacture includes hardware logic as well as software or programmable code embedded in a computer readable medium that is executed by a processor. In general, the computer-readable programs may be implemented in any programming language, such as LISP, PERL, C, C++, C#, PROLOG, or in any byte code language such as JAVA. The software programs may be stored on or in one or more articles of manufacture as object code.

While various embodiments of the methods and systems have been described, these embodiments are exemplary and in no way limit the scope of the described methods or systems. Those having skill in the relevant art can effect changes to form and details of the described methods and systems without departing from the broadest scope of the described methods and systems. Thus, the scope of the methods and systems described herein should not be limited by any of the exemplary embodiments and should be defined in accordance with the accompanying claims and their equivalents.

What is claimed:

1. A method for print alignment by a continuous feed printer, comprising:

detecting, by a sensor of a printer, a first line of a pattern on a non-printing side of a printing medium, the pattern comprising two non-parallel lines separated by a predetermined distance at a predetermined position of the printing medium;

advancing, by the printer, the printing medium a first distance;

detecting, by the sensor, a second line of the pattern;

advancing, by the printer, the printing medium a second distance;

detecting, by the sensor, a third line of the pattern;

identifying a difference between the first distance and the second distance; and identifying, by the printer, a horizontal offset of the printing medium from an expected location of the predetermined position proportional to the difference between the first distance and the predetermined distance, and proportional to the difference between the first distance and the second distance.

2. The method of claim 1, wherein identifying a difference between the first distance and the predetermined distance comprises identifying a first time period from detecting the first line to detecting the second line.

3. The method of claim 1, wherein the sensor and a print head of the printer are separated by a distance in the direction of travel of the printing medium, and wherein identifying the horizontal offset of the printing medium further comprises adjusting the identified horizontal offset by a correction factor proportional to the distance.

4. The method of claim 1, wherein the first line and second line of the pattern have different widths.

5. The method of claim 1, wherein identifying a horizontal offset of the printing medium corresponding to the identified difference comprises identifying a horizontal offset proportional to a ratio of the difference between the first distance and the second distance and the sum of the first distance and the second distance.

6. The method of claim 1, wherein the first and third lines of the pattern are parallel, and the second line of the pattern is not parallel to either the first or third line.

7. The method of claim 1, further comprising categorizing, by the printer, each of the first line, second line, and third line, as belonging to either a first category or a second category.

8. The method of claim 7, further comprising maintaining a state machine, by the printer, the state machine having probability weights corresponding to transitions from the first category to the second category and from the second category to the first category.

9. The method of claim 1, further comprising printing, by the printer, an image on the printing side of the printing medium, offset according to the identified horizontal offset.

10. The method of claim 9, wherein the printing offset is obtained by dithering and quantizing the identified horizontal offset to a predetermined resolution.

11. A system for print alignment by a continuous feed printer, comprising:

a continuous feed printer comprising a sensor placed to detect a pattern on a non-printing side of the printing medium, the pattern comprising two non-parallel lines separated by a predetermined distance at a predetermined position of the printing medium, and a print engine configured for:

detecting, via the sensor, a first line of the pattern, advancing the printing medium a first distance, detecting, via the sensor, a second line of the pattern, advancing the printing medium a second distance, detecting, via the sensor, a third line of the pattern, identifying a difference between the first distance and the second distance, and identifying a horizontal offset of the printing medium from an expected location of the predetermined position, proportional to the difference between the first distance and the predetermined distance, and proportional to the identified difference between the first distance and the second distance.

12. The system of claim 11, wherein the print engine is further configured for identifying a first time period from detecting the first line to detecting the second line.

13. The system of claim 11 wherein the sensor and a print head of the printer are separated by a distance in the direction of travel of the printing medium, and wherein the print engine is further configured for identifying the horizontal offset of the printing medium further by adjusting the identified horizontal offset by a correction factor proportional to the distance.

14. The system of claim 11, wherein the first line and second line of the pattern have different widths.

15. The system of claim 11, wherein the print engine is further configured for identifying the horizontal offset of the printing medium corresponding to the identified difference as proportional to a ratio of the difference between the first distance and the second distance and the sum of the first distance and the second distance.

16. The system of claim 11, wherein the first and third lines of the pattern are parallel, and the second line of the pattern is not parallel to either the first or third line.

17. The system of claim 11, wherein the print engine is further configured for categorizing each of the first line, second line, and third line, as belonging to either a first category or a second category.

18. The system of claim 17, wherein the print engine is further configured for maintaining a state machine, the state machine having probability weights corresponding to transitions from the first category to the second category and from the second category to the first category.

19. The system of claim 11, wherein the print engine is further configured for printing an image on the printing side of the printing medium, offset according to the identified horizontal offset.

20. The system of claim 18, wherein the printing offset is obtained by dithering and quantizing the identified horizontal offset to a predetermined resolution.

* * * * *